US012734420B2

(12) United States Patent
Funaki et al.

(10) Patent No.: US 12,734,420 B2
(45) Date of Patent: Sep. 15, 2026

(54) GOLF CLUB HAVING AN ADJUSTABLE WEIGHT ASSEMBLY

(71) Applicant: Acushnet Company, Fairhaven, MA (US)

(72) Inventors: Takeshi Casey Funaki, San Diego, CA (US); Ryan E. Locke, San Diego, CA (US); Thomas Orrin Bennett, Carlsbad, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 285 days.

(21) Appl. No.: 18/545,368

(22) Filed: Dec. 19, 2023

(65) Prior Publication Data

US 2024/0189675 A1 Jun. 13, 2024

Related U.S. Application Data

(63) Continuation-in-part of application No. 18/349,887, filed on Jul. 10, 2023, which is a continuation-in-part (Continued)

(51) Int. Cl.

| | |
|---|---|
| ***A63B 53/06*** | (2015.01) |
| ***A63B 53/04*** | (2015.01) |
| ***A63B 53/08*** | (2015.01) |

(52) U.S. Cl.

CPC ..... *A63B 53/08* (2013.01); *A63B 53/0433* (2020.08); *A63B 53/0466* (2013.01); *A63B 53/06* (2013.01); *A63B 2053/0491* (2013.01)

(58) Field of Classification Search

CPC ..... A63B 2053/0491; A63B 2053/0495 (Continued)

(56) References Cited

U.S. PATENT DOCUMENTS

| | | | |
|---|---|---|---|
| 645,942 | A | 3/1900 | Cran |
| 1,213,382 | A | 1/1917 | Kent |

(Continued)

FOREIGN PATENT DOCUMENTS

| | | | |
|---|---|---|---|
| CN | 2175887 | Y | 8/1994 |
| CN | 101970061 | | 2/2011 |

(Continued)

OTHER PUBLICATIONS

European Search Report for EP Application 22166630.8 mailed Aug. 25, 2022 (12 pages).

(Continued)

*Primary Examiner* — Alvin A Hunter

(74) *Attorney, Agent, or Firm* — Womble Bond Dickinson (US) LLP

(57) ABSTRACT

A golf club head includes a recessed channel; and a weight assembly including a weight at least partially disposed within the recessed channel, a cover at least partially covering the recessed channel, the cover including a cover main body, a top rail protruding from the cover main body along a first direction, and a side rail protruding from the cover main body along a second direction different from the first direction, and a fastener coupling the cover to the body, wherein the weight has top and side grooves that are respectively shaped and sized to receive at least part of the top and side rails, wherein the top groove has opposite front and rear surfaces respectively proximal and distal to the striking face, and wherein the side groove has opposite top and bottom surfaces respectively proximal and distal to an exterior surface of the cover.

19 Claims, 123 Drawing Sheets

Related U.S. Application Data of application No. 18/069,829, filed on Dec. 21, 2022, now Pat. No. 12,102,895, which is a continuation-in-part of application No. 17/812,649, filed on Jul. 14, 2022, now Pat. No. 12,478,843, which is a continuation-in-part of application No. 17/556,154, filed on Dec. 20, 2021, now Pat. No. 12,415,120, which is a continuation-in-part of application No. 17/362,488, filed on Jun. 29, 2021, now Pat. No. 11,497,974, which is a continuation-in-part of application No. 17/222,774, filed on Apr. 5, 2021, now Pat. No. 11,439,879, which is a continuation-in-part of application No. 17/122,887, filed on Dec. 15, 2020, now Pat. No. 11,229,827, which is a continuation-in-part of application No. 16/843,640, filed on Apr. 8, 2020, now Pat. No. 10,918,917, which is a continuation-in-part of application No. 16/708,255, filed on Dec. 9, 2019, now Pat. No. 11,090,536, which is a continuation-in-part of application No. 16/535,844, filed on Aug. 8, 2019, now Pat. No. 10,926,143, which is a continuation-in-part of application No. 16/387,859, filed on Apr. 18, 2019, now Pat. No. 10,695,628.

(58) Field of Classification Search
USPC ..... 473/334–339
See application file for complete search history.

(56) References Cited

U.S. PATENT DOCUMENTS 1,642,462 A 9/1927 Reach
2,155,830 A 4/1939 Howard
2,163,091 A 6/1939 Held
2,460,445 A 2/1949 Bigler
3,199,874 A 8/1965 Blasing
3,610,630 A 10/1971 Glover
4,085,934 A 4/1978 Churchward
4,340,230 A 7/1982 Churchward
5,050,879 A 9/1991 Sun
5,769,737 A 6/1998 Holladay et al.
5,916,042 A 6/1999 Reimers
6,015,354 A 1/2000 Ahn
6,277,032 B1 8/2001 Smith
6,409,612 B1 6/2002 Evans
6,592,468 B2 7/2003 Vincent
6,616,547 B2 9/2003 Vincent
6,648,772 B2 11/2003 Vincent
6,663,505 B1 12/2003 Solari
6,811,496 B2 11/2004 Wahl
6,860,818 B2 3/2005 Mahaffey
6,890,267 B2 5/2005 Mahaffey
6,923,734 B2 8/2005 Meyer
6,988,960 B2 1/2006 Mahaffey
7,083,530 B2 * 8/2006 Wahl ..... A63B 53/047 337/350
7,108,609 B2 9/2006 Stites
7,121,956 B2 10/2006 Lo
7,166,041 B2 1/2007 Evans
7,201,669 B2 4/2007 Stites et al.
7,309,295 B2 12/2007 Solari
7,530,903 B2 5/2009 Imamoto
7,611,424 B2 11/2009 Nagai
7,704,163 B2 4/2010 Stites
7,758,451 B2 7/2010 Liang
7,775,905 B2 8/2010 Beach
7,806,782 B2 10/2010 Stites
7,854,667 B2 12/2010 Gillig
7,871,339 B2 1/2011 Sanchez
7,927,231 B2 4/2011 Sato
8,016,694 B2 9/2011 Llewellyn
8,043,167 B2 10/2011 Boyd
8,057,323 B2 11/2011 Liang
8,142,308 B2 3/2012 Gillig
8,192,303 B2 6/2012 Ban
8,202,175 B2 6/2012 Ban
8,206,243 B2 6/2012 Stites
8,262,495 B2 9/2012 Stites
8,303,433 B2 11/2012 Roach
8,337,325 B2 12/2012 Boyd
8,357,057 B2 1/2013 Stites
8,409,031 B2 4/2013 Stites
8,444,505 B2 5/2013 Beach
8,574,094 B2 11/2013 Nicolette
8,684,863 B2 4/2014 Bezilla
8,690,706 B2 4/2014 Stities
8,696,491 B1 4/2014 Myers
8,753,226 B2 6/2014 Rice
8,790,195 B1 7/2014 Myers
8,834,294 B1 9/2014 Seluga et al.
8,858,362 B1 10/2014 Leposky
8,870,679 B2 10/2014 Oldknow
8,894,506 B1 11/2014 Myers
8,968,116 B1 3/2015 Myers
8,979,671 B1 3/2015 DeMille
9,067,110 B1 6/2015 Seluga et al.
9,072,949 B2 7/2015 Stites
9,079,080 B2 7/2015 Jetson
9,084,921 B1 7/2015 Liang
9,095,753 B2 8/2015 Bezilla
9,174,096 B2 11/2015 Sargent
9,180,349 B1 * 11/2015 Seluga ..... A63B 53/0466
9,205,312 B2 * 12/2015 Zimmerman ..... A63B 53/0466
9,211,453 B1 12/2015 Foster et al.
9,238,162 B2 1/2016 Breier
9,259,625 B2 2/2016 Sargent
9,259,627 B1 * 2/2016 Myers ..... A63B 53/04
9,289,660 B1 3/2016 Myers
9,364,728 B1 6/2016 Myers
9,381,410 B2 7/2016 Golden et al.
9,387,373 B1 7/2016 DeMille
9,387,376 B1 7/2016 Hall
9,387,377 B2 7/2016 Liang
9,421,438 B2 8/2016 Beno
9,440,123 B2 9/2016 Beno
9,440,126 B2 9/2016 Boyd
9,498,686 B2 11/2016 Breier
9,561,413 B2 2/2017 Nielson
9,597,561 B1 3/2017 Seluga
9,597,563 B2 3/2017 Voshall
9,616,301 B2 4/2017 Clausen
9,623,294 B1 4/2017 Kingston et al.
9,623,302 B1 * 4/2017 Myers ..... A63B 53/0466
9,630,069 B2 4/2017 Foster
9,636,553 B1 5/2017 Myers
9,636,556 B2 5/2017 Beck
9,682,296 B1 6/2017 Myers
9,682,298 B1 6/2017 Kingston et al.
9,694,256 B2 7/2017 Myers
9,694,261 B2 7/2017 Nunez
9,700,764 B2 7/2017 Carter
9,700,767 B2 7/2017 Zimmerman
9,707,458 B2 7/2017 Luttrell
9,707,459 B1 7/2017 Myers
9,724,577 B1 8/2017 Kingston et al.
9,731,175 B1 8/2017 Myers
9,757,630 B2 9/2017 Mata
9,764,210 B2 9/2017 Curtis
9,795,846 B2 10/2017 Sargent
9,868,036 B1 1/2018 Kleinert
9,878,223 B2 1/2018 Foster et al.
9,914,028 B1 3/2018 Cleghorn et al.
9,937,392 B2 4/2018 Myers
9,968,833 B2 5/2018 Breier
9,975,019 B2 5/2018 Frame
9,981,165 B2 5/2018 Goudarzi
9,993,703 B2 6/2018 Beck
10,004,956 B2 6/2018 Beck
10,022,602 B2 7/2018 Kingston et al.
10,029,161 B2 7/2018 Knutson
10,035,051 B2 7/2018 Cleghorn
10,065,085 B2 9/2018 Seluga
10,065,094 B2 9/2018 Wallin

(56) References Cited

U.S. PATENT DOCUMENTS 10,071,293 B2 9/2018 Green
10,092,803 B2 10/2018 Cleghorn
10,166,444 B1 1/2019 Forshner
10,183,203 B1 1/2019 Yi et al.
10,188,916 B2 1/2019 Harbert
10,213,665 B1 2/2019 Day
10,258,839 B2 4/2019 Beck
10,391,371 B2 8/2019 Luttrell
10,398,952 B1 9/2019 Yi et al.
10,434,385 B2 10/2019 Mine et al.
10,493,337 B2 12/2019 Kii
10,543,406 B2 1/2020 Carter
10,556,161 B2 2/2020 Jertson
10,576,337 B2 3/2020 Soracco
10,596,428 B1 3/2020 Rumble
10,646,755 B1 5/2020 Kleinert
10,653,926 B2 5/2020 Story
10,695,628 B1 * 6/2020 Yi ..... A63B 53/08
10,864,416 B2 12/2020 Jertson
10,874,914 B2 12/2020 Johnson
10,918,917 B2 2/2021 Northcutt
10,926,143 B2 2/2021 Bennett
10,974,109 B2 4/2021 Stokke et al.
10,981,039 B1 4/2021 Ripp et al.
11,013,965 B2 5/2021 Story
11,033,782 B1 6/2021 Evans et al.
11,052,294 B2 7/2021 Carter
11,090,536 B2 * 8/2021 Bennett ..... A63B 53/08
11,192,005 B2 12/2021 Bennett et al.
11,229,827 B2 1/2022 Yi
11,266,889 B2 3/2022 Bamber
11,406,881 B2 8/2022 Harbert
11,413,509 B2 8/2022 Carter
11,439,877 B2 9/2022 Northcutt
11,439,878 B2 9/2022 Bennett
11,439,879 B2 9/2022 Yi
11,497,974 B2 11/2022 Northcutt
11,504,589 B2 11/2022 Tassistro
11,684,830 B2 * 6/2023 Mizutani ..... A63B 53/0466
473/345
11,691,057 B2 7/2023 Bennett
11,773,232 B2 10/2023 Lindenfelzer et al.
11,813,491 B2 11/2023 Cleghorn
11,819,741 B2 11/2023 Oldknow
11,911,672 B1 2/2024 Hettinger
11,918,870 B2 3/2024 Bamber
11,925,841 B2 3/2024 Yi
12,005,327 B2 6/2024 Hettinger
12,070,666 B2 8/2024 Nielson
12,090,377 B2 9/2024 Beach
12,102,895 B2 * 10/2024 Funaki ..... A63B 53/06
12,157,041 B2 12/2024 Stokke et al.
12,246,227 B2 3/2025 Bennett
12,296,235 B2 5/2025 Hettinger et al.
12,472,409 B2 11/2025 Yi et al.
12,478,843 B2 11/2025 Northcutt et al.
12,527,997 B2 1/2026 Sanchez et al.
2005/0037864 A1 2/2005 Gilbert
2005/0043113 A1 2/2005 Mann et al.
2005/0101408 A1 5/2005 Sanchez
2006/0058112 A1 3/2006 Haralason et al.
2006/0122004 A1 6/2006 Chen
2006/0172821 A1 8/2006 Evans
2006/0178229 A1 8/2006 Liang et al.
2006/0240908 A1 10/2006 Adams
2007/0099720 A1 5/2007 Gillig
2007/0117651 A1 5/2007 Belmont
2007/0135231 A1 6/2007 Lo
2008/0020861 A1 1/2008 Adams
2008/0039228 A1 2/2008 Breier
2008/0146370 A1 6/2008 Beach
2008/0261715 A1 10/2008 Carter
2009/0215551 A1 8/2009 Liang
2010/0075773 A1 3/2010 Casati
2010/0075774 A1 3/2010 Ban
2010/0331103 A1 12/2010 Takahashi
2011/0009209 A1 1/2011 Llewellyn et al.
2011/0070964 A1 3/2011 Stites
2011/0081987 A1 4/2011 Gilig
2011/0250985 A1 10/2011 Stites
2011/0256953 A1 10/2011 Jorgensen et al.
2012/0202615 A1 8/2012 Beach et al.
2013/0165251 A1 6/2013 Jorgensen
2013/0165254 A1 6/2013 Rice et al.
2013/0260913 A1 10/2013 Beach et al.
2013/0296070 A1 11/2013 Stites
2013/0324299 A1 12/2013 Clausen
2013/0337937 A1 12/2013 Stites et al.
2013/0344976 A1 12/2013 Stites
2014/0038746 A1 2/2014 Beach
2014/0080628 A1 3/2014 Sargent
2014/0080629 A1 3/2014 Sargent
2014/0113741 A1 4/2014 Bezilla
2014/0113742 A1 * 4/2014 Zimmerman ..... A63B 53/0466
473/335
2014/0228142 A1 * 8/2014 Beno ..... A63B 53/06
473/226
2015/0038258 A1 2/2015 Beach
2015/0072802 A1 3/2015 Myers
2015/0297961 A1 10/2015 Voshall et al.
2015/0297962 A1 10/2015 Cleghorn
2015/0306473 A1 10/2015 Breier
2015/0306474 A1 10/2015 Breier et al.
2015/0306475 A1 10/2015 Curtis
2015/0314176 A1 11/2015 Liang
2015/0321055 A1 11/2015 Golden
2016/0038796 A1 2/2016 Taylor et al.
2016/0051869 A1 * 2/2016 Foster ..... A63B 53/0466
473/335
2016/0074716 A1 3/2016 Roach
2016/0089583 A1 3/2016 Breier
2016/0101330 A1 * 4/2016 Harrington ..... A63B 53/047
473/338
2016/0129323 A1 5/2016 Myers
2016/0236048 A1 8/2016 Clausen
2016/0271464 A1 9/2016 Murphy
2016/0296808 A1 10/2016 Harrington et al.
2017/0072278 A1 3/2017 Breier
2017/0173413 A1 6/2017 Cleghorn et al.
2017/0173420 A1 6/2017 Frame et al.
2017/0173422 A1 6/2017 Foster
2017/0304690 A1 10/2017 Carter
2017/0361185 A1 12/2017 Henrikson
2018/0056154 A1 3/2018 Wallin
2018/0065005 A1 * 3/2018 Cleghorn ..... A63B 53/0466
2018/0117428 A1 5/2018 Jonathan et al.
2018/0345093 A1 12/2018 Harbert
2019/0009146 A1 1/2019 Luttrell
2019/0022481 A1 1/2019 Mine
2019/0060718 A1 2/2019 Milleman
2019/0083862 A1 3/2019 Jertson
2019/0105544 A1 4/2019 Carter
2019/0118050 A1 4/2019 Cleghorn
2019/0176001 A1 6/2019 Jertson
2019/0192928 A1 6/2019 Soracco
2019/0329106 A1 10/2019 Luttrell
2020/0013035 A1 1/2020 Long et al.
2020/0129821 A1 4/2020 Sanchez et al.
2020/0129822 A1 4/2020 Cleghorn et al.
2020/0197769 A1 6/2020 Stokke et al.
2020/0261776 A1 8/2020 Carter
2020/0330834 A1 10/2020 Northcutt
2020/0330835 A1 10/2020 Bennett
2020/0330836 A1 10/2020 Bennett
2021/0001191 A1 1/2021 Bamber
2021/0069560 A1 3/2021 Jertson et al.
2021/0086042 A1 3/2021 Story et al.
2021/0128994 A1 5/2021 Yi
2021/0138318 A1 5/2021 Northcutt
2021/0138319 A1 5/2021 Bennett
2021/0178235 A1 6/2021 Halberg
2021/0187371 A1 6/2021 Stokke et al.
2021/0299525 A1 9/2021 Mizutani
2021/0402270 A1 12/2021 Bennett

(56) References Cited

U.S. PATENT DOCUMENTS

| | | | | |
|---|---|---|---|---|
| 2022/0111263 | A1 | 4/2022 | Yi | |
| 2022/0111270 | A1 | 4/2022 | Yi | |
| 2022/0168616 | A1 | 6/2022 | Bamber | |
| 2022/0241655 | A1 | 8/2022 | Funaki et al. | |
| 2022/0379180 | A1* | 12/2022 | Hettinger | A63B 53/047 |
| 2023/0064631 | A1 | 3/2023 | Sanchez | |
| 2023/0072814 | A1 | 3/2023 | Hettinger et al. | |
| 2023/0083855 | A1* | 3/2023 | Hettinger | A63B 53/0408 473/349 |
| 2023/0233911 | A1 | 7/2023 | Carr | |
| 2023/0233912 | A1 | 7/2023 | Yi | |
| 2023/0271066 | A1 | 8/2023 | Mizutani | |
| 2023/0285817 | A1 | 9/2023 | Bennett | |
| 2023/0330499 | A1 | 10/2023 | Yi | |
| 2023/0338794 | A1 | 10/2023 | Hettinger | |
| 2023/0347214 | A1 | 11/2023 | Cornelius et al. | |
| 2024/0017137 | A1 | 1/2024 | Yi et al. | |
| 2024/0066366 | A1 | 2/2024 | Yi | |
| 2024/0066367 | A1 | 2/2024 | Hettinger | |
| 2024/0066368 | A1 | 2/2024 | Ines | |
| 2024/0157206 | A1 | 5/2024 | Hettinger | |
| 2024/0181310 | A1 | 6/2024 | Yi et al. | |
| 2024/0189674 | A1 | 6/2024 | Murphy et al. | |
| 2024/0226673 | A1 | 7/2024 | Cleghorn | |
| 2024/0299814 | A1 | 9/2024 | Sugimae et al. | |
| 2024/0316420 | A1 | 9/2024 | Yi | |
| 2024/0316422 | A1 | 9/2024 | Yi | |
| 2024/0359064 | A1 | 10/2024 | Hettinger | |
| 2025/0025755 | A1 | 1/2025 | Yi | |
| 2025/0090911 | A1 | 3/2025 | Stokke et al. | |

FOREIGN PATENT DOCUMENTS

| | | | |
|---|---|---|---|
| CN | 102281927 | | 12/2011 |
| CN | 102574010 | A | 7/2012 |
| CN | 109126070 | A | 1/2019 |
| CN | 113491863 | | 10/2021 |
| CN | 215841488 | | 2/2022 |
| CN | 115245667 | | 10/2022 |
| CN | 118217607 | | 6/2024 |
| EP | 1955740 | B1 | 12/2010 |
| EP | 4070863 | | 10/2022 |
| EP | 4400184 | | 7/2024 |
| EP | 4467212 | A2 | 11/2024 |
| EP | 3897883 | B1 | 2/2025 |
| FR | 2581320 | | 11/1986 |
| GB | 190920747 | A | 9/1910 |
| GB | 1387955 | | 3/1975 |
| GB | 2094158 | | 9/1982 |
| GB | 2327889 | | 2/1999 |
| GB | 2407781 | | 5/2005 |
| JP | 01043278 | | 2/1989 |
| JP | 2729760 | | 3/1998 |
| JP | 2002011124 | | 1/2002 |
| JP | 2005058765 | | 3/2005 |
| JP | 2005296582 | | 10/2005 |
| JP | 2005323978 | | 11/2005 |
| JP | 2006320493 | | 11/2006 |
| JP | 2007083012 | A * | 4/2007 |
| JP | 2007319687 | | 12/2007 |
| JP | 2008173314 | | 7/2008 |
| JP | 2008194454 | | 8/2008 |
| JP | 2010069106 | | 4/2010 |
| JP | 2010136772 | | 6/2010 |
| JP | 2010148702 | | 7/2010 |
| JP | 2010252964 | | 11/2010 |
| JP | 2011005011 | | 1/2011 |
| JP | 2011092763 | | 5/2011 |
| JP | 2012125291 | | 7/2012 |
| JP | 2012139450 | | 7/2012 |
| JP | 2014223548 | | 12/2014 |
| JP | 2015036097 | | 2/2015 |
| JP | 2016179061 | | 10/2016 |
| JP | 2019000664 | | 1/2019 |
| JP | 2019042192 | | 3/2019 |
| JP | 2019519324 | A | 7/2019 |
| JP | 2020175196 | | 10/2020 |
| JP | 2021079086 | | 5/2021 |
| JP | 2021151381 | | 9/2021 |
| JP | 2022160000 | | 10/2022 |
| JP | 2023091773 | | 6/2023 |
| JP | 2024035113 | | 3/2024 |
| JP | 7483475 | | 5/2024 |
| JP | 3246905 | | 6/2024 |
| JP | 3249412 | | 12/2024 |
| KR | 19990076463 | | 10/1999 |
| KR | 20060023226 | | 3/2006 |
| KR | 20060126735 | A | 12/2006 |
| KR | 20110033462 | | 3/2011 |
| KR | 20130005384 | | 1/2013 |
| KR | 101401409 | | 5/2014 |
| KR | 20160121568 | | 10/2016 |
| KR | 20200039768 | | 4/2020 |
| KR | 20220138878 | | 10/2022 |
| KR | 20230094163 | | 10/2022 |
| KR | 20240001700 | | 10/2024 |
| KR | 102781205 | B1 | 3/2025 |
| KR | 20250037601 | A | 3/2025 |
| TW | M306126 | | 2/2007 |
| TW | 201538208 | | 10/2015 |
| WO | 0243819 | | 6/2002 |
| WO | 2006018929 | A1 | 2/2006 |
| WO | 2007044220 | | 4/2007 |
| WO | 2007101350 | A1 | 9/2007 |
| WO | 2011037678 | A1 | 3/2011 |
| WO | 2015123661 | | 8/2015 |
| WO | 2017080387 | | 5/2017 |
| WO | 2017205699 | A1 | 11/2017 |
| WO | 2017025699 | | 2/2019 |
| WO | 2019035912 | | 2/2019 |
| WO | 2021012002 | | 1/2021 |
| WO | 2020132512 | | 2/2021 |

OTHER PUBLICATIONS

"MuCell", Techniplas, Available at: https://web.archive.org/web/20230604001956/https://www.techniplas.com/technology/mucell/, Jun. 4, 2023, 2 pages.

First Office Action Search Report for CN Application No. 2021103693793 mailed May 22, 2025 (8 pages).

Non-Final Office Action received for U.S. Appl. No. 18/055,795, mailed on Feb. 18, 2026, 19 pages.

Office Action including English Translation received for Japanese Patent Application No. 2022-62331, mailed on Jan. 27, 2026, 8 pages.

* cited by examiner

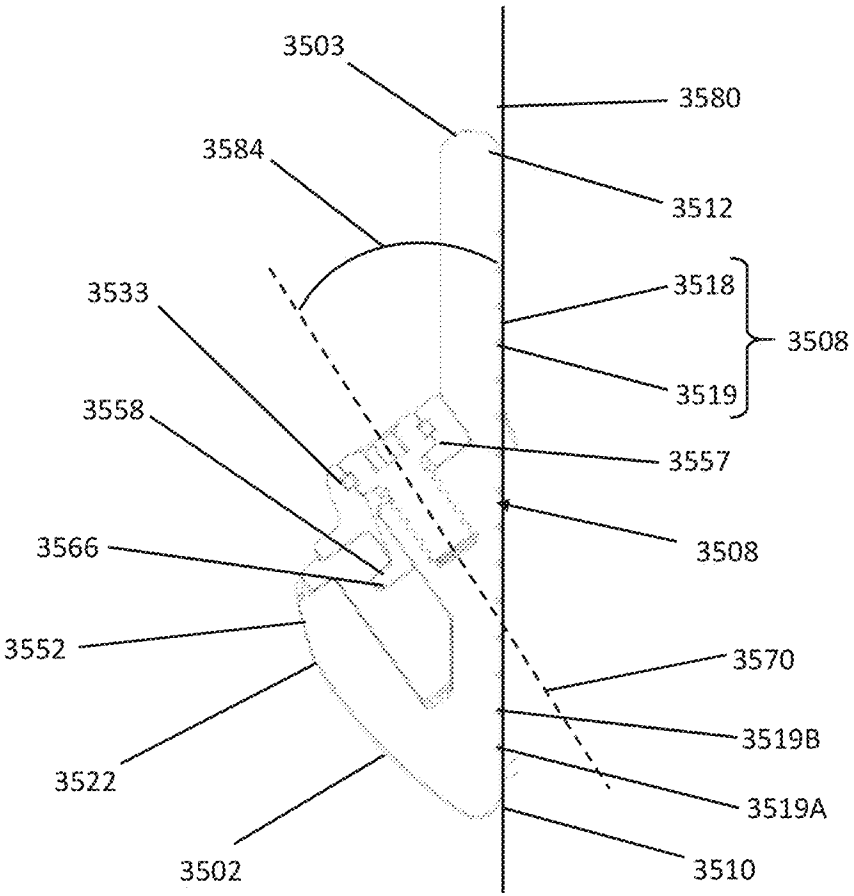
FIG. 111
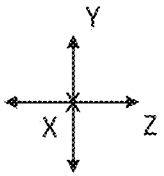

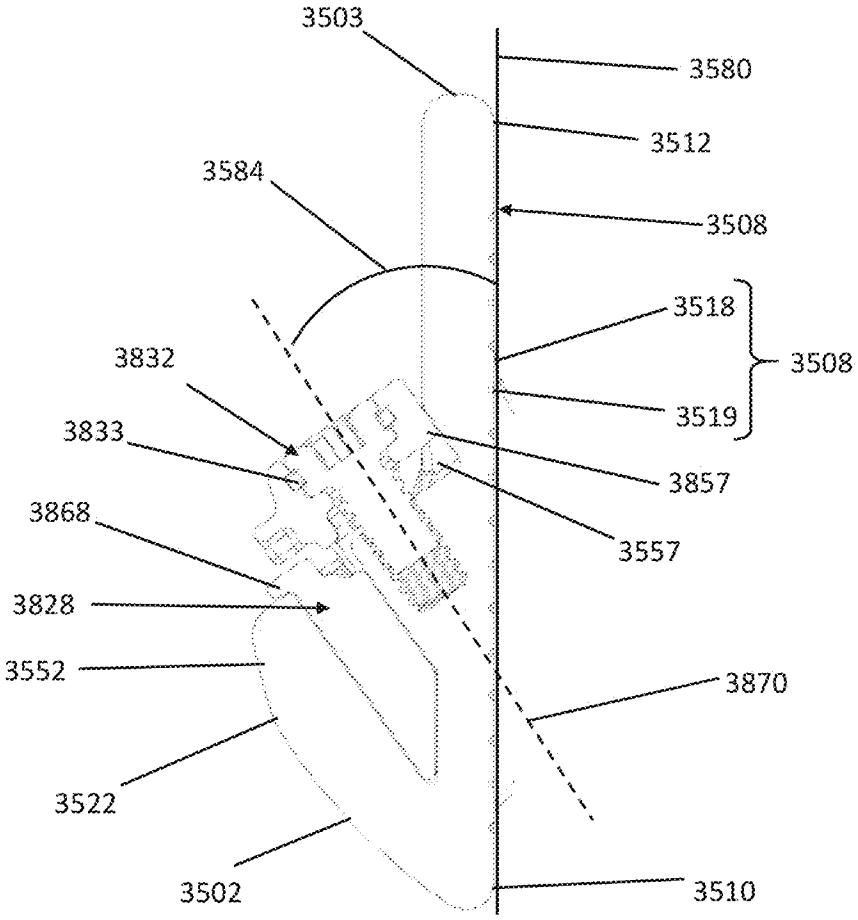
FIG. 120
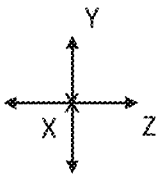

GOLF CLUB HAVING AN ADJUSTABLE WEIGHT ASSEMBLY

CROSS-REFERENCE TO RELATED APPLICATIONS

This application is a continuation-in-part of U.S. patent application Ser. No. 18/349,887, filed on Jul. 10, 2023, which is a continuation-in-part of U.S. patent application Ser. No. 18/069,829, filed Dec. 21, 2022, which is a continuation-in-part of U.S. patent application Ser. No. 17/812,649, filed on Jul. 14, 2022, which is a continuation-in-part of U.S. patent application Ser. No. 17/556,154, filed Dec. 20, 2021, which is a continuation-in-part of U.S. patent application Ser. No. 17/362,488, filed Jun. 29, 2021, now U.S. Pat. No. 11,497,974, which is a continuation-in-part of U.S. patent application Ser. No. 17/222,774, filed Apr. 5, 2021, now U.S. Pat. No. 11,439,879, which is a continuation-in-part of U.S. patent application Ser. No. 17/122,887, filed Dec. 15, 2020, now U.S. Pat. No. 11,229,827, which is a continuation-in-part of U.S. patent application Ser. No. 16/843,640, filed Apr. 8, 2020, now U.S. Pat. No. 10,918,917, which is a continuation-in-part of U.S. patent application Ser. No. 16/708,255, filed Dec. 9, 2019, now U.S. Pat. No. 11,090,536, which is a continuation-in-part of U.S. patent application Ser. No. 16/535,844, filed Aug. 8, 2019, now U.S. Pat. No. 10,926,143, which is a continuation-in-part of U.S. patent application Ser. No. 16/387,859, filed Apr. 18, 2019, now U.S. Pat. No. 10,695,628, and which are hereby incorporated by reference in their entireties. To the extent appropriate, the present application claims priority to the above-referenced applications.

BACKGROUND

The flight characteristics of a golf ball after being struck by a golf club are dependent not only on the swing of the golf club but also on the golf club itself. For example, flight characteristics of the golf ball, such as fades, draws, launch angles, ball spin, and speed are impacted by the design of the golf club. By adjusting one or more design properties of the golf club, the flight characteristics of the golf ball can be improved, thereby increasing golf club performance. In some examples, adjusting a center of gravity (CG) and/or a moment of inertia (MOI) of a head of the golf club through selective weight placement impacts the flight characteristics of the golf ball. However, these adjustable weights need to be both securely attached to the golf club head and selectively moveable. As such, improvements to adjustable weight assemblies for golf club heads are desired.

SUMMARY

According to an aspect, the technology is related to a golf club head, including: a body including: a striking face having a lower leading edge, and a sole extending from the lower leading edge, wherein the striking face and the sole form part of an outer surface of the body; a recessed channel formed in the outer surface; and a weight assembly including: a weight at least partially disposed within the recessed channel and configured to be moveable therein, a cover at least partially covering the recessed channel, the cover including a cover main body, a top rail extending along a toe-heel direction and protruding from the cover main body along a first direction, and a side rail extending along a toe-heel direction and protruding from the cover main body along a second direction different from the first direction, and a fastener coupling the cover to the body and configured to indirectly retain the weight within the recessed channel by the cover, wherein the weight has top and side grooves that are respectively shaped and sized to receive at least part of the top and side rails, wherein the top groove has opposite front and rear surfaces respectively proximal and distal to the striking face, and a bottom surface connecting the front and rear surfaces, and wherein the side groove has opposite top and bottom surfaces respectively proximal and distal to an exterior surface of the cover configured to face outwardly from the golf club head, and a front surface connecting the top and bottom surfaces.

In some examples, the first and second directions are within 15 degrees of being perpendicular to each other. In some examples, at least part of the front surface, at least part of the rear surface, and at least part of the bottom surface of the top groove are each substantially flat, and the substantially flat parts respectively of the front and rear surfaces of the top groove are substantially parallel to each other, and at least part of the top surface, at least part of the bottom surface, and at least part of the front surface of the side groove are each substantially flat, and the substantially flat parts respectively of the top and bottom surfaces of the side groove are substantially parallel to each other. In some examples, between about 0% and about 30% of an outer surface of the weight is visible when the cover secures the weight within the recessed channel. In some examples, one or more windows are formed in the cover and are adapted to visibly identify a position of the weight within the recessed channel, and the weight assembly further includes one or more at least partially transparent window members attached to the cover and overlapping the one or more windows. In some examples, the cover is moveable, via the fastener, between at least an unlocked configuration, whereby the cover is raised at least partially out of the recessed channel and the weight is selectively movable within the recessed channel, and a locked configuration, whereby the cover is at least partially disposed within the recessed channel and the weight is secured within the recessed channel. In some examples, the fastener is a threaded fastener that is movable along a fastener axis by rotating about the fastener axis, and the threaded fastener is selectively positionable in at least a first position and when the cover is in the locked configuration, and a second position when the cover is in the unlocked configuration, and the weight assembly is configured such that: the weight is entirely covered when the cover is in the locked configuration, and the weight becomes visible from under the cover when the threaded fastener is rotated through three or fewer full rotations about the fastener axis from the first position. In some examples, the recessed channel is in the sole.

According to another aspect, the technology relates to a golf club head, including: a body, including: a striking face having a lower leading edge, and a sole extending from the lower leading edge; a recessed channel formed in the sole; and a weight assembly including: a weight at least partially disposed within the recessed channel and configured to be moveable therein, a cover coupled to the body and adapted to releasably secure the weight within the recessed channel, the cover: having an exterior surface and an opposite interior surface, and one or more windows extending through the cover between the exterior and interior surfaces; including a top rail extending along a toe-heel direction and protruding from the interior surface along a first direction; and including a side rail extending along a toe-heel direction and protruding from a side surface of the cover along a second direction different from the first direction, and one or more at least partially transparent window members attached to the cover and overlapping the one or more window openings, wherein the weight has top and side grooves that are respectively shaped and sized to receive at least part of the top and side rails, wherein the top groove has opposite front and rear surfaces respectively proximal and distal to the striking face and that are each at least partly substantially flat, and a bottom surface connecting the front and rear surfaces, and wherein the side groove has opposite top and bottom surfaces respectively proximal and distal to the exterior surface and that are each at least partly substantially flat, and a front surface connecting the top and bottom surfaces.

In some examples, the golf club head is a driver type golf club head, a metalwood type golf club head, or a hybrid type golf club head, and an outermost surface of the striking face is curved outwardly. In some examples, the weight assembly further includes a threaded fastener coupling the cover to the body and configured to only indirectly retain the weight in the recessed channel. In some examples, the cover is moveable, via the threaded fastener, between at least an unlocked configuration, whereby the cover is raised at least partially out of the recessed channel and the weight is selectively movable within the recessed channel, and a locked configuration, whereby the cover is at least partially disposed within the recessed channel and the weight is entirely concealed except for through the one or more windows, and the weight assembly is configured such that, as the cover is moved from the locked configuration toward the unlocked configuration, the weight becomes visible from under the cover before the top rail is entirely removed from the recessed channel. In some examples, the one or more window openings includes a plurality of window openings arranged along the toe-heel direction of the golf club head. In some examples, the one or more window openings includes only one window opening that is elongated along the toe-heel direction of the golf club head.

According to another aspect, the technology relates to a golf club head, including: a body including: a striking face having a lower leading edge, and a sole extending from the lower leading edge, wherein the striking face and the sole form part of an outer surface of the body; a recessed channel formed in the outer surface; and a weight assembly including: a weight at least partially disposed within the recessed channel and configured to be moveable therein, a cover coupled to the body and adapted to releasably secure the weight within the recessed channel, the cover having one or more window openings adapted to identify a location of the weight within the recessed channel, and a threaded fastener coupling the cover to the body and selectively moveable along a fastener axis between at least a first position and a second position by rotating about the fastener axis, wherein the cover is moveable, via the threaded fastener, between at least: an unlocked configuration, whereby the cover is raised at least partially out of the recessed channel, the weight is selectively movable within the recessed channel, and the threaded fastener is in the first position; and a locked configuration, whereby the cover is at least partially disposed within the recessed channel, the weight is secured within the recessed channel, and the threaded fastener is in the second position, and wherein the weight assembly is configured such that, when the cover is in the locked configuration, the cover entirely conceals the weight except for through the one or more window openings, and such that the weight becomes visibly exposed from under the cover when the threaded fastener is rotated through three or fewer full rotations about the fastener axis from the first position toward the second position.

In some examples, the cover includes a top rail extending along a toe-heel direction of the golf club head, and protruding from an interior surface of the cover that is configured to face the recessed channel, and the weight has a top groove shaped and sized to receive at least part of the top rail. In some examples, the top groove has opposite front and rear surfaces respectively proximal and distal to the striking face, and a bottom surface connecting the front and rear surfaces. In some examples, the top groove is spaced apart from a front surface of the weight proximal to the striking face. In some examples, the cover includes a side rail extending along the toe-heel direction, and protruding from a side surface, and the weight has a side groove shaped and sized to receive at least part of the side rail. In some examples, the recessed channel includes a plurality of locating lugs arranged along a toe-heel direction of the golf club head, and the weight is configured to engage with the one or more locating lugs such that the weight is positionable in the recessed channel in a plurality of discrete locations corresponding to the plurality of locating lugs when the recessed channel secures the weight within the recessed channel.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

FIG. 111 is a cross-sectional view in the toe-to-heel direction of the golf club head of FIG. 105 taken along line **110*a*-110*a* in FIG. 110** and with the weight assembly in the locked configuration.

FIG. 119 is cross-sectional view in the toe-to-heel direction of the golf club head of FIG. 116 taken along line **116*a*-116*a*** and when the weight assembly is in the locked configuration.

FIG. 120 is cross-sectional view in the toe-to-heel direction of the golf club head of FIG. 116 taken along line **116*a*-116*a*** and when the weight assembly is in the unlocked configuration.

FIG. 121 is a back view of a golf club head with another weight assembly in the locked configuration.

FIG. 122 is another back view of the golf club head of FIG. 121 when the weight assembly is in the unlocked configuration.

FIG. 123 is a perspective view of the golf club head of FIG. 121 when the weight assembly is in the unlocked configuration.

FIG. 124 is a partially exploded, perspective view of the golf club head of FIG. 121.

FIG. 125 is a cross-sectional view in the toe-to-heel direction of the golf club head of FIG. 121 along line **121*a*-121*a*** and when the weight configuration is in the locked configuration.

FIG. 126 is a cross-sectional view of the golf club head of FIG. 121 along line **121*a*-121*a*** and when the weight configuration is in the unlocked configuration.

FIG. 127 is a bottom view of a golf club head with another weight assembly in the locked configuration.

FIG. 128 is a top view of the golf club head of FIG. 127.

FIG. 129 is another top view of the golf club head of FIG. 127 without the crown piece of the golf club head.

FIG. 130 is a cross-sectional view of the golf club head of FIG. 127 along line **130*a*-130*a* of FIG. 128** when the weight assembly is in the locked configuration.

Figure 127:
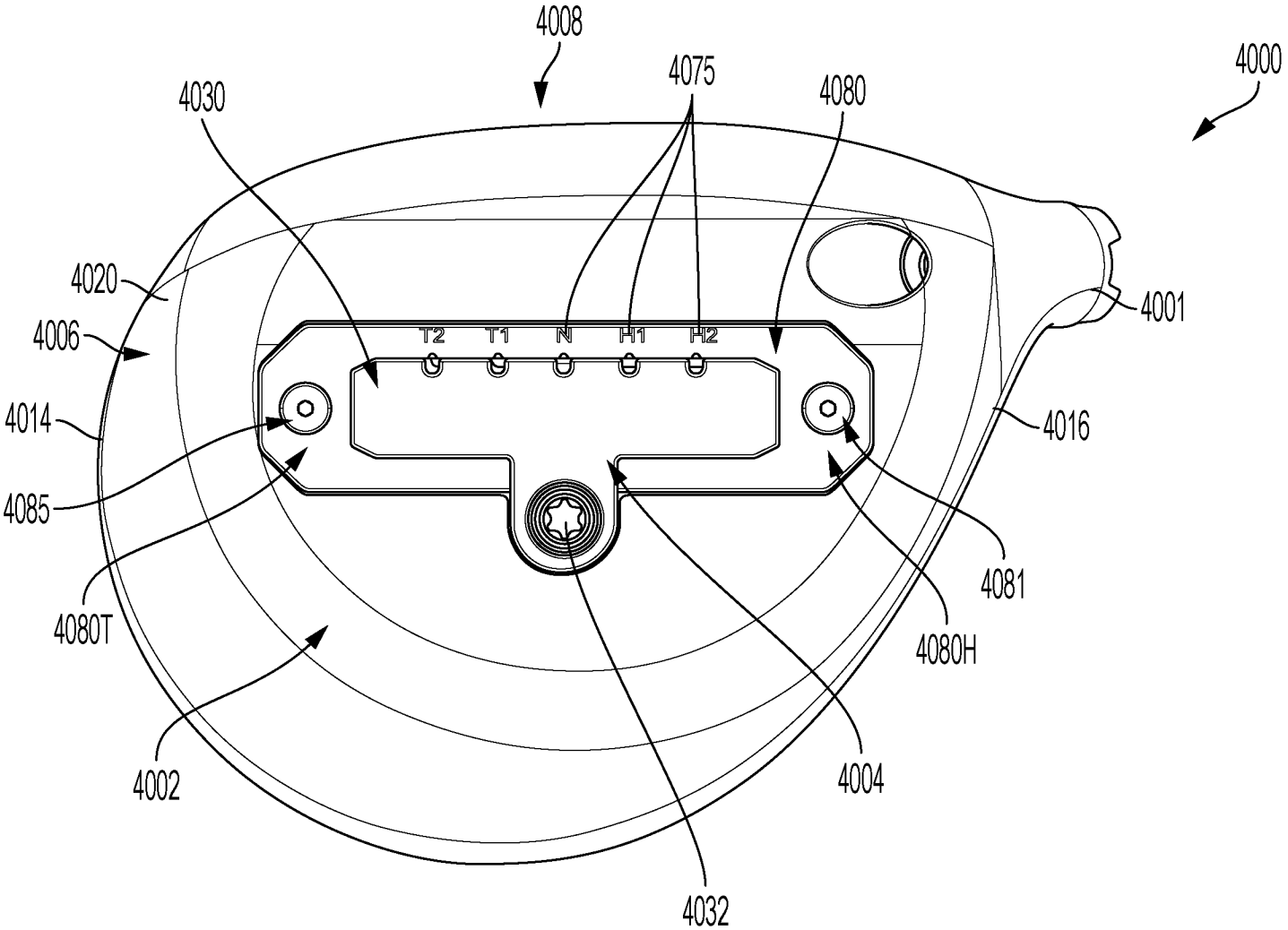
Figure 131:
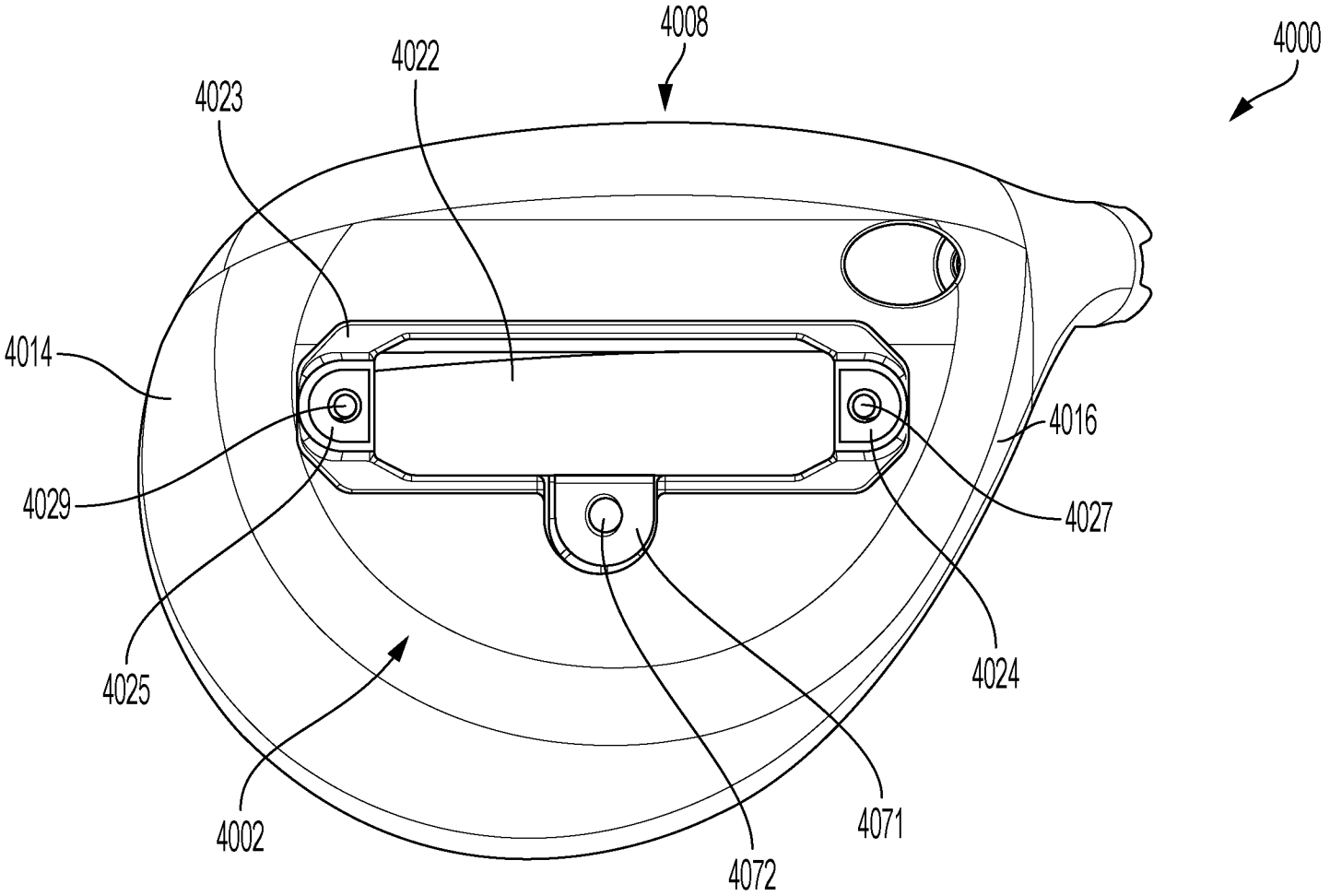

FIG. 131 is another bottom view of the golf club head of FIG. 127 without the pocket and the weight assembly of the golf club head.

Figure 132:
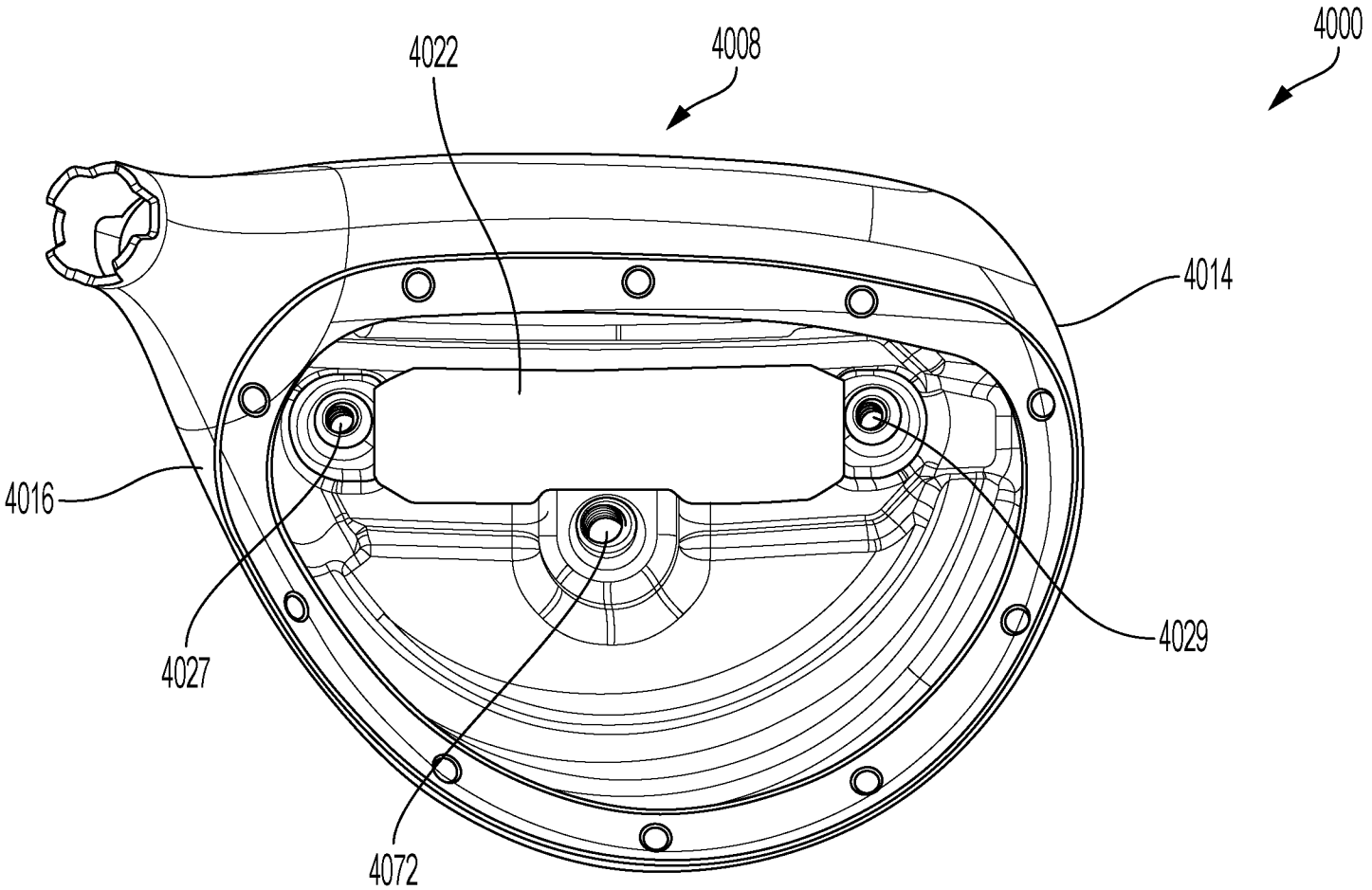

FIG. 132 is another top view of the golf club head of FIG. 127 without the crown piece, the pocket, and the weight assembly of the golf club head.

Figure 133:
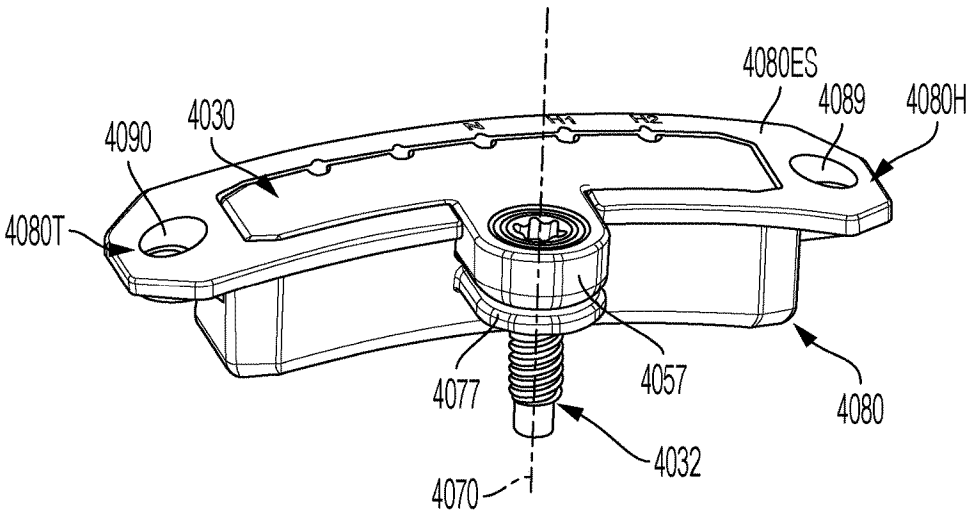

FIG. 133 is a perspective view of the pocket and weight assembly of the golf club head of FIG. 127 when the weight assembly is in the locked configuration.

Figure 134:
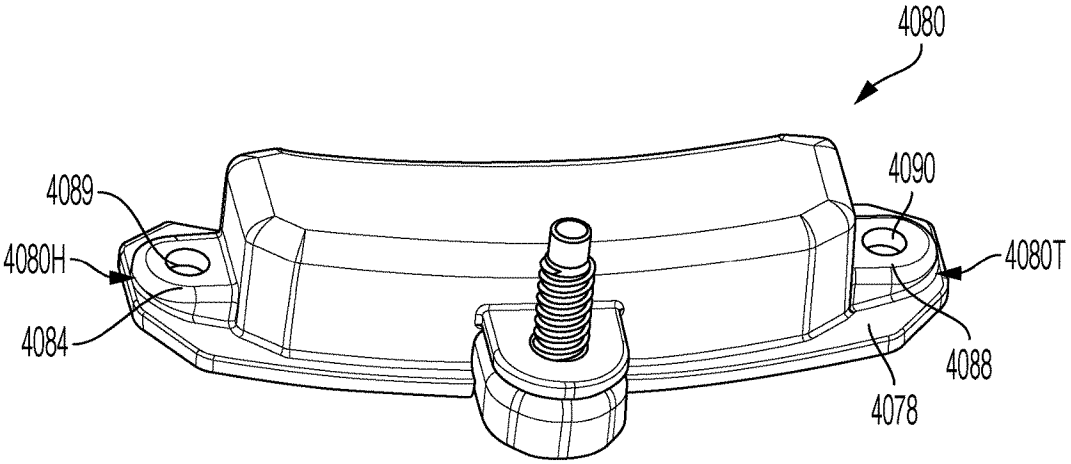

FIG. 134 is another perspective view of the pocket and weight assembly of the golf club head of FIG. 127 when the weight assembly is in the locked configuration.

Figure 135:
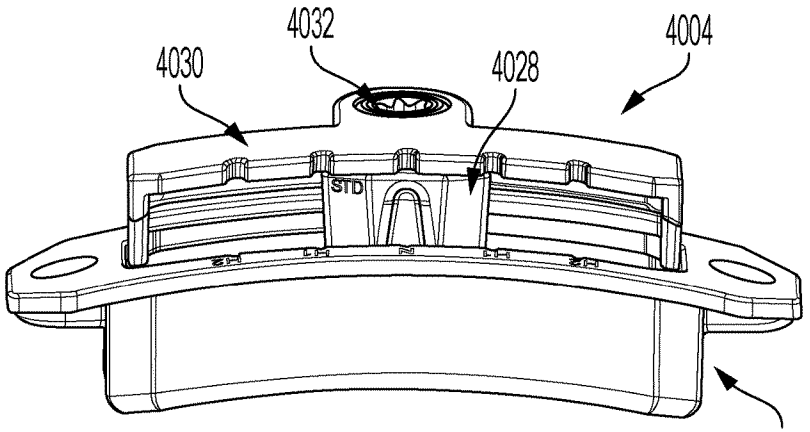

FIG. 135 is another perspective view of the pocket and weight assembly of the golf club head of FIG. 127 when the weight assembly is in the unlocked configuration.

Figure 136:
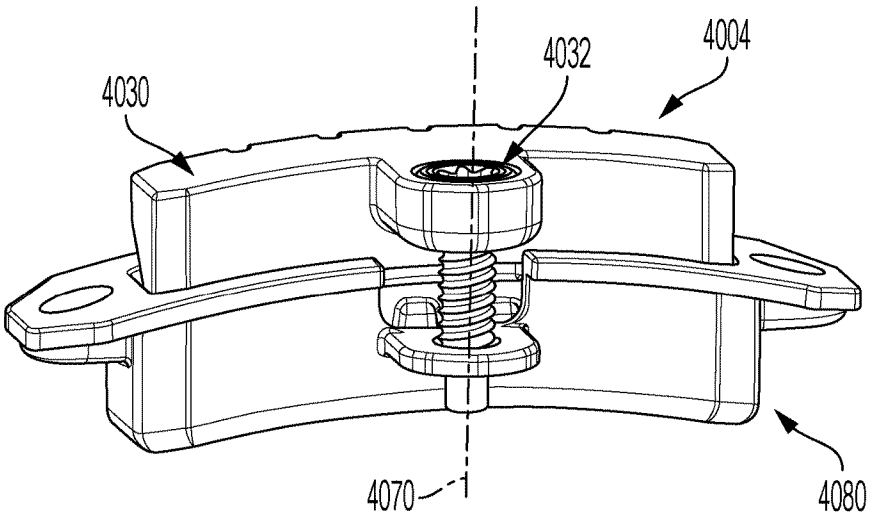

FIG. 136 is another perspective view of the pocket and weight assembly of the golf club head of FIG. 127 when the weight assembly is in the unlocked configuration.

Figure 137:
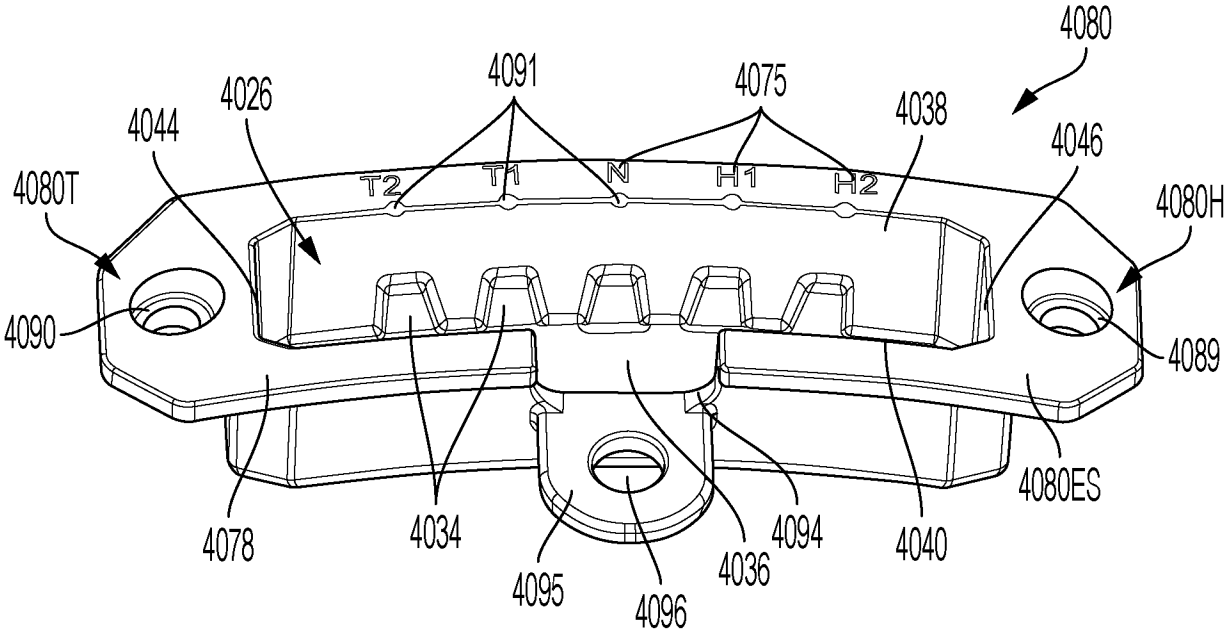

FIG. 137 is a perspective view of the pocket of the golf club head of FIG. 127 without the weight assembly.

Figure 138:
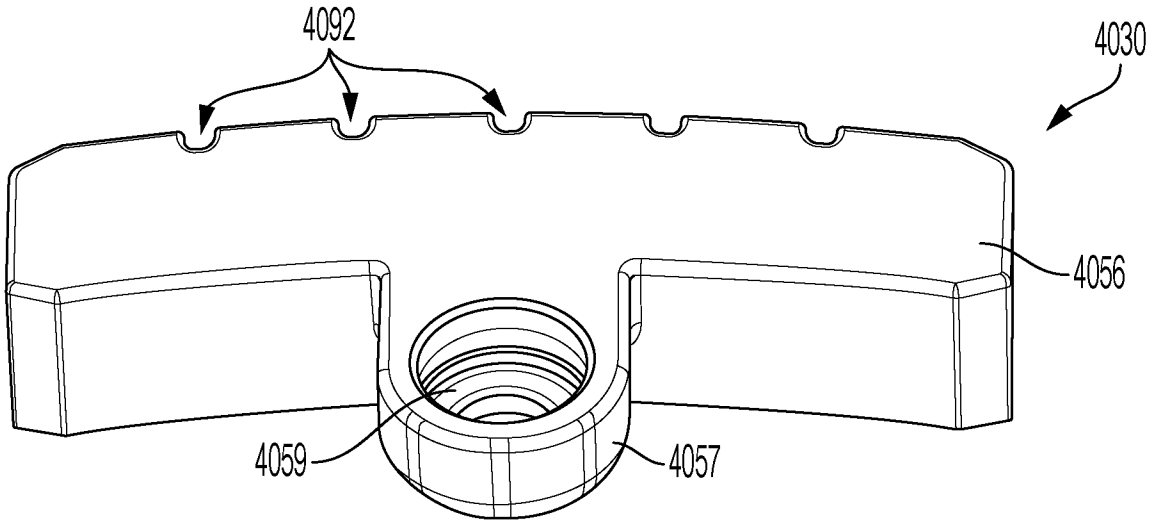

FIG. 138 is a perspective view of the cover of the weight assembly of the golf club head of FIG. 127.

Figure 139:
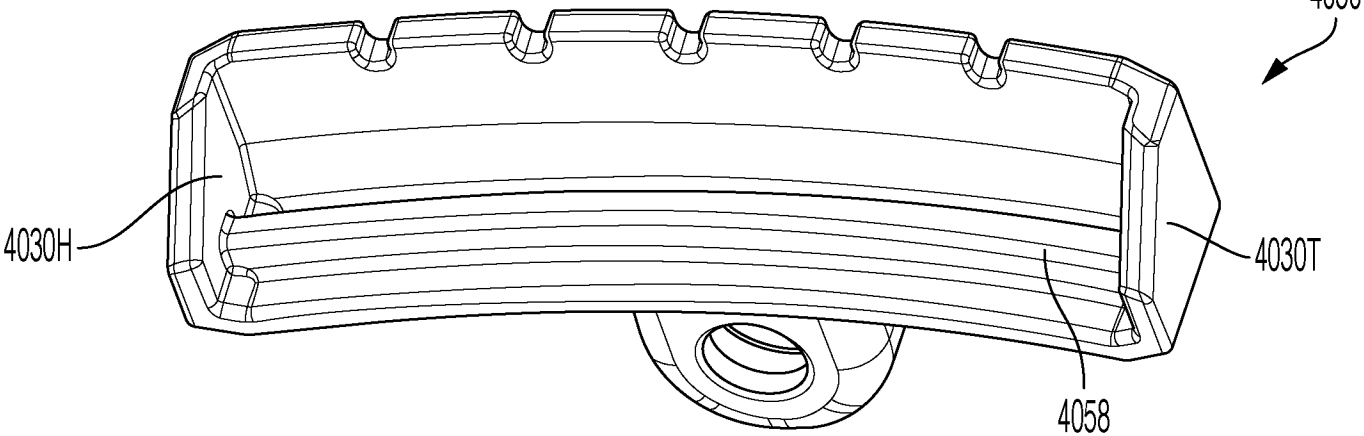

FIG. 139 is another perspective view of the cover of the weight assembly of the golf club head of FIG. 127.

Figure 140:
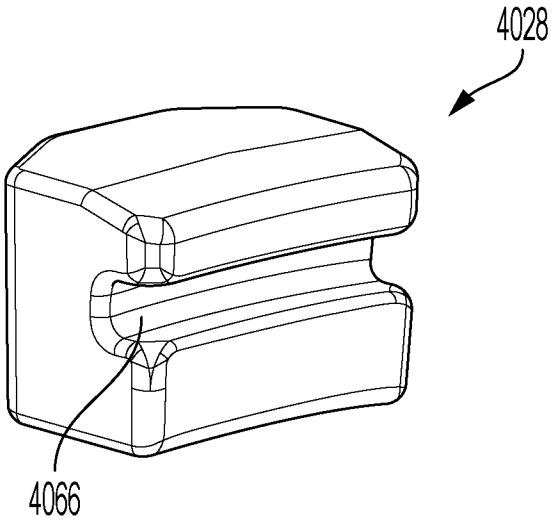

FIG. 140 is a perspective view of the weight of the weight assembly of the golf club head of FIG. 127.

Figure 141:
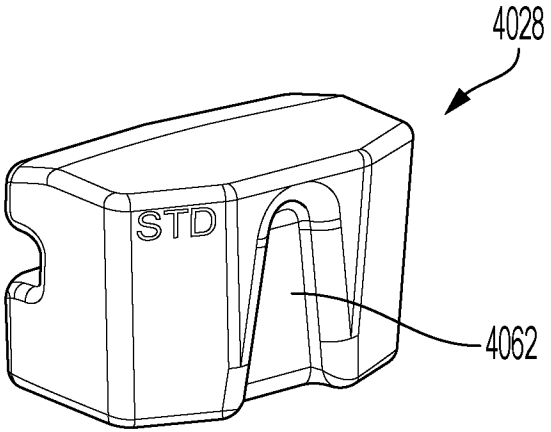

FIG. 141 is another perspective view of the weight of the weight assembly of the golf club head of FIG. 127.

Figure 142:
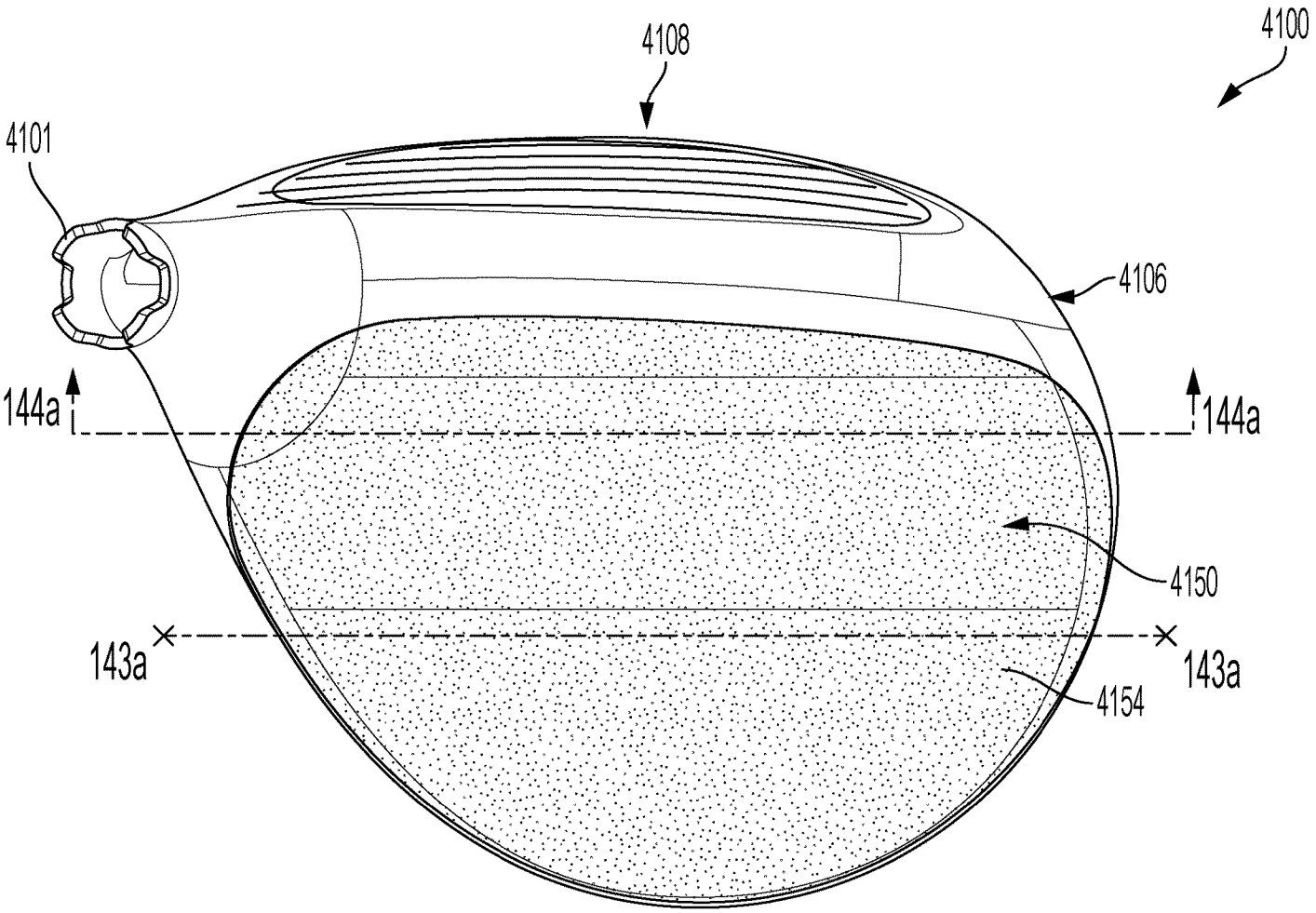

FIG. 142 is a top view of another golf club head with another weight assembly.

Figure 143:
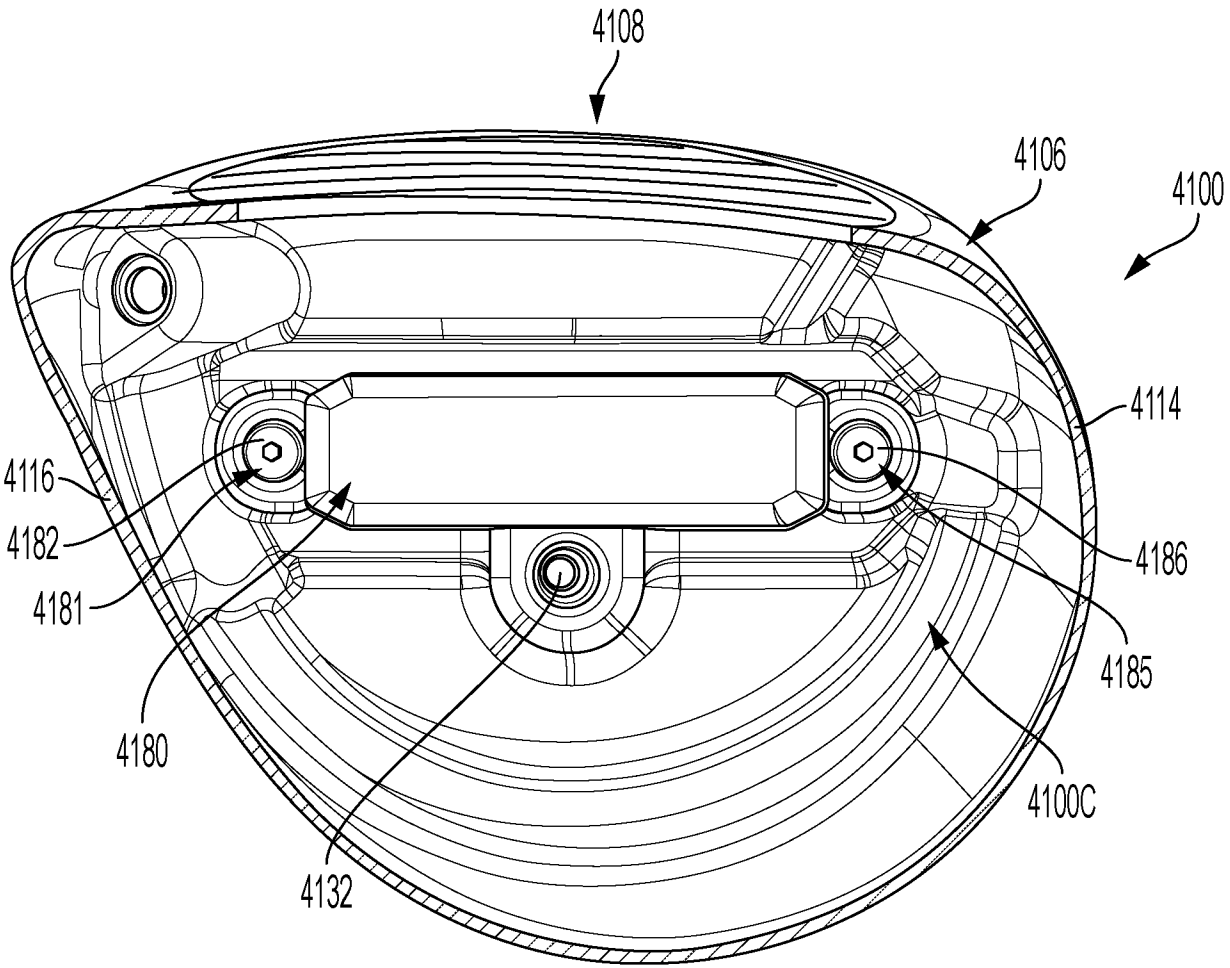

FIG. 143 is a top, cross-sectional view of the golf club head of FIG. 142 along line 143*a*-143*a* of FIG. 142.

Figure 144:
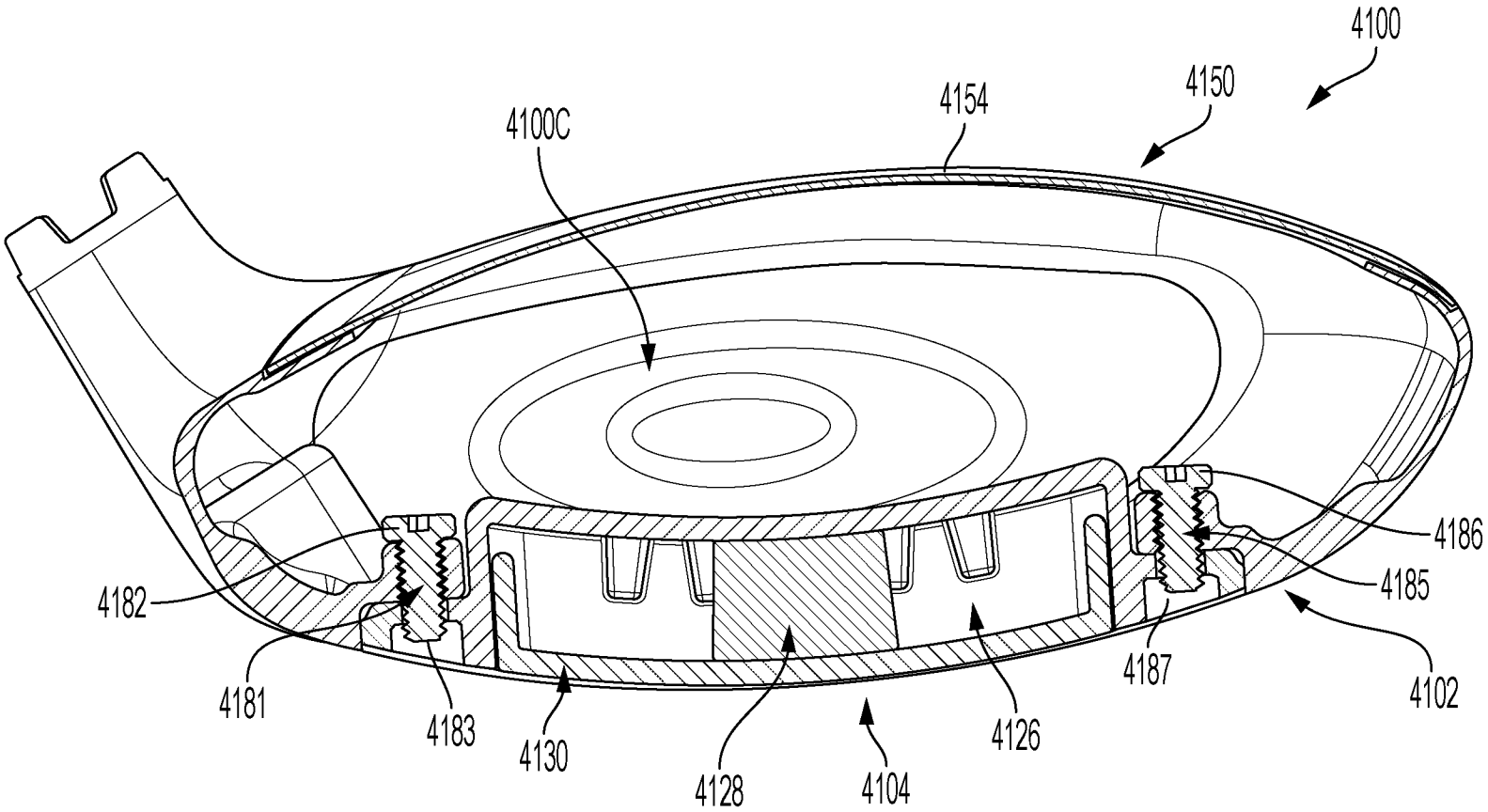

FIG. 144 is a cross-sectional view of the golf club head of FIG. 142 along line 144*a*-144*a* of FIG. 142 when the weight assembly is in the locked configuration.

Figure 145:
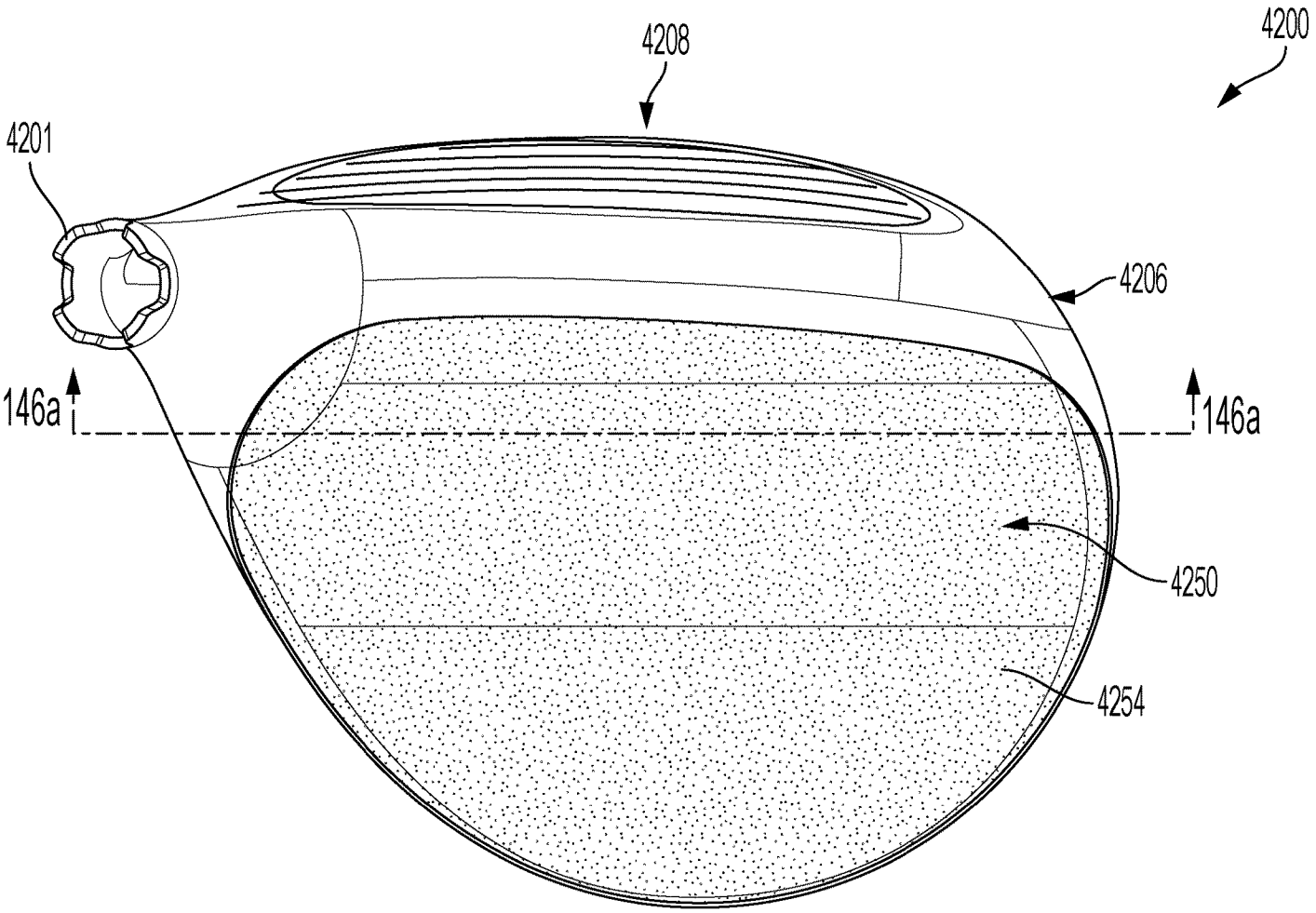

FIG. 145 is a top view of another golf club head with another weight assembly.

Figure 146:
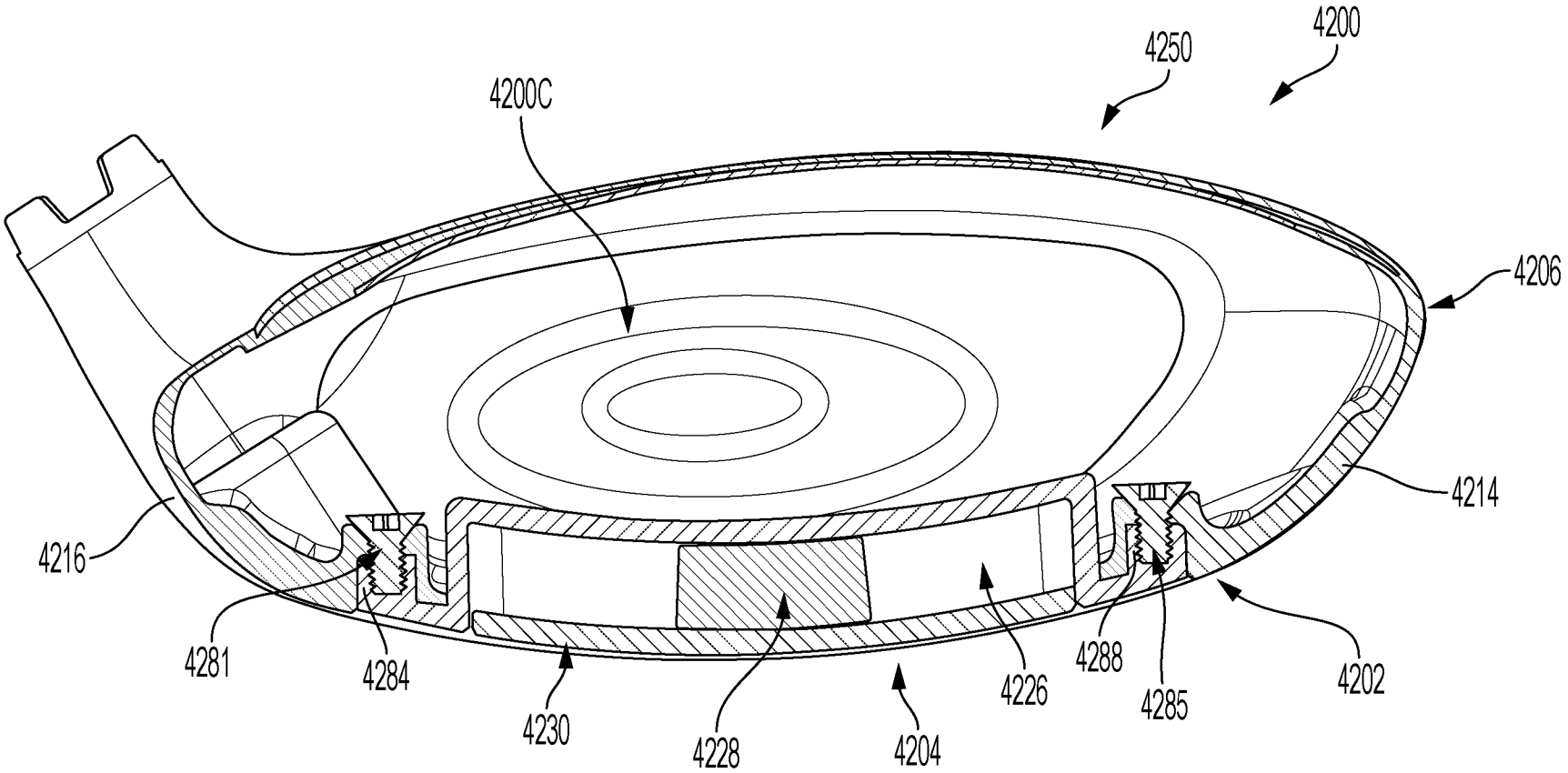

FIG. 146 is a cross-sectional view of the golf club head of FIG. 145 along line 146*a*-146*a* of FIG. 145.

Figure 147:
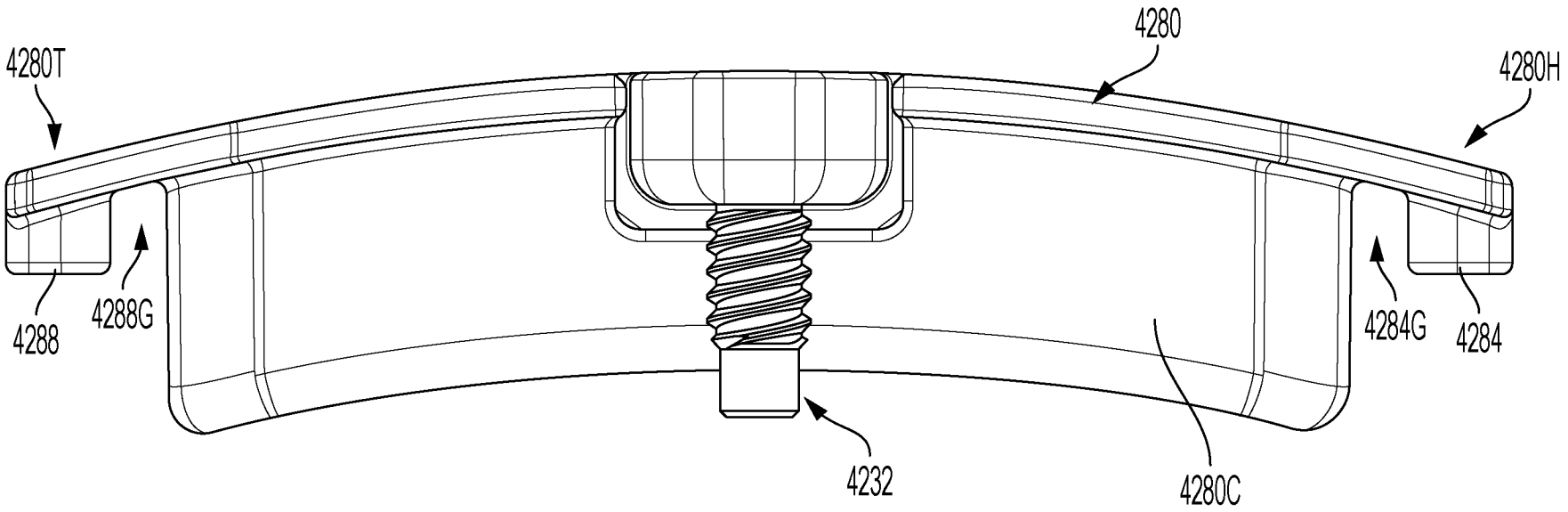

FIG. 147 is a side view of the pocket of the golf club head of FIG. 145.

Figure 148:
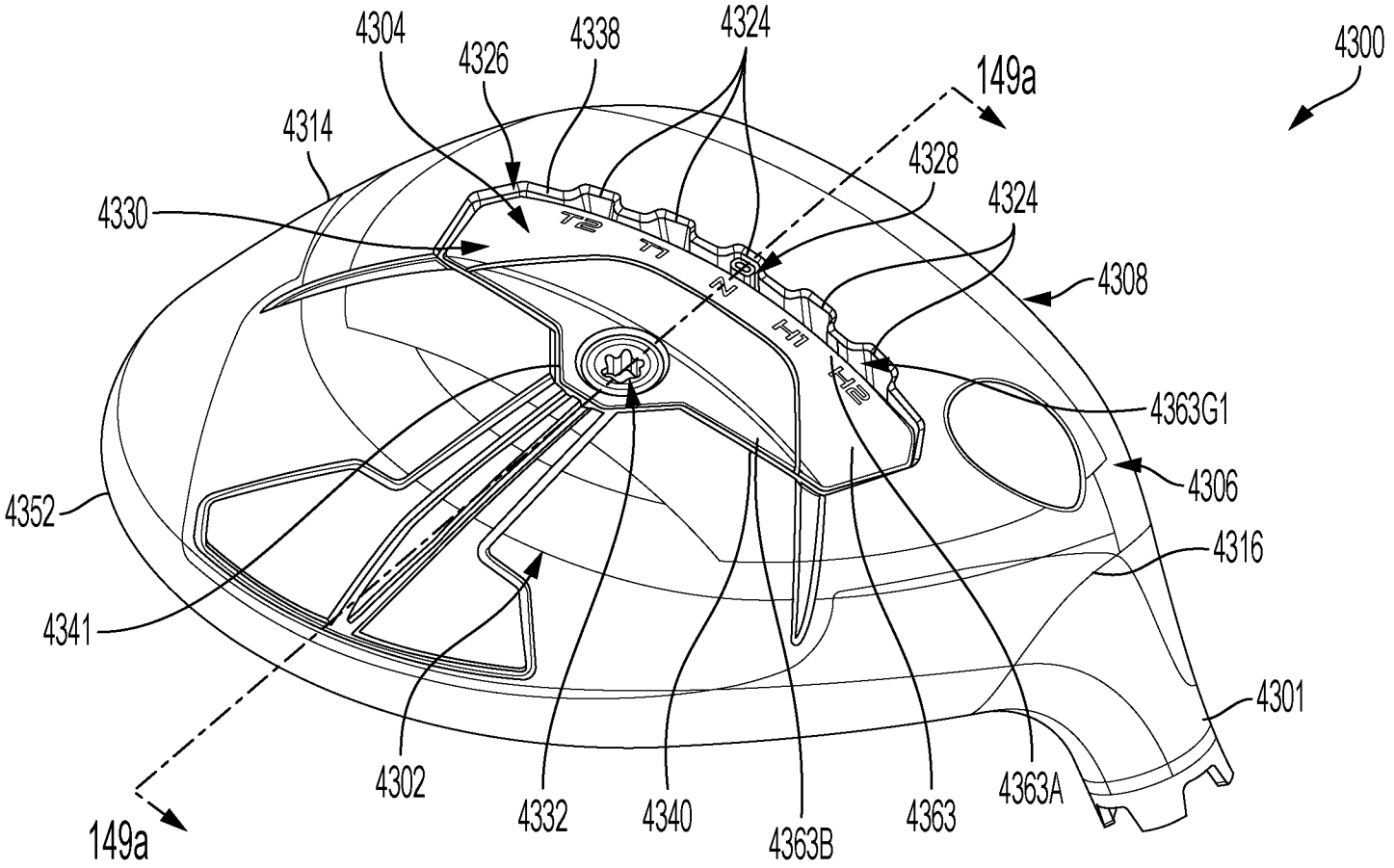

FIG. 148 is a bottom, heel perspective view of another golf club head with another weight assembly.

Figure 149:
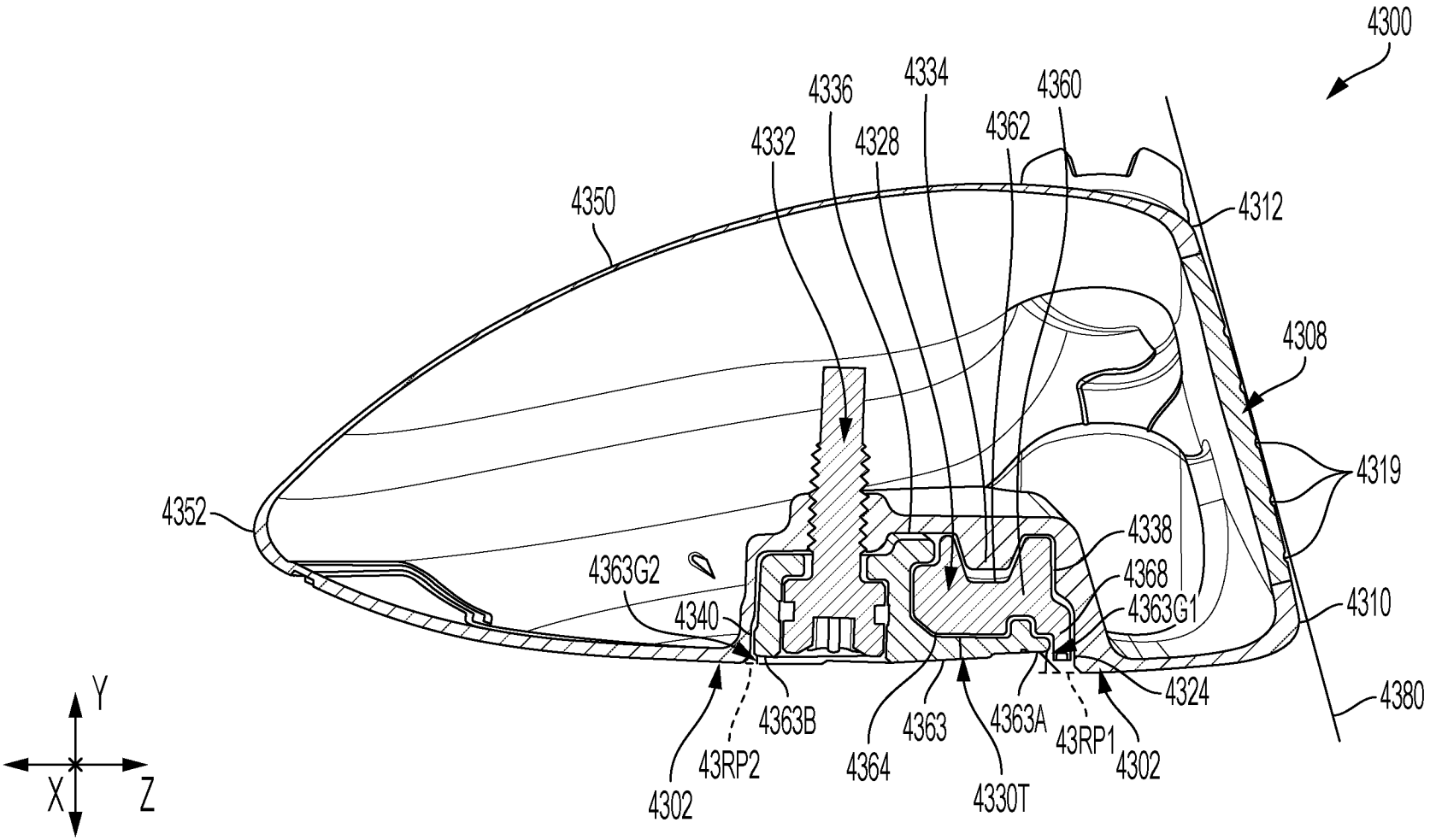

FIG. 149 is a toe-to-heel cross-sectional view of the golf club head of FIG. 148 along line 149*a*-149*a* of FIG. 148.

Figure 150:
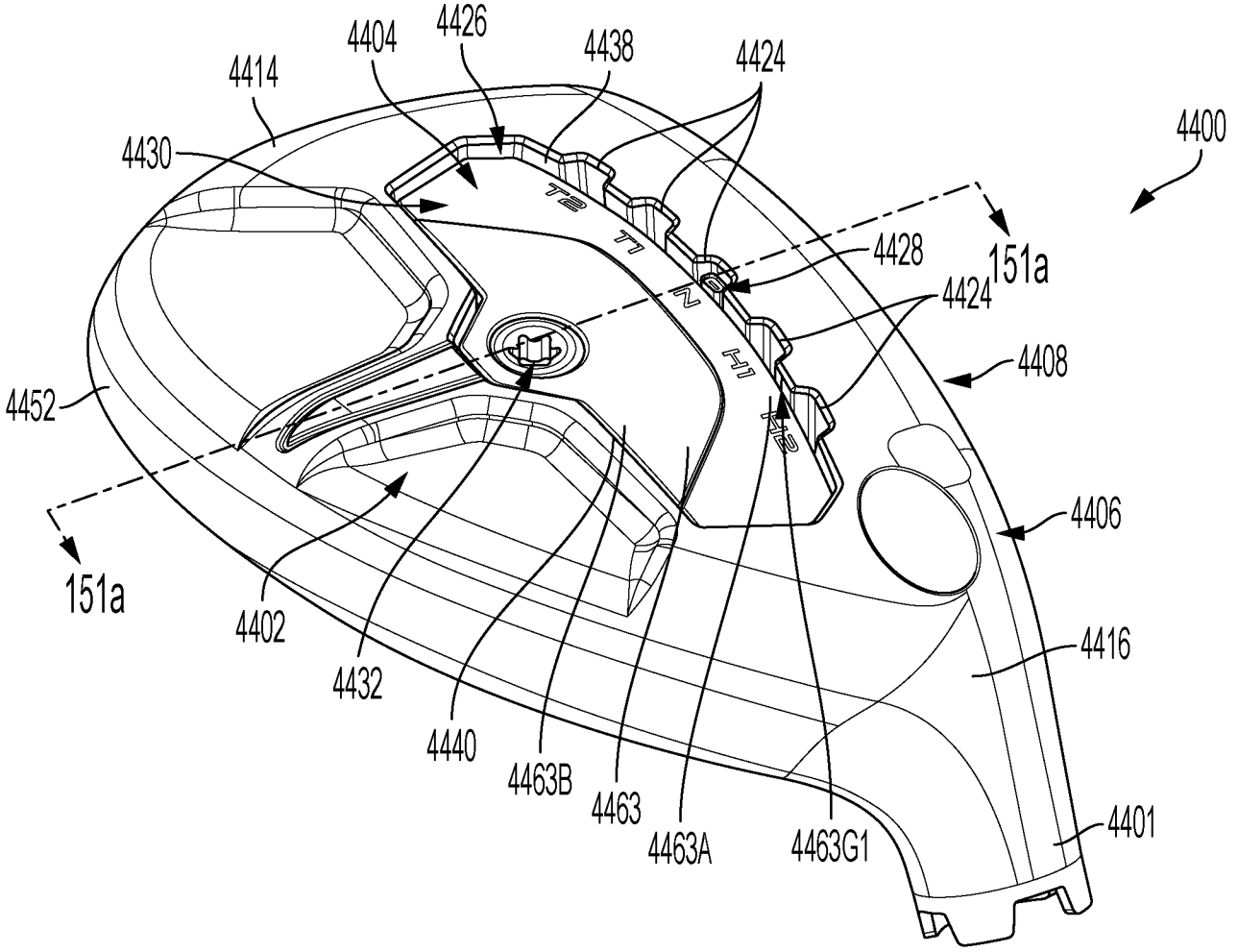

FIG. 150 is a bottom, heel perspective view of another golf club head with another weight assembly.

Figure 151:
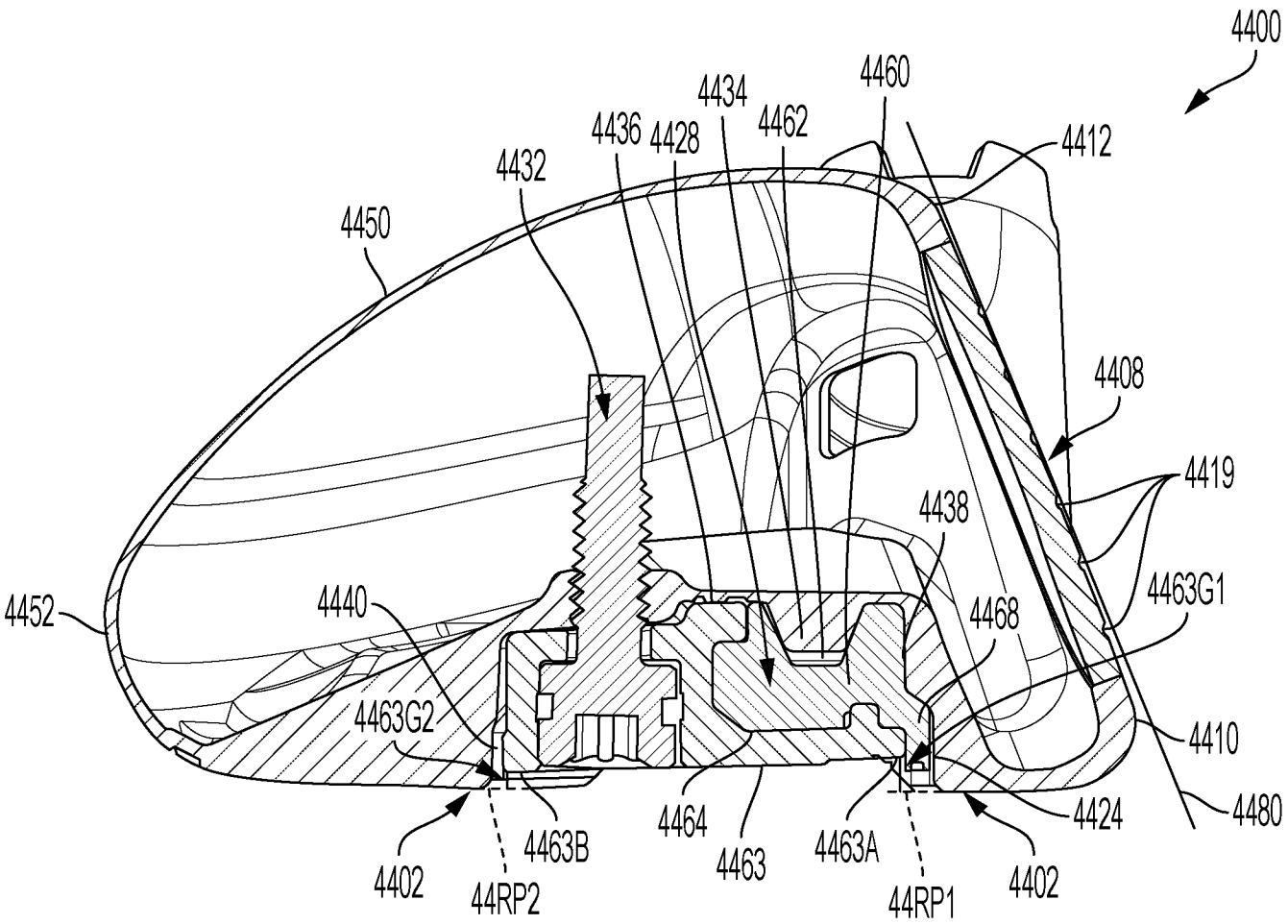

FIG. 151 is cross-sectional view of the golf club head of FIG. 150 along line 151*a*-151*a* of FIG. 150.

Figure 152:
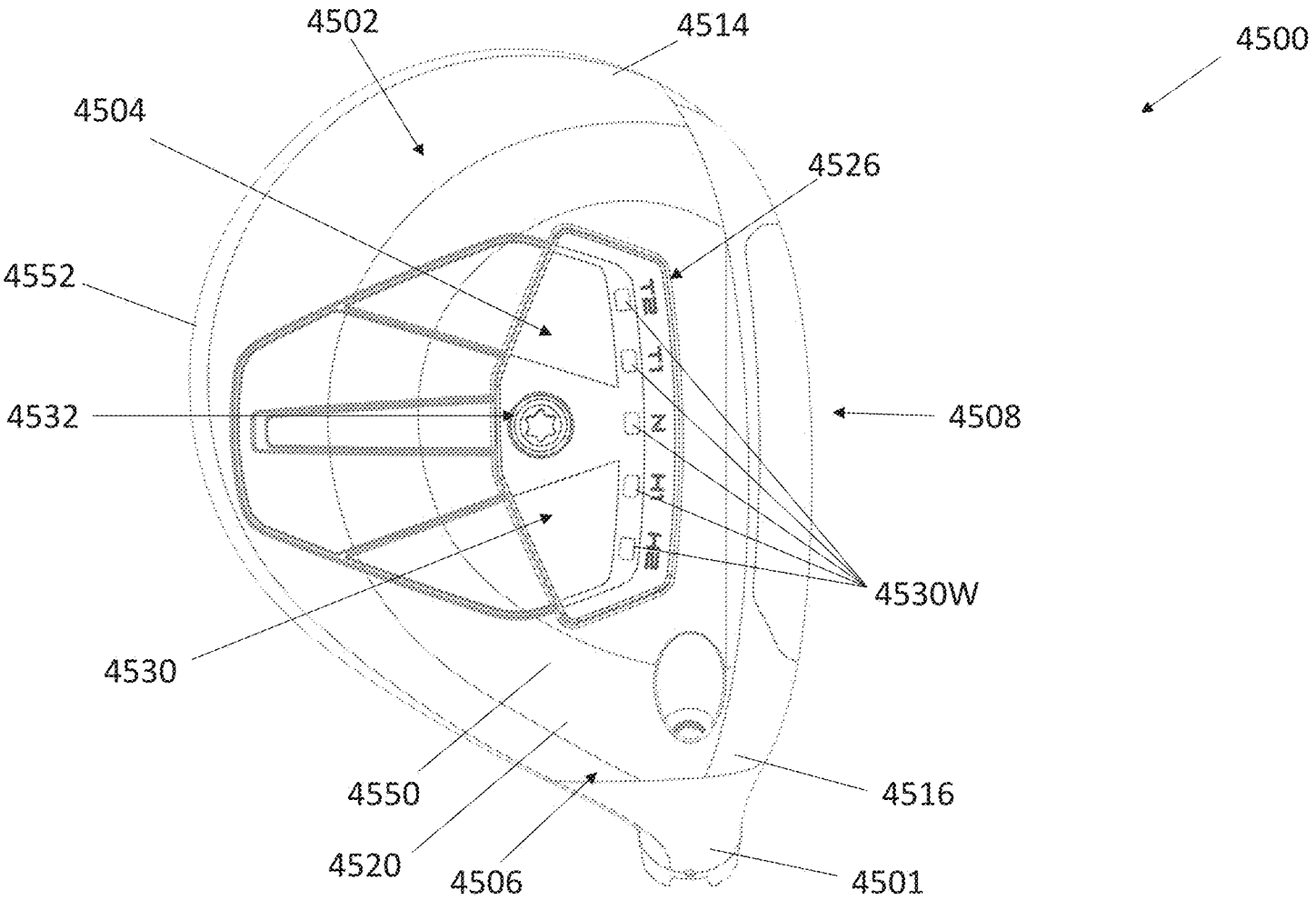

FIG. 152 is a bottom view of another golf club head with another weight assembly in a locked position.

Figure 153:
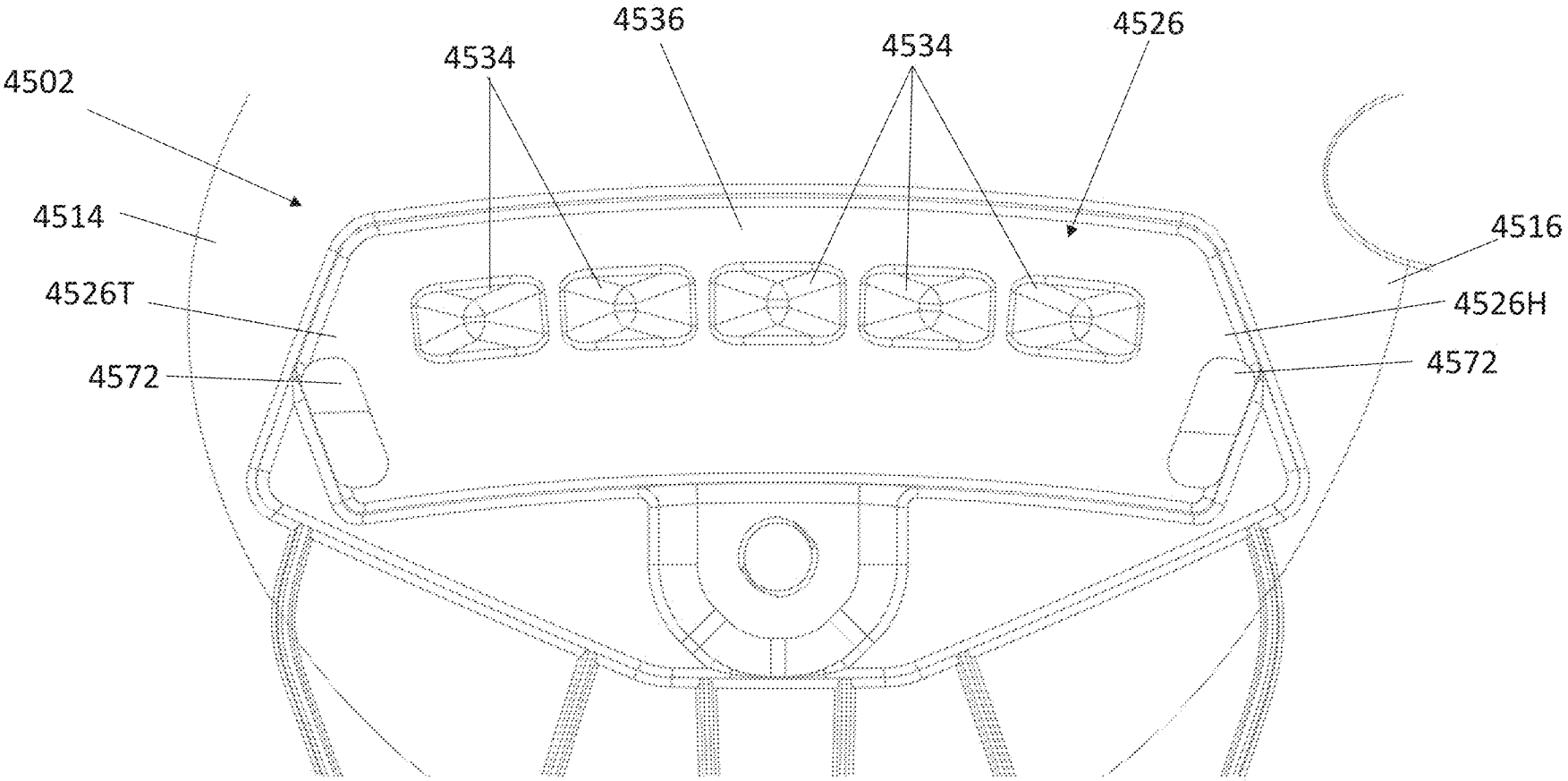

FIG. 153 is another bottom view of part of the golf club head of FIG. 152 without the weight assembly.

Figure 154:
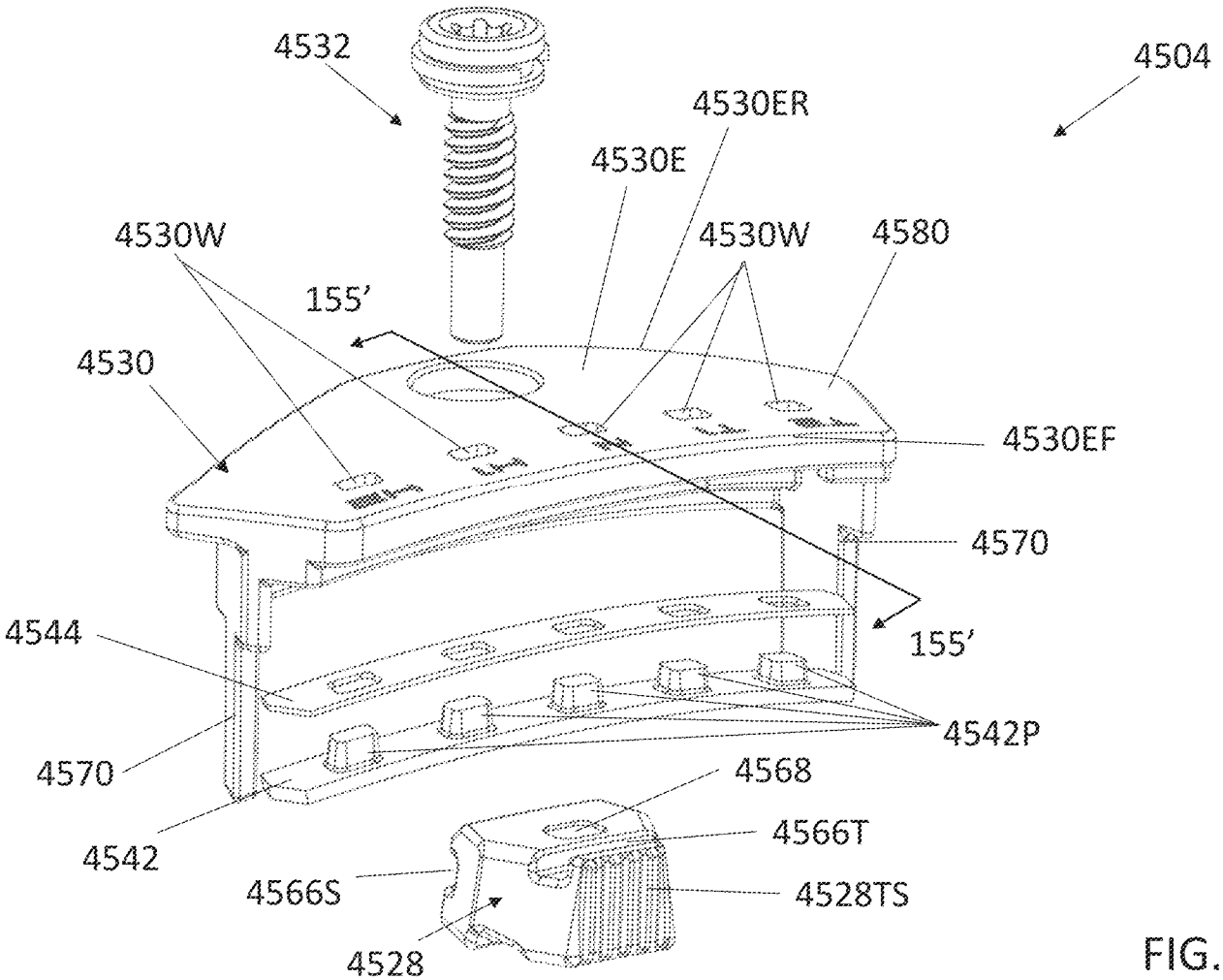

FIG. 154 is an exploded perspective view of the weight assembly of the golf club head of FIG. 152.

Figure 155:
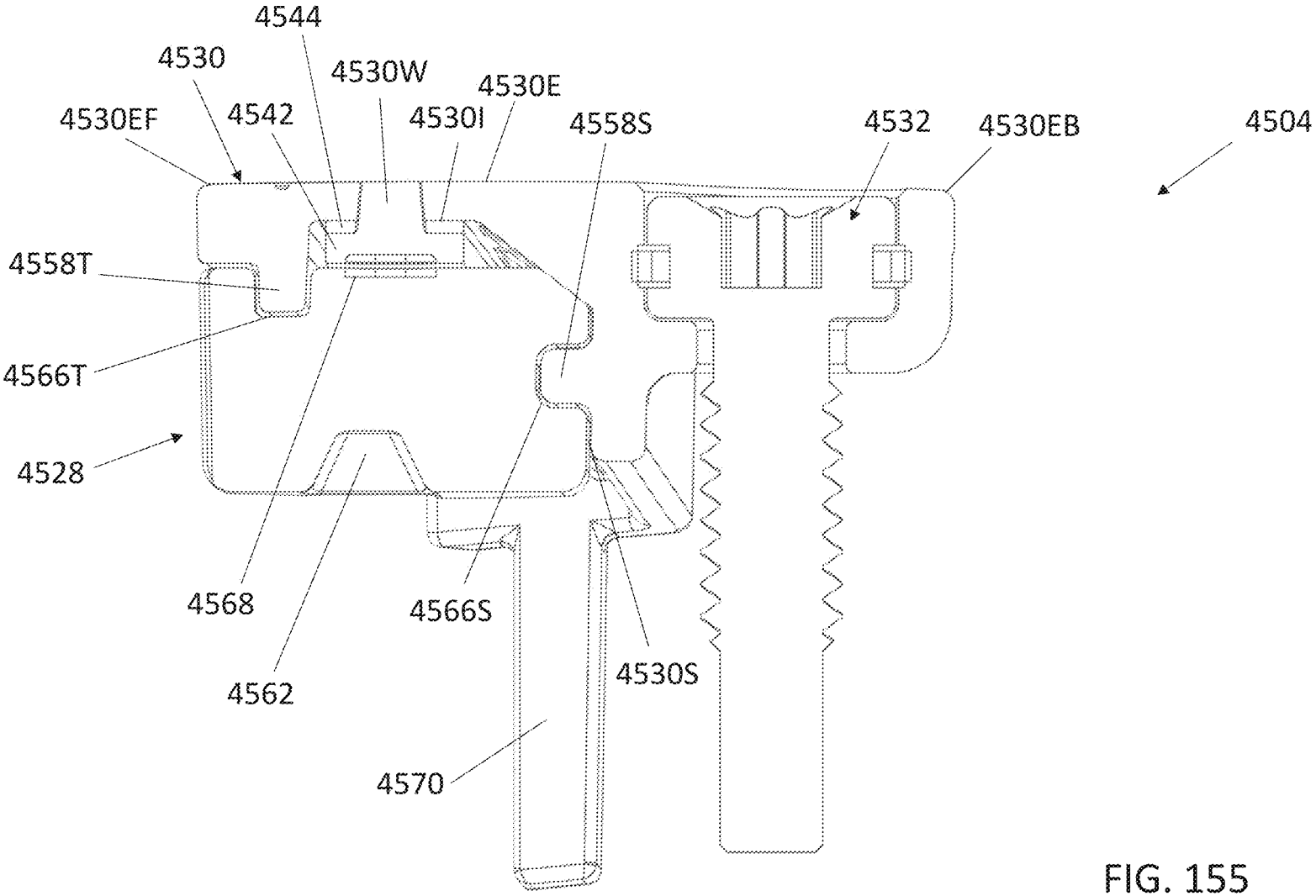

FIG. 155 is a cross-sectional view of the weight assembly along line 155'-155' in FIG. 154 when the weight assembly is assembled.

Figure 156:
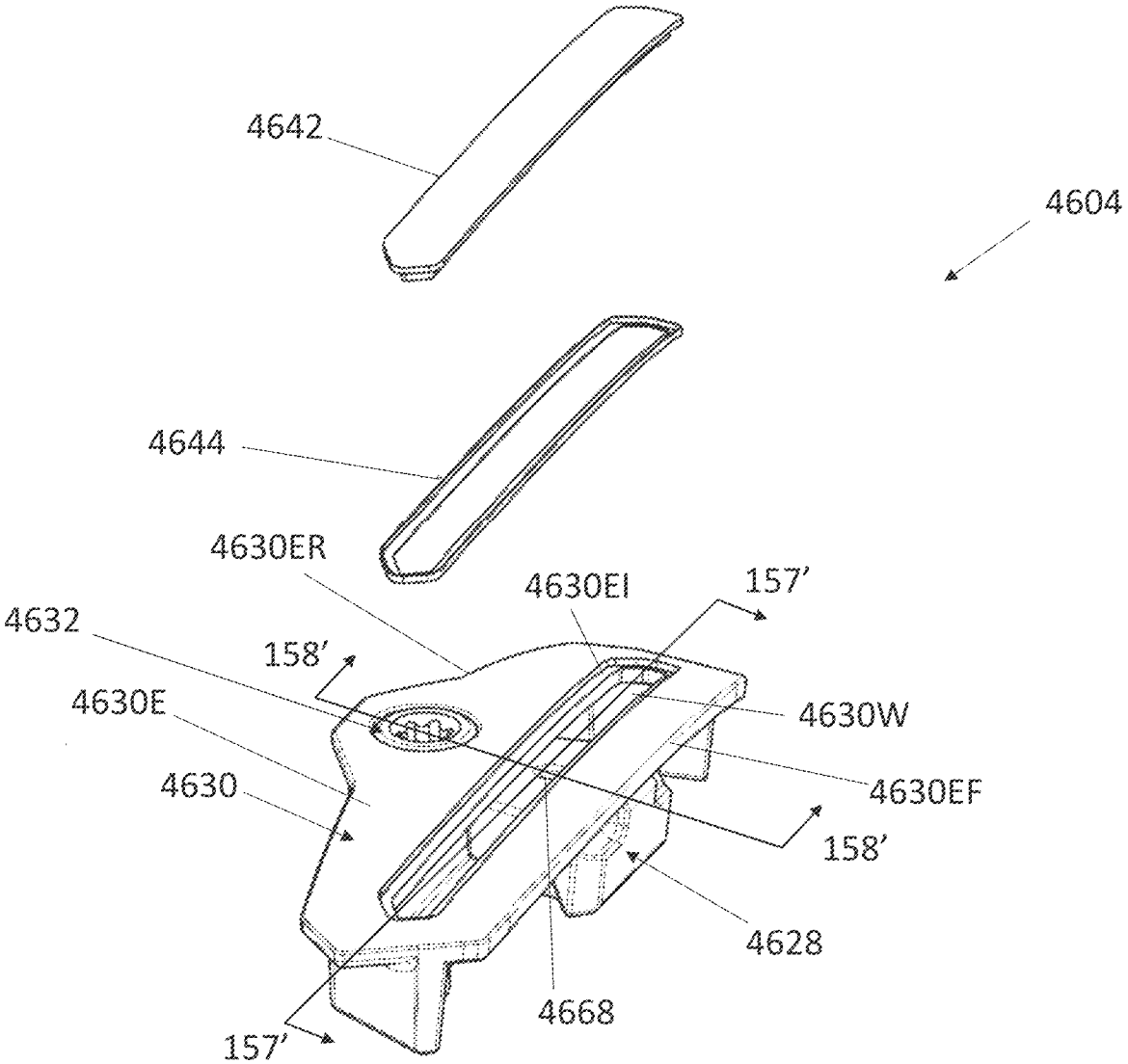

FIG. 156 depicts an exploded perspective view of another weight assembly.

Figure 157:
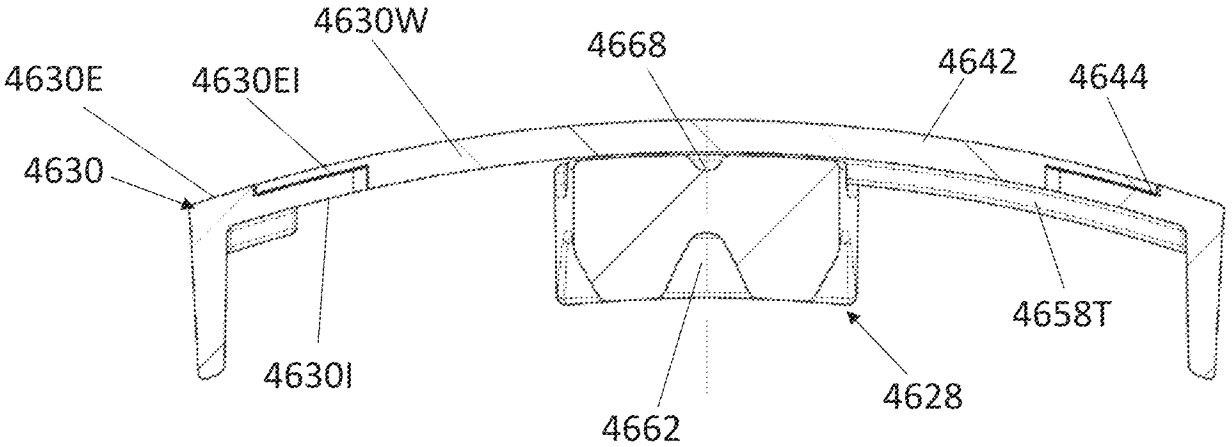

FIG. 157 depicts a cross-sectional view of the weight assembly of FIG. 156 along the line 157'-157' in FIG. 156 and when the weight assembly is assembled.

Figure 158:
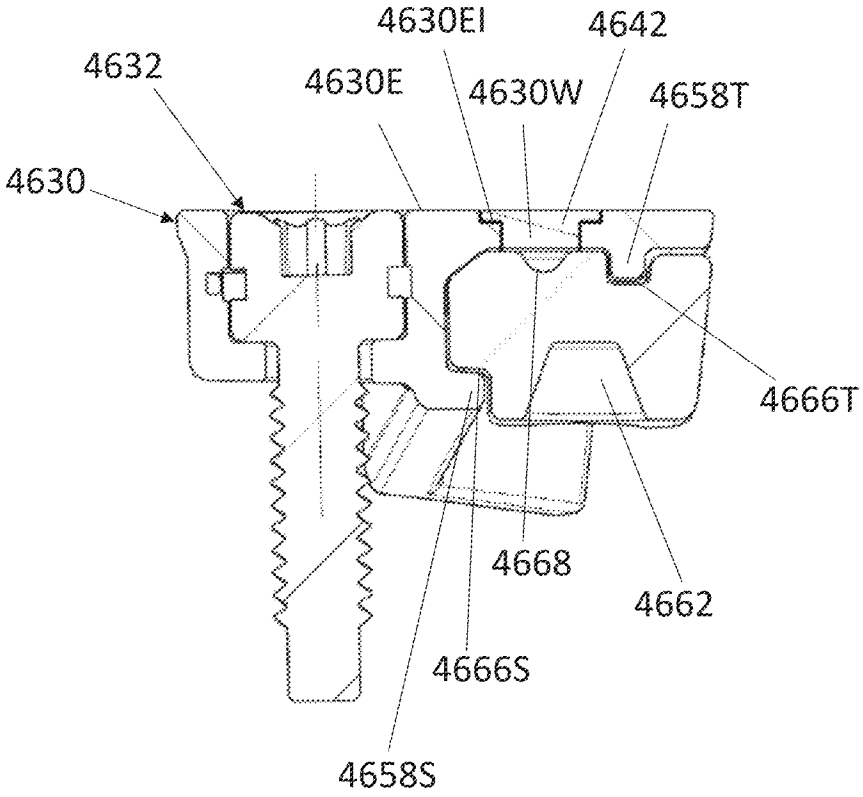

FIG. 158 depicts a cross-sectional view of the weight assembly of FIG. 156 along the line 158'-158' in FIG. 156 and when the weight assembly is assembled.

Figure 159:
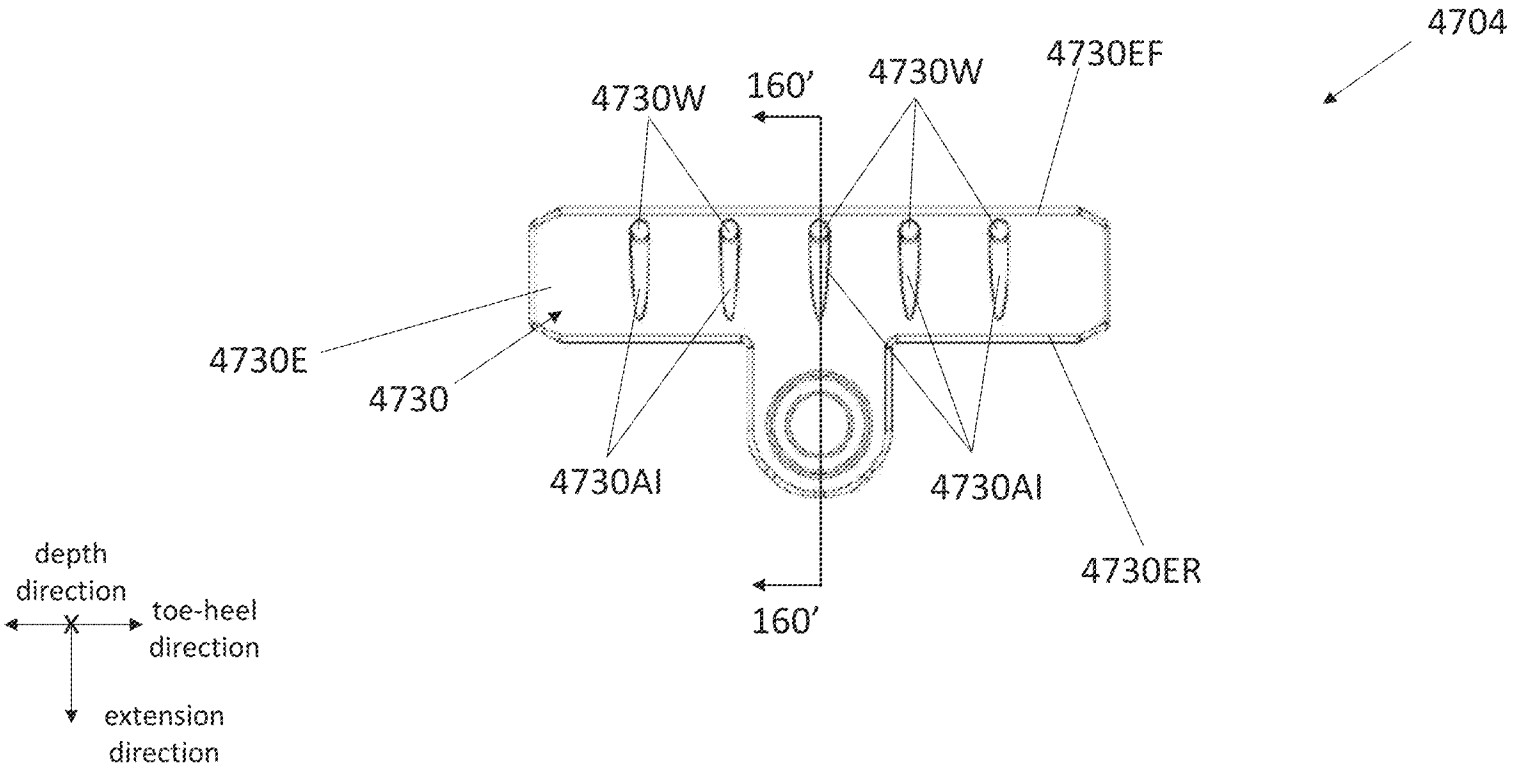

FIG. 159 depicts a top view of another weight assembly 4704.

Figure 160:
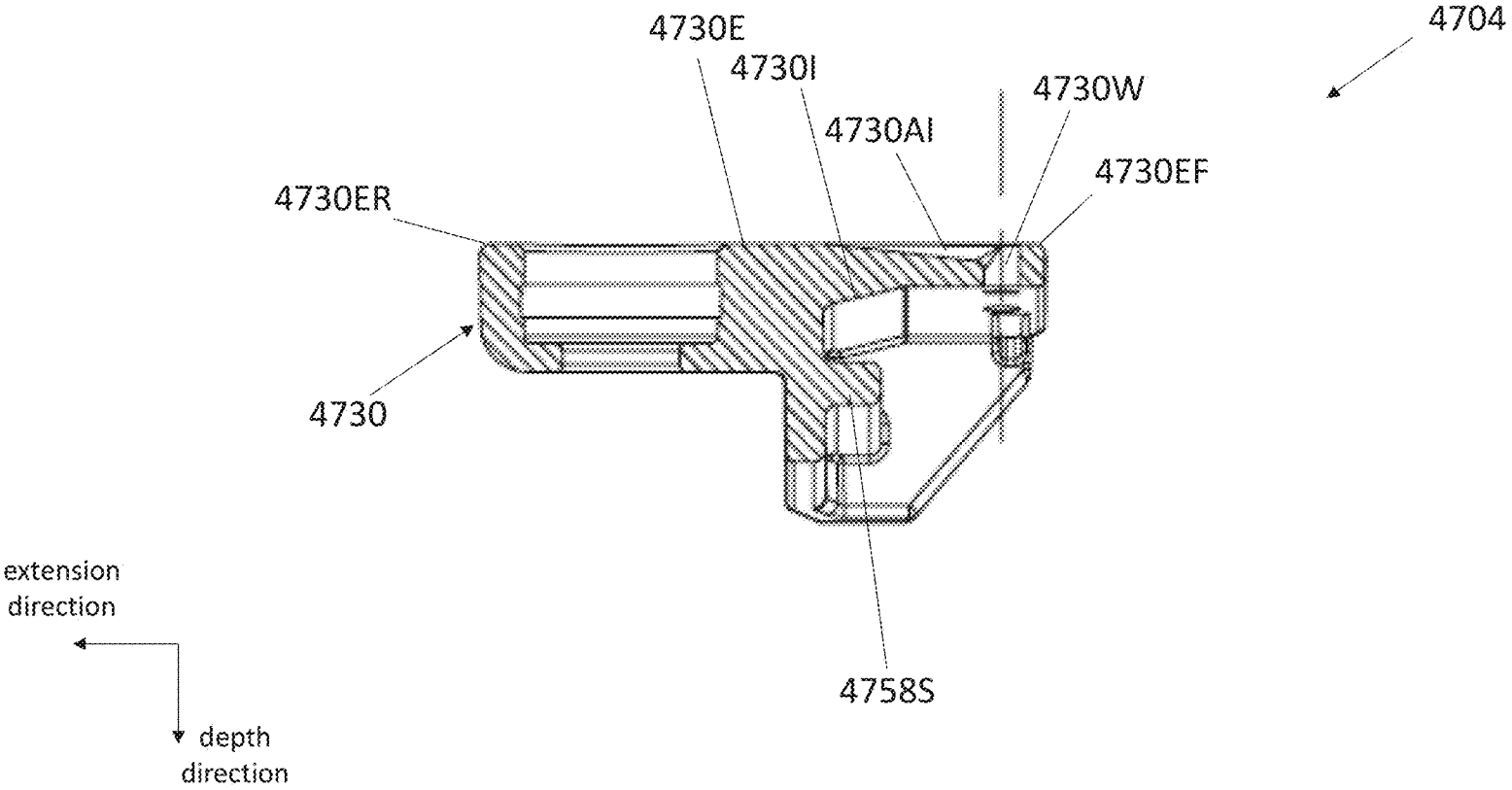

FIG. 160 depicts a cross-sectional view of the weight assembly 4704 of FIG. 159 along the line 160'-160' in FIG. 159.

Figure 161:
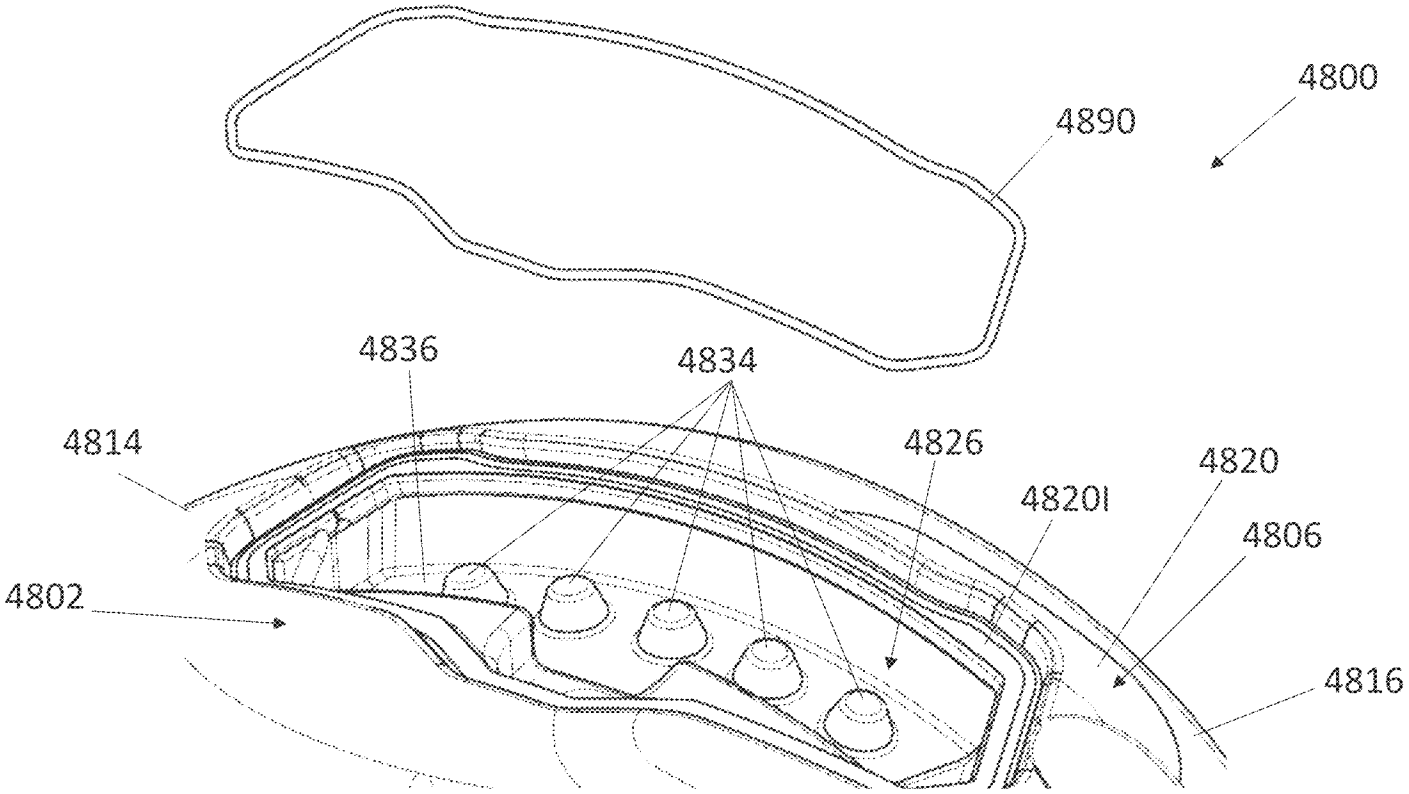

FIG. 161 is a partially exploded bottom view of part of another golf club head without the weight assembly of the golf club head.

Figure 162:
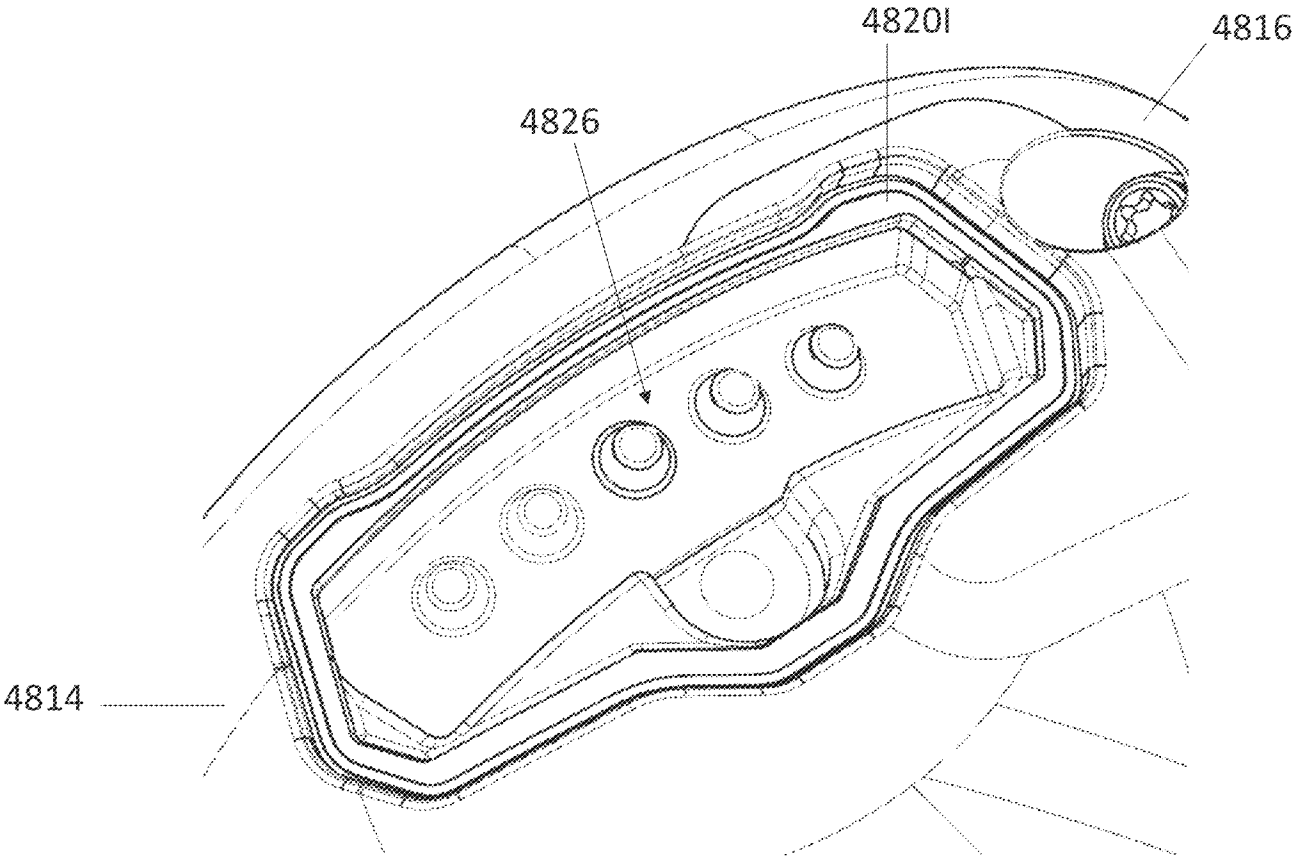

FIG. 162 is a bottom view of part of the golf club head of FIG. 161 without the weight assembly of the golf club head.

Figure 163:
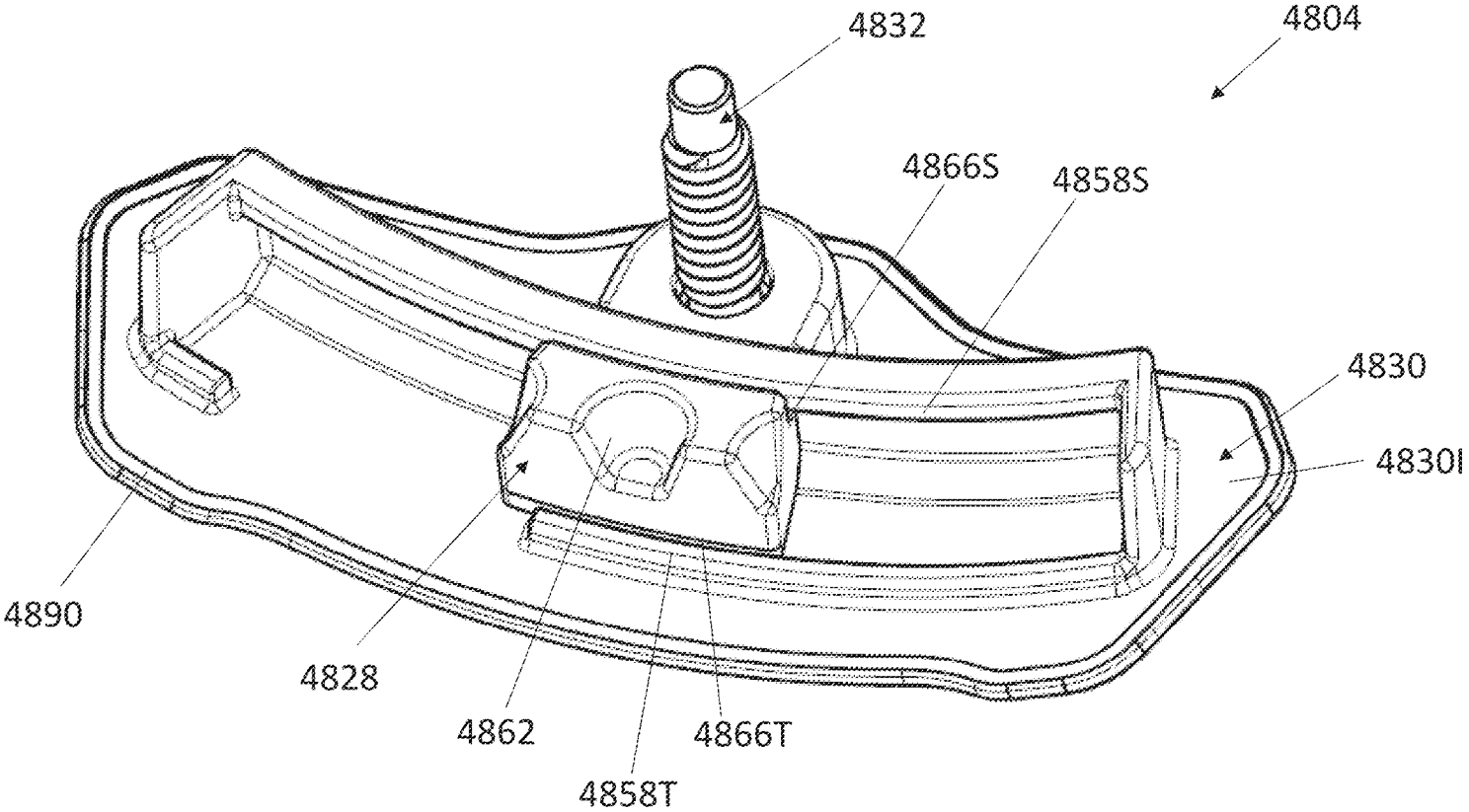

FIG. 163 is a perspective view of the weight assembly of the golf club head of FIG. 161.

Figure 164:
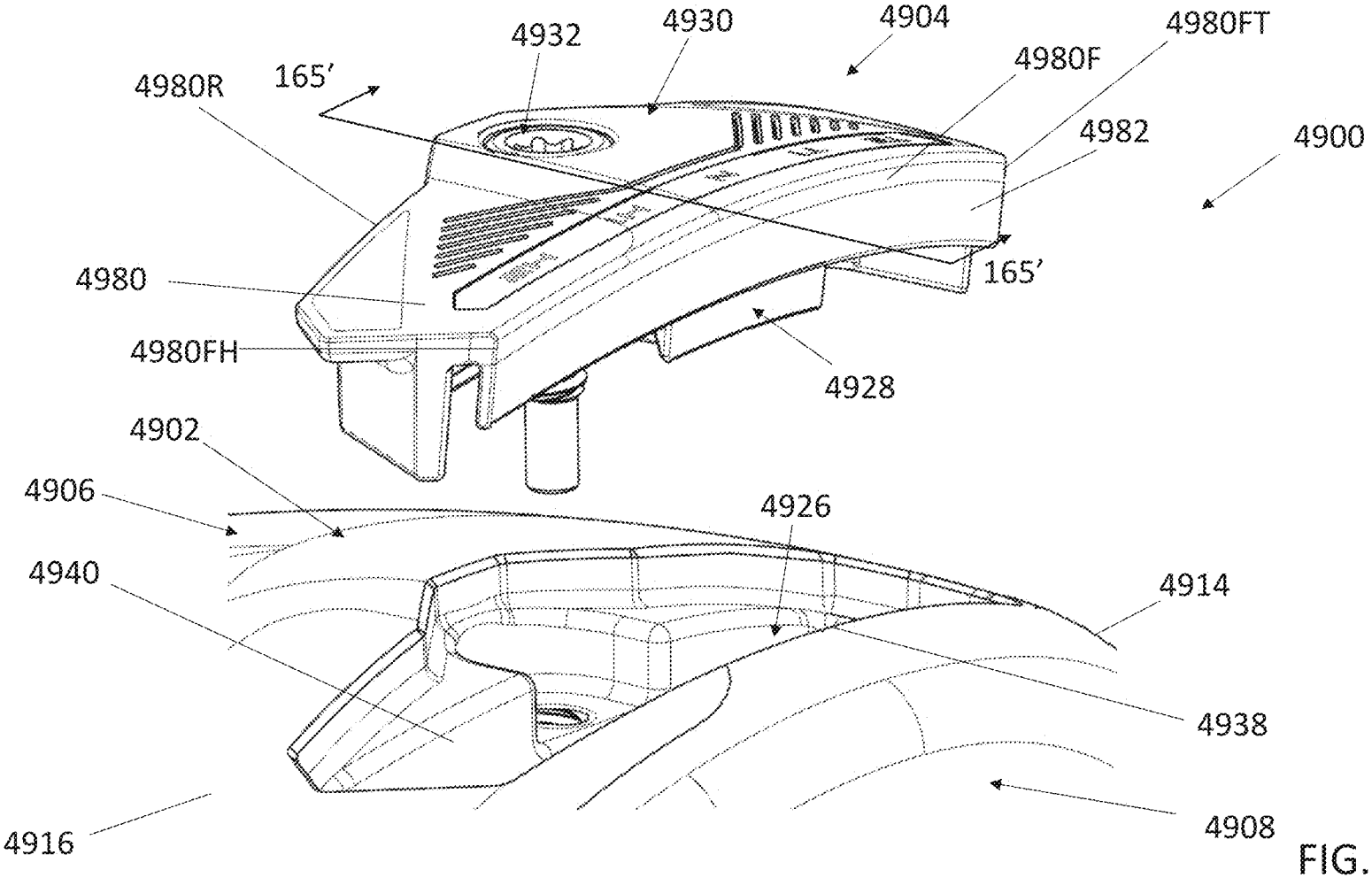

FIG. 164 is a partially exploded perspective view of another golf club head with another weight assembly.

Figure 165:
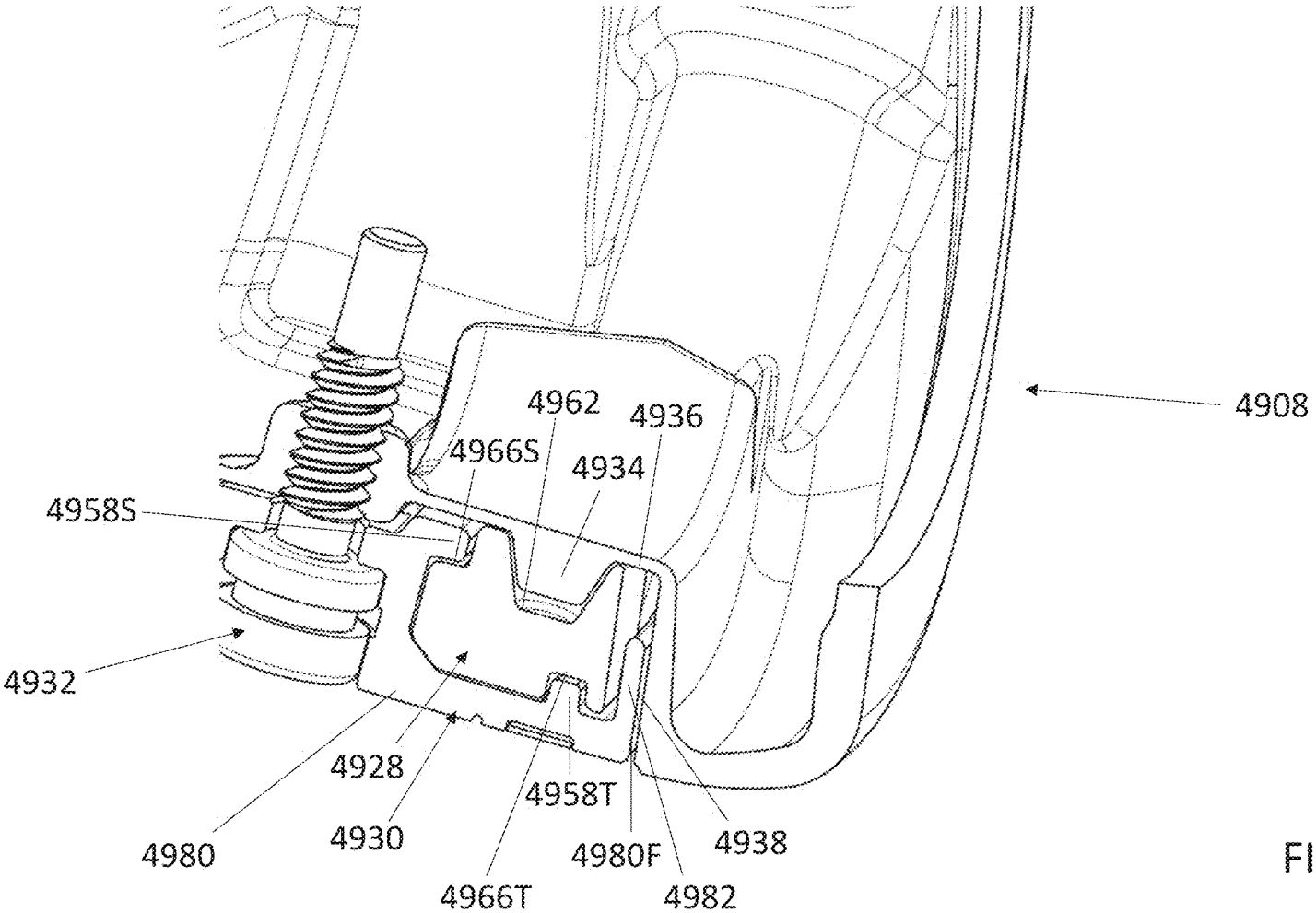

FIG. 165 is a cross-sectional view of the golf club head along the line 165'-165' in FIG. 164 and when the weight assembly is in a locked configuration.

Figure 166:
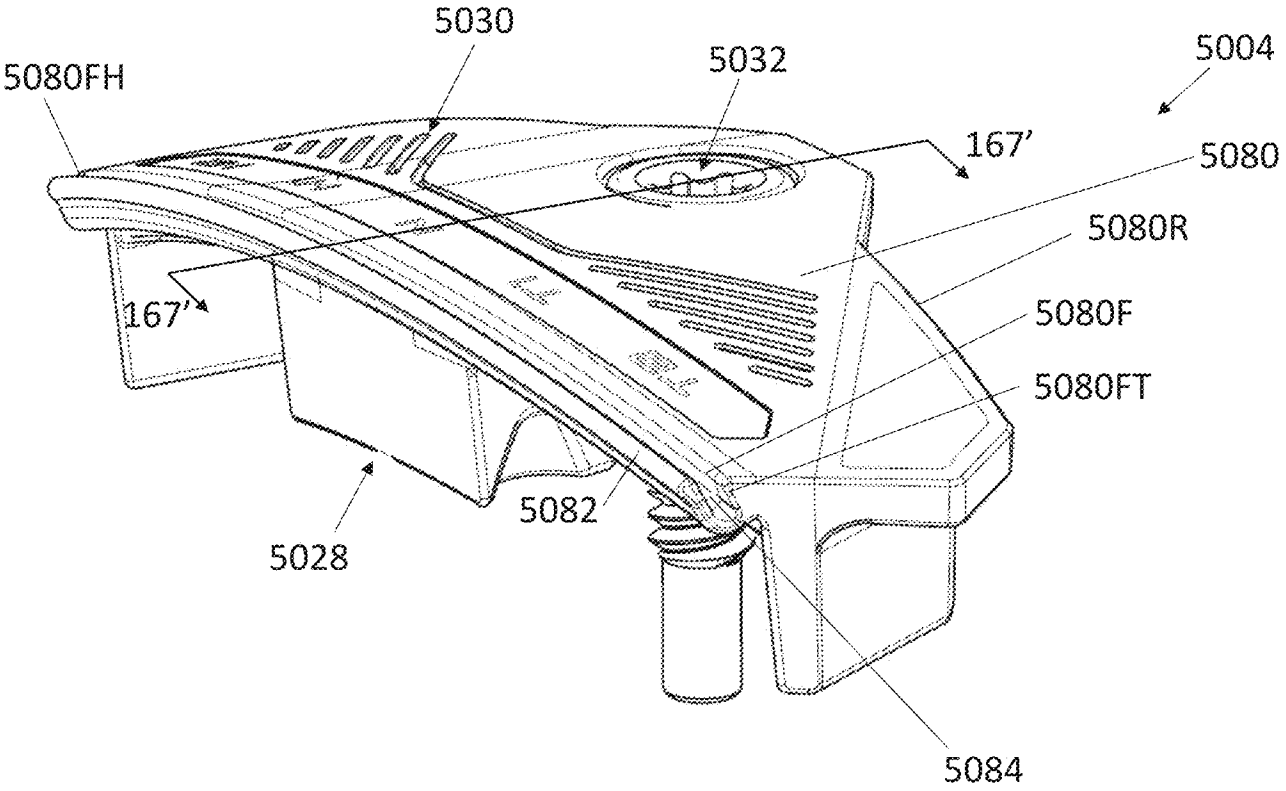

FIG. 166 is a perspective view of another weight assembly.

Figure 167:
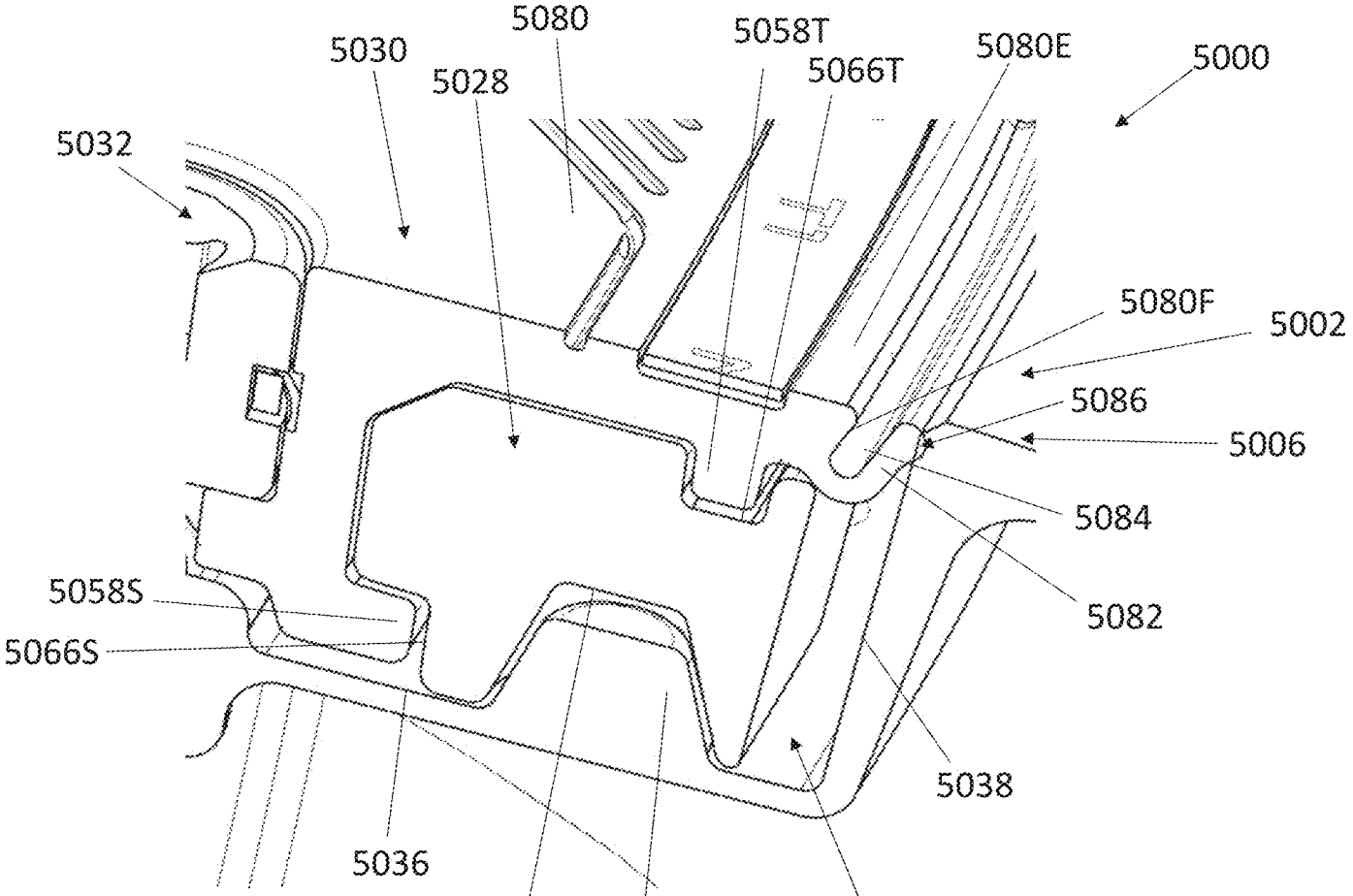

FIG. 167 is a cross-sectional view of the weight assembly of FIG. 166 along the line 167'-167' when the weight assembly is coupled to a golf club head and the weight assembly is in a locked configuration.

Figure 168:
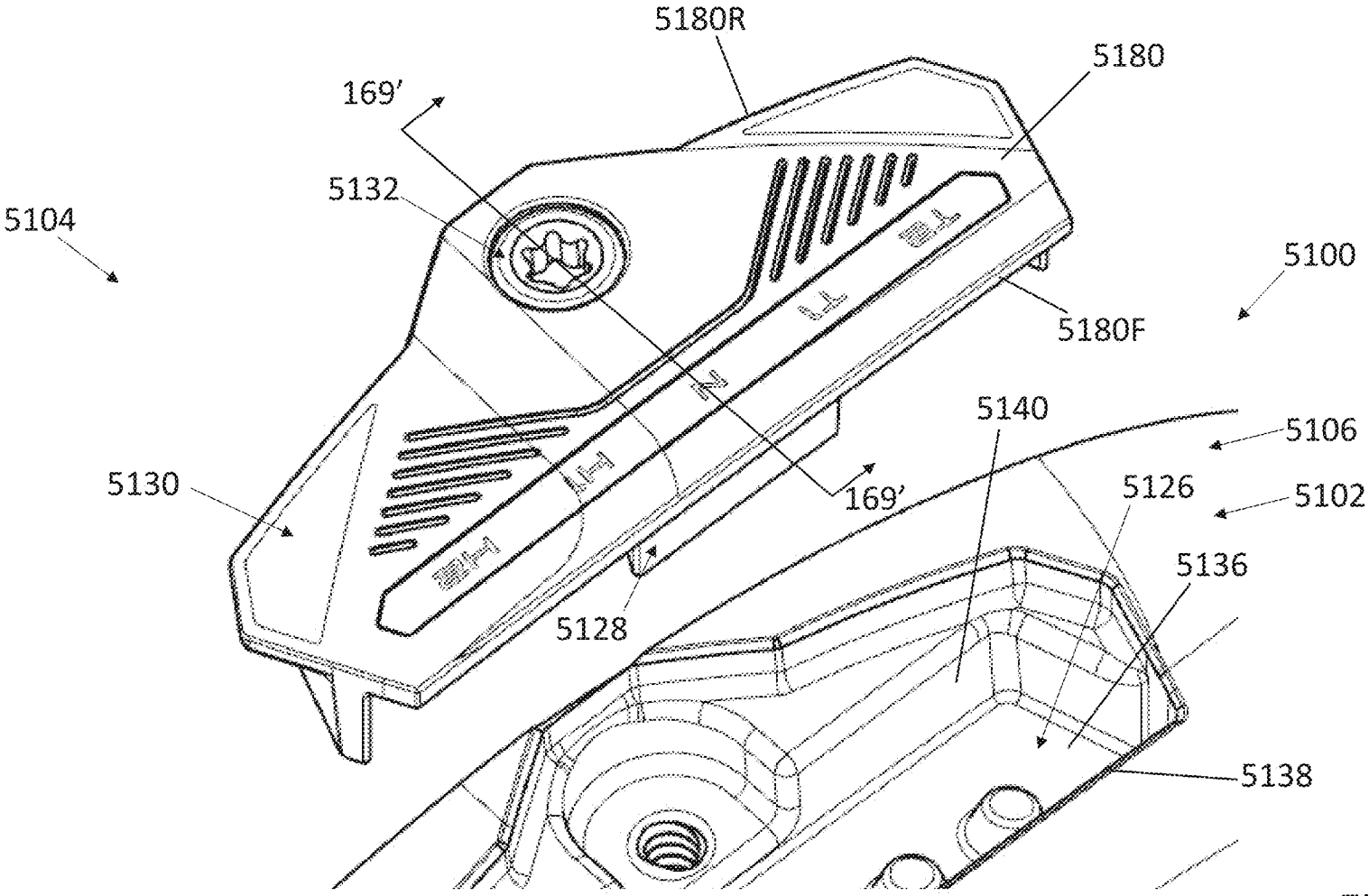

FIG. 168 is a partially exploded bottom view of part of another golf club head with another weight assembly.

Figure 169:
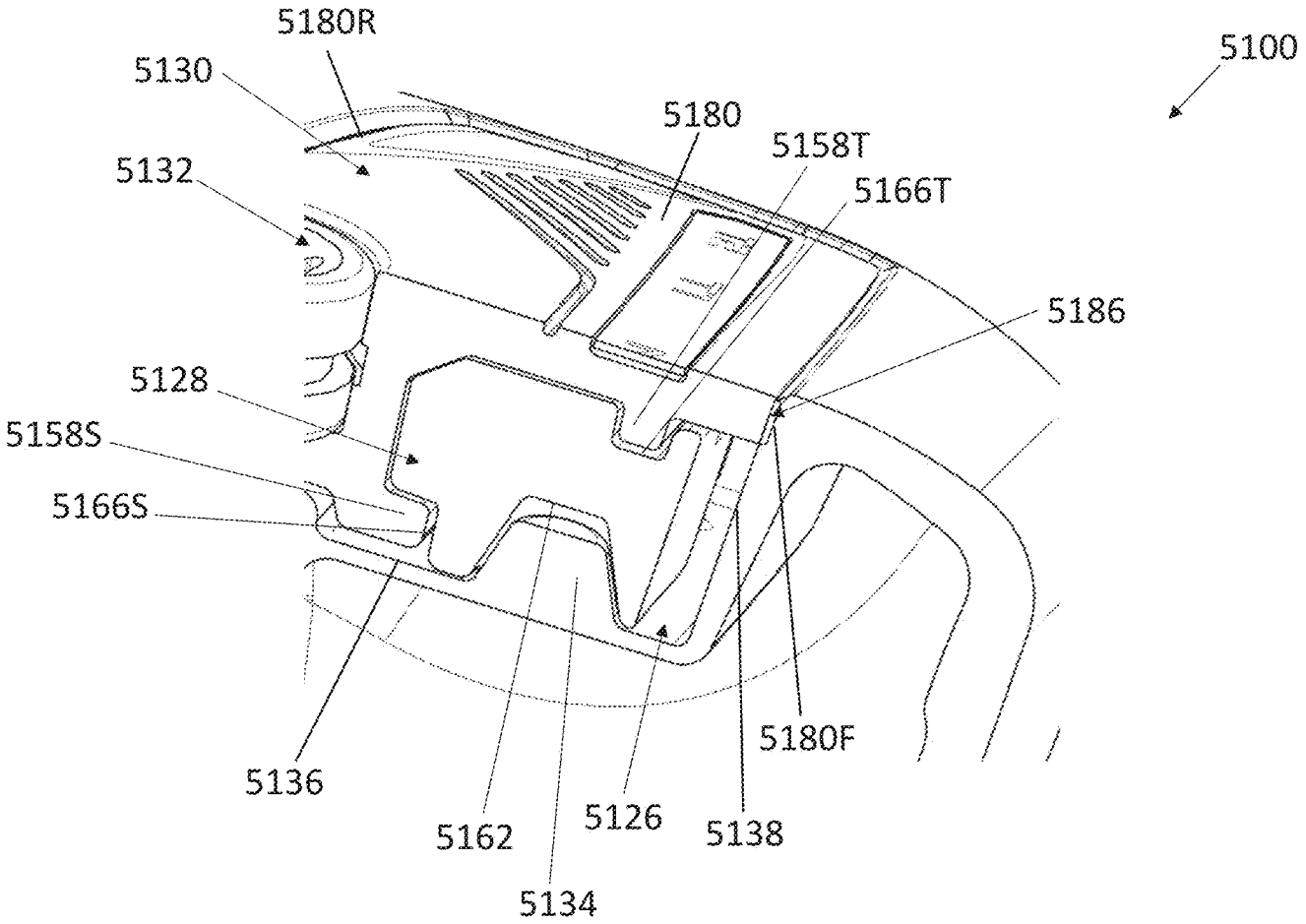

FIG. 169 is a cross-sectional view of the golf club head of FIG. 168 along the line 169'-169' when the weight assembly is in a locked configuration.

Figure 170:
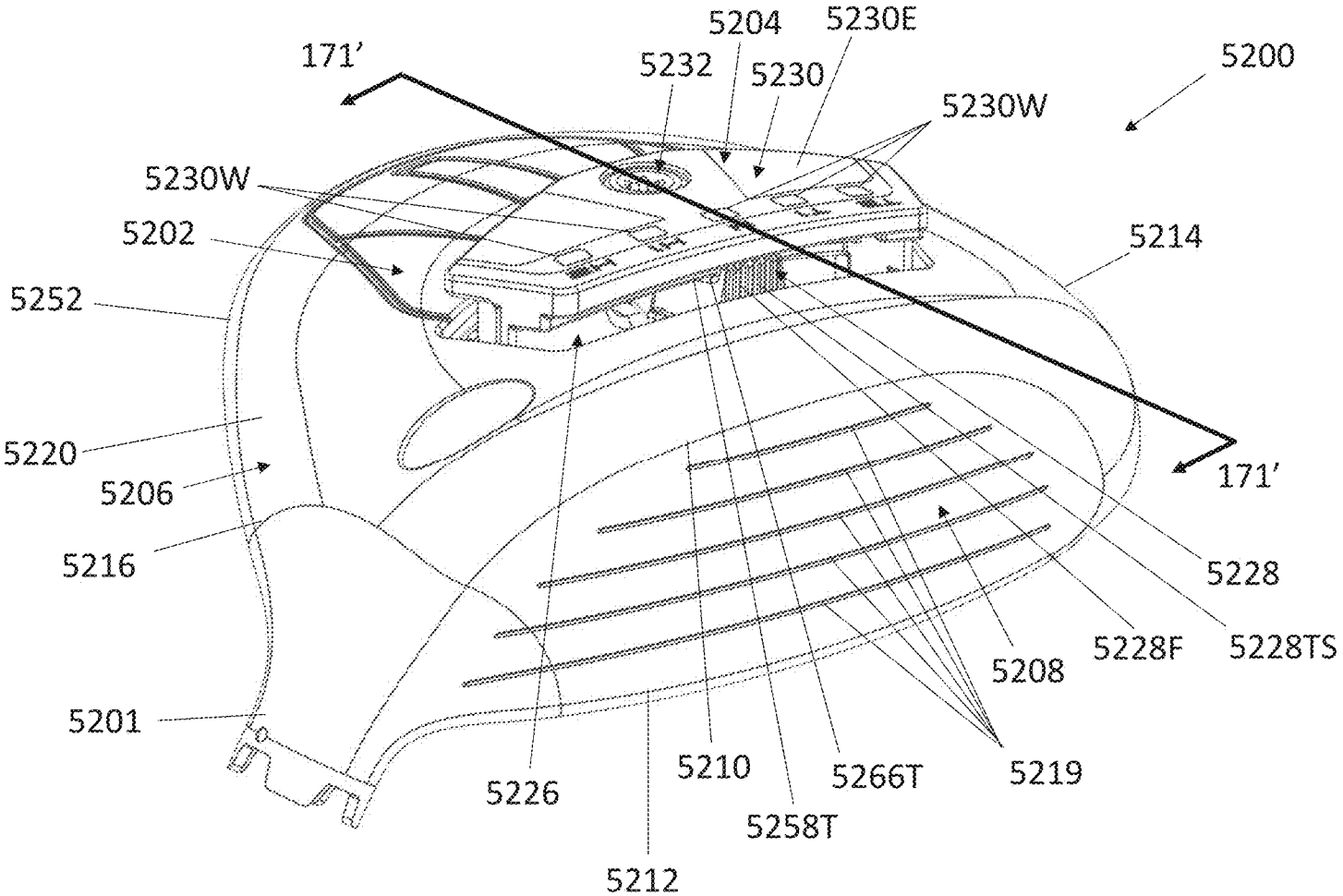

FIG. 170 is a perspective view of another golf club head with another weight assembly raised part way out of a recessed channel.

Figure 171:
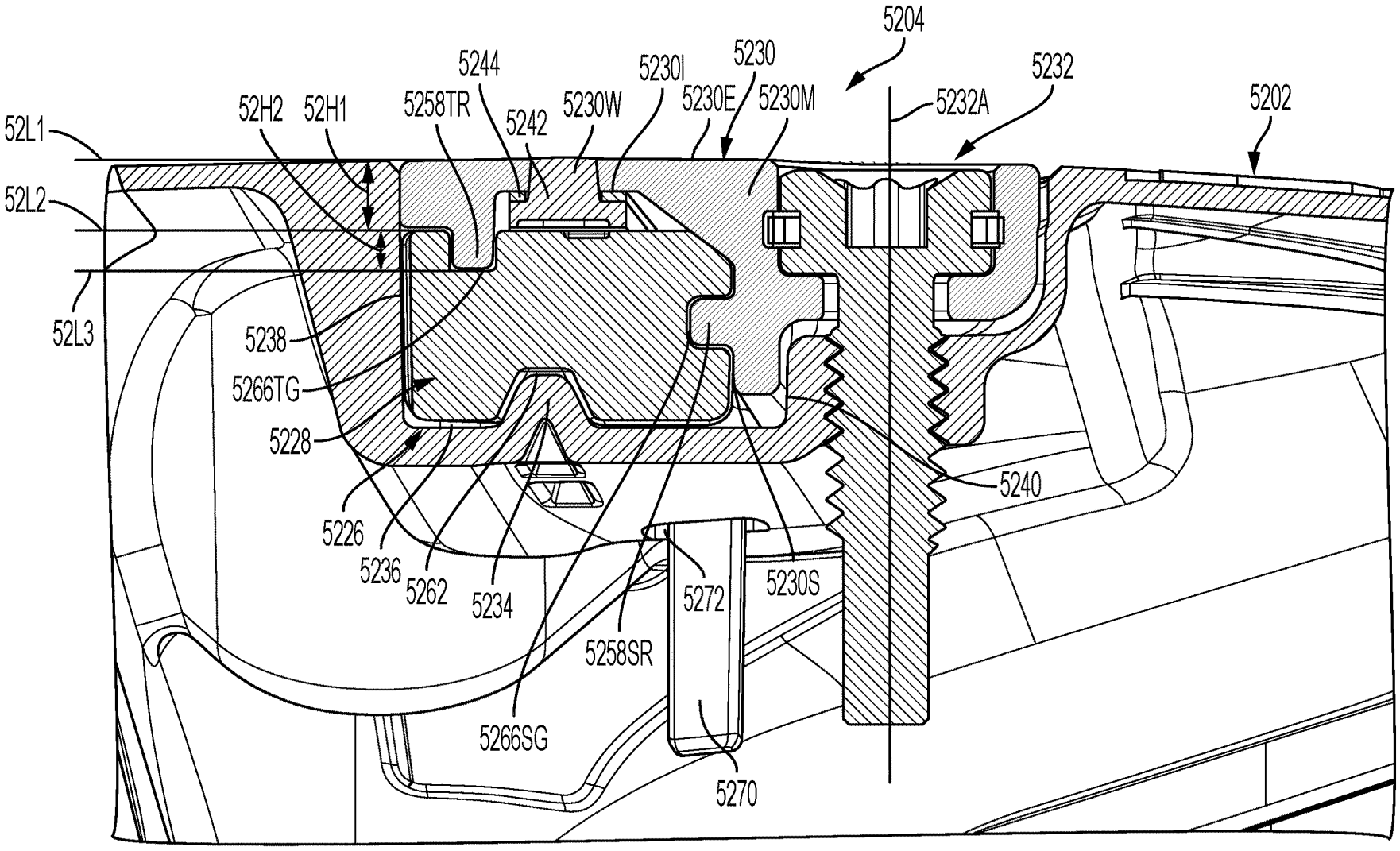

FIG. 171 is a toe-to-heel cross-sectional view of the golf club head of FIG. 170 along line 171'-171' in FIG. 170 when the weight assembly is in a locked configuration.

Figure 172:
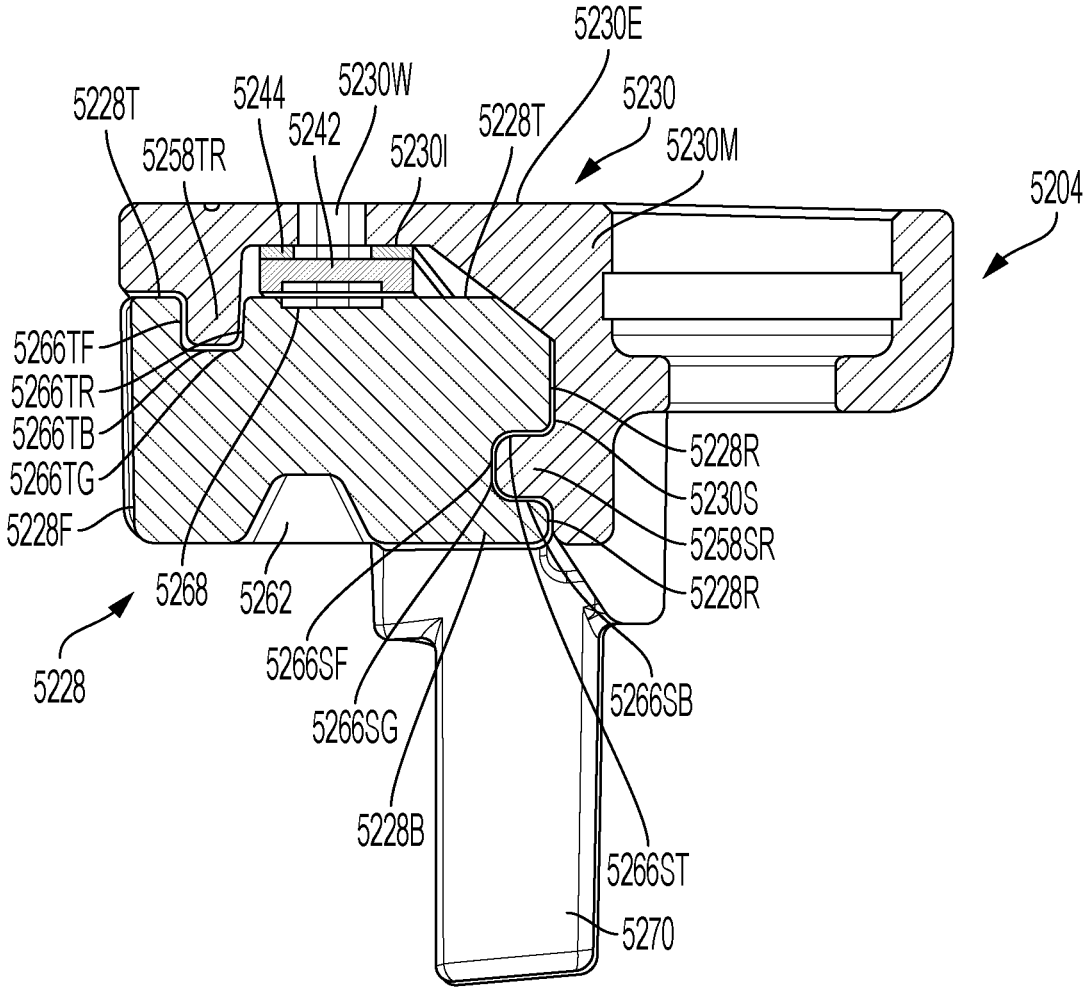

FIG. 172 is a cross-sectional view of the weight assembly of the golf club head of FIG. 170 along the line 171'-171'.

Figure 173:
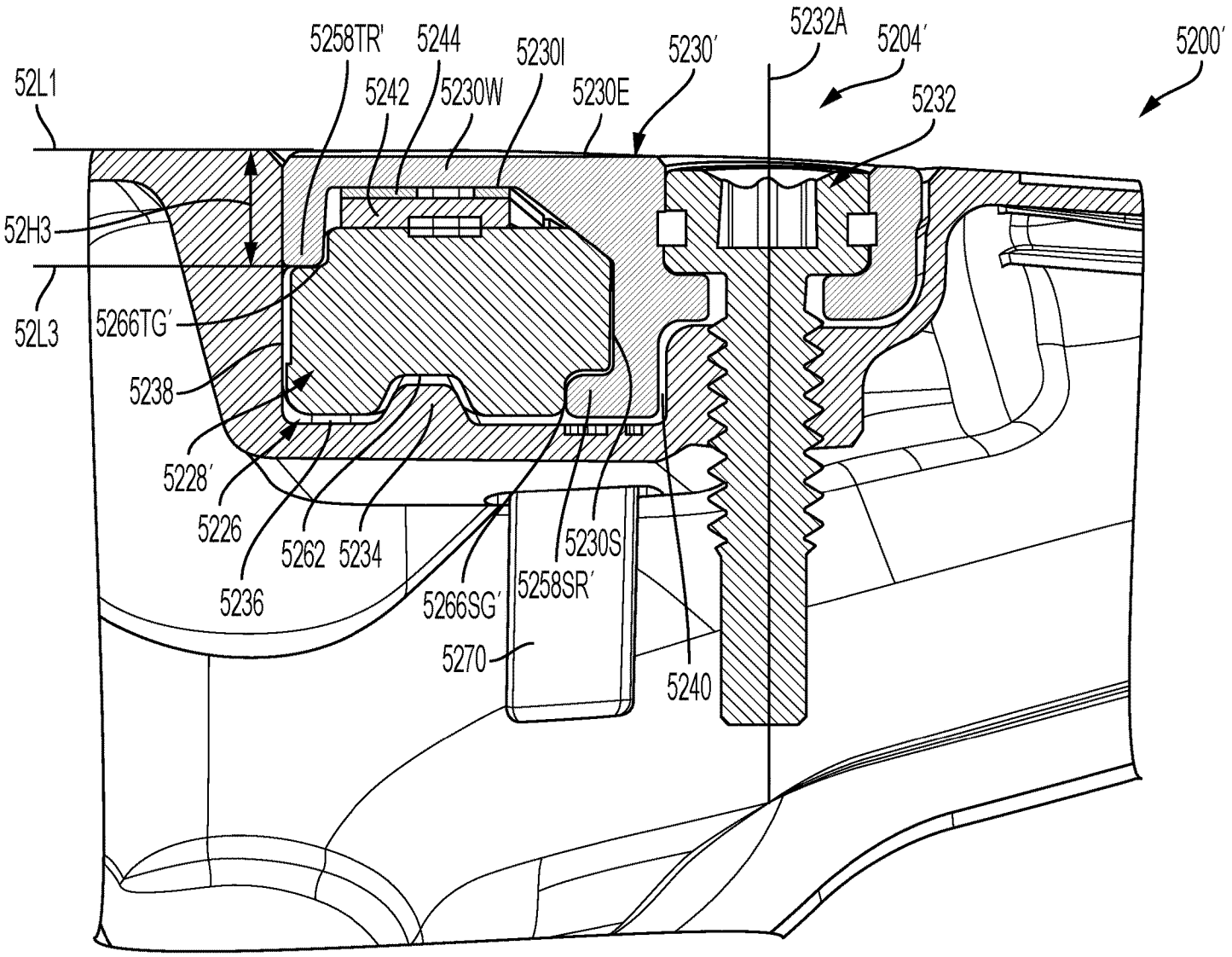

FIG. 173 is a toe-to-heel cross-sectional view of another golf club head, according to some examples.

Figure 174A:
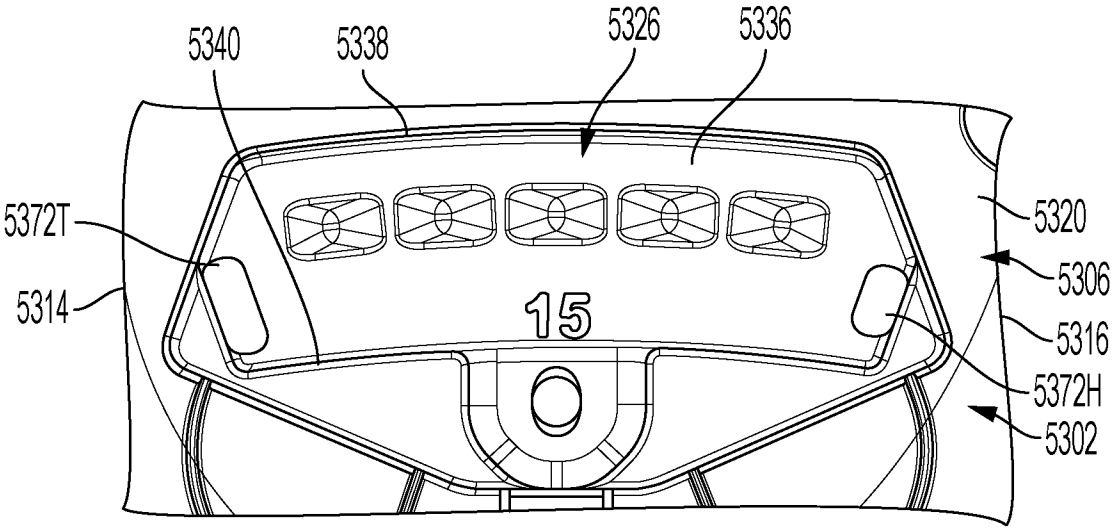

FIG. 174A is a sole view of another golf club head, according to some examples, and without a weight assembly installed on the golf club head.

Figure 174B:
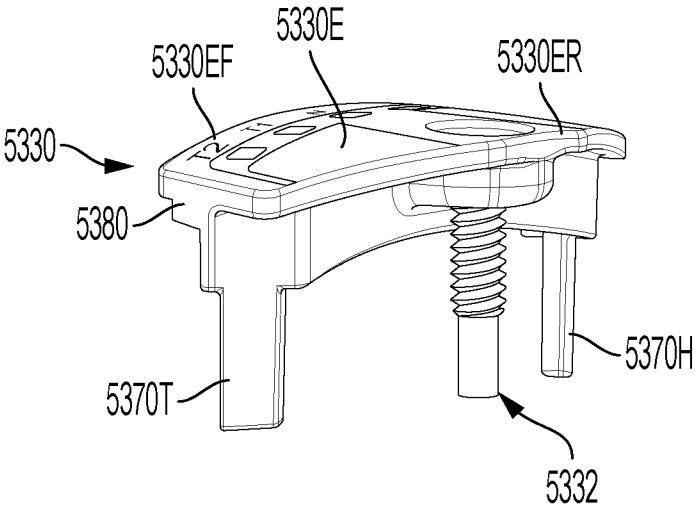

FIG. 174B is a perspective view of the weight and fastener of the weight assembly of the golf club head of FIG. 174A.

Figure 175A:
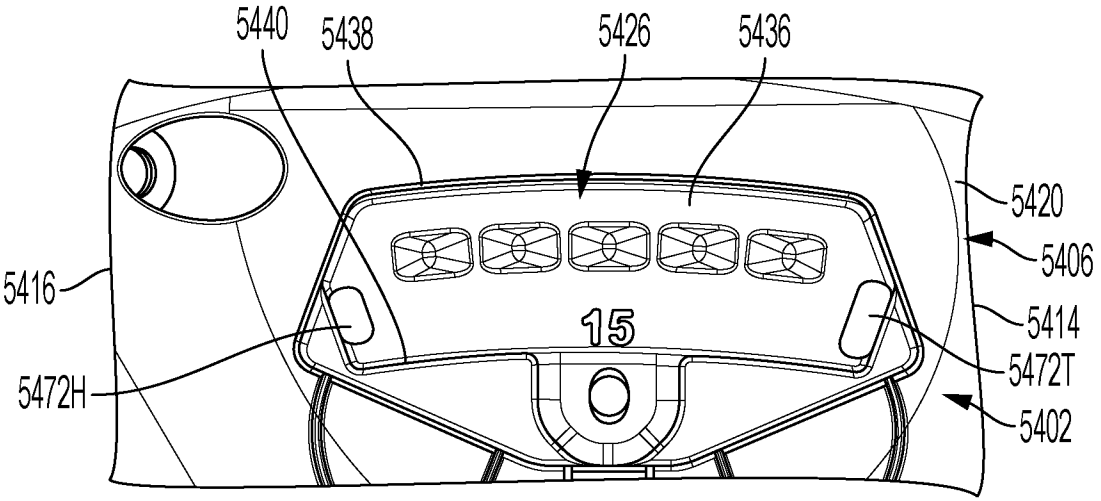

FIG. 175A is a sole view of another golf club head, according to some examples, and without a weight assembly installed on the golf club head.

Figure 175B:
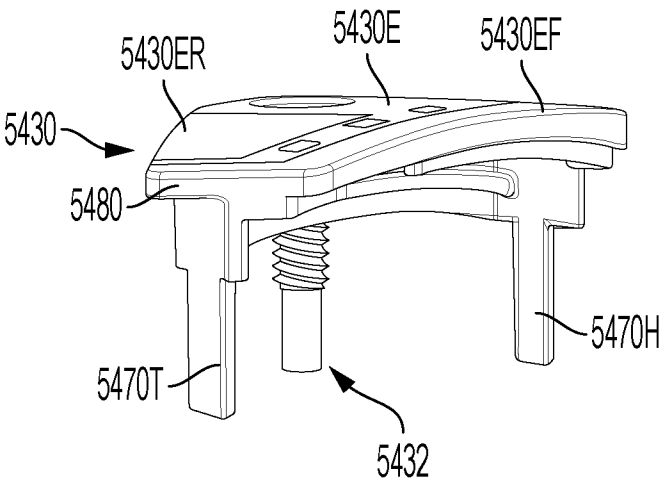

FIG. 175B is a perspective view of the weight and fastener of the weight assembly of the golf club head of FIG. 175A.

DETAILED DESCRIPTION

The technologies described herein contemplate a golf club head, such as a fairway metal, driver, or other golf club head, that includes an adjustable weight assembly. Through the weight balance of the golf club head, the flight characteristics of the golf ball can be improved, thereby increasing golf club performance. In the examples described herein, the weight assembly enables for the CG and/or MOI of a head of the golf club to be adjusted through selective weight placement to impact the flight characteristics of the golf ball, such as fades, draws, launch angles, ball spin, and speed. Additionally or alternatively, the weight assembly enables for the swing weight of the golf club head to be adjustable (e.g., increasing or decreasing the weight of the club head).

In examples, the present technologies provide a golf club head with a recessed channel defined therein. A slidable weight is disposed at least partially within the channel and secured therein by a cover and a fastener. The cover is configured to retain the weight within the channel indirectly so that the fastener never engages with the weight. This configuration enables for the size, shape, and/or density of the weight to be defined so that the CG and MOI of the golf club head can be finely tuned. Additionally, the cover includes additional features that increase securement of the weight within the channel and reduce undesirable rattling or movement during the golf club swing. Furthermore, the weight assemblies described herein allow for the weight to be adjusted quickly and easily without requiring any component to be fully detached from the club head. Thereby reducing lost or misplaced components during club head adjustment. In an aspect, the weight is engaged with the cover so that the two components can move together with respect to the golf club head. Additionally, the weight is restricted from tilting relative to the cover so as to reduce or prevent binding of the weight within the channel.

Figure 1:
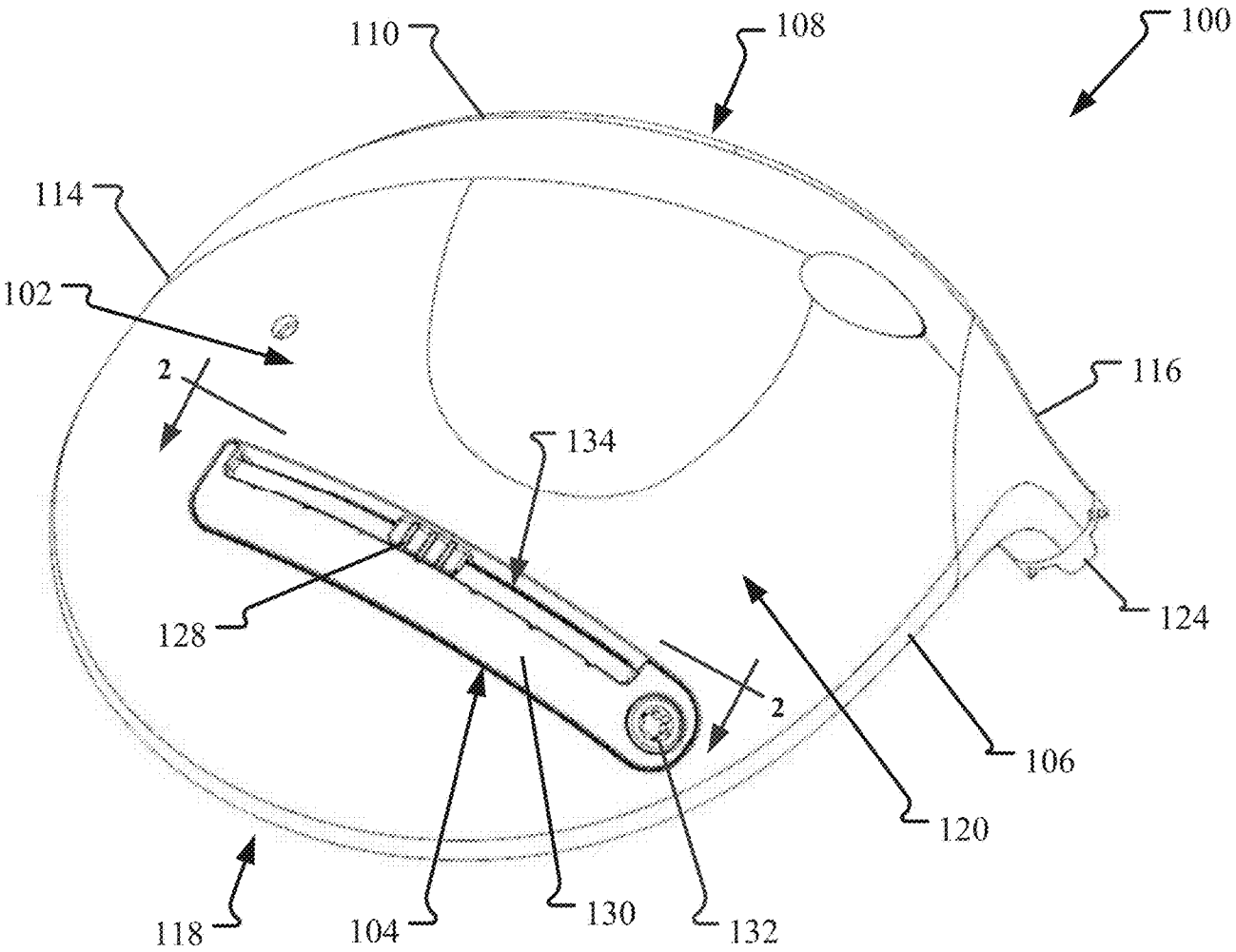
FIG. 1 is a perspective view of a sole of a golf club head with an exemplary weight assembly.

FIG. 1 is a perspective view of a sole 102 of a golf club head 100 with an exemplary weight assembly 104. The golf club head 100 is a metalwood-type golf club head having a body 106 that includes a striking face 108 positioned towards the front of the club head 100 and having a lower edge 110 and an upper edge 112 (e.g., shown in FIG. 8) each extending between a toe 114 and heel 116 of the club head 100. The sole 102 extends from the lower edge 110 on the bottom side of the club head 100 and a crown 118 extends from the upper edge 112 on the top of the club head 100. The sole 102, the striking face 108, and the crown 118 are coupled together so as to define an outer surface 120 of the body 106 with an interior cavity 122 (shown in FIG. 2) formed within. A hosel 124 is disposed at the heel 116 and is configured to couple to a shaft (not shown). In some examples, a skirt 126 (shown in FIG. 8) may also form a portion of the club head 100 and is positioned between the crown 118 and the sole 102. In such examples and for purposes of this application, the crown 118 may still be considered to be attached or coupled to the sole 102, via the skirt 126. Furthermore, the body 106 may form any type club head, such as an iron-type club head or hybrid-type club head, as required or desired.

In operation, the sole 102 generally provides the lower surface of the club head 100 when the club head 100 is placed in an address position. The club head 100 defines a center of gravity (CG) and a moment of inertia (MOI) that impact flight characteristics of a golf ball (not shown) when hit with the striking face 108. The weight assembly 104 is coupled to the club head 100 such that the CG and/or the MOI of the club head 100 can be selectively adjusted as required or desired. In the example, the weight assembly 104 includes a movable weight 128, a cover 130 configured to secure the weight 128 in place, and a fastener 132 for coupling the weight assembly 104 to one or more other portions of the club head 100. In some examples, the weight 128 may be formed from tungsten. In examples, the weight 128 may be between about 2 grams to 15 grams. In some specific examples, the weight 128 may be about 9 grams.

A recessed elongated channel 134 is formed in the outer surface 120 of the club head 100. More specifically, the channel 134 is substantially linear and defined in the sole 102 of the club head 100. In other examples, the channel 134 may be defined at any other location of the body 106 (e.g., the crown 118 or the skirt 126) as required or desired. The channel 134 is sized and shaped to receive at least a portion of the weight 128 so that the weight 128 can be slidable therein. In the example, the channel 134 extends substantially linearly in a toe 114—heel 116 direction so that the CG and the MOI of the club head 100 can be adjusted (by selectively moving the weight 128) for fade or draw bias. The channel 134 can be angularly offset from the plane of the striking face 108 as illustrated in FIG. 1. In other examples, the channel 134 may extend substantially parallel to the striking face 108. In the example, the fastener 132 is positioned proximate to the heel side of the channel 134. In other examples, the fastener 132 may be positioned at any other location relative to the channel 134 to enable the weight assembly 104 to function as described herein. For example, at approximately a midpoint of the channel 134 as described in reference to FIG. 26 or proximate the toe side of the channel 134.

In operation and through use of the fastener 132, the cover 130 is coupled to the body 106 and extends at least partially over the channel 134 so as to selectively secure the weight 128 to the club head 100. Additionally, the cover 130 covers at least a portion of the channel 134 so as to reduce dust and dirt from accumulating therein. However, the fastener 132 is separate from the weight 128 and only indirectly (e.g., via the cover 130) secures the weight 128 to the club head 100. In examples, the fastener 132 and the cover 130 are adapted to retain the weight 128 in the channel 134 only by contact with the cover 130 such that the fastener 132 never engages the weight 128. As described herein, when the fastener 132 indirectly retains the weight 128, the fastener 132 never engages the weight 128 directly and it is a separate component (e.g., the cover 130) that directly engages the weight 128 for securement to the club head 100.

The cover 130 may be loosened or completely removed, via the fastener 132, from the club head 100 to enable the weight 128 to slide within the channel 134 and selectively adjust the CG and the MOI as required or desired. Because the weight 128 is selectively moveable, the weight assembly 104 (e.g., the fastener 132, the weight 128, and the cover 130) enables the movement of the weight 128, while also securing the weight 128 to one or more portions of the club head 100 so that undesirable movement (e.g., during a club swing) is reduced or prevented. By separating the fastener 132 from the weight 128, the size, shape, and/or density of the weight 128 may be configured so that the CG and the MOI of the club head 100 may be more finely tuned, thereby increases the performance of the golf club head 100. The weight assembly 104 is described further below.

Figure 2:
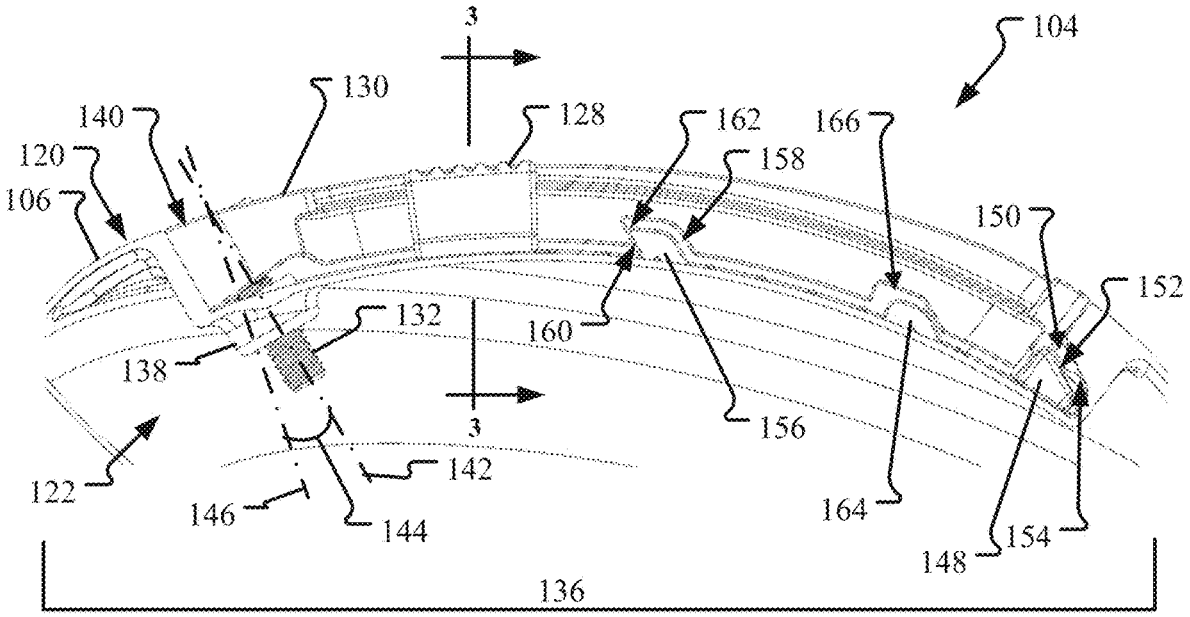
FIG. 2 is a cross-sectional view of the golf club head taken along line 2-2 in FIG. 1 where the weight assembly is in a locked configuration.
Figure 3:
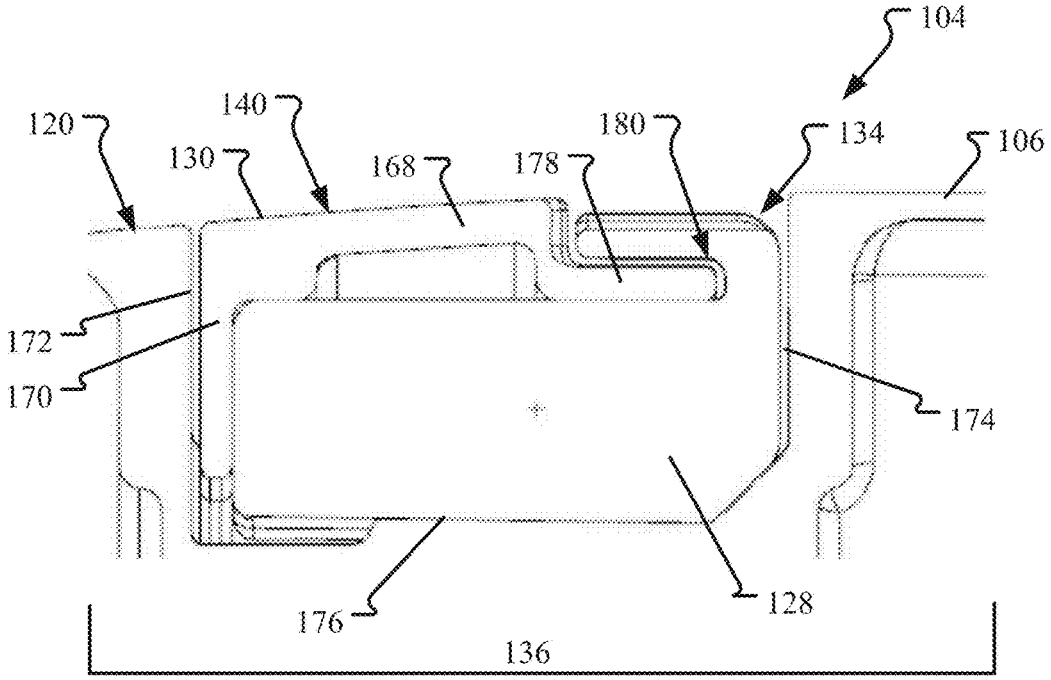
FIG. 3 is a cross-sectional view of the weight assembly taken along line 3-3 in FIG. 2.

FIG. 2 is a cross-sectional view of the golf club head 100 taken along line 2-2 in FIG. 1 and showing the weight assembly 104 in a locked configuration 136. FIG. 3 is a cross-sectional view of the weight assembly 104 taken along line 3-3 in FIG. 2. Referring concurrently to FIGS. 2 and 3, when the weight assembly 104 is in the locked configuration 136, the cover 130 is disposed within the channel 134 and the weight 128 is secured within the channel 134 such that movement is restricted. In the example, to lock the cover 130 to the body 106, the fastener 132 may be a threaded bolt that threadingly engages with a nut 138 positioned within the heel end of the channel 134. In some examples, the nut 138 may be integrally formed within the body 106.

When the cover 130 is in the locked configuration 136, an exterior surface 140 of the cover 130 is substantially aligned (e.g., flush) with the outer surface 120 of the body 106. Additionally, the fastener 132 defines a fastener axis 142. In the example, the fastener axis 142 is disposed at an angle 144 relative to a plane 146 that is normal to the exterior surface 140 of the cover 130 proximate the fastener 132. The angle 144 defines the orientation that the cover 130 may move relative to the body 106. The angle 144 may be between about 0° (e.g., aligned with the plane 146) and about 88°. In examples, the angle 144 may be between about 200 and 50°. In one example, the angle 144 may be about 45°.

In the example, only a single fastener 132 is used to couple the cover 130 to the body 106 and the fastener 132 is positioned at the heel end of the weight assembly 104. As such, to connect the toe end of the cover 130 to the body 106, the cover 130 may include one or more projections 148 that extend from the toe end. The projection 148 is sized and shaped to be received within one or more corresponding chambers 150 defined at the toe end of the channel 134. When the weight assembly 104 is in the locked configuration 136, the projection 148 is received at least partially within the chamber 150 and engaged therewith. By engaging the cover 130 to the body 106 at a position opposite from the fastener 132, when the weight 128 is positioned away from the fastener 132, the cover 130 still enables securement of the weight 128 within the channel 134 and reduces or prevents movement of the weight 128 in the locked configuration 136. In the example, the projection 148 extends in the toe-heel direction of the cover 130 and includes at least one oblique surface 152 that frictionally engages with a corresponding at least one oblique surface 154 of the chamber 150. In some examples, the oblique surfaces 152, 154 may be substantially parallel to the fastener axis 142. In other examples, the oblique surfaces 152, 154 may be oriented at a different angle than the fastener axis 142 (e.g., steeper or shallower angles). Additionally or alternatively, the projection 148 and chamber 150 may extend substantially orthogonal to the toe-heel direction (e.g., in and out of the page of FIG. 2).

The cover 130 may also be engaged with the body 106 at one or more intermediate positions between the fastener 132 and the opposite end. A seat 156 may protrude into the channel 134 at a location between the toe end and the heel end, for example, proximate a midpoint location of the channel 134. The seat 156 is sized and shaped to be received within a corresponding notch 158 defined in the cover 130. When the weight assembly 104 is in the locked configuration 136, the seat 156 is received at least partially within the notch 158 and engaged therewith. This engagement of the cover 130 to the body 106 at a position away from the fastener 132, also secures the weight 128 within the channel 134 and reduces or prevents movement of the weight 128 in the locked configuration 136. In the example, the seat 156 extends in the toe-heel direction of the channel 134 and includes at least one oblique surface 160 that frictionally engages with a corresponding at least one oblique surface 162 of the notch 158. In some examples, the oblique surfaces 160, 162 may be substantially parallel to the fastener axis 142. In other examples, the oblique surfaces 160, 162 may extend at angle relative to the bottom of the channel 134 between about 3° and 88°. In one example, the oblique surfaces 160, 162 may extend at an angle relative to the bottom of the channel 134 of about 30°.

A cam 164 may also protrude into the channel 134 at a location between the toe end and the heel end, for example, between the seat 156 and the chamber 150. The cam 164 is sized and shaped to receive within a corresponding cutout 166 defined in the cover 130. When the weight assembly 104 is in the locked configuration 136, the cam 164 is received at least partially within the cutout 166. The cam 164 and the cutout 166 are described further below in reference to FIG. 4.

In the example, the cover 130 is substantially L-shaped with a long leg 168 and a short leg 170. In the locked configuration 136, the long leg 168 forms the exterior surface 140 and the short leg 170 extends within the channel 134. The channel 134 is formed from two opposing sidewalls 172, 174 and a bottom track 176 offset from the outer surface 120 of the body 106. The long leg 168 of the cover 130 opposes the track 176 of the channel 134 and the short leg 170 of the cover 130 is adjacent to one of the sidewalls 172. The seat 156 and the cam 164 may protrude from the sidewall 172 of the channel 134 and the corresponding notch 158 and cutout 166 may be defined in the short leg 170 of the cover 130. When the weight 128 is secured within the channel 134 and in the locked configuration 136, the weight 128 is compressed between cover 130 and one or more walls (e.g., the sidewall 174 and/or the track 176) of the channel 134. As such, the weight 128 is frictionally secured to one or more portions of the club head 100 by the weight assembly 104.

Additionally, the weight 128 may be slidably coupled to the cover 130. The long leg 168 of the cover 130 may include a flange 178 extending therefrom. The flange 178 is sized and shaped to be received at least partially within a corresponding groove 180 defined in the weight 128. In the locked configuration 136, a portion of the weight 128 is not covered by the cover 130 and exposed within the channel 134 such that the portion forms part of the outer surface 120 of the body 106. This enables for the location of the weight 128 within the channel 134 to be easily determined by visual inspection.

Figure 4:
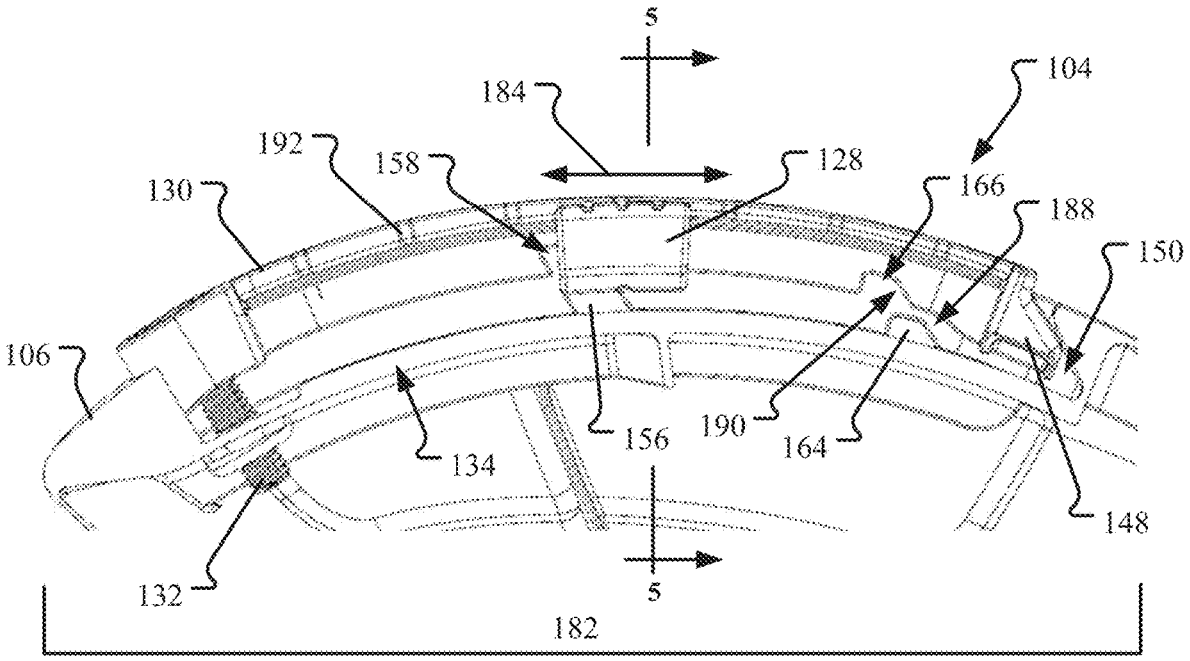
FIG. 4 is a cross-sectional view of the golf club head taken along line 2-2 in FIG. 1 where the weight assembly is in an unlocked configuration.
Figure 5:
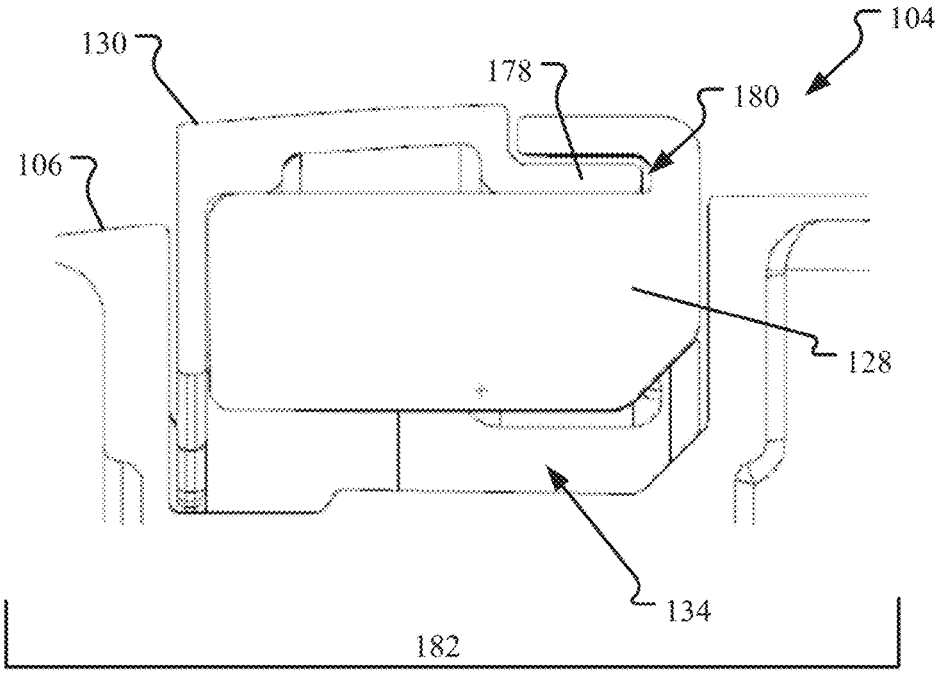
FIG. 5 is a cross-sectional view of the weight assembly taken along line 5-5 in FIG. 4.

FIG. 4 is a cross-sectional view of the club head 100 taken along line 2-2 in FIG. 1 and showing the weight assembly 104 in an unlocked configuration 182. FIG. 5 is a cross-sectional view of the weight assembly 104 taken along line 5-5 in FIG. 4. Referring concurrently to FIGS. 4 and 5, when the weight assembly 104 is in the unlocked configuration 182, at least a portion of the cover 130 is lifted and raised out of the channel 134 such that the weight 128 is selectively slidable (e.g., along a toe-heel direction 184) within the channel 134. In the example, the fastener 132 may be coupled to the cover 130 (e.g., with a lock washer 186 (shown in FIG. 16)), so that the cover 130 moves along the fastener axis 142 (shown in FIG. 2) upon rotation of the fastener 132. The cover 130 and the fastener 132 may be completely removed from the body 106 as required or desired so as to completely remove the weight 128 from the channel 134. However, in examples, moving the weight assembly 104 between the locked configuration 136 (shown in FIGS. 2 and 3) and the unlocked configuration 182 does not require that the weight assembly 104 be uncoupled from the body 106. As such, in the unlocked configuration 182, the cover 130 may remain coupled to the body 106 so that it is less likely that the components become lost or misplaced. In some examples, the fastener 132 and/or the nut 138 may include a hard stop (not shown) that prevents the fastener 132 from being completely de-threaded from the club head 100 as required or desired.

Since only a single fastener 132 is used to couple the cover 130 to the body 106 and the fastener 132 is positioned at the heel end of the weight assembly 104, the cam 164 may be used to assist the toe end of the cover 130 with lifting from the channel 134 in the unlocked configuration 182. This enables the weight 128 to more easily slide to positions away from the fastener 132. In the example, the cam 164 extends in the toe-heel direction of the channel 134 and includes at least one camming surface 188 that slidingly engages with a corresponding camming surface 190 of the cutout 166. As the cover 130 moves from the locked configuration 136, where the cam 164 is received within the cutout 166, toward the unlocked configuration 182, the camming surfaces 188, 190 slide against one another to lift the toe end of the cover 130. In some examples, when the weight assembly 104 is in the unlocked configuration 182, a portion of the cover 130 may be supported on the cam 164. The camming surfaces 188, 190 may be substantially parallel to the fastener axis 142.

Additionally, in the unlocked configuration 182, the notch 158 may lift away from the seat 156 to disengage the oblique surfaces 160, 162 (shown in FIG. 2). In the unlocked configuration 182, the notch 158 may lift partially or completely for the seat 156. The projection 148 may also lift away from the chamber 150. However, the projection 148 may remain at least partially engaged with the chamber 150 so that the weight 128 cannot slide out of the toe end of the cover 130 and remain within the channel 134 in the unlocked configuration 182. Furthermore, because the weight 128 is engaged with the cover 130 (e.g., the flange 178 and the groove 180), the weight 128 moves with the cover 130 between the locked configuration 136 and the unlocked configuration 182. This enables the weight 128 to be more easily slidable in the unlocked configuration 182.

In some examples, one or more of the weight 128, the cover 130, and the channel 134 may include complementary features (e.g., corresponding detents 192 on the cover 130 and recesses (not shown) on the weight 128) that index the location of the weight 128 to the channel 134 and/or the cover 130. These complementary indexing features may provide tactile and/or audible feedback when the weight 128 is moved. Additionally, the complementary indexing features may also provide increased resistance to the relative movement between the weight 128 and the channel 134 and/or cover 130 when the weight assembly 104 is in the locked configuration 136.

Figure 6:
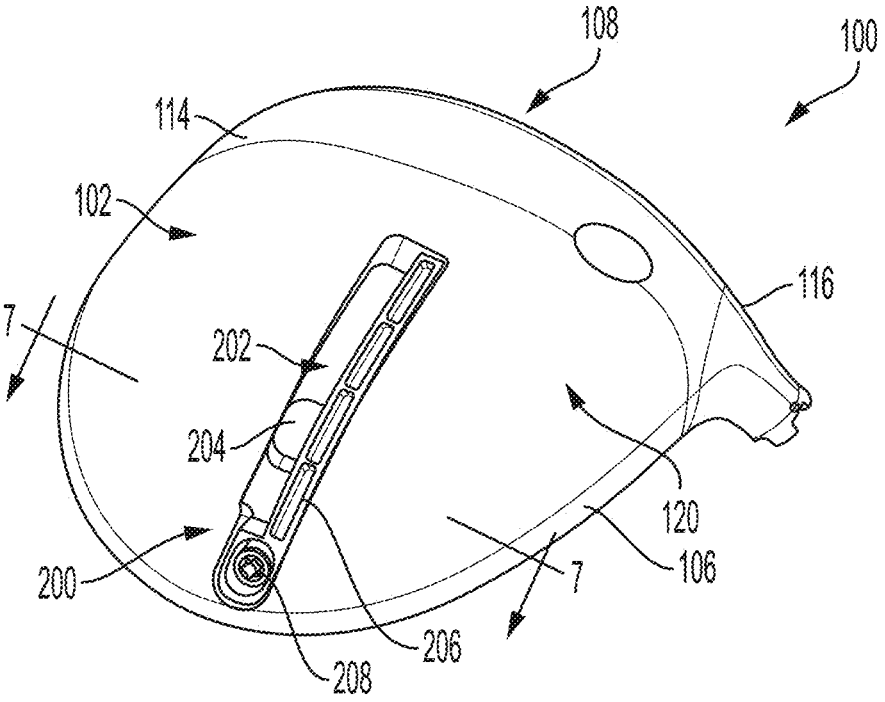
FIG. 6 is a perspective view of the sole of the golf club head with another weight assembly.
Figure 7:
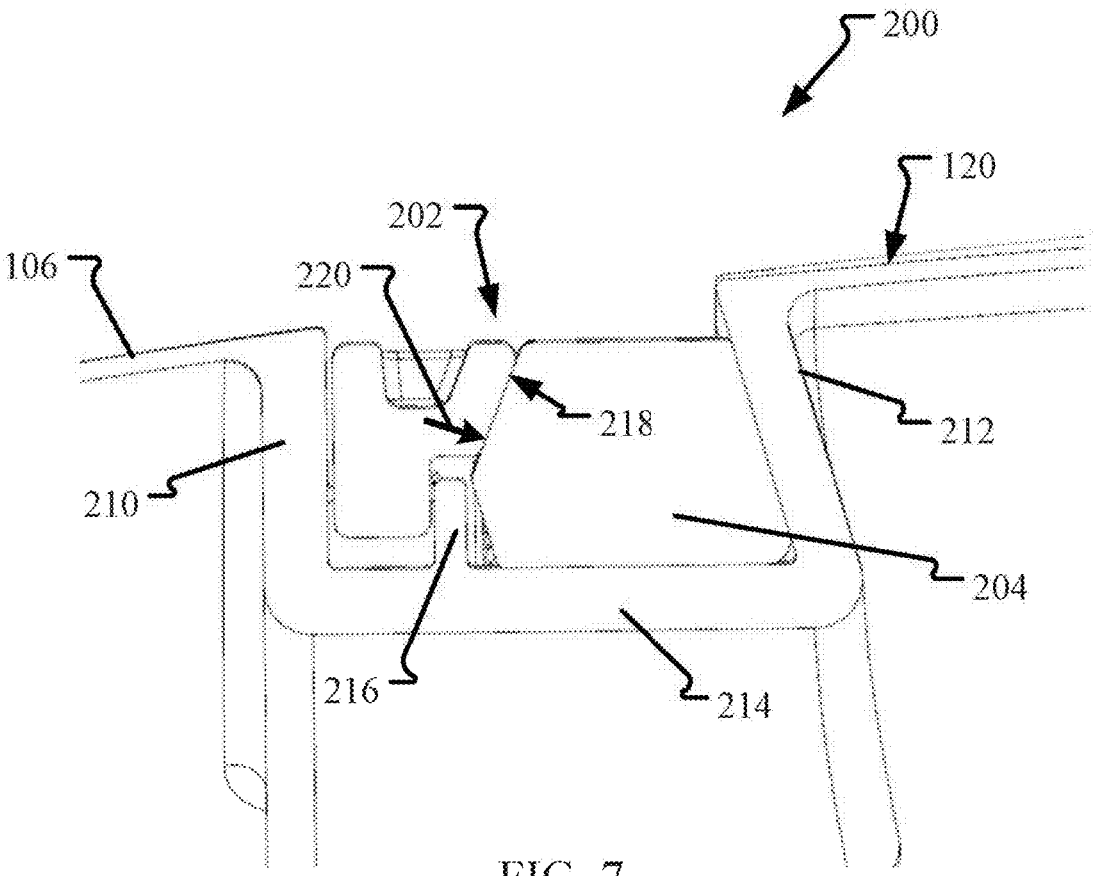
FIG. 7 is a cross-sectional view of the weight assembly taken along line 7-7 in FIG. 6.

FIG. 6 is a perspective view of the sole 102 of the golf club head 100 with another weight assembly 200. FIG. 7 is a cross-sectional view of the weight assembly 200 taken along line 7-7 in FIG. 6. Certain components are described above, and thus, are not necessarily described further. Referring concurrently to FIGS. 6 and 7, the weight assembly 200 includes a recessed channel 202 defined within the sole 102 of the body 106 of the club head 100, however, the channel 202 extends substantially linearly in a front-rear direction so that the CG and the MOI of the club head 100 can be adjusted for launch angle bias. The channel 202 can be substantially orthogonal to the striking face 108 as illustrated in FIG. 6. In other examples, the channel 202 may extend at either an acute or obtuse angle relative to the striking face 108. The weight assembly 200 also includes a slidable weight 204, a cover 206, and a fastener 208. In this example, the fastener 208 is positioned proximate to the rear of channel 202 and opposite of the striking face 108. In other examples, the fastener 208 may be positioned at any other location relative to the channel 202 to enable the weight assembly 200 to function as described herein. For example, at approximately a midpoint of the channel 202 or proximate the striking face 108 side of the channel 202.

In this example, the channel 202 is formed by two opposing sidewalls, a cover sidewall 210 and an undercut sidewall 212, and a bottom track 214 offset from the outer surface 120 of the body 106. A partial wall 216 also extends from the bottom track 214. Here, the cover 206 is located adjacent to the cover sidewall 210 and includes an angled surface 218. As such, when the weight assembly 200 is in a locked configuration (e.g., FIG. 7), the cover 206 generates a compressive force 220 along the angled surface 218 that acts in both a downward direction and a transverse direction to secure the weight 204 between the cover 206 and the undercut sidewall 212. Accordingly, the weight 204 is frictionally secured to one or more portions of the club head 100 by the weight assembly 200 and at least partially underneath the angled surface 218 and the undercut sidewall 212. The weight 204 is at least partially trapezoidal in cross-sectional shape so that the undercuts of the sidewall 212 and the cover 206 assist in retaining the weight 204 within the channel 202. Additionally, the cover 206 engages with the partial wall 216 so that the portion of the cover 206 away from the fastener 208 is restricted from moving within the channel 202 (e.g., bending or flexing) towards the undercut sidewall 212. Furthermore, the partial wall 216 is substantially parallel to the fastener axis (not shown) of the fastener 208 so that the cover 206 is guided between the locked and unlocked configuration. In some example, the weight assembly 200 may include the seat/notch interface as described above to further engage the cover 206 within the channel 202 and increase the securement of the weight 204 to one or more portions of the club head 100.

Figure 8:
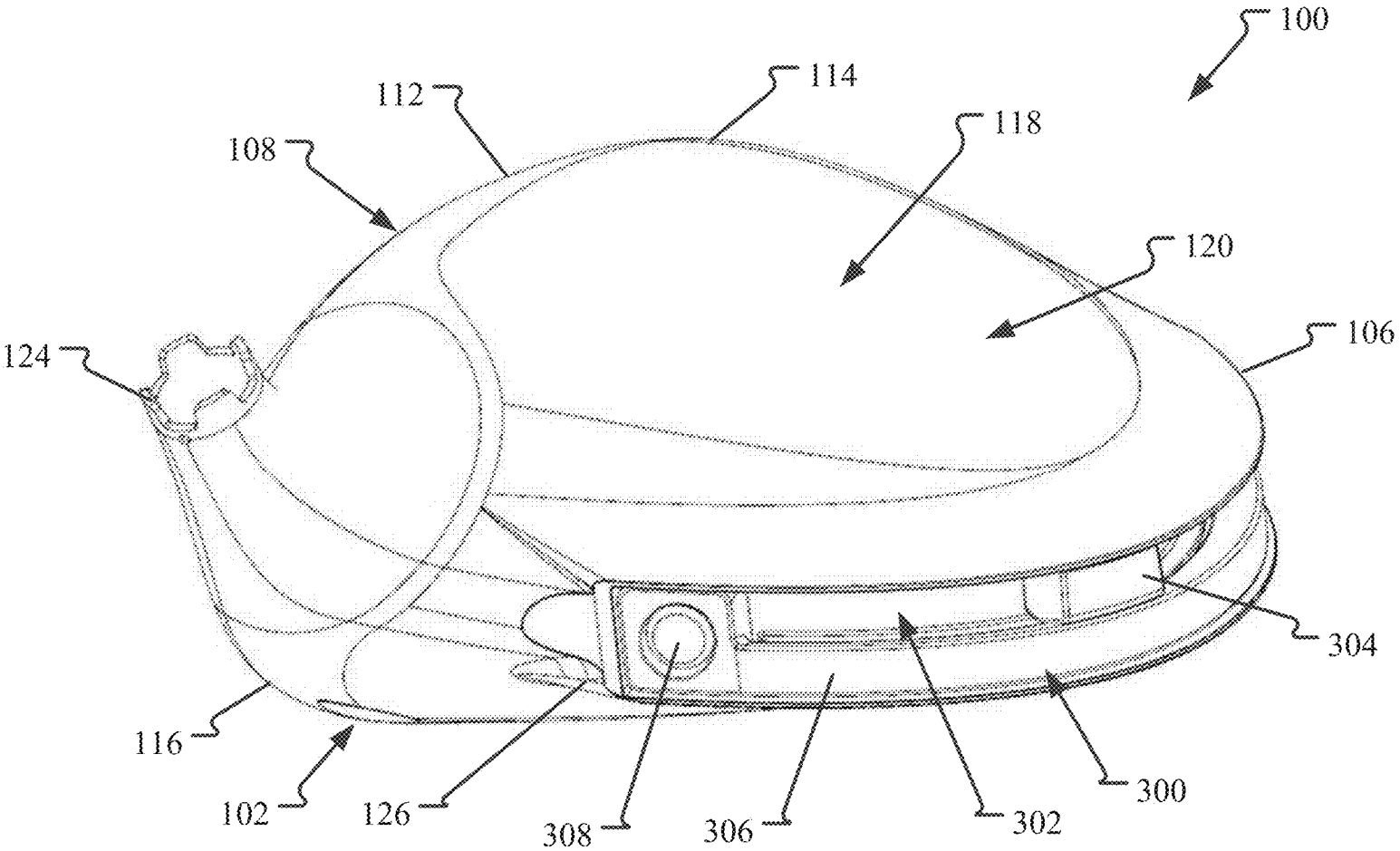
FIG. 8 is a perspective view of the golf club head with another weight assembly.

FIG. 8 is a perspective view of the golf club head 100 with another weight assembly 300. Certain components are described above, and thus, are not necessarily described further. In this example, the club head 100 includes the skirt 126 positioned between the crown 118 and the sole 102, opposite of the striking face 108. The weight assembly 300 includes a recessed channel 302 defined within the skirt 126 of the body 106 of the club head 100 and extends along the rear perimeter of the club head 100 such that the channel 302 has a curved shape. The weight assembly 300 also includes a slidable weight 304, a cover 306, and a fastener 308. In this example, the fastener 308 is coupled to the heel 116 side of the body 106. In other examples, the fastener 308 may be coupled to the toe 114 side of the body 106 as required or desired. The weight assembly 300 may include one or more of the weight assembly features described herein to enable the CG and the MOI of the club head 100 to be adjustable for fade-draw bias, while securing the weight 304 in a locked configuration (as shown in FIG. 8).

Figure 9:
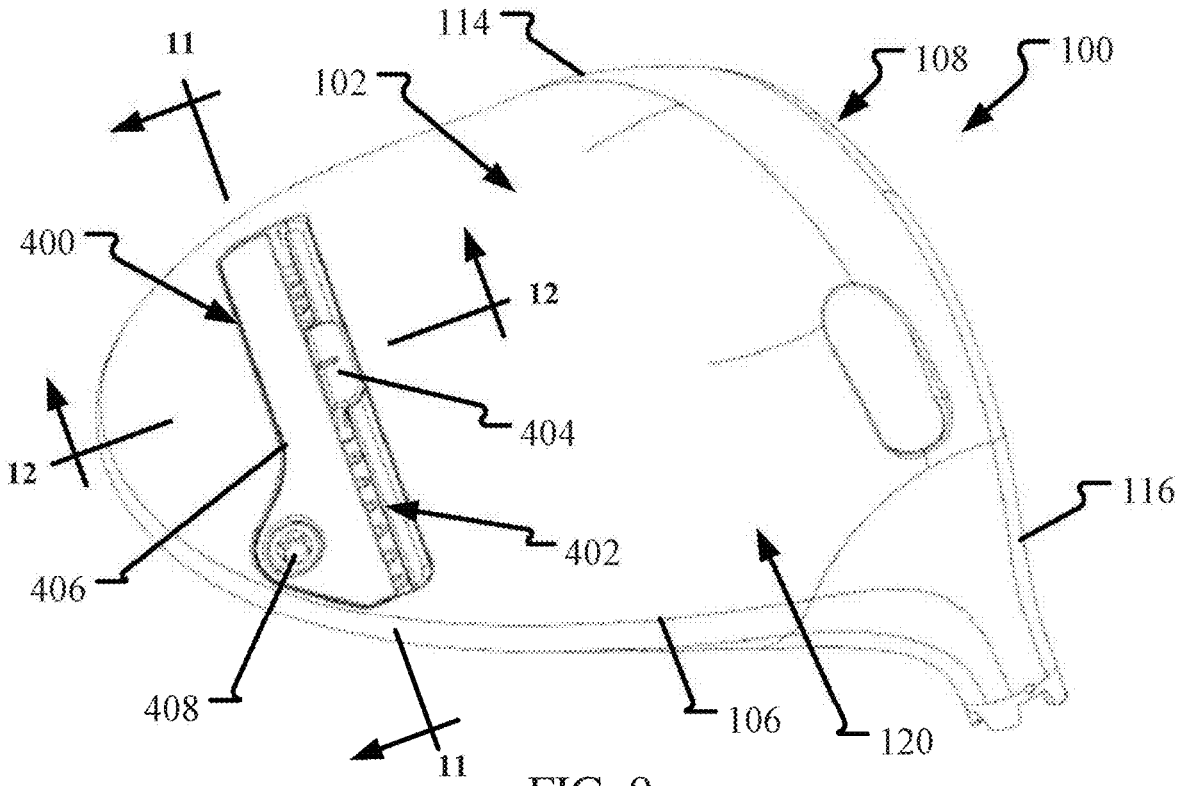
FIG. 9 is a perspective view of the sole of the golf club head with another weight assembly.
Figure 10:
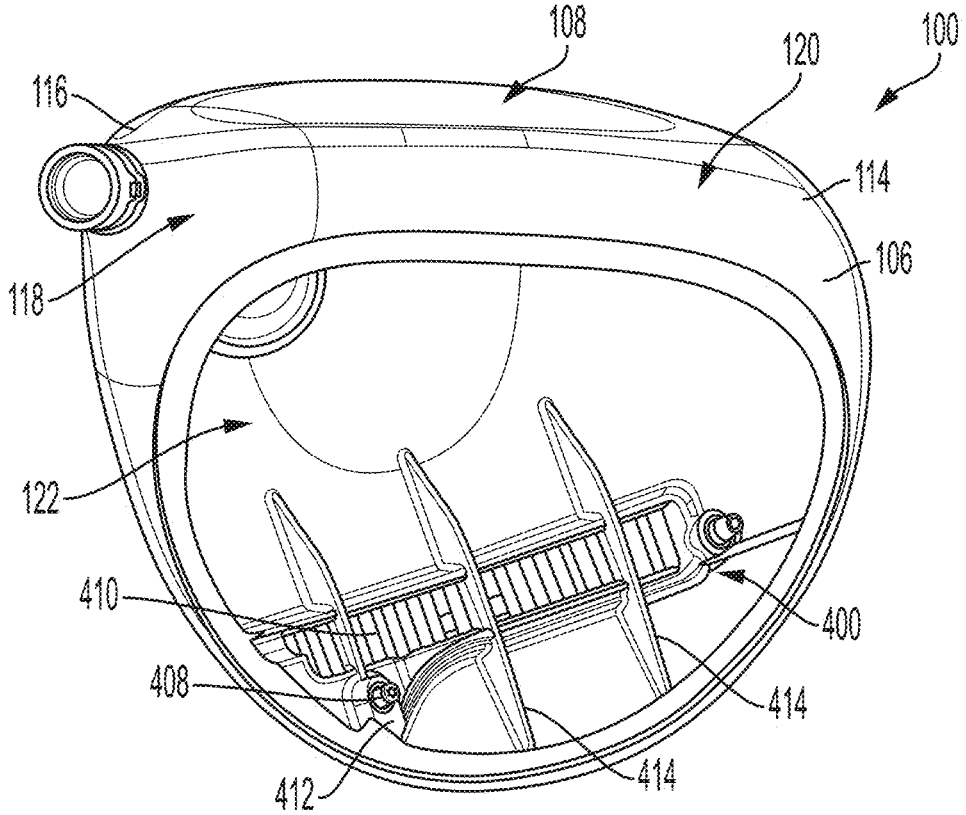
FIG. 10 is a top view of the golf club head shown in FIG. 9 with a portion of a crown removed.

FIG. 9 is a perspective view of the sole 102 of the golf club head 100 with another weight assembly 400. FIG. 10 is a top view of the golf club head 100 shown in FIG. 9 with a portion of the crown 118 removed. Certain components are described above, and thus, are not necessarily described further. Referring concurrently to FIGS. 9 and 10, the weight assembly 400 includes a recessed channel 402 defined within the sole 102 of the body 106 of the club head 100 that extends substantially linearly in the toe 114—heel 116 direction. The weight assembly 400 also includes a slidable weight 404, a cover 406, and a fastener 408. The channel 402 includes a bottom track 410 that the weight 404 is slidable on. In this example, the fastener 408, and also a nut 412 that the fastener 408 couples to, are offset from the track 410 and positioned towards the rear of the body 106. By offsetting the fastener 408 from the track 410, the length of the track 410 can be extended in the toe-heel direction so that the weight 404 can be positioned at a greater number of locations on the sole 102. In other examples, the fastener 408 may be offset from the track 410 and positioned towards the front and the striking face 108 of the body 106 as required or desired.

In this example, one or more support ribs 414 may extend from the channel 402 and within the interior cavity 122 of the body 106. The support ribs 414 are substantially orthogonal to the length of the channel 402. The support ribs 414 provide structural strength to the channel 402 so that the channel 402 is resistant to deformation when the cover 406 compresses the weight 404 therein. In some examples, the support ribs 414 may extend the entire distance between the sole 102 and the crown 118 within the interior cavity 122.

Figure 11:
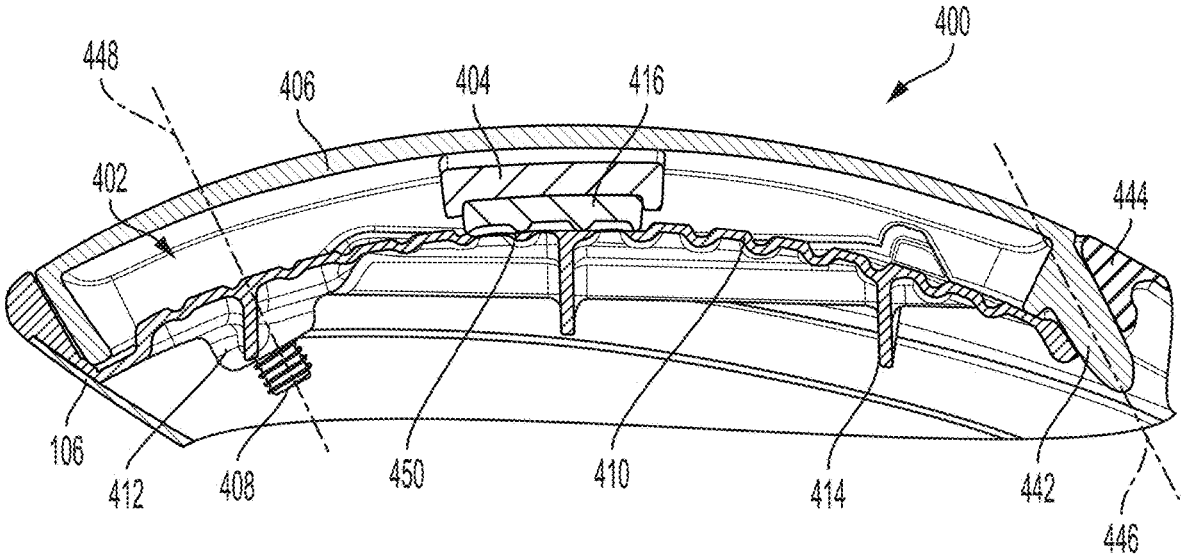
FIG. 11 is a cross-sectional view of the weight assembly taken along line 11-11 in FIG. 9.
Figure 12:
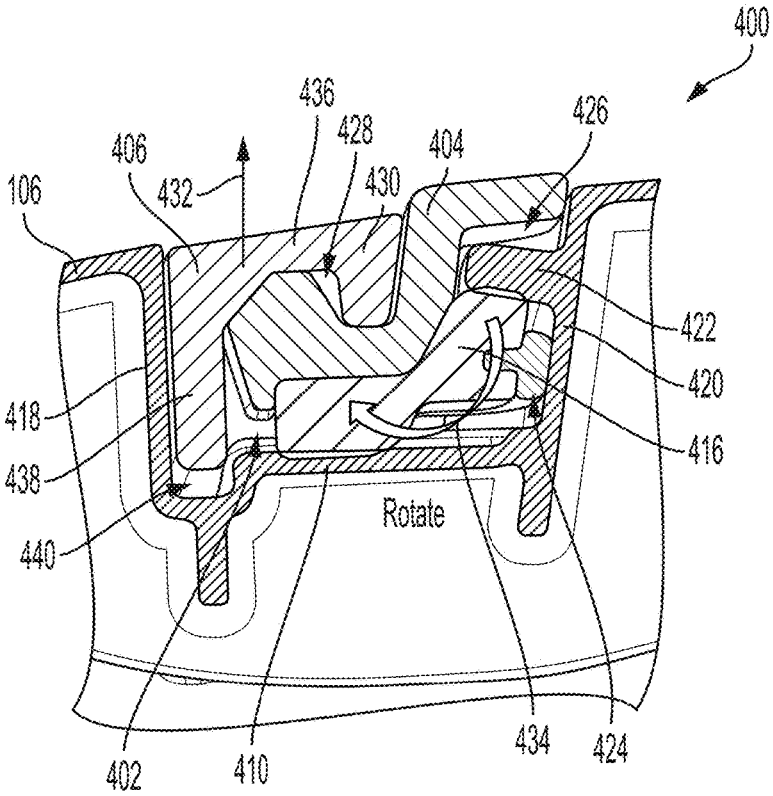
FIG. 12 is a cross-sectional view of the weight assembly taken along line 12-12 in FIG. 9.

FIG. 11 is a cross-sectional view of the weight assembly 400 taken along line 11-11 in FIG. 9. FIG. 12 is a cross-sectional view of the weight assembly 400 taken along line 12-12 in FIG. 9. Certain components are described above, and thus, are not necessarily described further. Referring concurrently to FIGS. 11 and 12, the weight assembly 400 is illustrated in a locked configuration so that the weight 404 is secured within the channel 402. In this example, the weight 404 includes an elastomeric material 416 (e.g., a rubber-based material) that engages with the channel 402 and/or the cover 406 and further increase securement of the weight 404 in the locked configuration. Additionally, the elastomeric material 416 decreases rattling of the weight 404 within the channel 402 during the swing of the club head.

In this example, the channel 402 is formed from two opposing sidewalls 418, 420 and the track 410. One sidewall 420 may include an elongate fin 422 extending into the channel 402. The weight 404 is sized and shaped to be received at least partially within the channel 402 and includes a bottom surface 424 that is positioned adjacent to the track 410 and a slot 426 that engages with the fin 422. Additionally, opposite of the slot 426, the weight 404 includes a groove 428 that engages with a flange 430 of the cover 406. The elastomeric material 416 may be coupled to the weight 404 so that the material 416 extends from the bottom surface 424 and also into the slot 426. In one example, the elastomeric material 416 may be a unitary piece that extends through one or more holes within the weight 404. In other examples, the elastomeric material 416 may be adhered to one or more external surfaces of the weight 404. In still other examples, at least a portion of the elastomeric material 416 may form the weight 404 itself.

In operation, when the cover 406 is in the locked configuration, the flange 430 engages with the groove 428 of the weight 404 and compresses the weight 404 into the channel 402. As such, the elastomeric material 416 may engage with the track 410 and the fin 422 of the channel 402. By engaging the elastomeric material 416 in more than one location, securement of the weight 404 within the channel 402 increases. This reduces undesirable movement and rattling of the weight 404 within the channel 402. In some examples, the elastomeric material 416 may deform when compressed within the channel 402. Since the cover 406 engages with only a portion of the weight 404, when the cover 406 is lifted 432 for the unlocked configuration (not shown), the weight 404 can rotate 434 within the channel 402 so that the elastomeric material 416 may disengage from the track 410 and the fin 422. This rotational movement 434 enables the weight 404 to be more easily slidable within the channel 402 while in the unlocked configuration because the elastomeric material 416 is at least partially positioned away from the channel surfaces. In some examples, the elastomeric material 416 extending from the bottom surface 424 may be only proximate the groove 428 so as to increase rotational movement 434 of the weight 404.

The cover 406 is substantially L-shaped in cross-section (see FIG. 12) and receives at least a portion of the weight 404 therein. The cover includes a first leg 436 that has the flange 430 and a second leg 438 that is adjacent to the sidewall 418 of the channel 402. The flange 430 may be substantially parallel to the second leg 438 so as to increase the structural rigidity of the cover 406 in the lengthwise direction. The second leg 438 may extend at least partially within a depression 440 of the track 410 so as to decrease bending of the cover 406 while in the locked configuration. Additionally, in the example, a projection 442 of the cover 406 may be substantially cylindrical in shape. The projection 442 is received within a corresponding cylindrical chamber 444. This projection 442 and chamber 444 structure increases the engagement of the cover 406 with the body 106 in the locked configuration (as illustrated in FIG. 11). In some examples, a projection axis 446 of the projection 442 may be substantially parallel to a fastener axis 448. This orientation guides the movement of the cover 406 between the locked configuration and the unlocked configuration. In some examples, the projection 442 may include a tapered nose. In this example, the weight 404 and the channel 402 may include complementary features 450 that index the location of the weight 404 to the channel 402.

Figure 13:
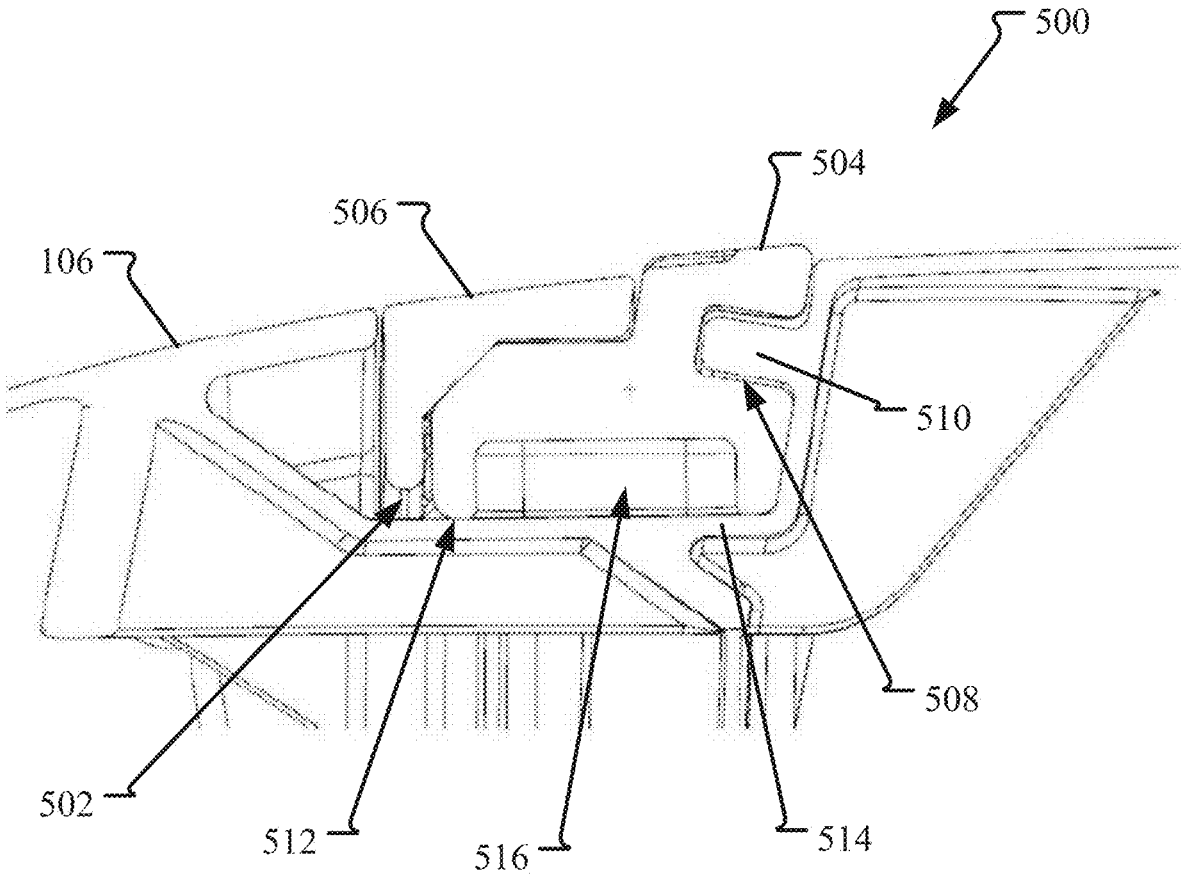
FIG. 13 is a cross-sectional view of another weight assembly.

FIG. 13 is a cross-sectional view of another weight assembly 500. Certain components are described above, and thus, are not necessarily described further. Similar to the example described in FIGS. 9-12, in this example, the weight assembly 500 includes a recessed channel 502 defined within the body 106 of the club head. The weight assembly 500 also includes a slidable weight 504 and a cover 506. The cover 506 is shown in a locked configuration and a slot 508 of the weight 504 is engaged with a fin 510 of the channel 502. However, in this example, a bottom surface 512 of the weight 504 is positioned directly against a track 514 of the channel 502. Additionally, in this example, the bottom surface 512 of the weight 504 includes a hollow 516. The hollow 516 reduces fictional sliding forces on the weight 504, when the weight assembly 500 is in the unlocked configuration (not shown). The hollow 516 also enables for the size and shape of the weight 504 to be formed while maintaining the required or desired mass and/or density of the weight 504. In some examples, an elastomeric material (not shown) may be disposed at least partially within the hollow 516.

Figure 14:
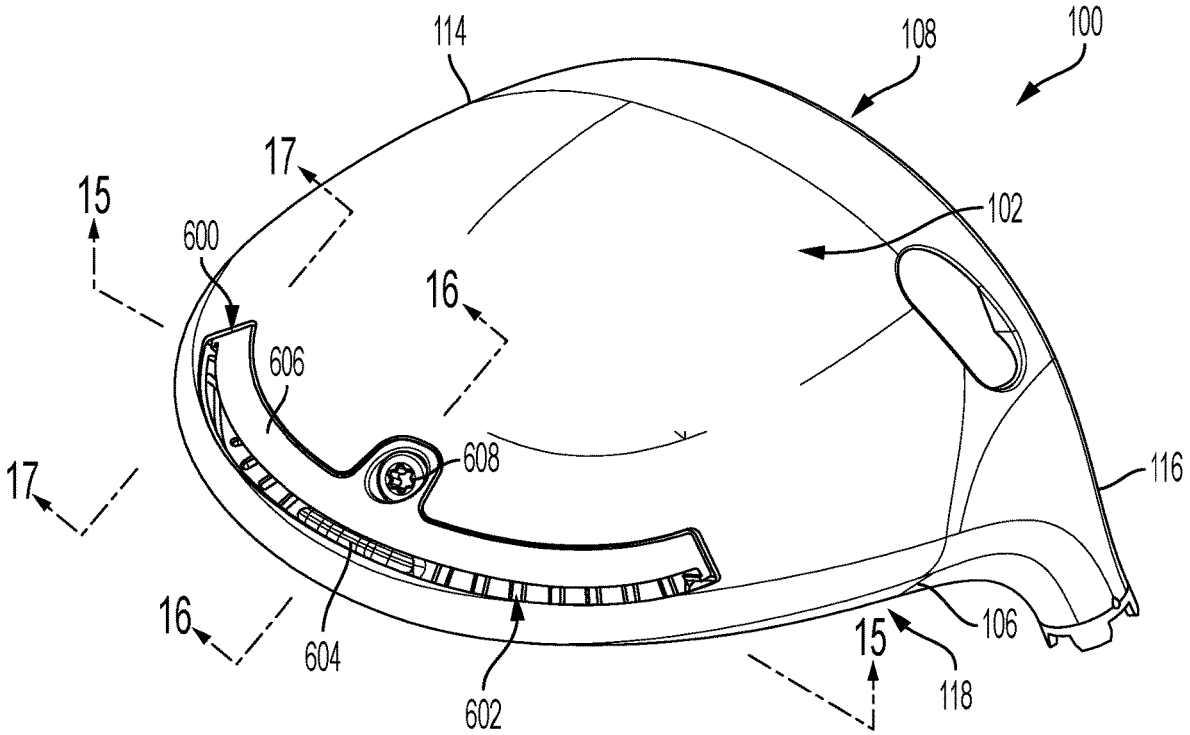
FIG. 14 is a perspective view of the sole of the golf club head with another weight assembly.

FIG. 14 is a perspective view of the sole 102 of the golf club head 100 with another weight assembly 600. Certain components are described above, and thus, are not necessarily described further. The weight assembly 600 includes a recessed channel 602 defined within the sole 102 of the body 106 of the club head 100. The channel 602 has a substantially curved shape in the toe 114—heel 116 direction so that the CG and the MOI of the club head 100 can be adjustable for fade-drawn bias. In some examples, the curve of the channel 602 matches the rear perimeter of the body 106, where the sole 102 and the crown 118 are coupled together. The weight assembly 600 also includes a slidable weight 604, a cover 606, and a fastener 608.

In this example, the fastener 608 is positioned in the concave area of the curved channel 602 and towards the striking face 108 of the body 106. This position enables the weight 604 to be positioned adjacent to the rear perimeter of the body 106 and increase the adjustability of the CG and MOI of the club head 100, when compared to having the fastener 608 positioned in the convex area of the curved channel 602 and the weight 604 being closer to the striking face 108. Additionally, the weight 604 may slide completely from the toe 114 side to the heel 116 side and be located at any position of the channel 602 even adjacent to the fastener 608. In other examples, the fastener 608 may be positioned in the convex area of the curved channel 602 as required or desired. The fastener 608 is also positioned at approximately the midpoint of the channel 602. In other examples, the fastener 608 may be offset from the midpoint of the channel 602, or two or more fastener 608 may be used to couple the cover 606 to the body 106 (e.g., at each end of the channel 602).

Figure 15:
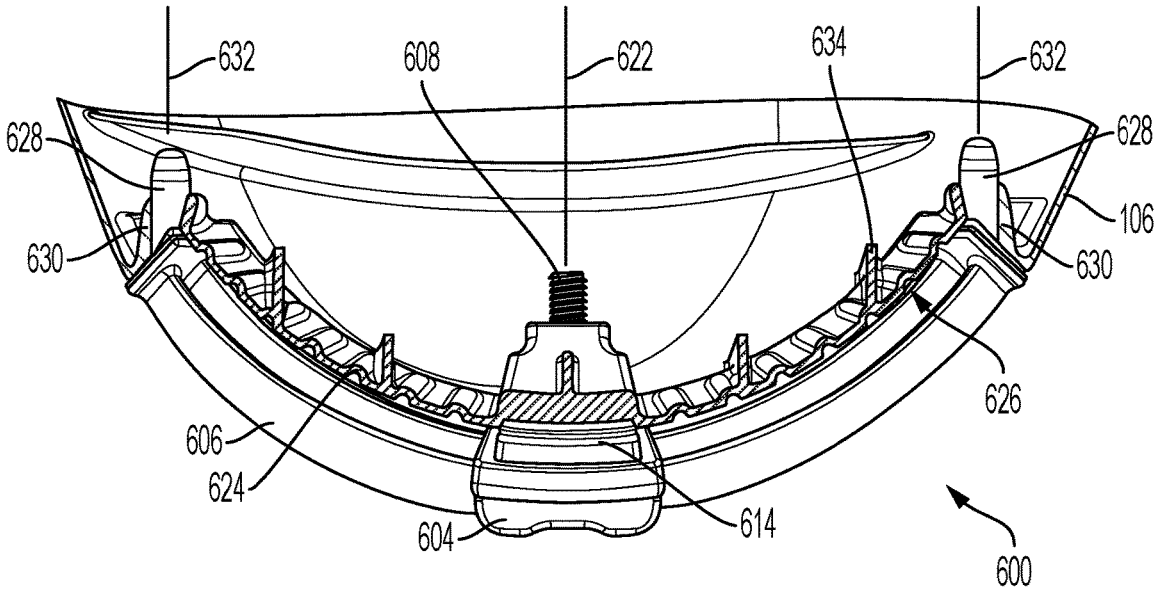
FIG. 15 is a cross-sectional view of the golf club head taken along line 15-15 in FIG. 14 and showing the weight assembly.
Figure 16:
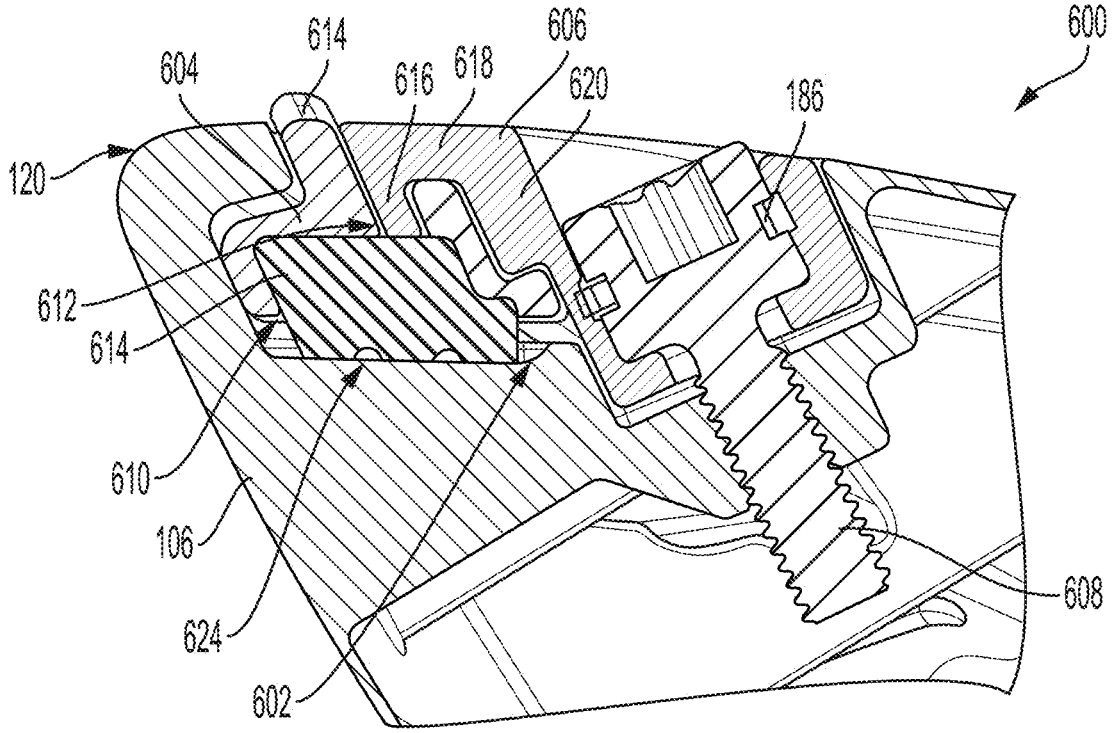
FIG. 16 is a cross-sectional view of the weight assembly taken along line 16-16 in FIG. 14.
Figure 17:
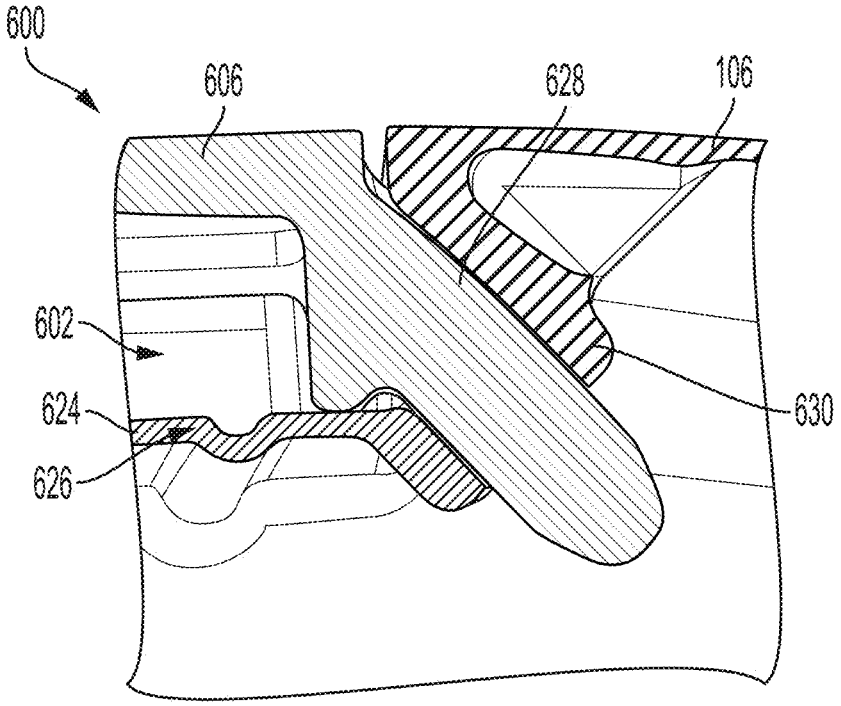
FIG. 17 is a cross-sectional view of the weight assembly taken along line 17-17 in FIG. 14.

FIG. 15 is a cross-sectional view of the club head 100 taken along line 15-15 in FIG. 14 and showing the weight assembly 600. FIG. 16 is a cross-sectional view of the weight assembly 600 taken along line 16-16 in FIG. 14. FIG. 17 is a cross-sectional view of the weight assembly 600 taken along line 17-17 in FIG. 14. Certain components are described above, and thus, are not necessarily described further. Referring concurrently to FIGS. 15-17, the weight assembly 600 is illustrated in a locked configuration and the weight 604 includes a bottom surface 610 and a groove 612. A tab 614 is disposed adjacent to the groove 612. Additionally, the weight 604 includes an elastomeric material 614. In this example, the elastomeric material 614 is coupled to the weight 604 and extends from the bottom surface 610 and also into the groove 612. The elastomeric material 614 is oversized relative to the channel 602 (e.g., between a 0.1 millimeter and 1.0 millimeter overlap) so that the material 614 may deform while being compressed within the channel 602. In other examples, the elastomeric material 614 may be adhered to the exterior surface of the weight 604. In yet other examples, the elastomeric material 614 may at least partially form the weight 604 itself.

The cover 606 is substantially C-shaped with a flange 616 that engages with the groove 612 of the weight 604. Additionally, the cover 606 includes a top leg 618 and a side leg 620 that is opposite of the flange 616. The top leg 618 has a thickness that is greater than the flange 616 and the side leg 620 so as to increase the structural rigidity of the cover 606 in a lengthwise direction. The fastener 608 is coupled to the cover 606 by a lock washer 186 that enables the fastener 608 to rotate relative to the cover 606 while allowing the cover 606 to move along a fastener axis 622 to raise and lower the cover 606 relative to the channel 602.

In operation, when the cover 606 is in the locked configuration, the flange 616 of the cover 606 is engaged within the groove 612 of the weight 604. This compresses the weight 604 between the cover 606 and a bottom track 624 of the channel 602. In the locked configuration, the elastomeric material 614 engages with both the cover 606 and the channel 602 to increase the securement of the weight 604 to one or more portion of the club head 100. In some examples, a plurality of grooves 626 are defined within the track 624 that the elastomeric material 614 deforms into the grooves 626 to facilitate securement of the weight 604 within the channel 602. Additionally, the tab 614 of the weight 604 may be positioned proximate the outer surface 120 of the body 106 so that the position of the weight 604 may be visible. When the weight assembly 600 is in the unlocked configuration (not shown), the cover 606 is lifted at least partially out of the channel 602 so that the weight 604 may be selectively slidable therein, for example, via the tab 614.

Each end of the cover 606 may include a substantially cylindrical projection 628 that is received within a corresponding cylindrical chamber 630 of the channel 602. The projections 628 extend along a projection axis 632 that is substantially parallel to the fastener axis 622. This orientation guides the movement of the cover 606 between the locked configuration and the unlocked configuration. In some examples, the projections 628 may include a tapered nose. Additionally, the chamber 630 may be open into the interior cavity 122 of the body 106 as illustrated in FIGS. 15 and 16. In other examples, the chamber 630 may be closed off from the interior cavity 122. One or more support ribs 634 may also extend from the track 624 and within the interior cavity 122 as required or desired.

Figure 18:
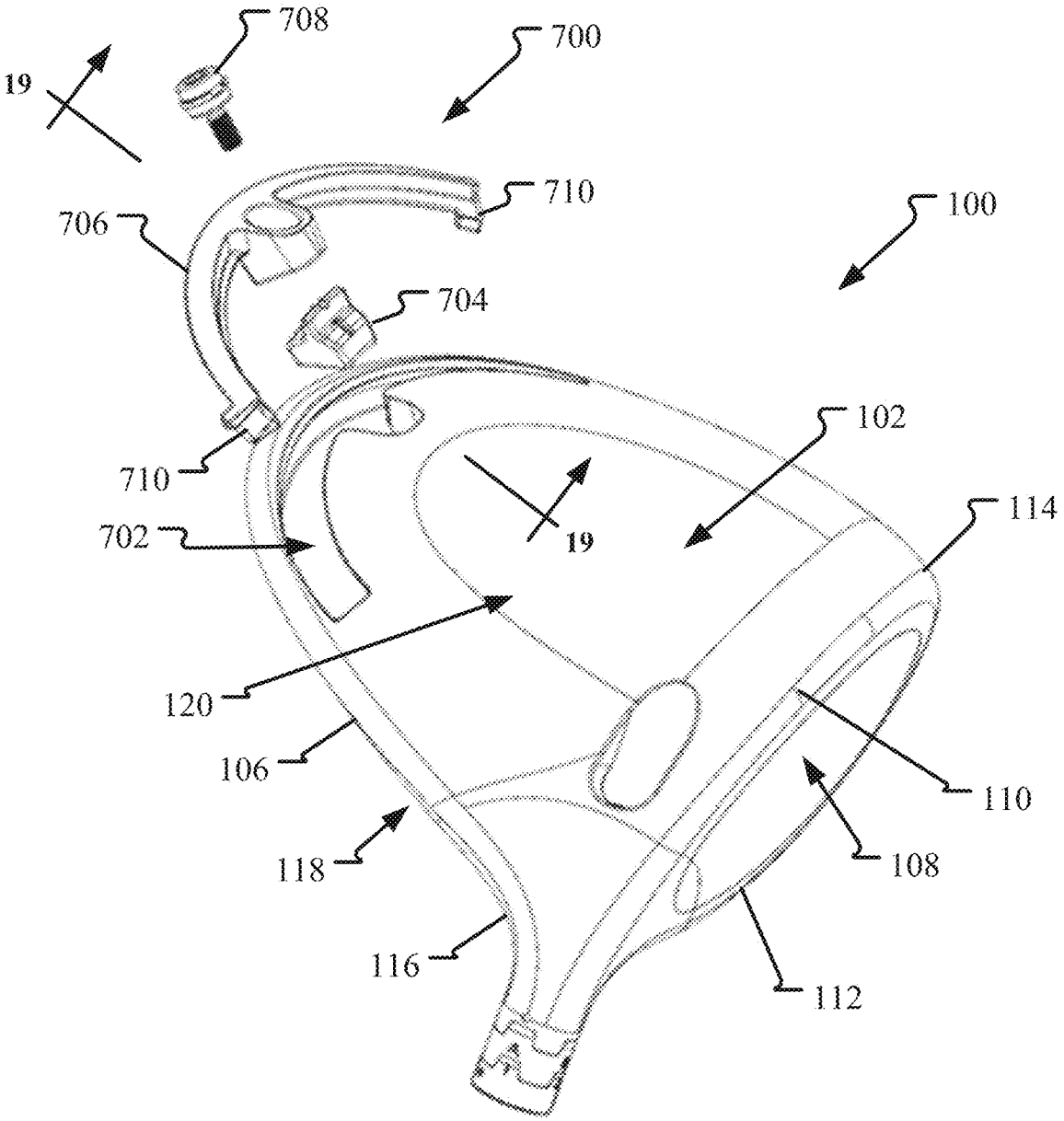
FIG. 18 is an exploded perspective view the golf club head with another weight assembly.

FIG. 18 is an exploded perspective view of the golf club head 100 with another weight assembly 700. Certain components are described above, and thus, are not necessarily described further. Similar to the example described in FIGS. 14-17, in this example, the weight assembly 700 includes a recessed channel 702 defined within the body 106 of the club head 100 and the channel 702 has a substantially curved shape in the toe 114—heel 116 direction. In some examples, the curve of the channel 702 matches the rear perimeter of the body 106, where the sole 102 and the crown 118 are coupled together. The weight assembly 700 also includes a slidable weight 704, a cover 706, and a fastener 708. At each end of the cover 706, projections 710 may extend for engagement within the channel 702.

Figure 19:
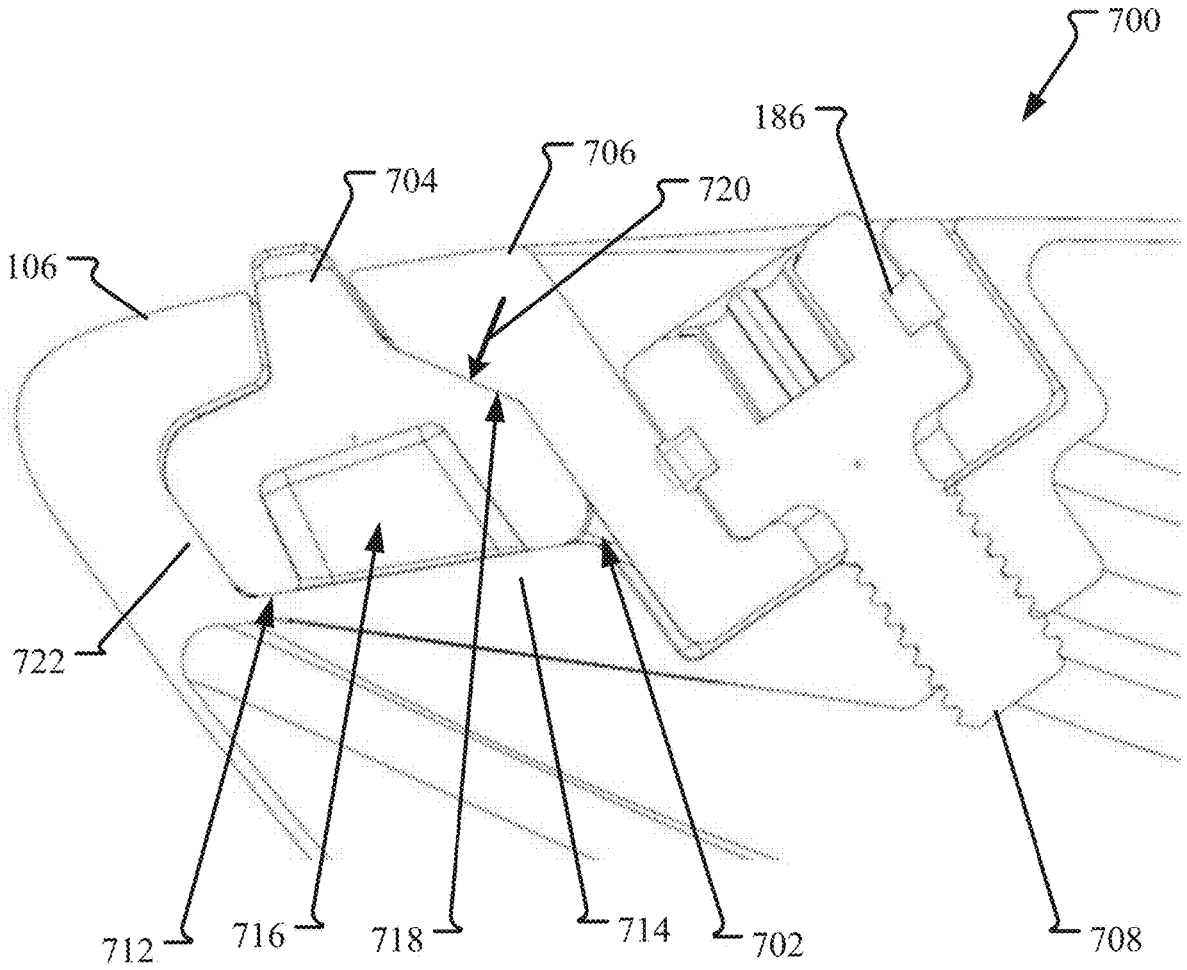
FIG. 19 is a cross-sectional view of the weight assembly taken along line 19-19 in FIG. 18.

FIG. 19 is a cross-sectional view of the weight assembly 700 taken along line 19-19 in FIG. 18. Certain components are described above, and thus, are not necessarily described further. The weight assembly 700 is illustrated in the locked configuration in FIG. 19 and a bottom surface 712 of the weight 704 is positioned directly against a track 714 of the channel 702. Additionally, in this example, the bottom surface 712 of the weight 704 includes a hollow 716. The hollow 716 reduces frictional sliding forces on the weight 704, when the weight assembly 700 is in the unlocked configuration (not shown). The hollow 716 also enables for the size and shape of the weight 704 to be formed while maintaining the required or desired mass and/or density of the weight 704. In some examples, an elastomeric material (not shown) may be disposed at least partially within the hollow 716.

Additionally, the cover 706 includes an angled surface 718 that abuts the weight 704. As such, when the weight assembly 700 is in a locked configuration (e.g., FIG. 19), the cover 706 generates a compressive force 720 along the angled surface 718 that acts in both a downward direction and a transverse direction to secure the weight 704 between the cover 706 and an undercut sidewall 722 of the channel 702. As such, the weight 704 is frictionally secured by the weight assembly 700 to one or more portions of the club head 100.

Figure 20:
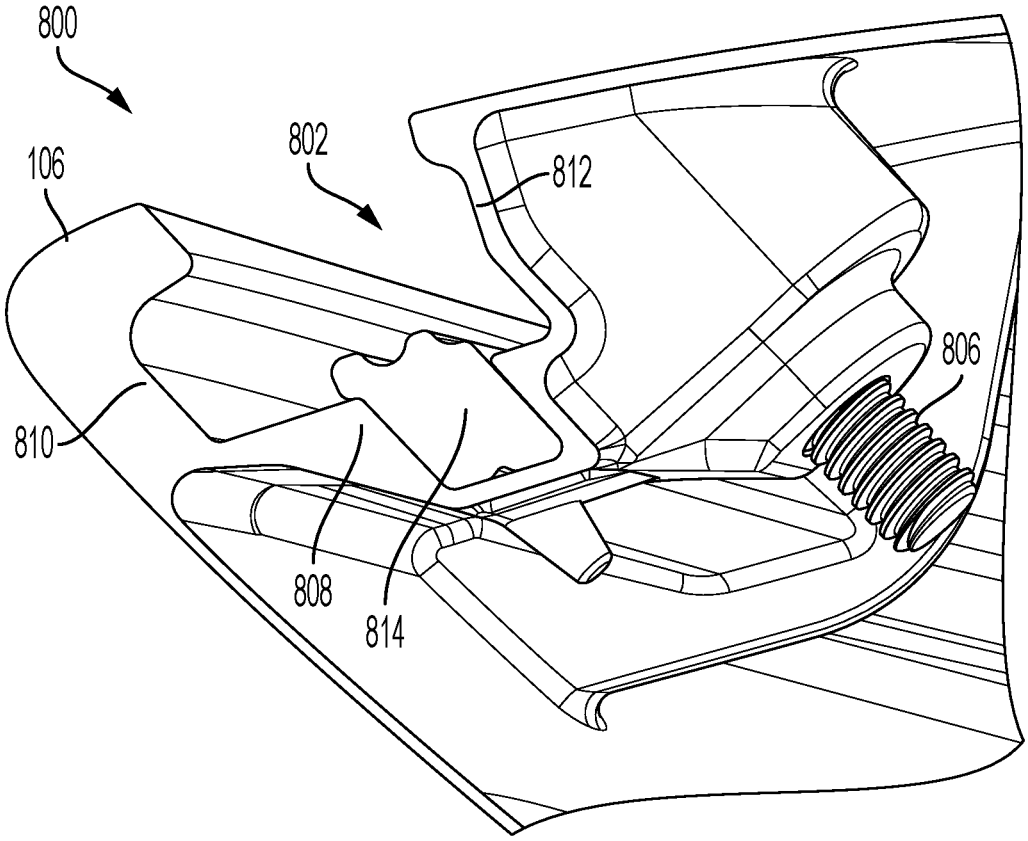
FIG. 20 is a partial cross-sectional perspective view of another weight assembly.
Figure 21:
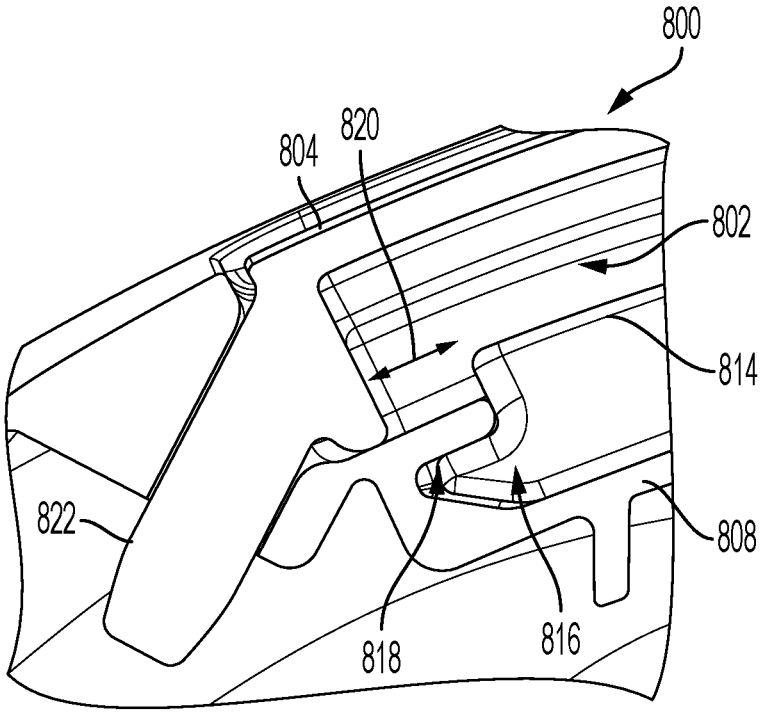
FIG. 21 is another cross-sectional view of the weight assembly shown in FIG. 20.

FIG. 20 is a partial cross-sectional perspective view of another weight assembly 800. FIG. 21 is another cross-sectional view of the weight assembly 800. Certain components are described above, and thus, are not necessarily described further. Referring concurrently to FIGS. 20 and 21, the cross-sectional views are substantially along a front-rear direction of the golf club head and, for example, similar to the examples described above in reference to FIGS. 16 and 17. The weight assembly 800 includes a recessed channel 802 defined within the body 106. The weight assembly 800 also includes a slidable weight (not shown), a cover 804, and a fastener 806. In this example, the channel 802 is defined by a bottom track 808 and two opposing sidewalls 810, 812. The bottom track 808 includes an elastomeric material 814 coupled thereto and that extends at least partially into the channel 802. The elastomeric material 814 engages with the weight and further increases securement of the weight within the channel 802 in the locked configuration. Additionally, the elastomeric material 814 decreases rattling of the weight during the swing of the club head. Additionally or alternatively, the elastomeric material 814 may be coupled to one or more of the sidewalls 810, 812 as required or desired. In still other examples, the elastomeric material 814 can be coupled to the cover 804.

In this example, the elastomeric material 814 extends along the longitudinal length of the channel 802. At each end 816 of the elastomeric material 814, a portion of the material may extend into an undercut area 818 within the channel 802 so as to secure the elastomeric material 814 within the channel 802. In other examples, the elastomeric material 814 may be adhered within the channel 802 or the cover 804 as required or desired. The end 816 of the elastomeric material 814 may be offset 820 from a projection 822 of the cover 804 so that the elastomeric material 814 does not interfere with the movement of the cover 804 between the locked and unlocked configurations as described herein.

Figure 22:
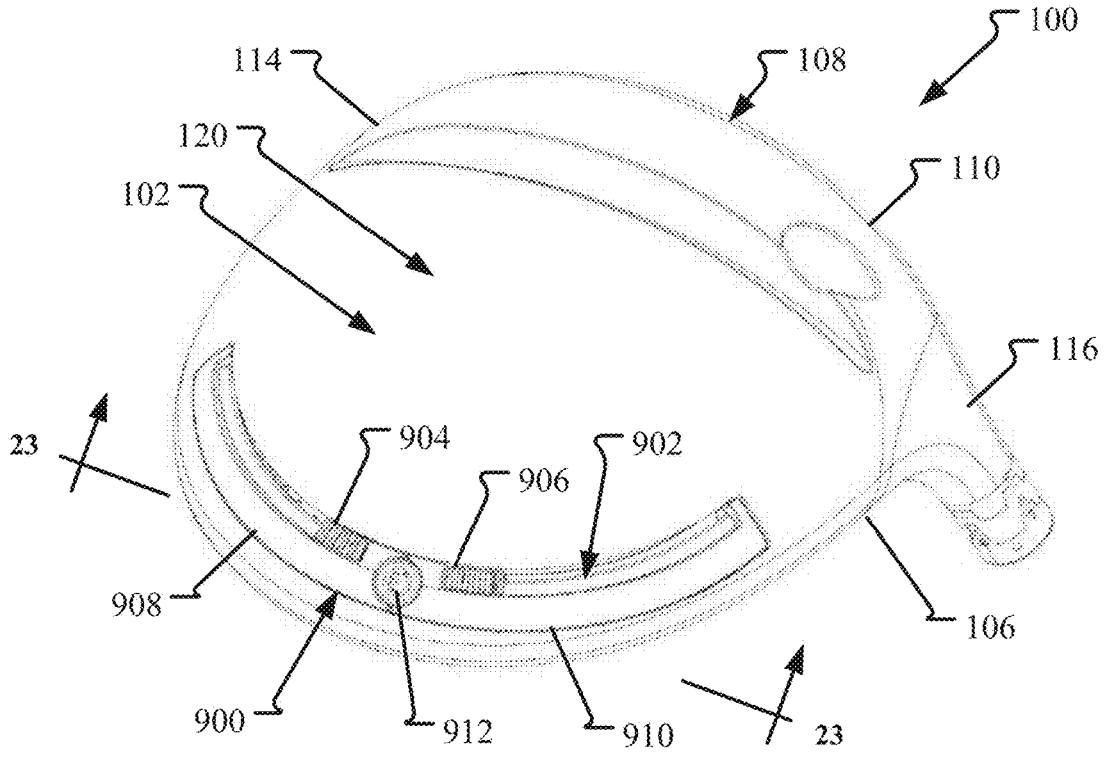
FIG. 22 is a perspective view of the sole of the golf club head with another weight assembly in a locked configuration.
Figure 23:
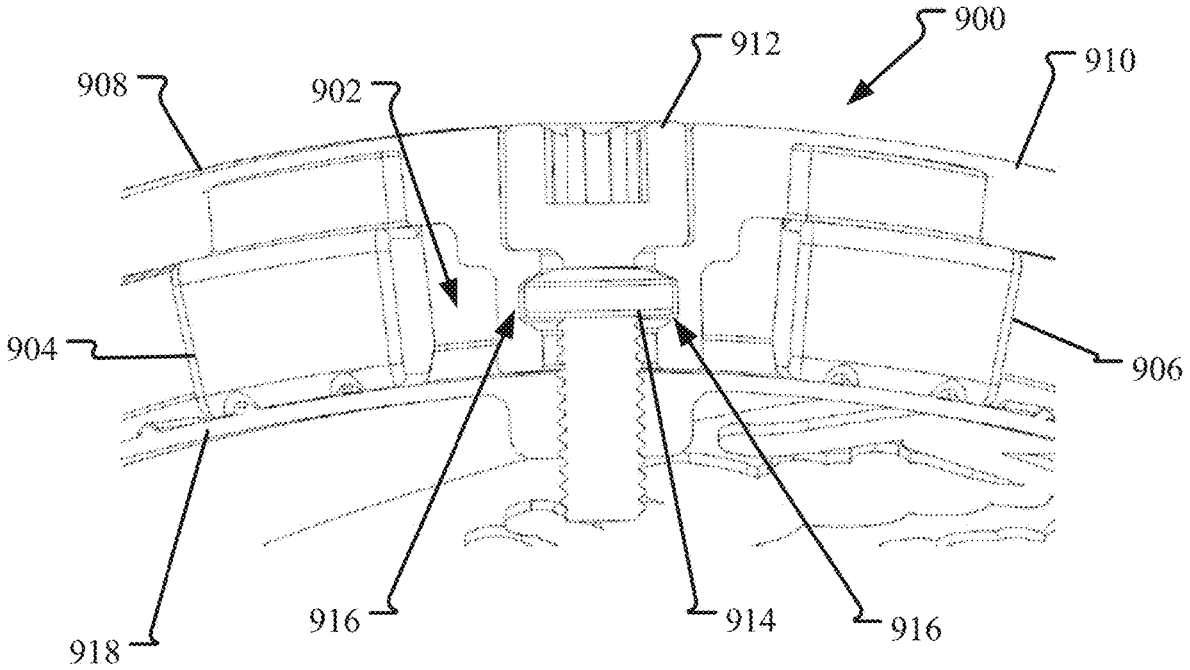
FIG. 23 is a cross-sectional view of the weight assembly taken along line 23-23 in FIG. 22.

FIG. 22 is a perspective view of the sole 102 of the golf club head 100 with another weight assembly 900 in a locked configuration. FIG. 23 is a cross-sectional view of the weight assembly 900 taken along line 23-23 in FIG. 22. Certain components are described above, and thus, are not necessarily described further. Referring concurrently to FIGS. 22 and 23, the weight assembly 900 is illustrated in a locked configuration and includes a recessed channel 902 defined within the sole 102 of the body 106 of the club head 100. The channel 902 has a substantially curved shape in the toe 114—heel 116 direction so that the CG and the MOI of the club head 100 can be adjustable for fade-drawn bias. In some examples, the curve of the channel 902 matches the rear perimeter of the body 106, where the sole 102 and the crown 118 are coupled together. The weight assembly 900 also includes a toe-side slidable weight 904, a heel-side slidable weight 906, a toe side cover 908, a heel side cover 910, and a fastener 912.

In this example, the fastener 912 is disposed within the channel 902 and divides the weight assembly 900 approximately in half. By positioning the fastener 912 within the channel 902 the size of the weight assembly 900 on the club head 100 is reduced. Additionally, the mass of the fastener 912 is moved further rearward from the striking face 108 than those examples described above. The weights 904, 906 extend from the inner convex side of the covers 908, 910 as illustrated in FIG. 22. In other examples, the weights 904, 906 may extend from the outer concave side of the covers 908, 910 as required or desired. In this example, two slidable weights 904, 906 are described since the fastener 912 prevents a weight from sliding completely from the toe side to the head side of the channel 902 and back. In some examples, the weight assembly 900 may include only one slidable weight and the fastener 912 and the covers 908, 910 are configured to allow the weight to pass between the toe 114 side and the heel 116 side. In other examples, the weight assembly 900 may include only one slidable weight that requires the assembly to be completely disassembled so as to move the weight from the toe side to the head side and back. In still other examples, the weights 904, 906 may be completely removable from the channel 902 as required or desired.

One end of each cover 908, 910 is engaged with the channel 902, for example, with the projection/channel interface as described herein, while the other opposite end of each cover 908, 910 is engaged with the fastener 912. In the example, the fastener 912 includes a washer 914 that is disposed below the head. The washer 914 is a substantially cylindrical flange extending from the threaded shaft that engages with both corresponding groove 916 within the covers 908, 910. When the weight assembly 900 is in the locked configuration the covers 908, 910 are disposed within the channel 902 and secured in place with the fastener 912, via the grooves 916, so that the weights 904, 906 cannot slide within the channel 902 and are locked in place. Additionally, the covers 908, 910 are flush with the outer surface 120 of the body 106. In some examples, the portion of the covers 908, 910 that define the grooves 916 may extend all the way to a bottom track 918 of the channel 902 so that overtightening of the fastener 912 is reduced or prevented.

Figure 24:
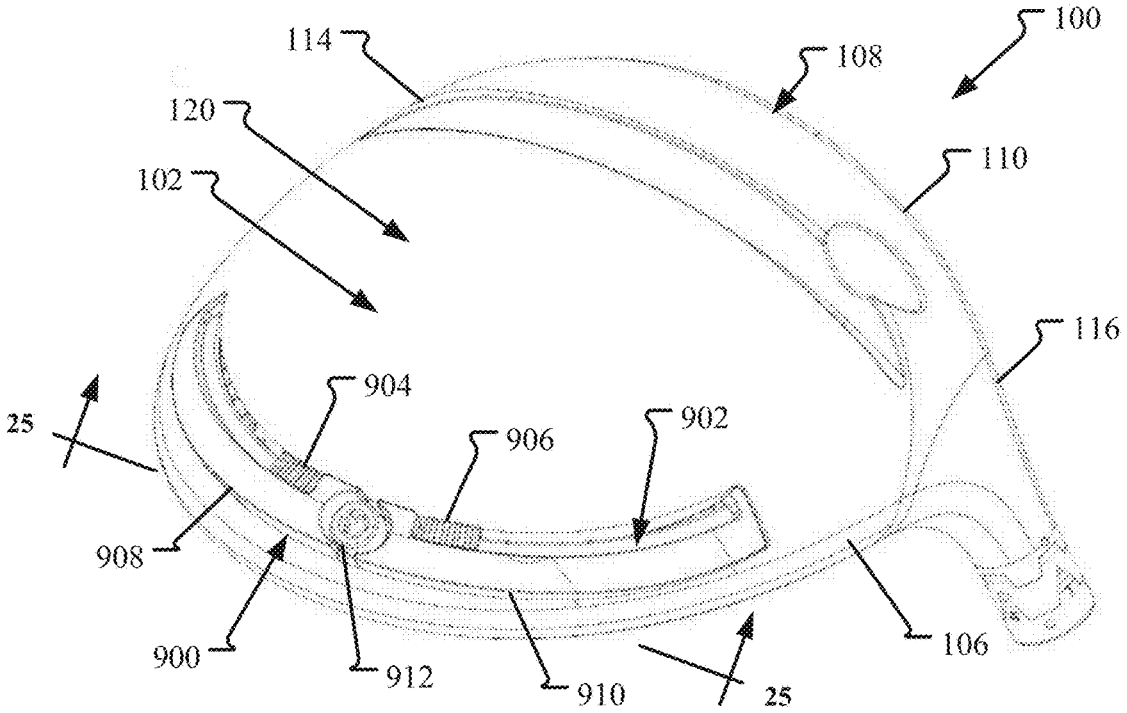
FIG. 24 is a perspective view of the sole of the golf club head with the weight assembly shown in FIG. 22 in an unlocked configuration.
Figure 25:
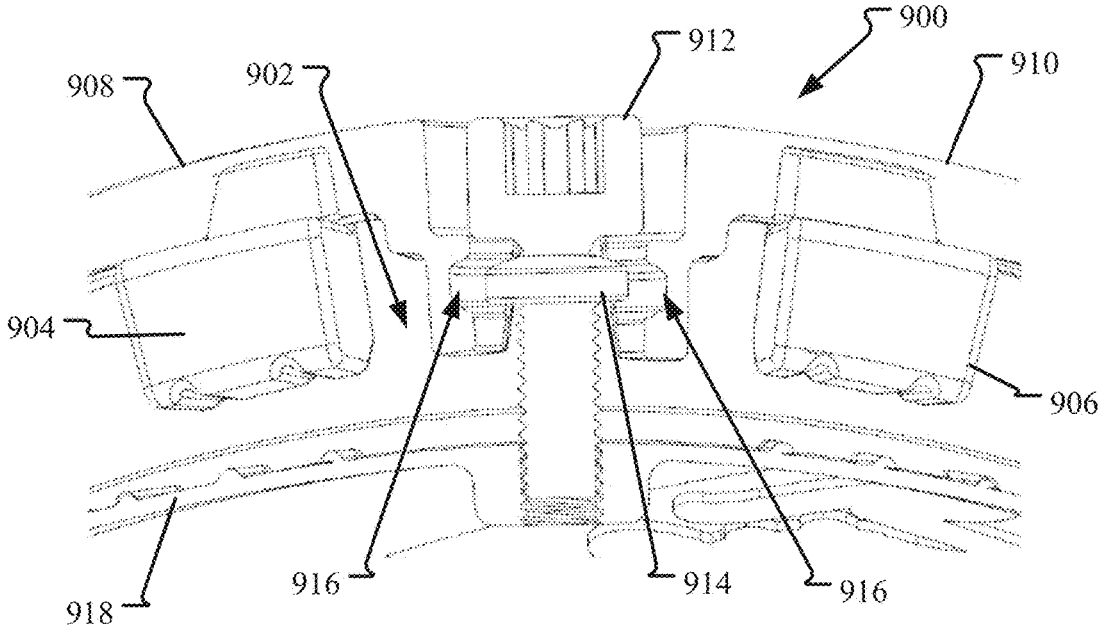
FIG. 25 is a cross-sectional view of the weight assembly taken along line 25-25 in FIG. 24.

FIG. 24 is a perspective view of the sole 102 of the golf club head 100 with the weight assembly shown 900 in an unlocked configuration. FIG. 25 is a cross-sectional view of the weight assembly 900 taken along line 25-25 in FIG. 24. Certain components are described above, and thus, are not necessarily described further. Referring concurrently to FIGS. 24 and 25, the weight assembly 900 is illustrated in an unlocked configuration. When the weight assembly 900 moves from the locked configuration (shown in FIGS. 22 and 23), the fastener 912 is rotated so as to lift at least partially out of the channel 902. This movement of the fastener 912 also lifts the ends of the covers 908, 910 that are engaged with the washer 914 at least partially out of the channel 902 so as to enable the weights 904, 906 to slide within the channel 902. In some examples, the weights 904, 906 may be engaged with the respective cover 908, 910 so as to lift away from the track 918 for ease of movement.

In some examples, the covers 908, 910 and the fastener 912 may be completely removed from the body 106 as required or desired so as to completely remove the weights 904, 906 from the channel 902. However, moving the weight assembly 900 between the locked configuration) and the unlocked configuration does not require that the weight assembly 900 be uncoupled from the body 106. As such, in the unlocked configuration, the covers 908, 910 remain coupled to the body 106 so that it is less likely that the components become lost or misplaced.

In this example, when the covers 908, 910 are in the unlocked configuration, the ends of the covers 908, 910 that are opposite of the fastener 912 and engaged with the channel 902 (e.g., with the projection/channel interface) remain engaged with the channel 902 and may form a pivot point that the covers 908, 910 rotate about. In other examples, the ends of the covers 908, 910 that are opposite of the fastener 912 may lift at least partially out of the channel 902 as described herein. For example, through a cam and cutout interface as described above.

Figure 26:
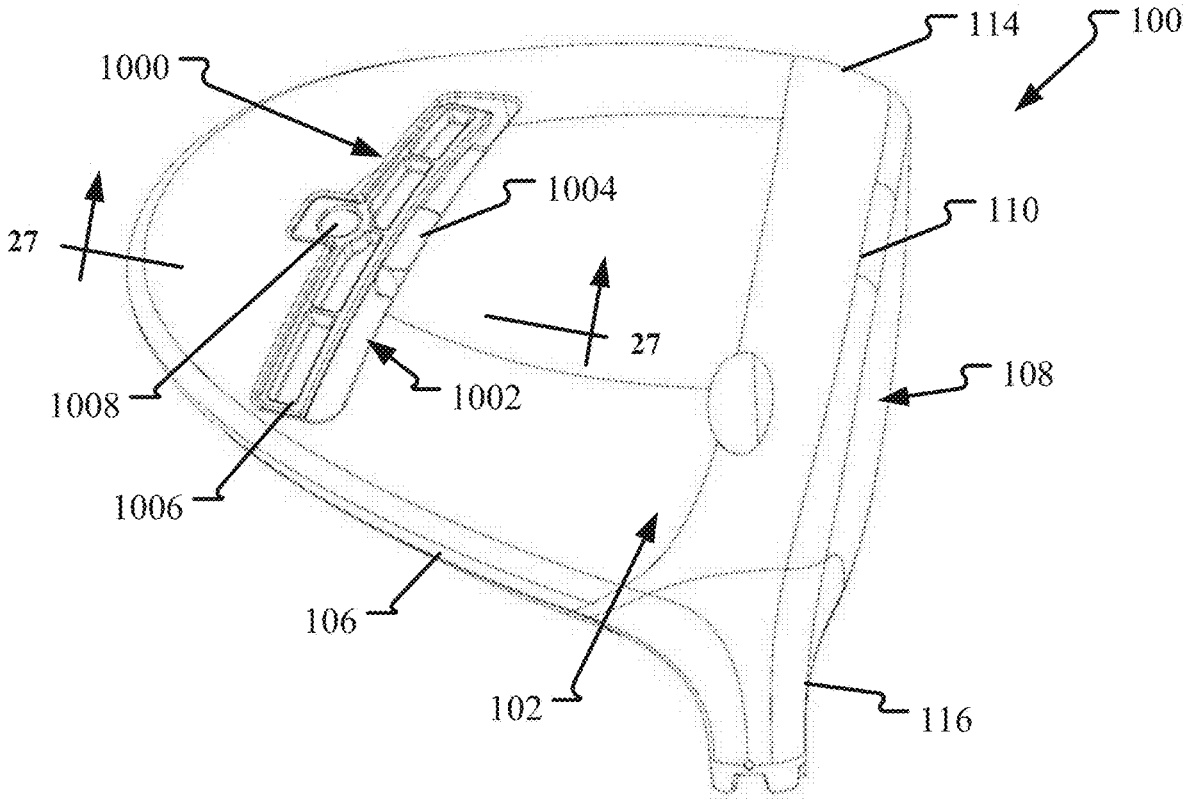
FIG. 26 is a perspective view of the sole of the golf club head with another weight assembly.
Figure 27:
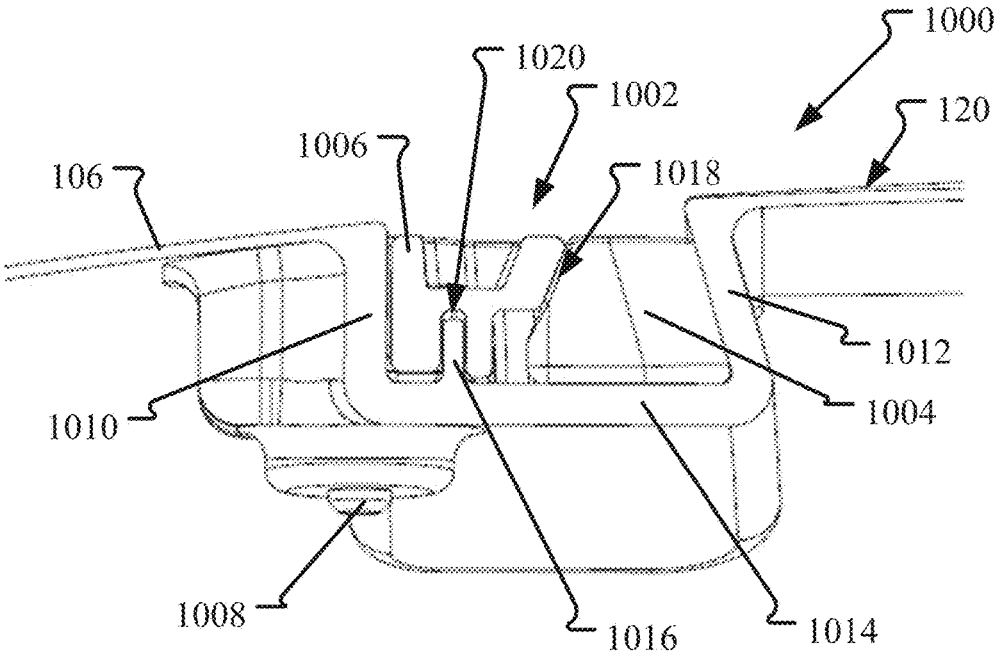
FIG. 27 is a cross-sectional view of the weight assembly taken along line 27-27 in FIG. 26.

FIG. 26 is a perspective view of the sole 102 of the golf club head 100 with another weight assembly 1000. FIG. 27 is a cross-sectional view of the weight assembly 1000 taken along line 27-27 in FIG. 26. Certain components are described above, and thus, are not necessarily described further. Referring concurrently to FIGS. 26 and 27, the weight assembly 1000 includes a substantially linear recessed channel 1002 defined within the sole 102. The weight assembly 1000 also includes a slidable weight 1004, a cover 1006, and a fastener 1008. In this example, the fastener 1008 may be positioned at approximately the midpoint of the channel 1002 and offset towards the rear of the club head 100. By positioning the fastener 1008 at a midpoint location, the distance between the fastener 1008 and the far end(s) of the cover 1006 is reduced so that the engagement between the cover 1006 and the channel 1002 is increased for securement of the weight 1004.

Similar to the example described above in reference to FIGS. 6 and 7, the channel 1002 is formed by two opposing sidewalls, a cover sidewall 1010 and an undercut sidewall 1012, and a bottom track 1014 offset from the outer surface 120 of the body 106. A partial wall 1016 also extends from the bottom track 1014. The cover 1006 is located adjacent to the cover sidewall 1010 and includes an angled surface 1018. As such, when the weight assembly 1000 is in a locked configuration (e.g., FIG. 27), the cover 1006 generates a compressive force along the angled surface 1018 that acts in both a downward direction and a transverse direction to secure the weight 1004 between the cover 1006 and the undercut sidewall 1012. Accordingly, the weight 1004 is frictionally secured by the weight assembly 1000 and at least partially underneath the angled surface 1018 and the undercut sidewall 1012. Additionally, the cover 1006 completely engages with the partial wall 1016 via a groove 1020 so that the portion of the cover 1006 away from the fastener 1008 is restricted from moving within the channel 1002 (e.g., bending or flexing) towards the undercut sidewall 1012. Furthermore, the partial wall 1016 is substantially parallel to the fastener axis (not shown) of the fastener 1008 so that the cover 1006 guides the movement between the locked and unlocked configuration.

Figure 28:
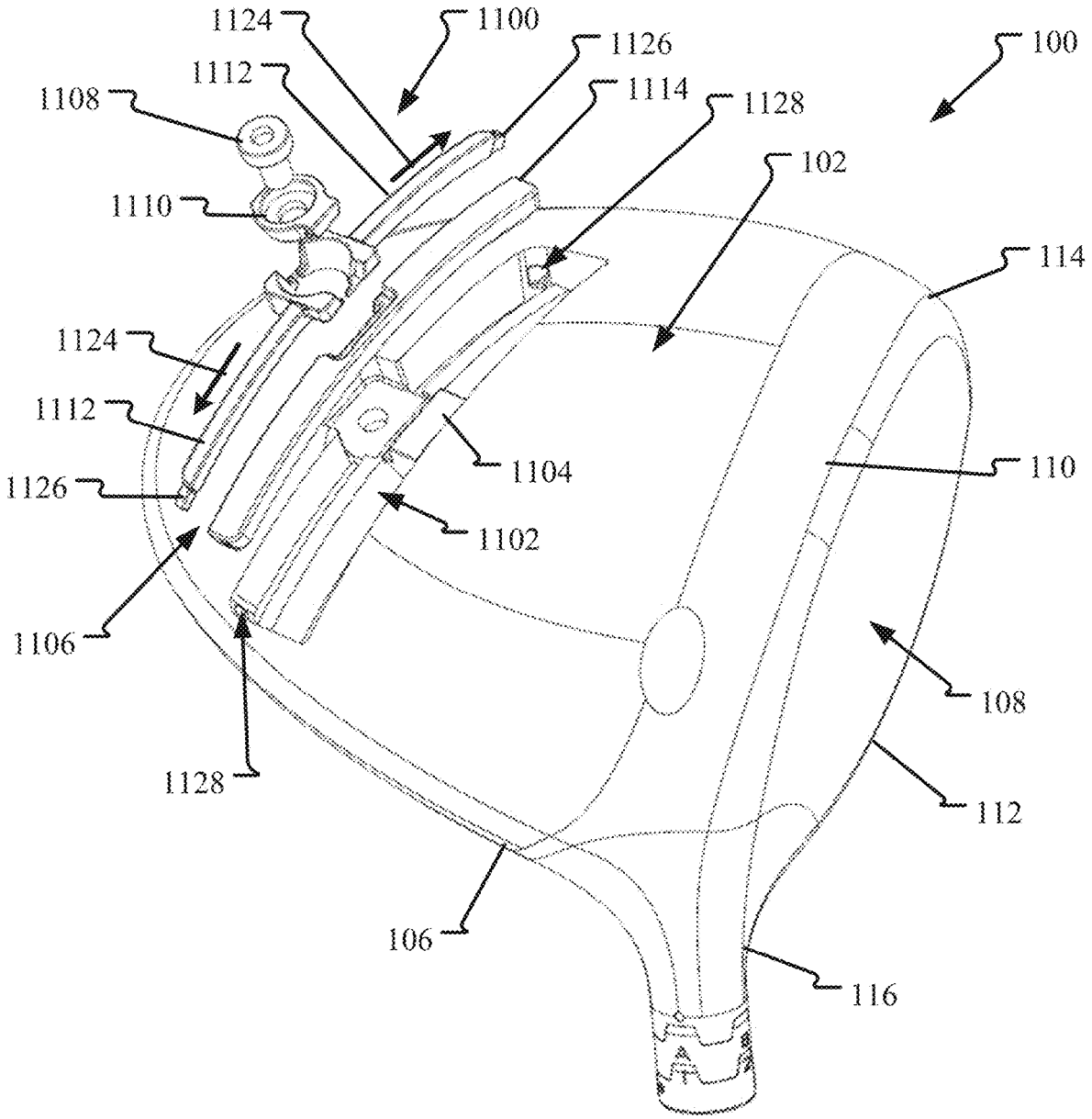
FIG. 28 is an exploded perspective view of the sole of the golf club head with another weight assembly.
Figure 29:
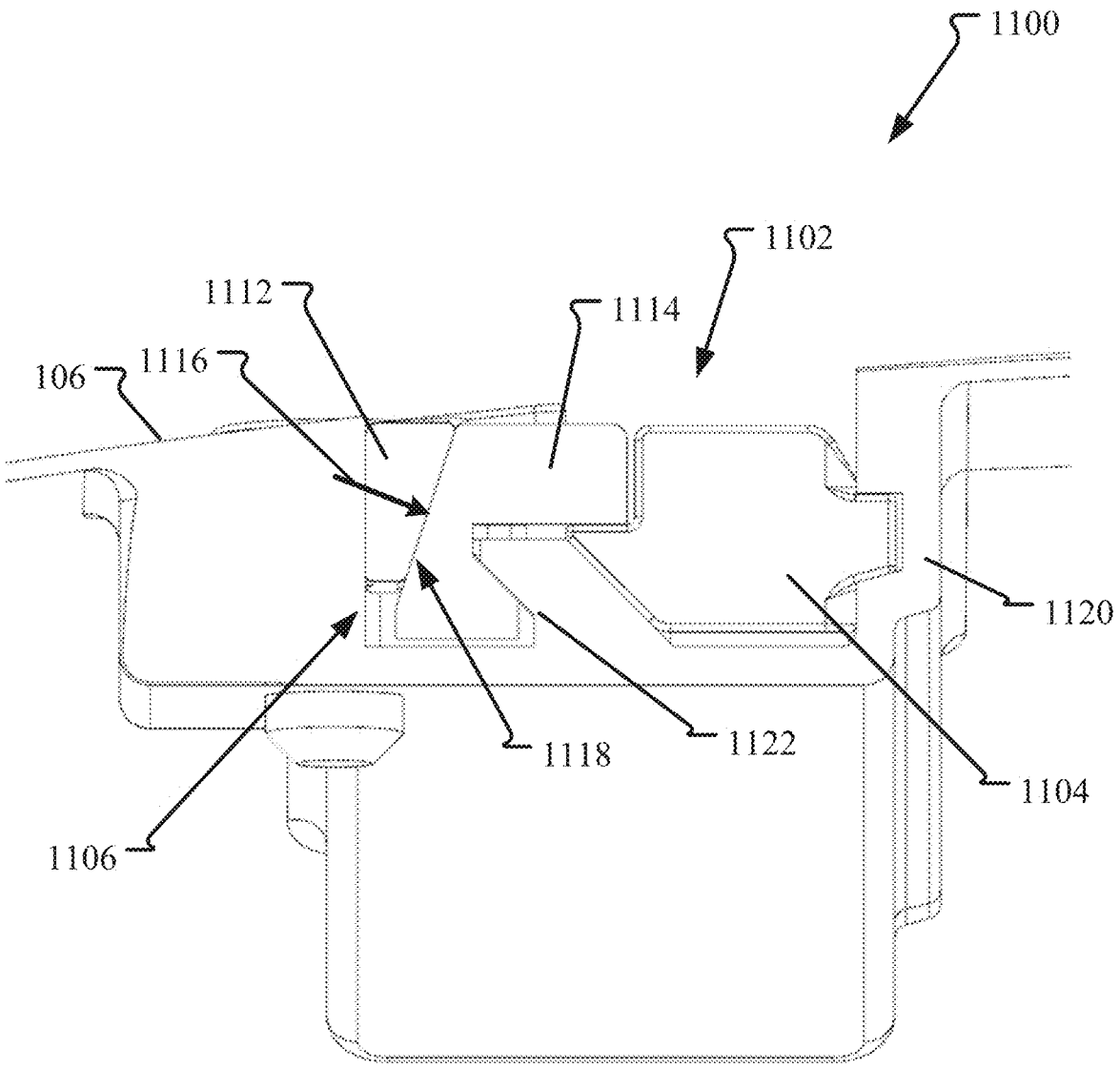
FIG. 29 is a cross-sectional view of the weight assembly shown in FIG. 28.

FIG. 28 is an exploded perspective view of the sole 102 of the golf club head 100 with another weight assembly 1100. FIG. 29 is a cross-sectional view of the weight assembly 1100. Certain components are described above, and thus, are not necessarily described further. Referring concurrently to FIGS. 28 and 29, the weight assembly 1100 includes a substantially linear recessed channel 1102 defined within the sole 102. The weight assembly 1100 also includes a slidable weight 1104, a cover assembly 1106, and a fastener 1108. In this example, the fastener 1108 may be positioned at approximately the midpoint of the channel 1102 and offset towards the rear of the club head 100. As described above, when the cover assembly 1106 is in the locked configuration, the cover assembly 1106 is coupled to the body 106 so that the weight 1104 is be secured within the weight assembly 1100 without movement or rattling. In this example, the cover assembly 1106 is a four piece assembly including a fastener member 1110, two opposing longitudinal members 1112, and a transverse member 1114.

When the cover assembly 1106 is moved towards the locked configuration (e.g., FIG. 29), the fastener 1108 is tightened to the body 106. The fastener 1108 engages with the fastener member 1110 and moves the fastener member 1110 along the fastener axis (not shown) and into the channel 1102. The fastener member 1110 has a tapered surface that engages with both of the longitudinal members 1112 so that as the fastener member 1110 is pulled down within the channel 1102, the longitudinal members 1112 are also pulled down within the channel 1102 and generate a compressive force 1116 along an angled surface 1118. The compressive force 1116 acts in both a downward direction and a transverse direction on the transverse member 1114 to position the transverse member 1114 within the channel 1102 and compress the weight 1104 between the transverse member 1114 and a sidewall 1120 of the channel.

Additionally, to reduce or prevent pull-out of the weight assembly 1100 from the body 106, the transverse member 1114 may engage with an undercut 1122 of the channel 1102. The compressive force 1116 from the longitudinal members 1112 lock the transverse member against the undercut 1122 so as to prevent movement. Additionally or alternatively, a portion of the weight 1104 may engage with the sidewall 1120 of the channel 1102 so as to reduce pull out of the weight assembly 1100 from the body 106. Additionally, the fastener member 1110 also pushes the longitudinal members 1112 away from the fastener 1108 (e.g., arrows 1124) so that ends 1126 of the members 1112 can engage with a corresponding chamber 1128 in the channel 1102 and also reduce pull out of the weight assembly 1100 from the body 106.

Figure 30:
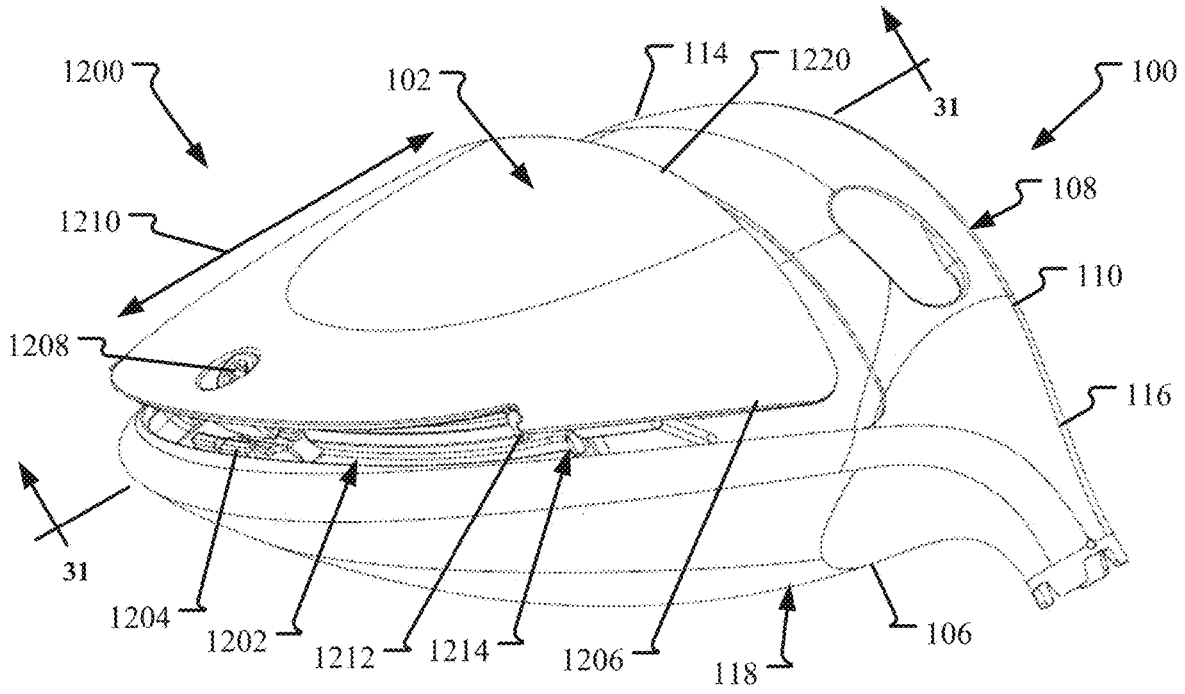
FIG. 30 is a perspective view of the sole of the golf club head with another weight assembly.
Figure 31:
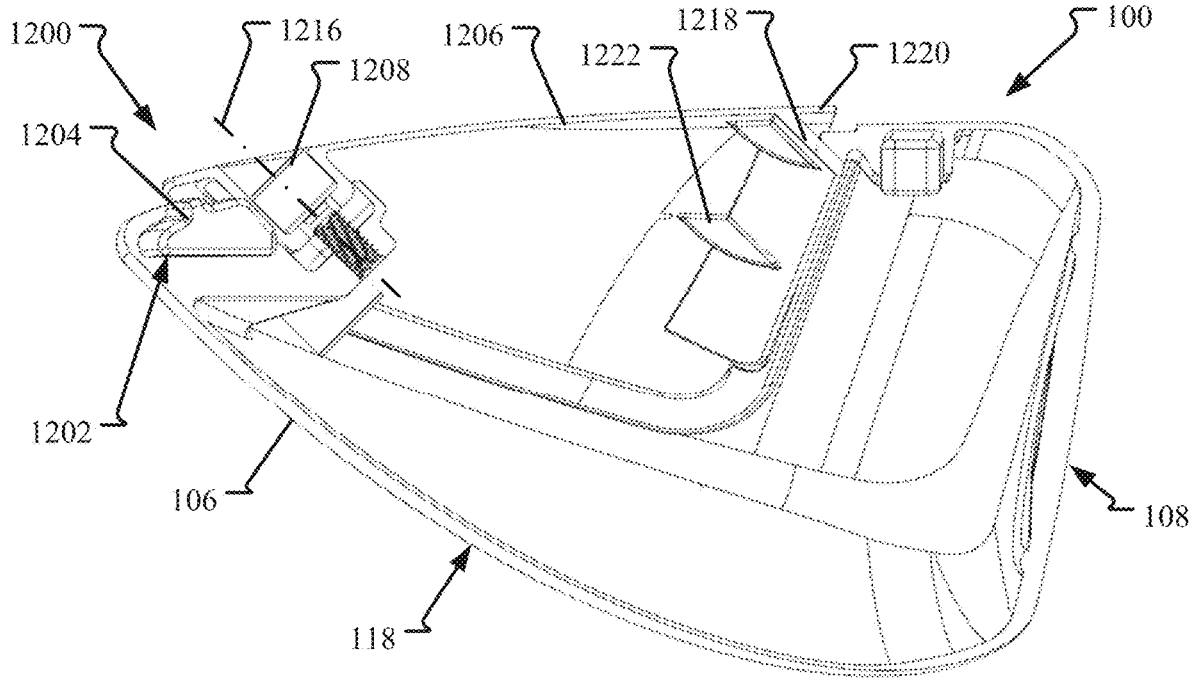
FIG. 31 is a cross-sectional view of the weight assembly taken along line 31-31 in FIG. 30.

FIG. 30 is a perspective view of the sole 102 of the golf club head 100 with another weight assembly 1200. FIG. 31 is a cross-sectional view of the weight assembly 1200 taken along line 31-31 in FIG. 30. Certain components are described above, and thus, are not necessarily described further. Referring concurrently to FIGS. 30 and 31, the weight assembly 1200 is illustrated in an unlocked configuration and includes a recessed channel 1202, a slidable weight 1204, a cover 1206, and a fastener 1208. The structure, size, shape, and orientation of the channel 1202, the weight 1204, and the fastener 1208 may be similar to any of the examples described above. In this example, however, a width 1210 of the cover 1206 is extended towards the striking face 108 so that the cover 1206 forms a greater portion of the sole 102 and does not only cover a portion of the channel 1202.

In some examples, the cover 1206 may form greater than or equal to 75% of the surface area of the sole 102. In other examples, the cover 1206 may form greater than to equal to 50% of the surface area of the sole 102. In still other examples, the cover 1206 may form greater than or equal to 25% of the surface area of the sole 102. In still further examples, the cover 1206 may be between about 10% and 90% of the surface area of the sole 102. In other examples, the cover 1206 may be between about 25% and 75% of the surface area of the sole 102.

By enlarging the cover 1206 of the weight assembly 1200, the golf club head structure that forms the sole 102 of the body 106 can be reduced. In some examples, the cover 1206 can be manufactured from a lighter weight material (e.g., composite materials, plastics, etc.) than the material that the body 106 is manufactured from. As such, the weight saved by the configuration of the sole construction can be used at other locations on the club head 100 as required or desired and further enable adjustment of the CG and MOI of the club head 100 for improving golf ball flight characteristics. In some examples, the weight saved by the sole construction can be included back into the slidable weight 1204. For example, the cover 1206 may reduce the weight of the sole construction by 11 grams or more, some or all of which mass that can then be included at least partially into the weight 1204.

The cover 1206 can include a projection 1212 extending therefrom that is configured to engage with a corresponding chamber 1214 within each end of the channel 1202 for increasing the structural rigidity of the cover 1206 connection as described in the examples above. In one example, the projection 1212 may be substantially cylindrical and parallel to a fastener axis 1216. At the opposite side of the cover 1206 from the fastener 1208, the cover 1206 includes a brace 1218 adjacent to an extended edge 1220 that frictionally engages with the remaining sole 102 of the club head 100 to secure the edge 1220 to the body 106. In some examples, the brace 1218 may extend at an angle that is substantially parallel to the fastener axis 1216 so as to guide the movement of the cover 1206 between the locked and unlocked configurations as described herein. The brace 1218 may include one or more brackets 1222 for increasing the structural rigidity of the brace 1218.

Figure 32:
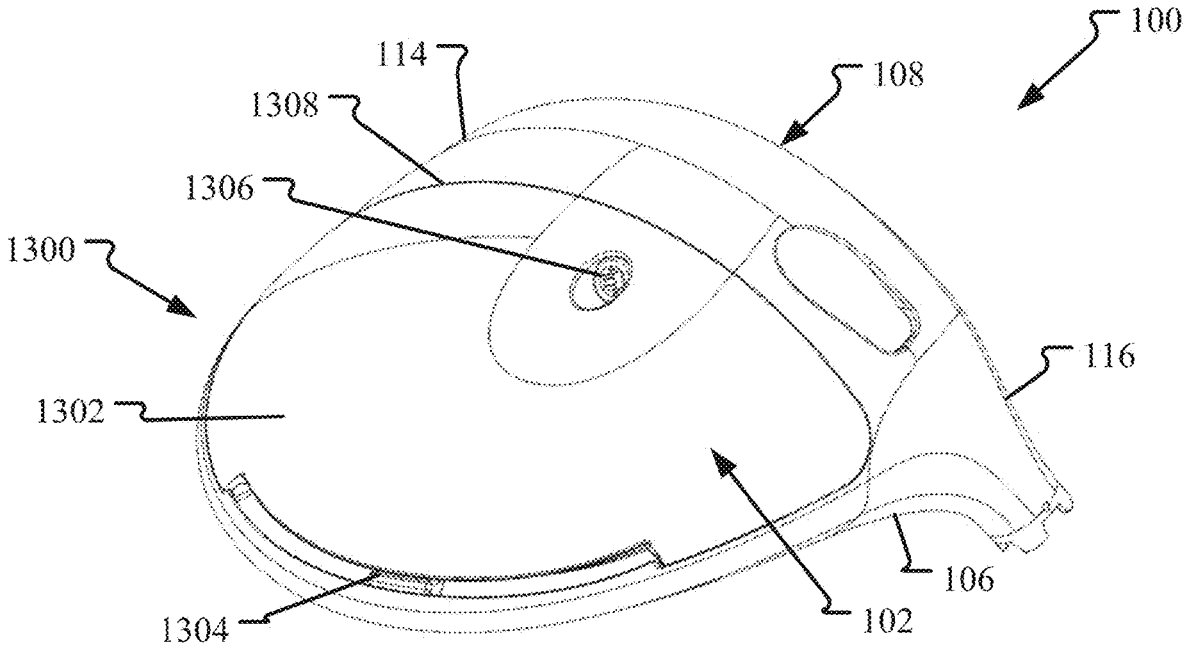
FIG. 32 is a perspective view of the sole of the golf club head with another weight assembly.

FIG. 32 is a perspective view of the sole 102 of the golf club head 100 with another weight assembly 1300. Certain components are described above, and thus, are not necessarily described further. Similar to the example described in FIGS. 30 and 31, the weight assembly 1300 includes an enlarged cover 1302 that selectively secures a slidable weight 1304 to one or more portions of the club head 100. In this example, however, a fastener 1306 is positioned more towards the striking face 108 and adjacent to an extended edge 1308 of the cover 1302. This example increases the securement of the edge 1308 to the body 106 of the golf club head 100. In other examples, the fastener 1306 may be positioned at any other location on the cover 1302 as required or desired. For example, towards the toe side 114, towards the heal side 116, centered on the cover 1302, etc.

Figure 33:
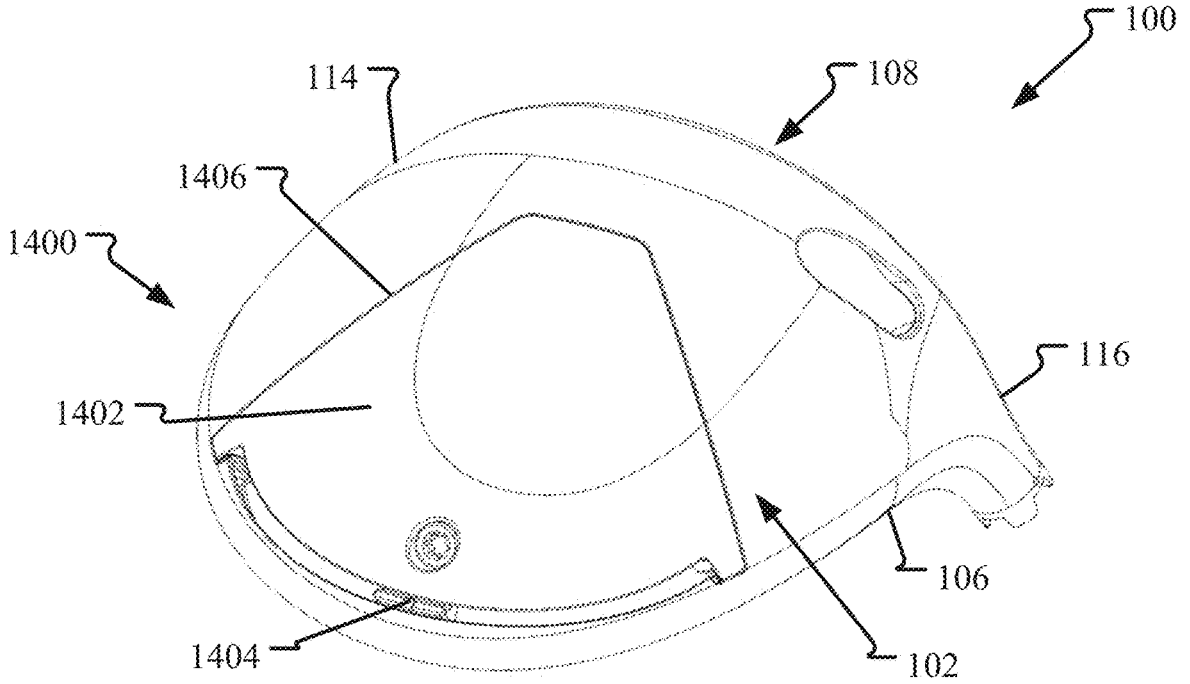
FIG. 33 is a perspective view of the sole of the golf club head with another weight assembly.

FIG. 33 is a perspective view of the sole 102 of the golf club head 100 with another weight assembly 1400. Certain components are described above, and thus, are not necessarily described further. Similar to the example described in FIGS. 30-32, the weight assembly 1400 includes an enlarged cover 1402 that selectively secures a slidable weight 1404 to one or more portions of the club head 100. In this example, however, the cover 1402 has an extended edge 1406 that is substantially V-shaped. Additionally, the cover 1402 is symmetrical in the toe 114—heel 116 direction. In other examples, the cover 1402 may be asymmetrical in the toe 114—heel 116 direction as required or desired.

Figure 34:
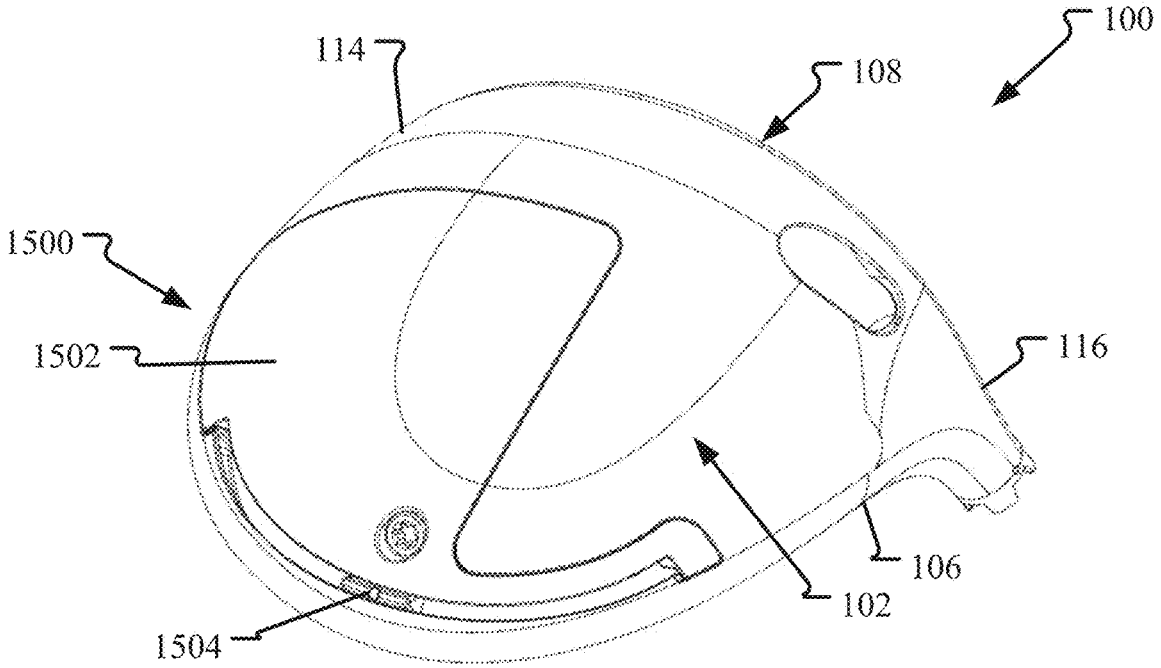
FIG. 34 is a perspective view of the sole of the golf club head with another weight assembly.

FIG. 34 is a perspective view of the sole 102 of the golf club head 100 with another weight assembly 1500. Certain components are described above, and thus, are not necessarily described further. Similar to the example described in FIGS. 30-33, the weight assembly 1500 includes an enlarged cover 1502 that selectively secures a slidable weight 1504 to one or more portions of the club head 100. In this example, however, the cover 1502 is asymmetrical in the toe side 114 direction. In other examples, the cover 1502 may be asymmetrical in the heel side 116 direction as required or desired.

Figure 35:
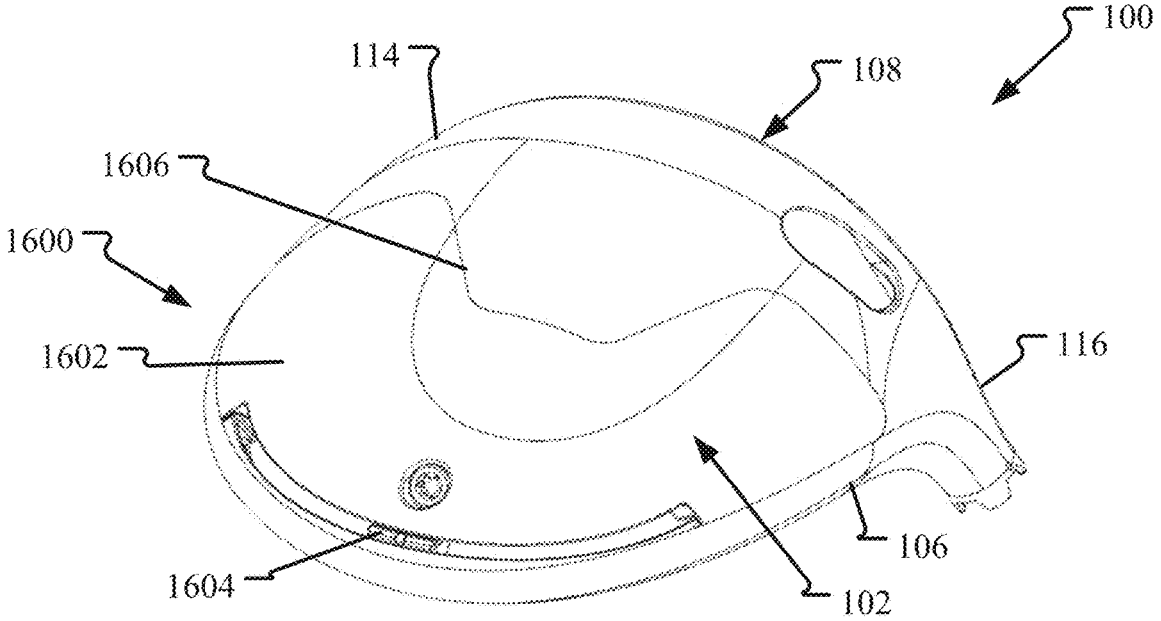
FIG. 35 is a perspective view of the sole of the golf club head with another weight assembly.

FIG. 35 is a perspective view of the sole 102 of the golf club head 100 with another weight assembly 1600. Certain components are described above, and thus are not necessarily described further. Similar to the example described in FIGS. 30-34, the weight assembly 1600 includes an enlarged cover 1602 that selectively secures a slidable weight 1604 to one or more portions of the club head 100. In this example, however, the cover 1602 has an extended edge 1606 that is substantially C-shaped. Additionally, the cover 1602 is symmetrical in the toe 114—heel 116 direction. In other examples, the cover 1602 may be asymmetrical in the toe 114—heel 116 direction as required or desired.

Figure 36:
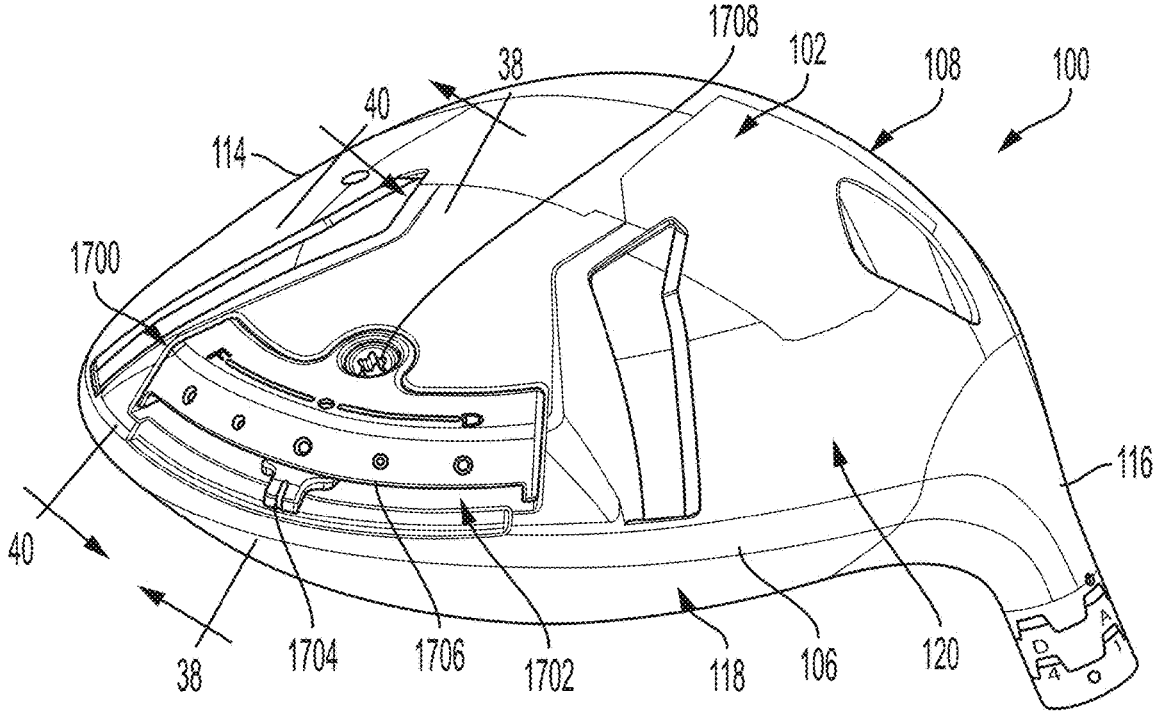
FIG. 36 is a perspective view of the sole of the golf club head with another weight assembly.
Figure 37:
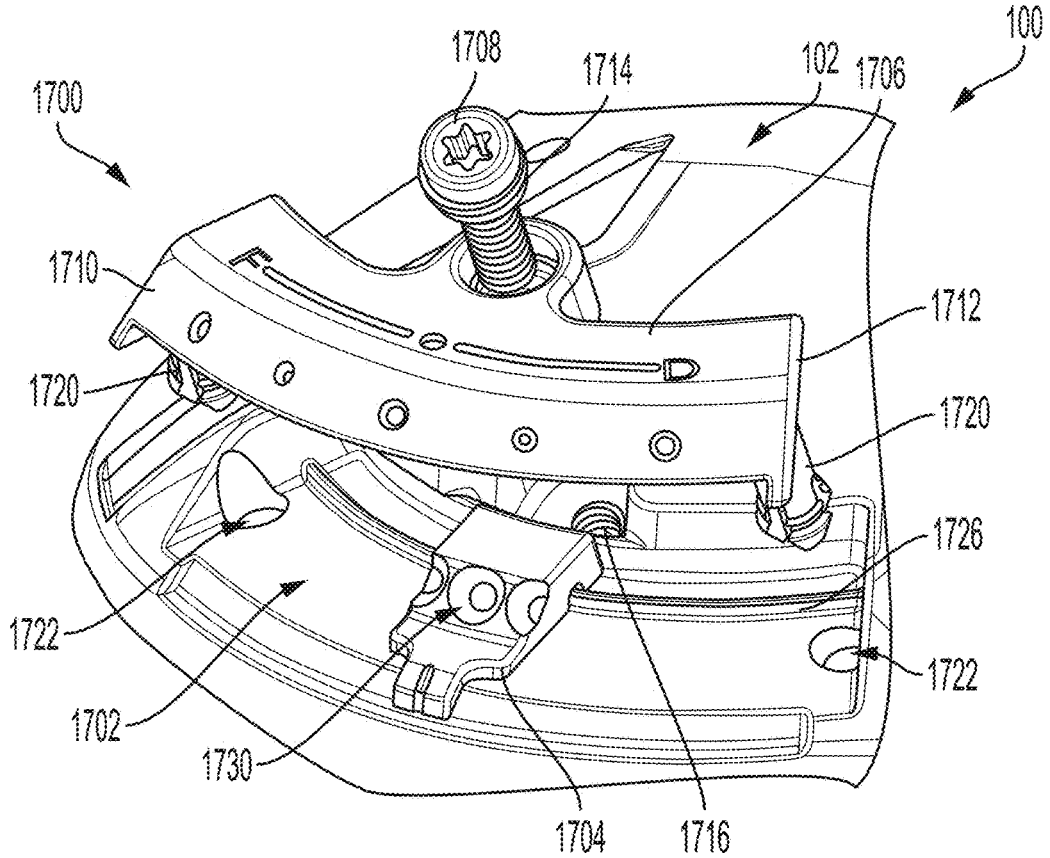
FIG. 37 is an exploded perspective view of the weight assembly shown in FIG. 36.

FIG. 36 is a perspective view of the sole 102 of the golf club head 100 with another weight assembly 1700. FIG. 37 is an exploded perspective view of the weight assembly 1700. Certain components are described above, and thus, are not necessarily described further. Referring concurrently to FIGS. 36 and 37, a recessed channel 1702 is defined within the sole 102 of the body 106 of the club head 100. The channel 1702 has a substantially curved shape in the toe 114—heel 116 direction so that the CG and the MOI of the club head 100 can be adjusted for fade-draw bias (e.g., the "F" and "D" indicia on a cover 1706 of the weight assembly 1700). In the example, the curve of the channel 1702 substantially corresponds to the rear outer perimeter of the body 106, where the sole 102 and the crown 118 are coupled together, and opposite of the striking face 108. The weight assembly 1700 includes a slidable weight 1704, a cover 1706, and a fastener 1708.

In this example, the cover 1706 is substantially U-shaped with a toe end 1710 and an opposite heel end 1712. The fastener 1708 is coupled to the cover 1706 by a lock washer 1714 (e.g., a retainer clip) and it is positioned on the inner concave side of the cover 1706 at approximately a midpoint between the ends 1710, 1712. The fastener 1708 is a threaded bolt that threadingly engages with a nut 1716 formed within the sole 102 of the body 106. The lock washer 1714 enables the cover 1706 to linearly move M (e.g., raise and lower) along a fastener axis 1718 (shown in FIG. 38) with respect to the recessed channel 1702 upon rotation of the fastener 1708. The fastener 1708 is offset from the recessed channel 1702 towards the front and the striking face 108 of the body 106. By offsetting the fastener 1708 from the recessed channel 1702, the length of the recessed channel 1702 can be extended in the toe-heel direction so that the weight 1704 can be positioned at a greater number of locations on the sole 102. Additionally, by positioning the fastener adjacent the inner concave side of the cover 1706, the weight 1704 is disposed closer to the outer perimeter of the body 106 so that the weight 1704 increases the adjustability of the CG and MOI of the club head 100.

Each end 1710, 1712 of the cover 1706 includes a projection 1720 extending therefrom. The projections 1720 are sized and shaped to be received within a corresponding chamber 1722 defined at the ends of the recessed channel 1702 and within the sole 102 of the body 106. The projection 1720 may be substantially cylindrical in shape and increases the engagement of the cover 1706 with the body 106 so that the weight 1704 is restricted from moving or rattling when secured within the recessed channel 1702 by the cover 1706. A projection axis 1724 of the projection 1720 (shown in FIG. 38) is substantially parallel to the fastener axis 1718 so as to facilitate guiding the movement of the cover 1706 relative to the recessed channel 1702.

In operation, the weight assembly 1700 is selectively moveable between at least three configurations to enable the CG and the MOI of the club head 100 to be adjustable. More specifically, in a first or locked configuration, the cover 1706 is at least partially disposed within the recessed channel 1702 so that the weight 1704 is secured within the channel 1702 and movement is restricted. This locked configuration is illustrated in FIG. 36. When the weight assembly 1700 is in the locked configuration, the projection 1720 is received at least partially within the chamber 1722 and engaged therewith. By engaging the cover 1706 to the body 106 at its ends 1710, 1712, when the weight 1704 is positioned away from the fastener 1708, the cover 1706 still enables securement of the weight 1704 within the channel 1702 and reduces or prevents movement of the weight 1704 in the locked configuration. The locked configuration is used when swinging the golf club head 100.

Figure 40:
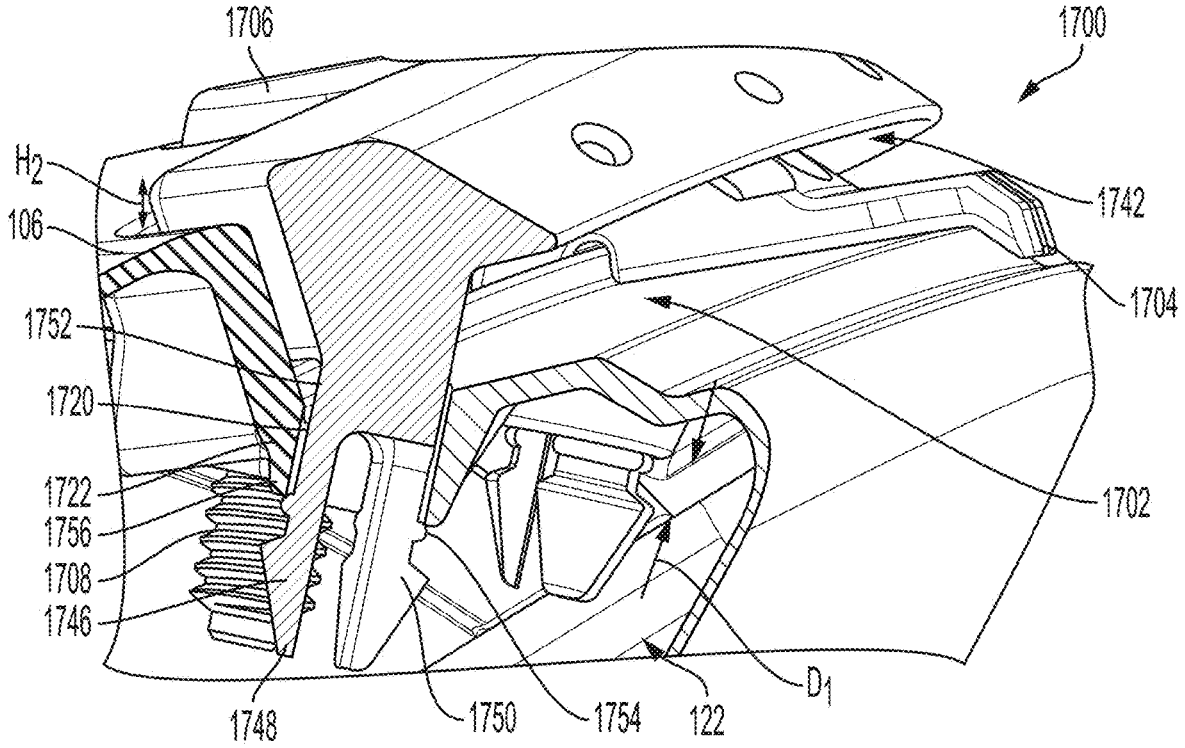
FIG. 40 is a cross-sectional view of the weight assembly taken along line 40-40 in FIG. 36 and in a weight sliding configuration.
Figure 41:
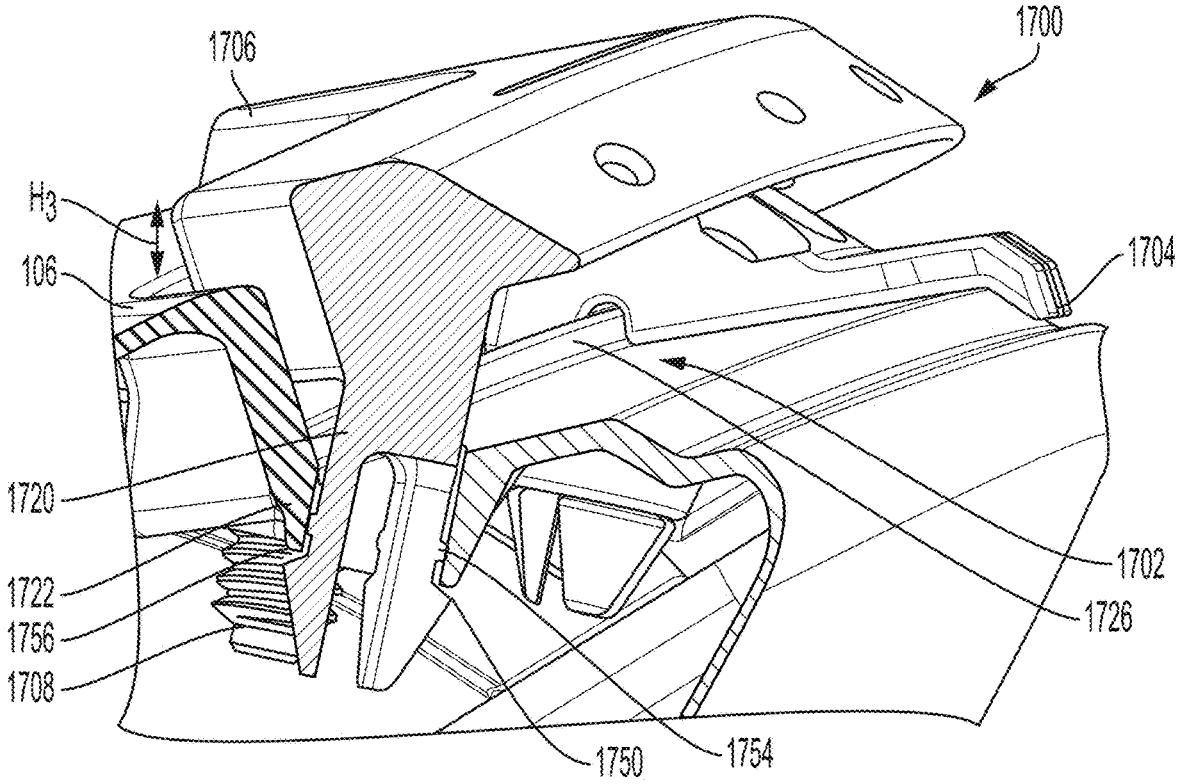
FIG. 41 is a cross-sectional view of the weight assembly taken along line 40-40 in FIG. 36 and in a weight removal configuration.

Additionally, the weight assembly 1700 can be positionable into at least two other configurations that enable the weight 1704 to be selectively slidable with the recessed channel 1702 and that enable the weight 1704 to be completely removable from the weight assembly 1700 and the club head 100. In a second or weight moving configuration, the cover 1706 is partially raised out of the recessed channel 1702 so that the position of the weight 1704 can be adjusted. However, the weight 1704 is still retained within the weight assembly 1700 and cannot be completely removed from the club head 100. This configuration is illustrated in FIG. 40 and described further below. In a third or weight removal configuration, the cover 1706 is positioned so that the weight 1704 can be completely removed, for example, so that a different weight (e.g., having a different mass) can be used with the club head 100 so as to adjust the swing weight. This configuration is illustrated in FIG. 41 and described further below. In each of the three configurations, however, the cover 1706 remains coupled to the body 106 so that the cover 1706 does not have to be completely removed. In some examples, however, the weight assembly 1700 may include a fourth configuration (not illustrated), whereby the cover 1706 is completely removable from the body 106 as required or desired.

A partial wall 1726 is disposed within the recessed channel 1702. The weight 1704 has a corresponding recess 1728 (shown in FIG. 38) so that the weight 1704 can slide along the partial wall 1726. The partial wall 1726 at least partially prevents the weight 1704 from being completely removed when the weight assembly 1700 is in the weight moving configuration. In some examples, the weight 1704 may include at least one locating feature 1730 (FIG. 37). The feature 1730 is sized and shaped to engage with one or more of a plurality of locating lugs 1732 (shown in FIG. 39) that extend from the cover 1706 when the weight assembly 1700 is in the locked configuration. The locating lugs 1732 and feature 1730 facilitate locating the weight 1704 at specific locations within the recessed channel 1702. In the example, the locating lugs 1732 are substantially frustoconical in shape and the locating features 1730 have a corresponding recessed shape. In other examples, the lugs 1732 and features 1730 can have any other shape and/or size that enable the cover 1706 and the weight 1704 to function as described herein.

Figure 38:
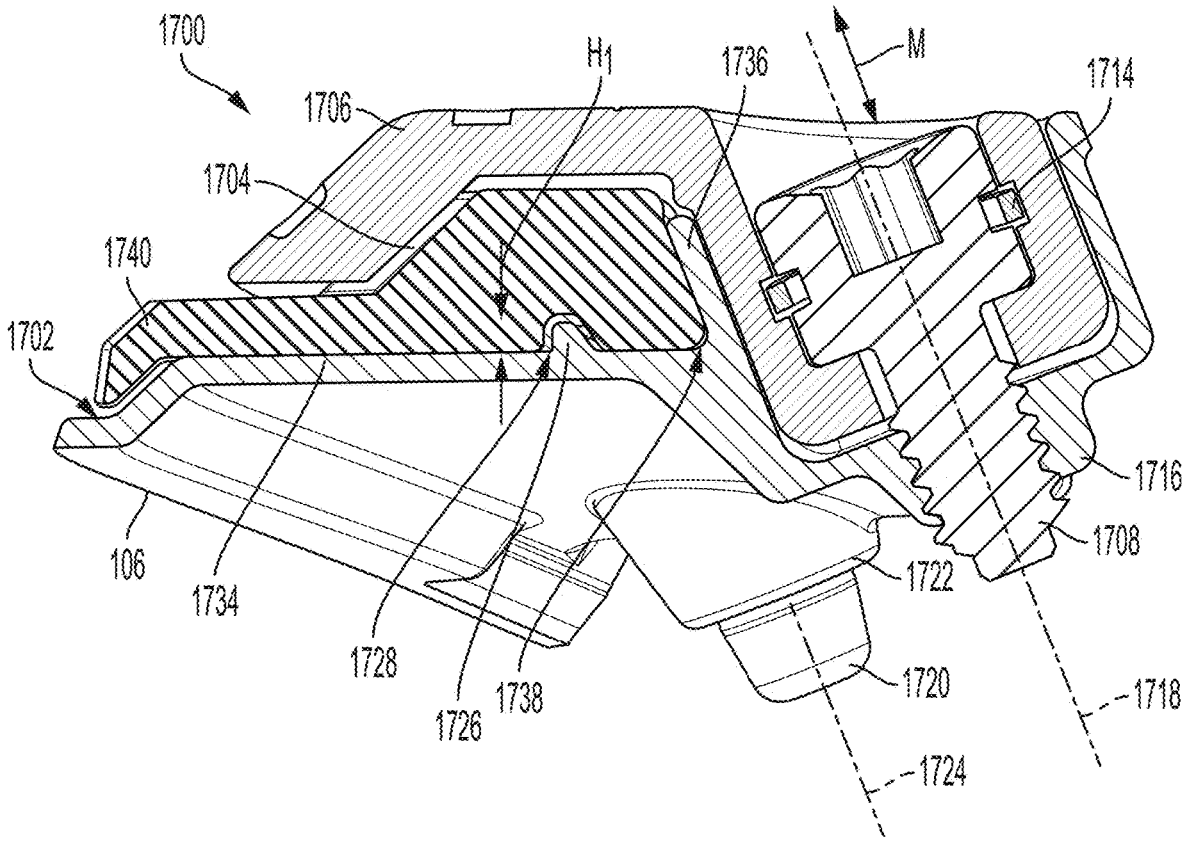
FIG. 38 is a cross-sectional view of the weight assembly taken along line 38-38 in FIG. 36.

FIG. 38 is a cross-sectional view of the weight assembly 1700 taken along line 38-38 in FIG. 36. Certain components are described above, and thus, are not necessarily described further. As described above, the weight 1704 is secured within the recessed channel 1702 by the cover 1706. The fastener 1708 positions and secures the cover 1706 to the body 106 of the golf club head, and thus, the fastener 1708 only retains the weight 1704 indirectly. In some examples, a washer (not shown) may be positioned on the fastener 1708 and between the body 106 and the cover 1706. The recessed channel 1702 is formed in cross-section by a bottom track wall 1734 and a side wall 1736 arranged in a substantially L-shape configuration with a corner 1738. In the example, the corner 1738 has an angle that is equal to or less than 90°. In another aspect, the corner 1738 has an angle that less than 90° so that the side wall 1736 is undercut. As such, when the weight assembly 1700 is in the locked configuration, the cover 1706 wedges the weight 1704 into the corner 1738 and against the side wall 1736 to frictionally secure the weight 1704 within the recessed channel 1702 and at least partially underneath the side wall 1736.

Adjacent to the corner 1738 and on the bottom track wall 1734, the partial wall 1726 extends in an upward direction and has a height $H_1$. The weight 1704 has a corresponding recess 1728 that receives at least a portion of the partial wall 1726. The partial wall 1726 at least partially contains the weight 1704 within the weight assembly 1700 when in the locked and weight sliding configurations. The weight 1704 also includes a tail 1740 that projects from the recessed channel 1702 and out from underneath the cover 1706. The tail 1740 of the weight 1704 provides structure for a user to grasp and slide the weight 1704 as required or desired. The tail 1740 is also visible on the outer surface of the club head so that its position is easily determined by visual inspection. In this example, the tail 1740 is at least partially corresponds to the shape of the bottom track wall 1734 of the recessed channel 1702. In other examples, the tail 1740 can have any other size and/or shape as required or desired.

Figure 39:
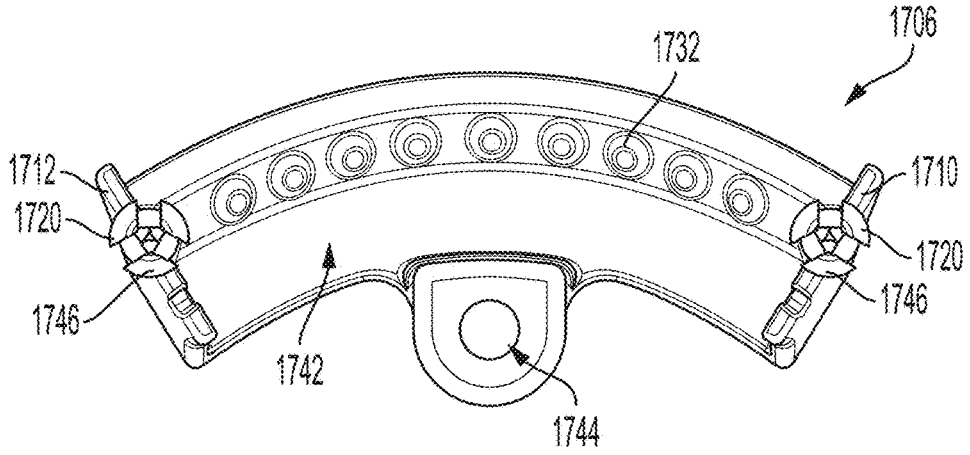
FIG. 39 is an inside surface view of a cover of the weight assembly shown in FIG. 36.

FIG. 39 is an inside surface 1742 view of the cover 1706 of the weight assembly 1700 (shown in FIGS. 36-38). The cover 1706 is substantially U-shaped with a concave side that receives the fastener at an aperture 1744. Proximate the convex side, the inside surface 1742 has the plurality of locating lugs 1732 that are configured to engage with the locating feature 1730 within the weight 1704 (shown in FIG. 37). When engaged (e.g., in the first, locked configuration), the cover 1706 wedges the weight in the corner of the recessed channel and against the side wall. However, when the cover 1706 raised out of the recessed channel, the locating lugs 1732 disengage from the weight so that the weight can be moved (e.g., in the weight sliding configuration) or so that the weight can be completely removed (e.g., in the weight removal configuration).

Each end 1710, 1712 of the cover 1706 includes the projection 1720 that, in addition to the fastener, secures the cover 1706 to the body of the club head. In the example, the projection 1720 engages with the chamber 1722 (shown in FIG. 37) in all three configurations (e.g., locked, weight moving, and weight removal) of the weight assembly. Furthermore, the projection 1720 also at least partially defines each of the three configurations. The projection 1720 is substantially cylindrical in shape and is configured to extend through the sole of the body and into the interior cavity of the club head via the chamber 1722. In the example, the projection 1720 includes a plurality of flexible arms 1746 circumferentially spaced to form the substantially cylindrical projection 1720. As illustrated, the projection 1720 includes three discrete flexible arms 1746. In other examples, the projection 1720 may include any other number of flexible arms 1746 (e.g., 2, 4, 5, etc.) as required or desired.

FIG. 40 is a cross-sectional view of the weight assembly 1700 taken along line 40-40 in FIG. 36 and in a weight sliding configuration. The projection 1720 has a distal end 1748 (relative to the inside surface 1742 of the cover 1706) that is formed as a tapered nose so that the cover 1706 can be press fit into the body 106 of the golf club head and extend all the way into the interior cavity 122 and through the chamber 1722. For example, the flexible arms 1746 can radially deflect so as to extend through the chamber 1722 and snap into place. This connection allows the cover 1706 to be secured to the body 106 and completely removed as required or desired. The cover 1706, however, does not need to be removed to adjust the weight 1704. The distal end 1748 includes at least one stop 1750 that extends radially outward on the projection 1720. In the example, the stop 1750 is formed as part of the tapered nose. The projection 1720 also has a proximal end 1752 (relative to the inside surface 1742 of the cover 1706) that is formed as a substantially cylindrical post. The proximal end 1752 frictionally engages with the chamber 1722 when the cover 1706 is in the locked configuration. This engagement facilitates the cover 1706 securing the weight 1704 within the recessed channel 1702 (in addition to the fastener). Additionally, at least one rib 1754 extends radially on the projection 1720. The rib 1754 is positioned between the distal end 1748 and the proximal end 1752, and offset a distance Di from the stop 1750.

To move the weight assembly 1700 from the locked configuration (shown in FIG. 36), when the cover 1706 secures the weight 1704 within the recessed channel 1702, to the weight moving configuration (shown in FIG. 40) that enables the weight 1704 to slide within the recessed channel 1702, the threaded fastener 1708 is rotated so that the cover 1706 raises out of the recessed channel 1702. When the rib 1754 engages with an end wall 1756 of the chamber 1722, further movement of the cover 1706 is restricted and the cover 1706 is raised to a height $H_2$ relative to the body 106 of the club head. As such, the cover 1706 indicates that the weight assembly 1700 is in the weight moving configuration. To move the weight assembly 1700 past the weight moving configuration to the weight removal position, additional force can be induced into the weight assembly 1700 (e.g., via rotation of the fastener 1708) to overcome the engagement between the rib 1754 and the chamber 1722 until the flexible arm 1746 flexes and the cover 1706 can further raise out of the recessed channel 1702.

FIG. 41 is a cross-sectional view of the weight assembly 1700 taken along line 40-40 in FIG. 36 and in a weight removal configuration. Once the engagement of the rib 1754 and the end wall 1756 is forcefully overcome (e.g., via rotation of the fastener 1708 driving movement of the cover 1706), the weight assembly 1700 can move from the weight moving configuration (shown in FIG. 40) to the weight removal configuration. In the weight removal configuration, the weight 1704 can be completely removed from the recessed channel 1702 because the cover 1706 is raised even further out of the recessed channel 1702. When the stop 1750 engages with the end wall 1756 of the chamber 1722, further movement of the cover 1706 is restricted and the cover 1706 is raised to a height $H_3$. The height $H_3$ is greater than the height $H_2$ of the prior weight sliding configuration (shown in FIG. 40). As such, the cover 1706 indicates that the weight assembly 1700 is in the weight removal configuration and the weight 1704 can be completely removed. In some examples, the weight assembly 1700 can be moved past the weight removal configuration and allow the cover 1706 to be completely removed. If this is the case, additional force is induced into the weight assembly 1700 to overcome the engagement between the stop 1750 and the chamber 1722 until the flexible arm 1746 flexes and the cover 1706 can be completely removed. In the example, the stop 1750 is radially larger than the rib 1754, so that the force required to completely remove the cover 1706 is greater than the force required to move between the weight moving configuration and the weight removal configuration.

Because the rib 1754 at least partially defines the weight moving configuration and the stop 1750 at least partially defines the weight removal configuration, the distance Di (shown in FIG. 40) between the rib 1754 and the stop 1750 defines the height that the cover 1706 rises between the two different configurations $H_2$ and $H_3$. In an aspect, the distance Di may be about five millimeters. Additionally, in an example, the distance Di may be at least equal to the height $H_1$ of the partial wall 1726 (shown in FIGS. 37 and 38), so that in the weight removal configuration, the weight 1704 can be lifted off of the partial wall 1726 and removed from the weight assembly 1700. In other examples, either the rib 1754 or the stop 1750 may be completely removed from the cover 1706 so that the cover 1706 moves between only two configurations as required or desired.

Figure 42:
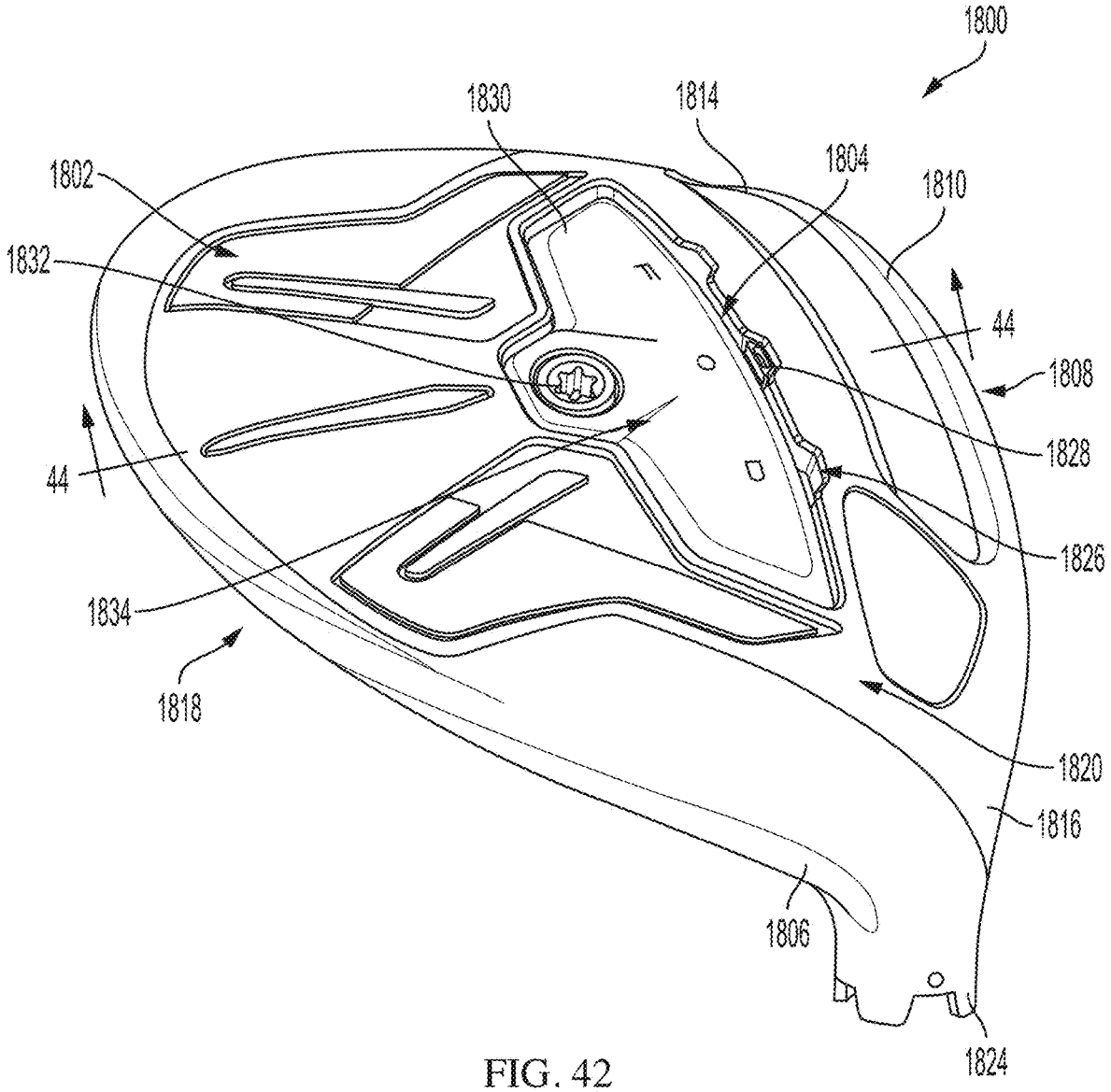
FIG. 42 is a perspective view of a sole of another golf club head with another weight assembly in a locked configuration.

FIG. 42 is a perspective view of a sole 1802 of another golf club head 1800 with another weight assembly 1804 in a locked configuration. The golf club head 1800 is a fairway-metal type golf club head having a body 1806 that includes a striking face 1808 with a lower edge 1810 and an upper edge 1812 (shown in FIG. 43), each extending between a toe 1814 and a heel 1816. The sole 1802 extends from the lower edge 1810 on the bottom side of the club head 1800 and a crown 1818 extends from the upper edge 1812 on the top of the club head 1800. The sole 1802, the striking face 1808, and the crown 1818 are coupled together so as to define an outer surface 1820 of the body 1806 with an interior cavity 1822 (shown in FIG. 44) formed within. A hosel 1824 is disposed at the heel 1816 and is configured to couple to a shaft (not shown). The functions of the components (e.g., sole, striking face, crown, hosel, etc.) of the fairway-metal type club head 1800 are similar to the component functions described above in the metalwood-type golf club head examples of FIGS. 1-41. However, fairway-metal type golf club heads 1800 may strike golf balls directly off the ground surface, thereby requiring or desiring a substantially smooth outer surface 1820 of the sole 1802 without any protruding portions. As illustrated in FIG. 42, the club head 1800 is a fairway-metal type club head, however, the body 1806 may form any type club head, such as an iron-type club head, hybrid-type club head, or metalwood-type club head (e.g., examples illustrated in FIGS. 1-41), as required or desired. Furthermore, the features of the weight assembly 1804 described below can additionally or alternatively be utilized in any type club head described herein as required or desired.

In this example, a recessed channel 1826 is defined within the sole 1802 of the body 1806 of the club head 1800. The channel 1826 extends in the toe 1814—heel 1816 direction so that the CG and the MOI of the club head 1800 can be adjusted for fade-draw bias (e.g., the "F" and "D" indicia on a cover 1830 of the weight assembly 1804). The weight assembly 1804 includes a slidable weight 1828 disposed at least partially within the channel 1826, a cover 1830 that extends at least partially over the channel 1826, and a fastener 1832 configured to couple the cover 1830 to the body 1806. The fastener 1832 retains the weight 1828 in the recessed channel 1826 indirectly via the cover 1830 so that the weight 1828 can be used to adjust the CG and the MOI of the club head 1800. In this example, the weight assembly 1804 and the recessed channel 1826 are located at a frontal section of the golf club head 1800. By "frontal section," it is meant that the weight 1828 is closer to the striking face 1808 than the rearmost outer perimeter of the body 1806, where the sole 1802 and the crown 1818 are coupled together farthest from the striking face 1808.

As illustrated in FIG. 42, the weight assembly 1804 is in a locked configuration with the cover 1830 at least partially disposed within the recessed channel 1826, and the weight 1828 secured within the channel 1826 and movement is restricted. When the cover 1830 and weight assembly 1804 are in the locked configuration, the weight 1828 is completely disposed within the channel 1826 and no portion of the weight 1828 extends above the outer surface 1820 of the body 1806. Additionally, the cover 1830 has an exterior surface 1834 that when the cover 1830 and weight assembly 1804 are in the locked configuration, the exterior surface 1834 of the cover 1830 aligns with the outer surface 1820 of the body 1806 and no portion of the cover 1830 extends above the outer surface 1820 of the body 1806. Because the weight assembly 1804 is completely disposed within the recessed channel 1826 and at least aligned with, or below, the outer surface 1820 of the body 1806, the smoothness of the outer surface 1820 of the club head 1800 is maintained so as to promote good ground interaction.

Figure 43:
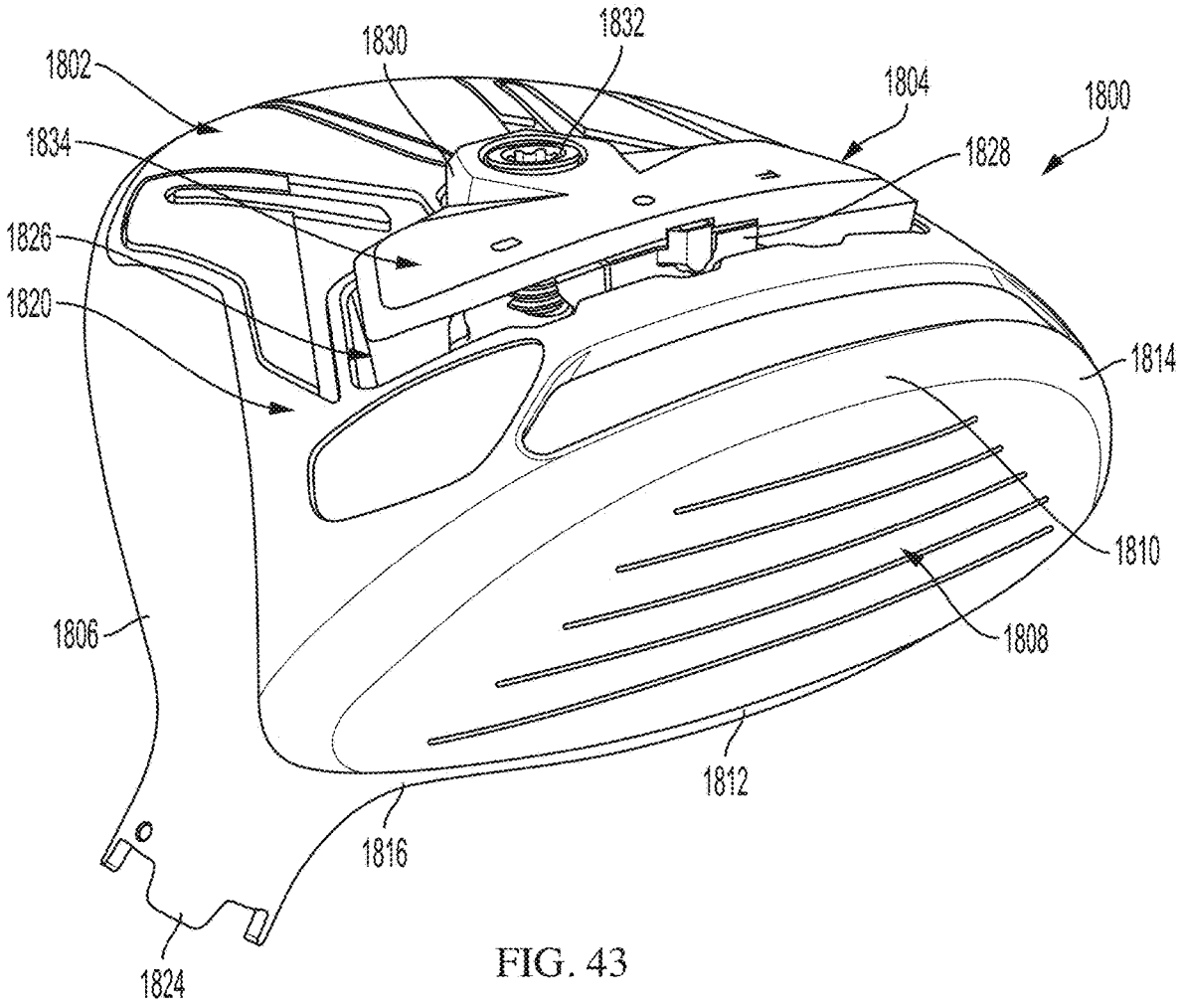
FIG. 43 is a perspective view of the sole of the golf club head with the weight assembly shown in FIG. 42 in an unlocked configuration.

FIG. 43 is a perspective view of the sole 1802 of the golf club head 1800 with the weight assembly 1804 in an unlocked configuration. Certain components are described above, and thus, are not necessarily described further. Via rotation of the fastener 1832, the cover 1830 can be raised at least partially out of the recessed channel 1826 and into the unlocked configuration. In the unlocked configuration, the weight 1828 is selectively slidable within the channel 1826 so as to adjust the CG and the MOI as required or desired. In this example, the weight 1828 is engaged with the cover 1830 so that the weight 1828 moves with the cover 1830 between the unlocked configuration and the locked configuration and raises at least partially out of the recessed channel 1826 when in the unlocked configuration. It should be appreciated, that while FIGS. 42 and 43 illustrate and describe the weight assembly 1804 in two different configurations, a locked configuration and an unlocked configuration, the weight assembly 1804 could be moveable between more than two configurations as required or desired. For example, the weight assembly 1804 can move between at least three configurations, a locked configuration, a weight moving configuration, and a weight removal configuration, as described above in reference to FIGS. 36-41.

Figure 44:
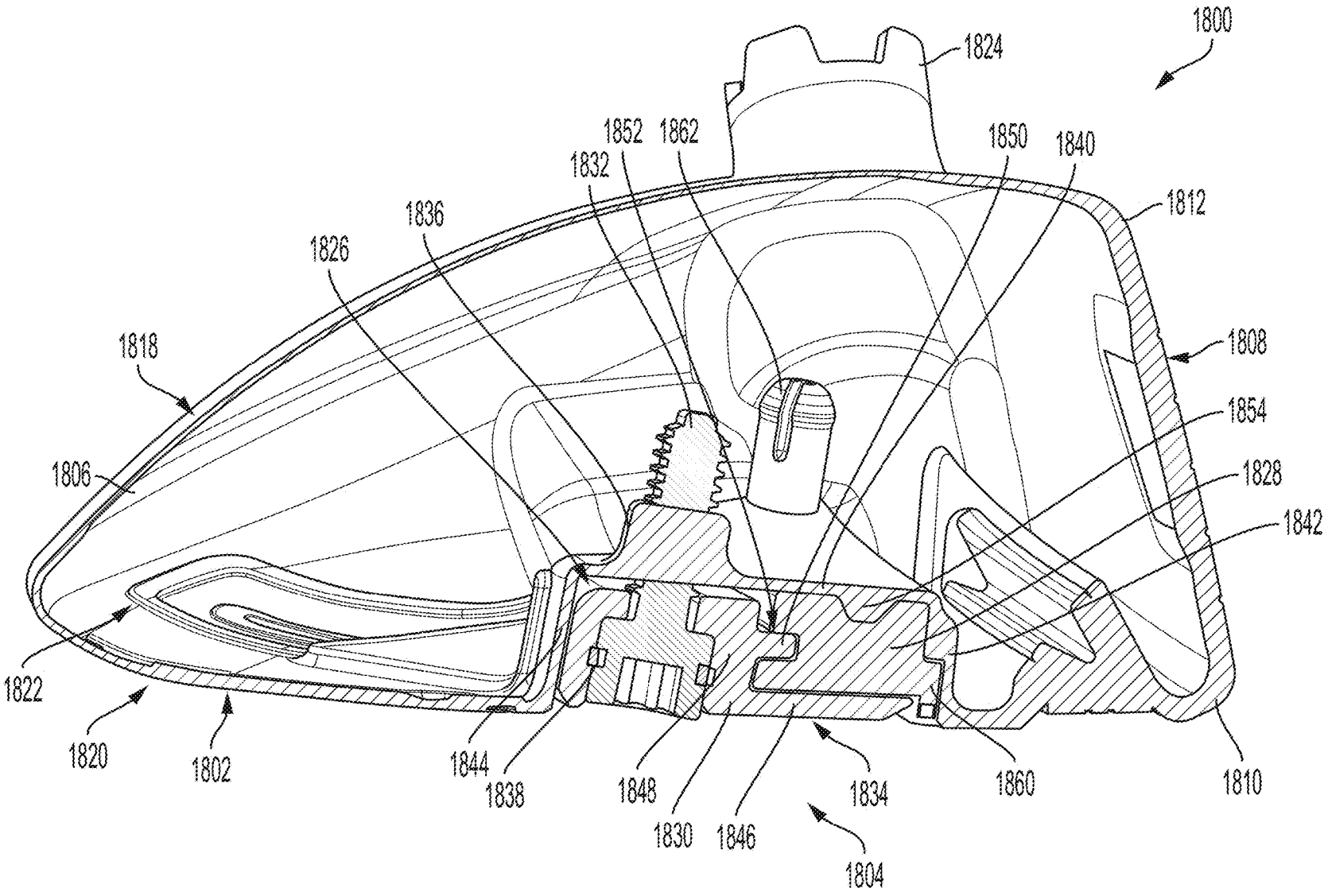
FIG. 44 is a cross-sectional view of the golf club head with the weight assembly taken along line 44-44 in FIG. 42.
Figure 45:
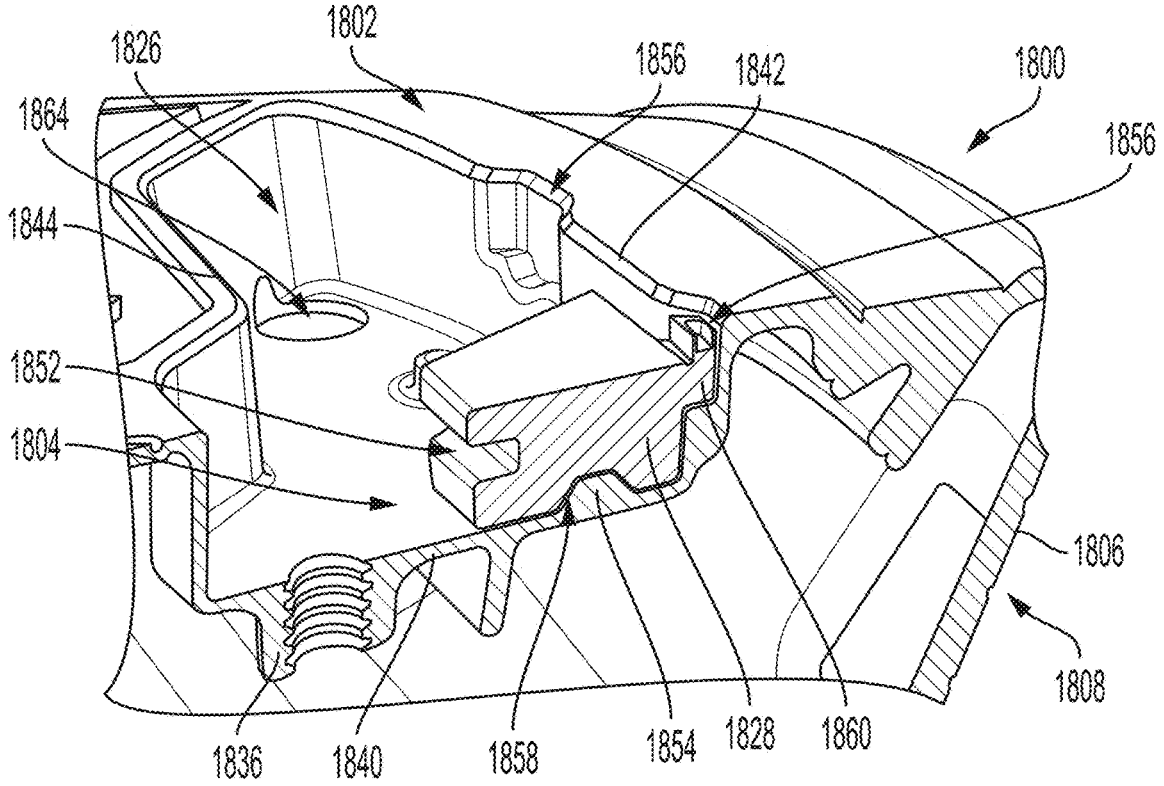
FIG. 45 is a partial perspective cross-sectional view of the weight assembly taken along line 44-44 in FIG. 42.

FIG. 44 is a cross-sectional view of the golf club head 1800 with the weight assembly 1804 taken along line 44-44 in FIG. 42. FIG. 45 is a partial perspective cross-sectional view of the weight assembly 1804 taken along line 44-44 in FIG. 42. Referring concurrently to FIGS. 44 and 45, certain components are described above, and thus, are not necessarily described further. The fastener 1832 is a threaded bolt that threadingly engages with a nut 1836 formed within the sole 1802 of the body 1806. The fastener 1832 is coupled to the cover 1830 by a lock washer 1838 so that linear movement (e.g., via rotation of the fastener 1832) is transferred to the cover 1830 and the cover 1830 can move in and out of the recessed channel 1826 as described herein.

In this example, the channel 1826 is defined by a bottom track 1840 and two opposing sidewalls 1842, 1844. A first sidewall 1842 is adjacent the striking face 1808 and a second sidewall 1844 is adjacent to the rear of the sole 1802. The cover 1830 is substantially L-shaped with a long leg 1846 and a short leg 1848. The short leg 1848 includes a portion that couples to the fastener 1832 and both the short leg 1848 and the fastener 1832 are positioned adjacent the second sidewall 1844. The short leg 1848 also includes a flange 1850. The weight 1828 includes a groove 1852 that is sized and shaped to receive the flange 1850. The weight 1828 is slidably engaged with the cover 1830 and with the flange 1850 received at least partially within the groove 1852. This engagement between the cover 1830 and the weight 1828 enables the weight 1828 to move (e.g., raise out and lower back into the channel 1826) with the cover 1830 between the locked configuration (shown in FIG. 42) and the unlocked configuration (shown in FIG. 43), while also enabling the weight 1828 to slide relative to the cover 1830 in the toe-heel direction when the weight assembly is in the unlocked configuration. When the cover 1830 is in the locked configuration, the long leg 1846 also substantially covers the weight 1828 so as to increase the smoothness of the outer surface 1820 of the club head 1800.

The bottom track 1840 includes a plurality of bosses 1854 extending into the channel 1826. In this example, there are three bosses 1854, each which corresponds respectively to a fade bias position of the weight 1828, a draw bias position of the weight 1828, and a center-neutral position of the weight 1828. Additionally, the first sidewall 1842 includes a plurality of dimples 1856 that correspond to the plurality of bosses 1854. The weight 1828 includes a hollow 1858 that is sized and shaped to receive the boss 1854 and a position indicator 1860 that is sized and shaped to be received within the dimple 1856. In operation, when the weight assembly 1804 is in the unlocked configuration (shown in FIG. 43), the weight 1828 is raised above the bosses 1854 so that it can be selectively moved between the bosses 1854 and the dimples 1856 of the channel 1826. Once the weight 1828 is positioned, the weight assembly 1804 can be moved to the locked configuration (shown in FIG. 42) and the selected boss 1854 is received at least partially within the hollow 1858 of the weight 1828, and the position indicator 1860 is received at least partially within the selected dimple 1856.

In this example, at least a portion of the position indicator 1860 of the weight 1828 is visible on the outer surface 1820 of the club head 1800, when the weight assembly 1804 is in the locked configuration. This allows the user to easily visually verify the position of the weight 1828 on the club head 1800. It should be appreciated that while three bosses 1854 and dimples 1856 are illustrated and described, any other number of bosses and dimples locating features may be provided to define the position of the weight 1828 within the recessed channel 1826. For example, five sets of bosses and dimples may be provided. Additionally, the position indicator 1860 has a cutout so that when the cover 1830 is raised to the unlocked configuration (shown in FIG. 43), the position indicator 1860 can slide completely out of the dimple 1856 and move above the first sidewall 1842 to adjust the position of the weight 1828.

The cover 1830 can also include one or more projections 1862 that are sized and shaped to be received within a corresponding chamber 1864 of the recessed channel 1826. The projections 1862 are configured to increase the engagement of the cover 1830 with the body 1806 so that the weight 1828 is restricted from moving or rattling when secured within the recessed channel 1826 by the cover 1830. In some examples, the projections 1862 may be similar to the projections described above in reference to FIGS. 36-41 and include one or more flexible arms, a tapered nose, a stop, and at least one rib.

Figure 46:
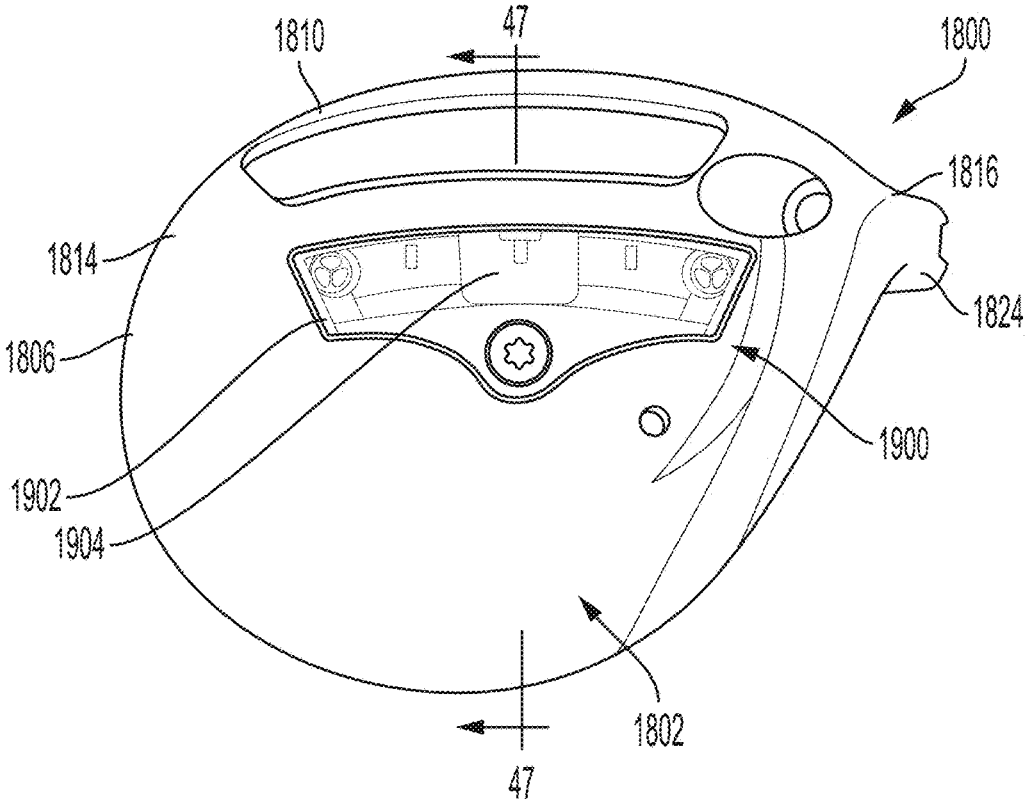
FIG. 46 is a bottom view of the golf club head with another weight assembly.
Figure 47:
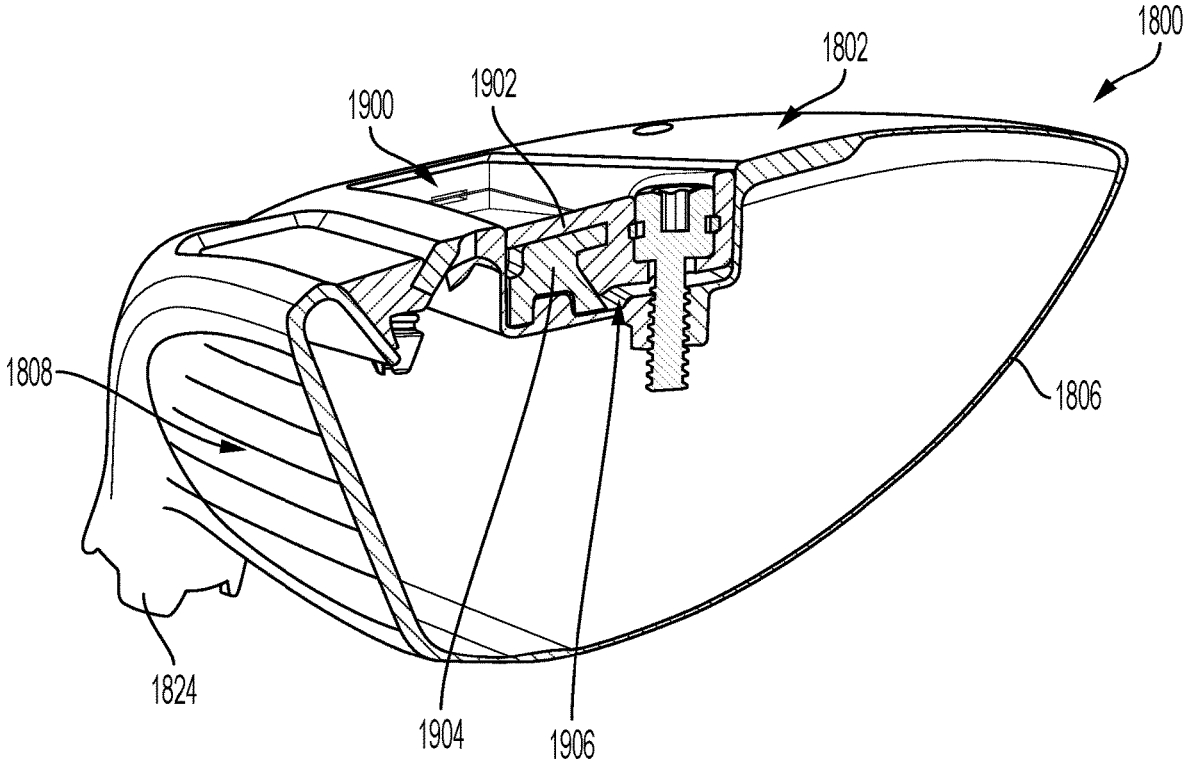
FIG. 47 is a perspective cross-section view of the golf club head with weight assembly taken along line 47-47 in FIG. 46.

FIG. 46 is a bottom view of the golf club head 1800 with another weight assembly 1900. FIG. 47 is a perspective cross-section view of the golf club head 1800 with the weight assembly 1900 taken along line 47-47 in FIG. 46. Referring concurrently to FIGS. 46 and 47, certain components are described above, and thus, are not necessarily described further. Similar to the example described in FIGS. 42-45, the weight assembly 1900 includes a cover 1902 that selectively secures a slidable weight 1904 within a recessed channel 1906. The weight 1904 is engaged with the cover 1902 so that the weight 1904 moves with the cover 1902 between two or more configurations. In this example, however, the cover 1902 completely covers the weight 1904 within the channel 1906, when the cover 1902 is in a locked configuration. The cover 1902 can be formed from an at least partially transparent material so that the position of the weight 1904 is visible to the user.

Figure 48:
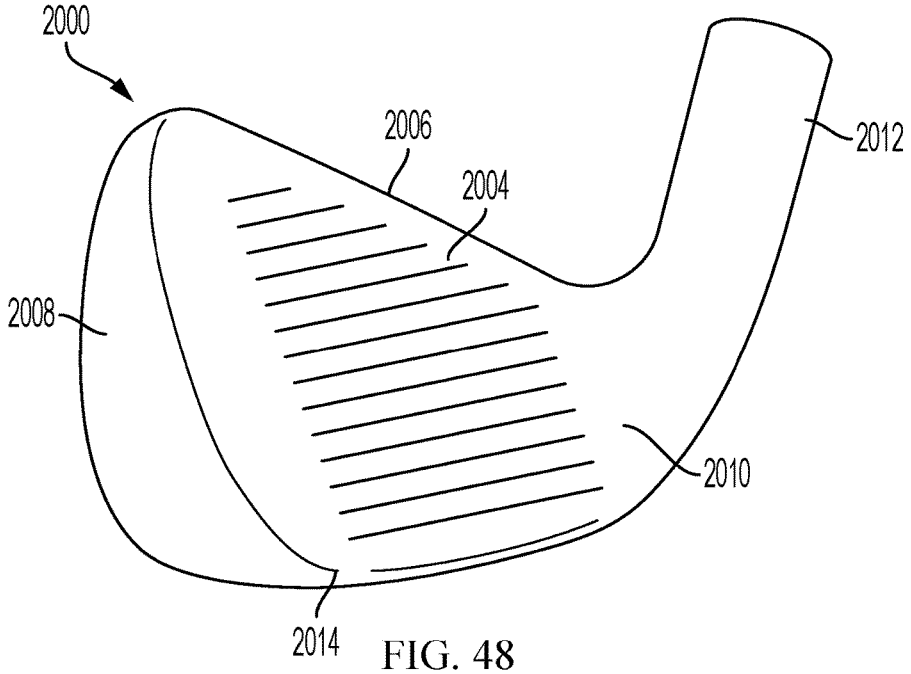
FIG. 48 is a perspective view of another golf club head.
Figure 49:
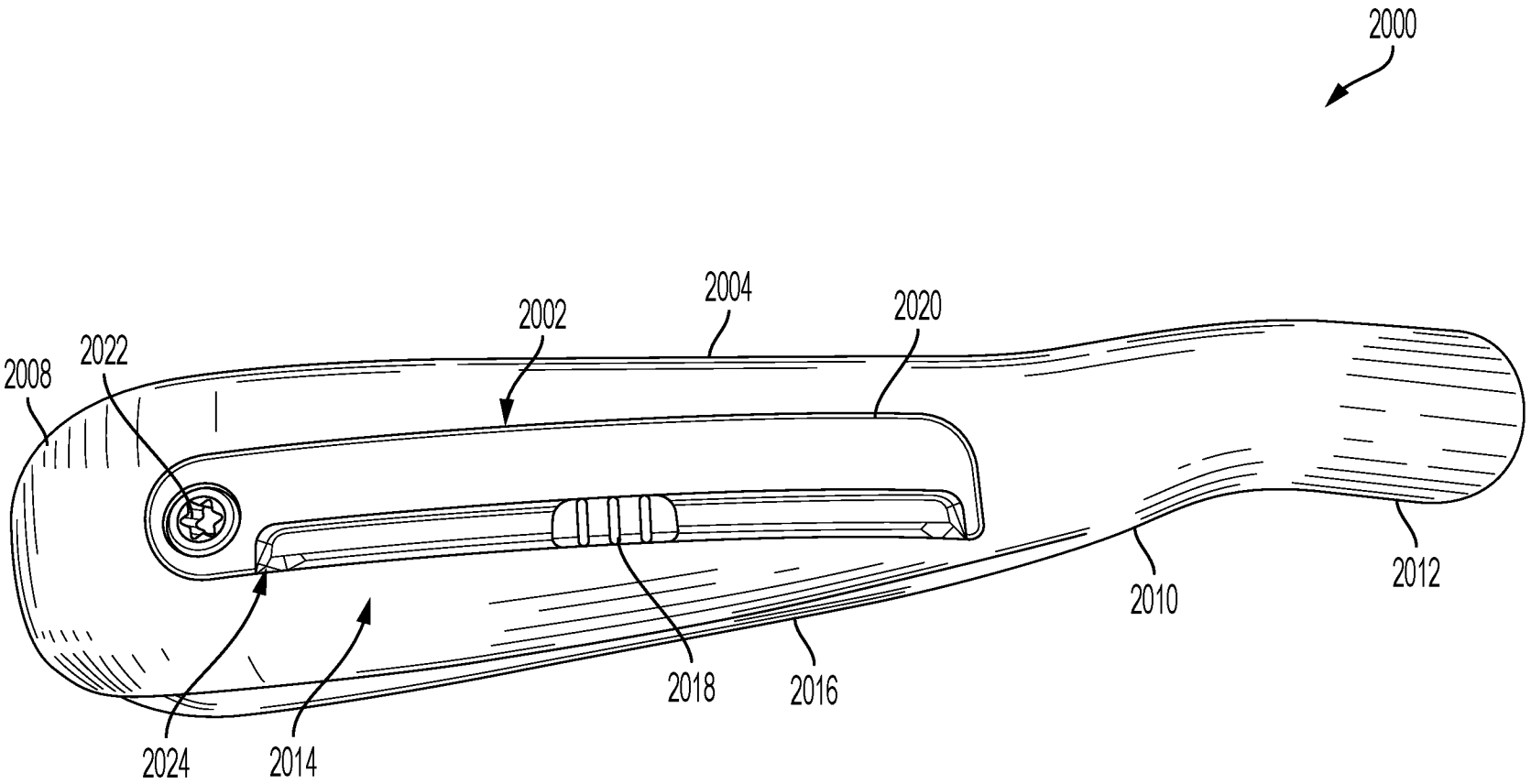
FIG. 49 is a bottom view of the club head shown in FIG. 48 with another weight assembly.

FIG. 48 is a perspective view of another golf club head 2000. FIG. 49 is a bottom view of the club head 2000 with another weight assembly 2002. Referring concurrently to FIGS. 48 and 49, the golf club head 2000 is an iron-type golf club head that includes a striking face 2004 configured to strike a golf ball. The striking face 2004 is connected to a top line portion 2006, a toe portion 2008, and a heel portion 2010. The toe portion 2008 and the heel portion 2010 are also at least in part connected to the top line portion 2006. The heel portion 2010 is connected to a hosel 2012 that is configured to couple to a shaft (not shown). The striking face 2004 is also connected to a sole 2014. The golf club head 2000 also includes a back portion 2016 that is attached at least partially to the sole 2014, the top line portion 2006, the toe portion 2008, and the heel portion 2010.

The components of the golf club head 2000, such as the striking face 2004, the top line portion 2006, the toe portion 2008, the heel portion 2010, and the back portion 2016 may be of a metallic material, such as a steel. The components of the golf club head 2000 may be formed through a casting process. Some of the components may be cast as a single piece and the remainder of the components may be attached subsequent to the casting process. For instance, the sole 2014, the top line portion 2006, the toe portion 2008, the heel portion 2010, and the back portion 2016 may be cast as a single piece. The striking face 2004 may then be attached to that single piece via welding or any other suitable process for attaching two club head components to one another. In such an example, the striking face 2004 may be an insert.

In operation, the sole 2014 generally provides the lower surface of the club head 2000 when the club head 2000 is placed in an address position. The club head 2000 defines a center of gravity (CG) and a moment of inertia (MOI) that impact flight characteristics of the golf ball when hit with the striking face 2004. The weight assembly 2002 is coupled to the club head 2000 such that the CG and/or the MOI of the club head 2000 can be selectively adjusted as required or desired. In this example, the weight assembly 2002 includes a movable weight 2018, a cover 2020 configured to secure the weight 2018 in place, and a fastener 2022 for coupling the weight assembly 2002 to one or more portions of the club head 2000. A recessed elongated channel 2024 is formed in the sole 2014 of the club head 2000 and is sized and shaped to receive at least a portion of the weight 2018. Similar to the examples described above, the fastener 2022 is adapted to retain the weight 2018 in the channel 2024 only indirectly by the cover 2020. Additionally, the cover 2020 can be loosened or completely removed, via the fastener 2022, to enable the weight 2018 to slide within the channel 2024 and selectively adjust the CG and the MOI as required or desired.

In this example, the fastener 2022 is positioned at the toe end of the weight assembly 2002 and aligned with the channel 2024. In other examples, the fastener 2022 may be positioned at the heel end of the weight assembly 2002 as required or desired.

Figure 50:
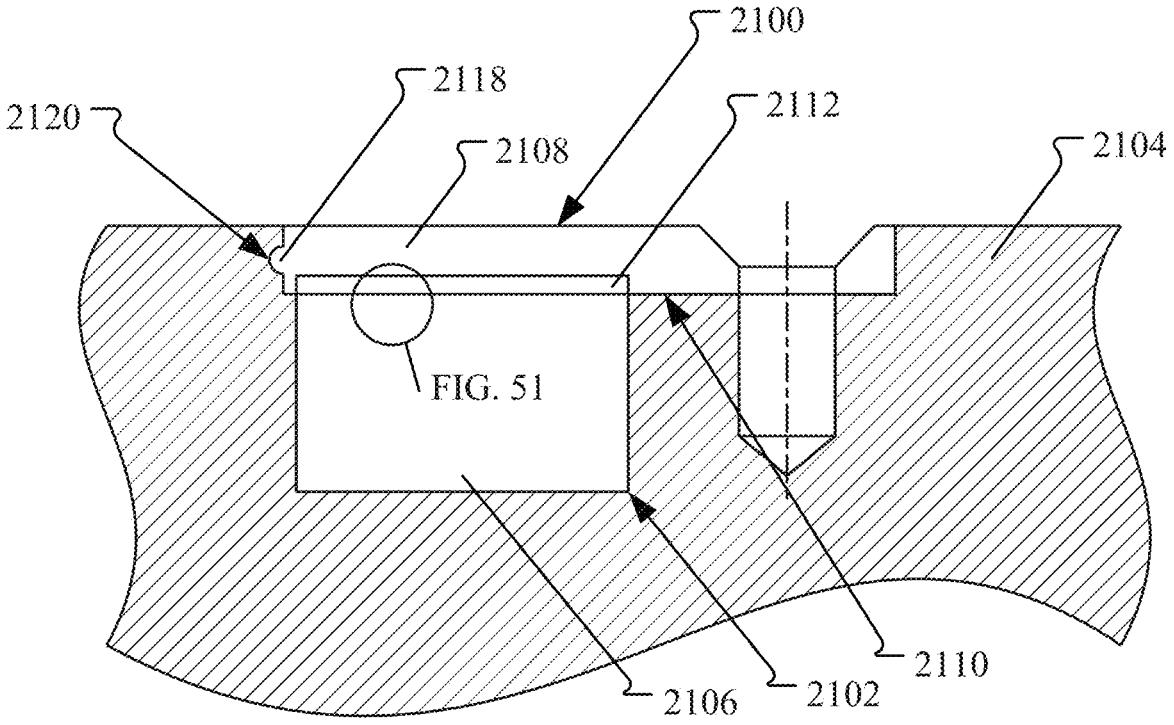
FIG. 50 is a cross-section view of another weight assembly.
Figure 51:
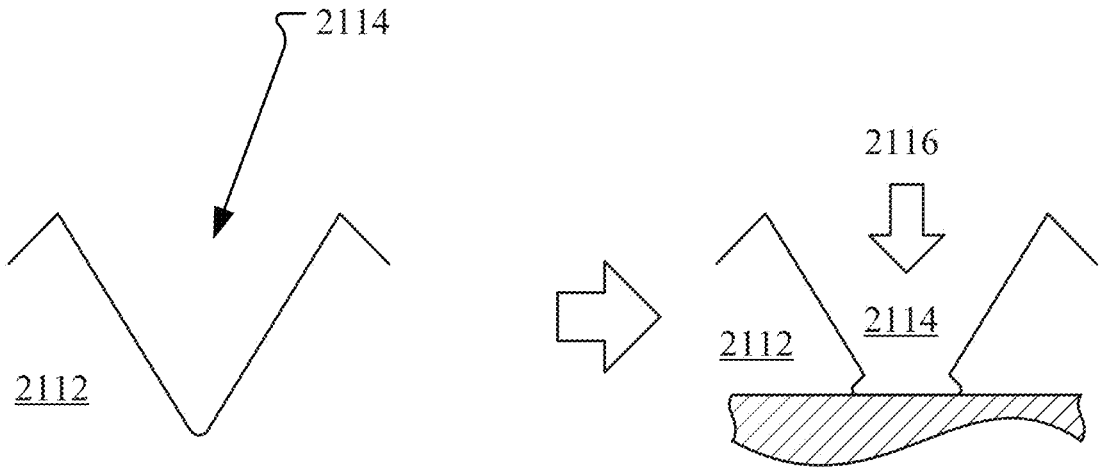
FIG. 51 is a schematic view of the weight assembly shown in FIG. 50.

FIG. 50 is a cross-section view of another weight assembly 2100. FIG. 51 is a schematic view of the weight assembly 2100. Referring concurrently to FIGS. 50 and 51, a recessed channel 2102 is defined within a body 2104 of a club head (e.g., club heads 100, 1800, and/or 2000 described above). The weight assembly 2100 includes a slidable weight 2106 and a cover 2108. A fastener (not shown) is used to retain the weight 2106 within the channel 2102. In this example, the cover 2108 includes an inside surface 2110 that engages with at least a portion of the weight 2106, when the weight 2106 is secured within the channel 2102. In this example, at least a portion of the inside surface 2110 of the cover 2108 includes a friction material liner 2112. The friction material 2112 is configured to frictionally engage with the weight 2106 when the cover 2108 is in a locked configuration. By frictionally engaging the weight 2106 with the cover 2108, the weight 2106 is secured within the channel 2102 while reducing or preventing the weight 2106 from rattling therein. In the example, the friction material can be a soft metal material, such as brass.

The friction material 2112 may include a plurality of grooves 2114 on the mating surface with the weight 2106. In this example, the grooves 2114 may be triangular in shape, although, other shapes are also contemplated herein. When a clamp load 2116 is applied to the friction material 2112, the material yields to hold the weight 2106 in place (as shown in FIG. 51) and match the particular surface combination of the channel 2102, weight 2106, and cover 2108. Once the deformation takes place and contact stress is established, the friction material 2112 will not deform further. By frictionally engaging the weight 2106 with the cover 2108, the weight 2106 can be positioned at any location within the channel 2102 and indexing features do not need to be included. Additionally, by removing the indexing features, the weight 2106 and channel 2102 have more substantially flat surfaces, which increases manufacturing efficiencies.

In this example, the cover 2108 may also include one or more protruding notches 2118 that engage with a corresponding cavities 2120 within the body 2104. The notches 2118 may be substantially circular in shape. The notches 2118 and cavities 2120 are described further below in reference to FIGS. 52 and 53. It should be appreciated that while the friction material 2112 is illustrated as being coupled to the cover 2108, the friction material 2112 can additionally or alternatively be coupled to the weight 2106.

Figure 52:
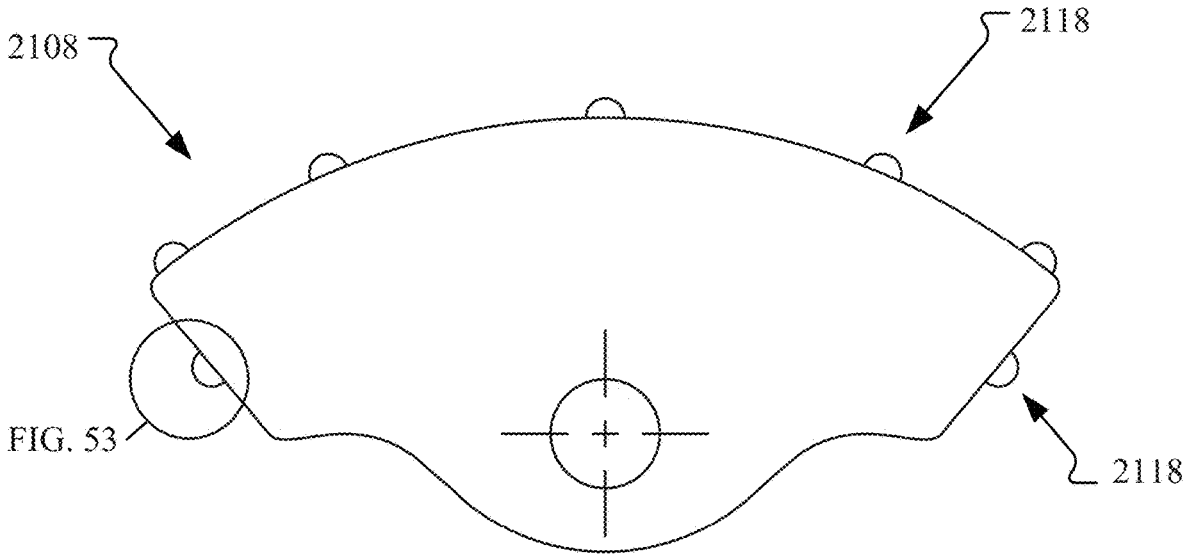
FIG. 52 is a top view of a cover of the weight assembly shown in FIG. 50.
Figure 53:
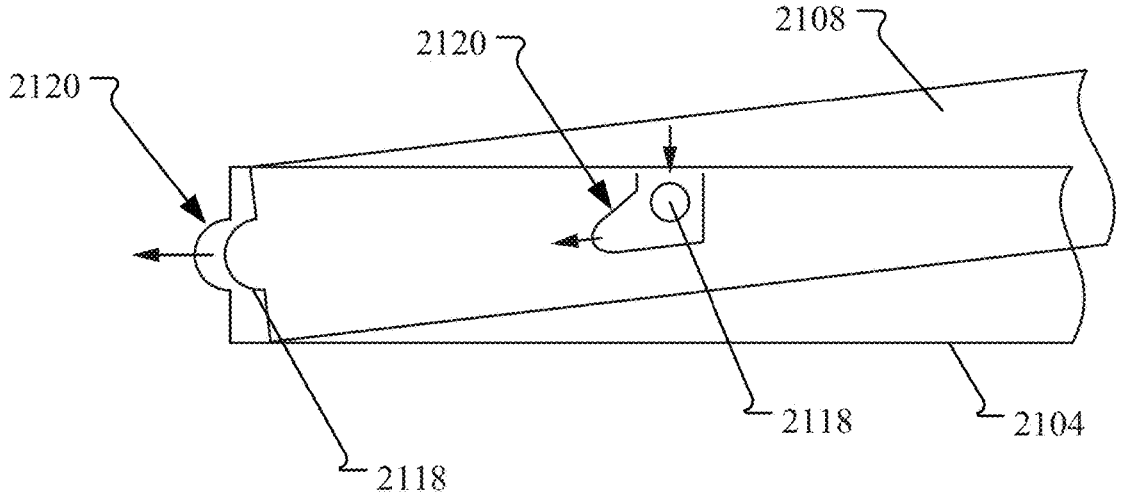
FIG. 53 is a side view of the cover of the weight assembly shown in FIG. 50.

FIG. 52 is a top view of the cover 2108 of the weight assembly 2100 (shown in FIG. 50). FIG. 53 is a side view of the cover 2108. Referring concurrently to FIGS. 52 and 53 certain components are described above, and thus, are not necessarily described further. The cover 2108 includes a plurality of protruding notches 2118 that engage with corresponding cavities 2120 within the body 2104. By engaging the cover 2108 at a plurality of locations, the cover 2108 is restricted or prevented from bowing out of alignment with the outer surface of the body 2104 when securing the weight. As illustrated in FIG. 53, the side cavities may be tapered so as to accept the cover 1206 sliding in at an angle.

Figure 54:
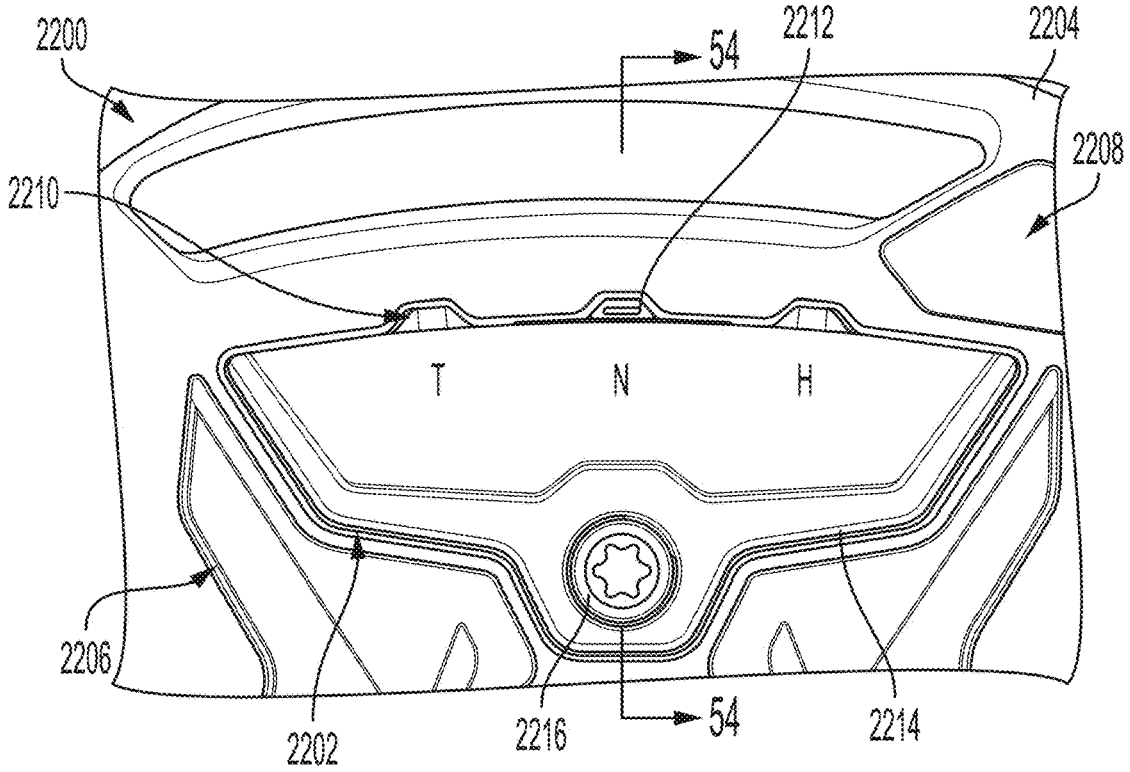
FIG. 54 is a bottom view of another golf club head with another weight assembly.

FIG. 54 is a bottom view of another golf club head 2200 with another weight assembly 2202 in a locked configuration. The golf club head 2200 includes a body 2204 having a sole 2206, and with the weight assembly 2202 disposed on the sole 2206. The body 2204 also includes a striking face and a crown (both not shown), such that the body 2204 has an outer surface 2208. In an aspect, the golf club head 2200 can be a fairway-metal type golf club head, however, the body 2204 can form any type club head, such as an iron-type club head, hybrid-type club head, or driver or other metal-wood type club head (e.g., one or more of the examples illustrated in FIGS. 1-53). Additionally, the functions of the components (e.g., sole, striking face, crown, hosel, etc.) of the club head 2200 are similar to the component functions described above in FIGS. 1-53. Furthermore, the features of the weight assembly 2202 described below can additionally or alternatively be utilized in any type club head described herein, and as required or desired.

In this example, a recessed channel 2210 is defined within the sole 2206 of the body 2204 of the club head 2200. The recessed channel 2210 extends in a toe-heel direction so that the CG and MOI of the club head 2200 can be adjusted (e.g., for fade-draw bias). The weight assembly 2202 includes a slidable weight 2212 disposed at least partially within the channel 2210, a cover 2214 that extends at least partially over the channel 2210, and a fastener 2216 configured to couple the cover 2214 to the body 2204. The fastener 2216 retains the weight 2212 in the recessed channel 2210 indirectly via the cover 2214 so that the weight 2212 can be used to adjust the CG and MOI of the club head 2200.

As illustrated in FIG. 54, the weight assembly 2202 is in a locked configuration with the cover 2214 at least partially disposed within the recessed channel 2210 and the weight 2212 secured within the channel 2210 so as to restrict movement. When the cover 2214 and the weight assembly 2202 are in the locked configuration, at least a portion of the weight 2212 is visible between the body 2204 and the cover 2214. This configuration enables the user to more easily determine the placement of the weight 2212 within the recessed channel 2210. The weight assembly 2202 can also be moved into an unlocked configuration as described herein. For example, via rotation of the fastener 2216, the cover 2214 can be raised at least partially out of the recessed channel 2210 and enable the weight 2212 to be repositioned.

In this example, the weight 2212 overlaps and engages with the cover 2214 so that both move together between the locked configuration and the unlocked configuration. Furthermore, this engagement is such that the weight 2212 is reduced or prevented from twisting and tilting relative to the cover 2214 when raising and lowering with respect to the recessed channel 2210. As such, the weight 2212 is prevented from binding within the recessed channel 2210 during weight adjustment, and thereby, increasing performance of the weight assembly 2202.

Figure 55:
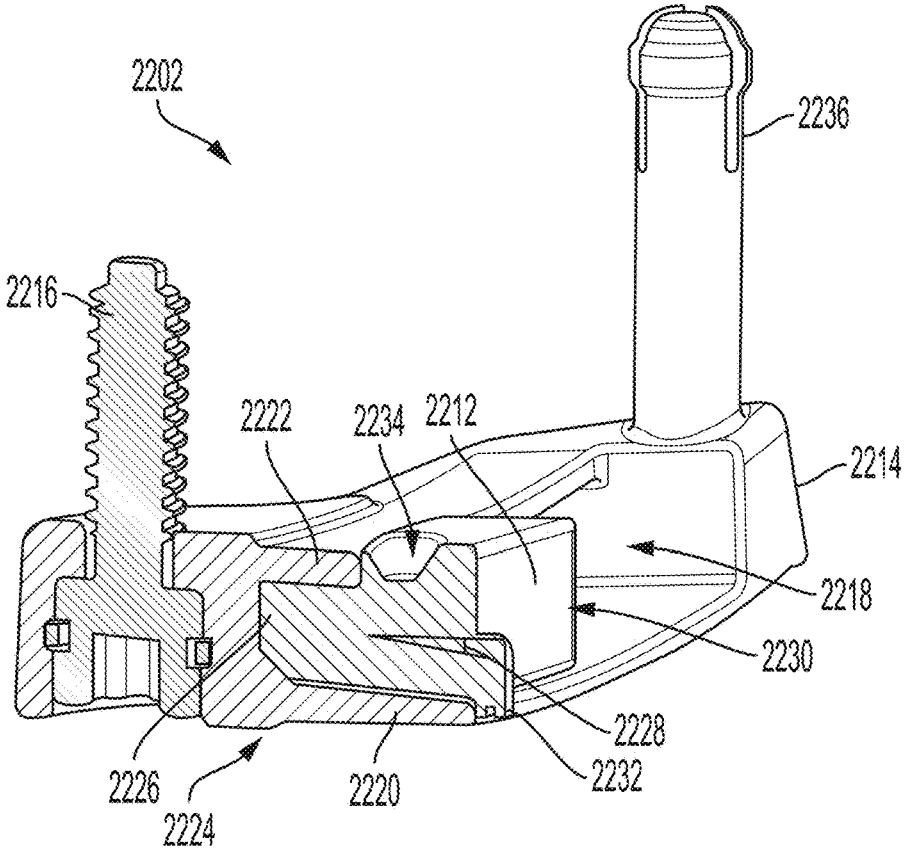
FIG. 55 is a perspective, cross-sectional, view of the weight assembly taken along line 54-54 in FIG. 54.
Figure 56:
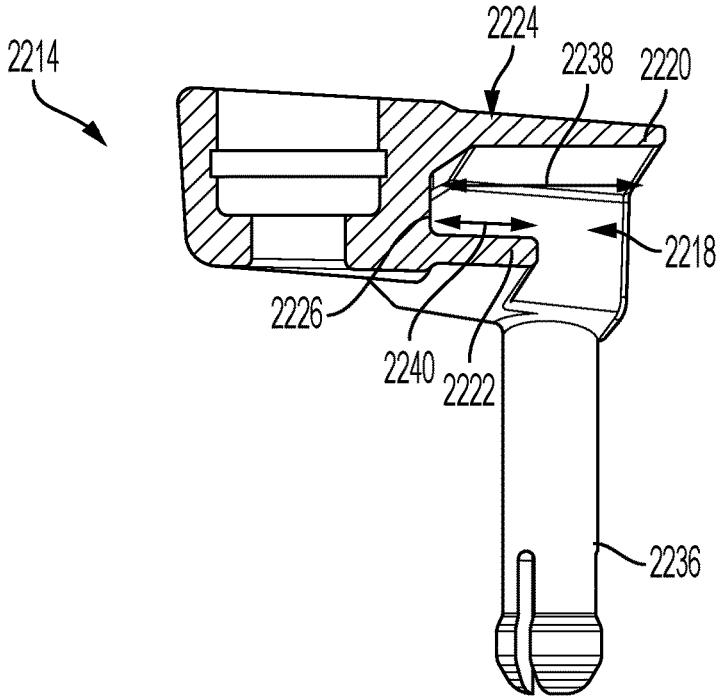
FIG. 56 is a cross-sectional view of a cover taken along line 54-54 in FIG. 54.

FIG. 55 is a perspective, cross-sectional, view of the weight assembly 2202 taken along line 54-54 in FIG. 54. FIG. 56 is a cross-sectional view of the cover 2214 taken along line 54-54 in FIG. 54. Referring concurrently to FIGS. 55 and 56, the cover 2214 has a shelf 2218 that is configured to slidably engage with the weight 2212. In the example, the shelf 2218 is open in a direction that faces towards the striking face of the club head and away from the fastener 2216. Additionally, the shelf 2218 extends within the cover 2214 in a toe-heel direction. It is appreciated, however, that the shelf 2218 can be defined within the cover 2214 in any other orientation and/or direction as required or desired to achieve the adjustable weight functionality as described herein. When the cover 2214 is in the unlocked position, the weight 2212 is raised relative to the club head such that the weight 2212 is selectively slidable within the shelf 2218 and the recessed channel 2210 (shown in FIG. 54). Conversely, when the cover 2214 is in the locked position, the weight 2212 is disposed at least partially within the recessed channel 2210 and the shelf 2218, and secured therein, so as to restrict or prevent movement of the weight 2212. In the example, the shelf 2218 provides an overlap for the cover 2214 with the weight 2212 so as to reduce the weight 2212 from binding within the recessed channel.

The shelf 2218 includes an outer wall 2220 and an opposite inner wall 2222. As described herein, the outer wall and inner wall of the shelf 2218 are in reference to the interior cavity of the body 2204 of the club head (shown in FIG. 54). As such, the outer wall 2220 is disposed proximate an exterior surface 2224 of the cover 2214. The weight 2212 is configured to be slidably received at least partially between the outer wall 2220 and the inner wall 2222 of the shelf 2218 and against an inner wall 2226 of the shelf 2218. The three walls of the shelf 2218 retain the weight 2212 within the cover 2214 so that the position of the weight 2212 is restricted or prevented from tilting relative to the cover 2214 when being moved between the locked configuration and unlocked configuration. This configuration restricts the weight 2212 from binding within the weight assembly 2202, and thus, increases performance of the weight assembly 2202.

In the example, this position of the weight 2212 within the cover 2214 can be measured by a tilt angle 2228 that is defined as an angular position of the weight 2212 relative to the outer wall 2220 of the shelf 2218. In an aspect, the tilt angle 2228 is substantially the same in both the unlocked configuration and the locked configuration. In another aspect, the tilt angle 2228 is substantially parallel to the outer wall 2220 of the shelf 2218 in both the unlocked configuration and the locked configuration. The weight 2212 has an outer surface 2230 that is positioned directly against the outer wall 2220, the inner wall 2222, and the inner wall 2226 of the cover 2214 when received within the shelf 2218. As such, the outer surface 2230 of the weight 2212 maintains its position directly against the walls of the shelf 2218 in both the unlocked configuration and locked configuration.

The weight 2212 includes a position indicator 2232 that extends at least partially out of the shelf 2218. The position indicator 2232 can be used to selectively slide the weight 2212 when the weight assembly 2202 is in the unlocked configuration. When in the locked configuration, the position indicator 2232 is visible between the cover 2214 and the body of club head so that the user can easily determine the weight characteristics of the club head. Additionally, the position indicator 2232 can be disposed within dimples (e.g., the dimples 1856 shown in FIG. 45) of the recessed channel. The weight 2212 also includes a hollow 2234 that is sized and shaped to receive a boss (e.g., the boss 1854 shown in FIG. 45) of the recessed channel. In the example, the hollow 2234 is disposed adjacent the inner wall 2222 of the shelf 2218.

The cover 2214 can also include one or more projections 2236 that are sized and shaped to be received within a corresponding chamber (not shown) of the recessed channel. The projection 2236 is configured to increase the engagement of the cover 2214 with the golf club head body so that the weight 2212 is restricted from moving or rattling when secured within the recessed channel by the cover 2214. The projection 2236 can also be used to limit the extraction of the cover 2214 from the body 2204 (shown in FIG. 54) to create a soft stop before completely unscrewing and extracting the cover 2214 from the body. In some examples, the projection 2236 may be similar to the projections described above in reference to FIGS. 36-41 and include one or more flexible arms, a tapered nose, a stop, and at least one rib.

In the example, a width 2238 of the outer wall 2220 relative to the inner wall 2226 is greater than a width 2240 of the inner wall 2222. This configuration enables the weight 2212 to be retained within the shelf 2218 without tilting and binding up within the weight assembly 2202. Additionally, the weight 2212 includes the hollow 2234 and the position indicator 2232 that can extend out from the shelf 2218 and enable the function of the weight assembly 2202 as described herein. For example, the inner wall 2226 enables the hollow 2234 of the weight 2212 to engage with corresponding structure within the recessed channel. In an aspect, the width of the outer wall is between approximately 2 to 4 times greater than the width of the inner wall. In another aspect, a ratio of the width 2238 of the outer wall 2220 to the width 2240 of the inner wall 2222 is greater than, or equal to, 2:1. In yet another aspect, the ratio of the width 2238 of the outer wall 2220 to the width 2240 of the inner wall 2222 is greater than, or equal to, 3:1. In still another aspect, the ratio of the width 2238 of the outer wall 2220 to the width 2240 of the inner wall 2222 is between approximately 2:1 and 4:1. It should be appreciated that other ratio values are also contemplated herein and may not be expressly listed above.

Figure 57:
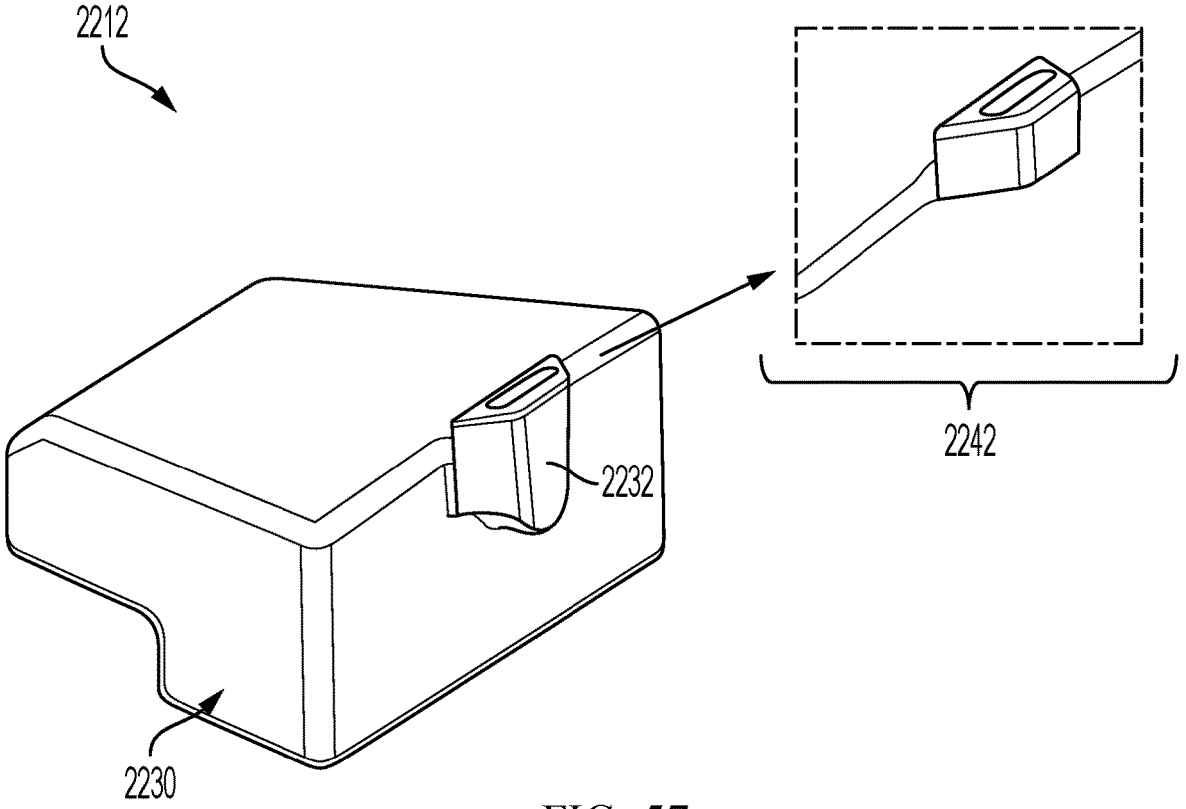
FIG. 57 is a perspective view of a weight of the weight assembly shown in FIGS. 55 and 56.
Figure 58:
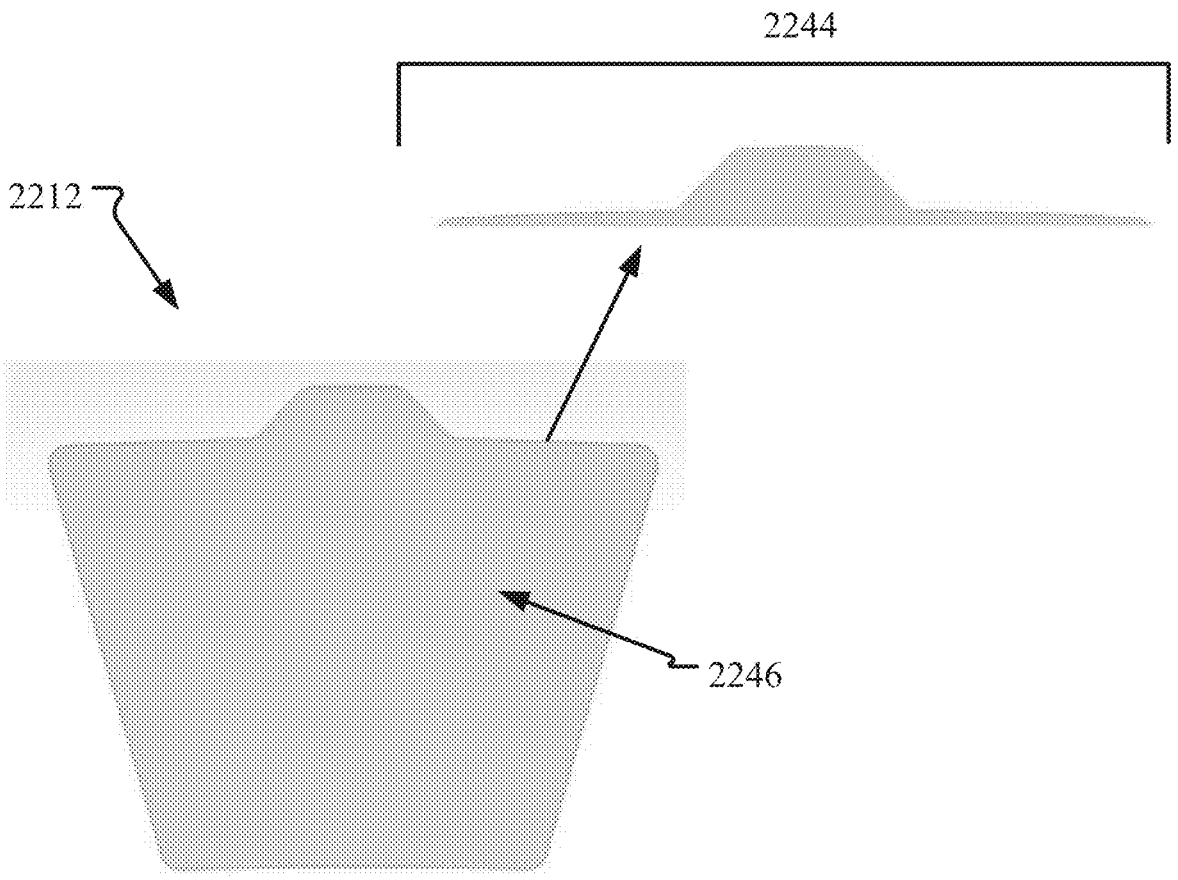
FIG. 58 is a schematic top plan view of the weight shown in FIG. 57.

FIG. 57 is a perspective view of the weight 2212. FIG. 58 is a schematic top plan view of the weight 2212. Referring concurrently to FIGS. 57 and 58, as well as FIG. 54, at least a portion of the weight 2212 is exposed and visible between the exterior surface of the cover 2214 and the outer surface 2208 of the body 2204, when the weight assembly 2202 in the locked configuration. That is, a gap is formed at least partially between a portion of the cover 2214 and the body 2204, and the weight 2212 at least partially fills this gap. For example, the position indicator 2232 may be exposed and visible on the golf club head 2200. This configuration enables the position of the weight 2212 to be easily determined. However, the weight 2212 is not entirely exposed and visible. By reducing the portions of the weight 2212 exposed on the golf club head 2200, the smoothness between the outer surface 1820 of the club head 2200 and the cover 2214 is increased. As such, the golf club head 2200 has increased performance (e.g., striking golf balls directly off the ground surface, aerodynamic performance, etc.), while also including the weight adjustable function via the weight assembly 2202 as described herein.

In the example, between approximately 0% and 30% of the weight 2212 is exposed and visible between the outer surface 2208 of the body 2204 and the exterior surface of the cover 2214 in the locked configuration. In an aspect, between approximately 10% and 20% of the weight 2212 is exposed between the outer surface 2208 of the body 2204 and the exterior surface of the cover 2214 in the locked configuration. In yet another aspect, approximately 16% of the weight 2212 is exposed. It should be appreciated that other percentage values are also contemplated herein and may not be expressly listed above. Although not shown in the figures, the weight 2212 can be completely invisible without departing from the scope and content of the present invention.

With reference to FIG. 57, the percentage of the weight 2212 visible and exposed (e.g., portion 2242) may be based on the outer surface area 2230 of the weight 2212. As used herein, the outer surface 2230 of the weight 2212 includes more than one side of the weight shape and the entire outer perimeter as illustrated in FIG. 57. For example, in an aspect, between approximately 0% and 30% of the outer surface 2230 of the weight 2212 is exposed between the outer surface 2208 of the body 2204 and the exterior surface of the cover 2214 in the locked configuration. In another aspect, between approximately 10% and 20% of the outer surface 2230 of the weight 2212 is exposed between the outer surface 2208 of the body 2204 and the exterior surface of the cover 2214 in the locked configuration. In yet another aspect, approximately 16% of the outer surface 2230 the weight 2212 is exposed. It should be appreciated that other percentage values are also contemplated herein and may not be expressly listed above.

With reference to FIG. 58, the percentage of the weight 2212 visible and exposed (e.g., portion 2244) may be based on a planar surface area 2246 of the weight 2212. As used herein, the planar surface area 2246 is the surface area only on one projection side of the weight shape (e.g., top planar area). While the top planar area is illustrated in FIG. 58, other weight sides (e.g., right planar area, left planar area, etc.) are also contemplated herein. For example, in an aspect, between approximately 0% and 30% of the planar surface area 2246 of the weight 2212 is exposed between the outer surface 2208 of the body 2204 and the exterior surface of the cover 2214 in the locked configuration. In another aspect, between approximately 10% and 20% of the planar surface area 2246 of the weight 2212 is exposed between the outer surface 2208 of the body 2204 and the exterior surface of the cover 2214 in the locked configuration. In yet another aspect, approximately 16% of the planar surface area 2246 the weight 2212 is exposed. It should be appreciated that other percentage values are also contemplated herein and may not be expressly listed above.

Figure 59:
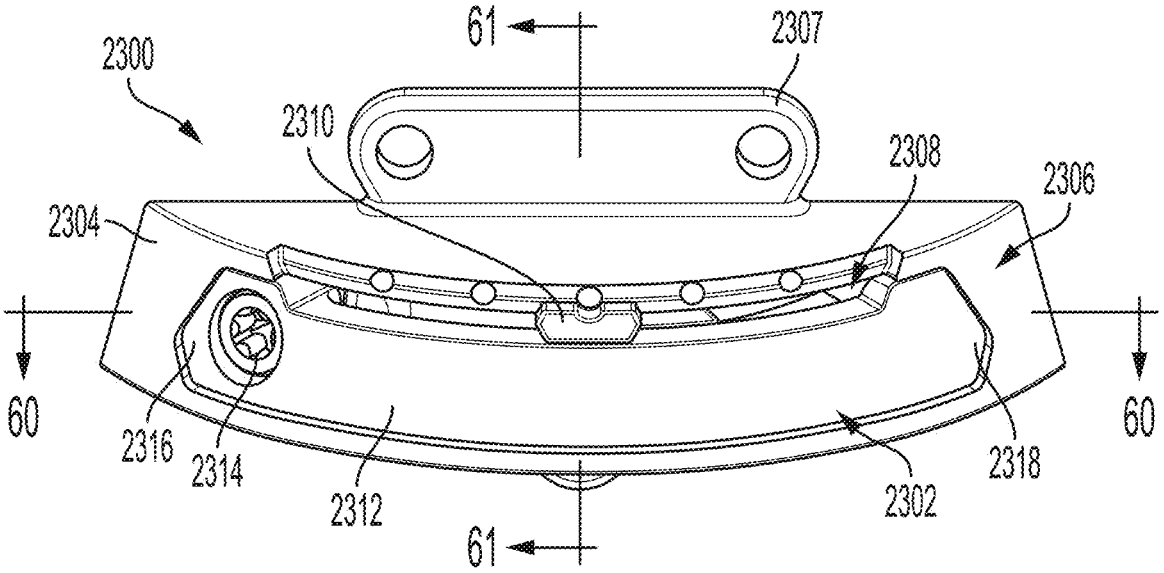
FIG. 59 is a schematic perspective view of an exemplary test mule with another weight assembly.
Figure 60:
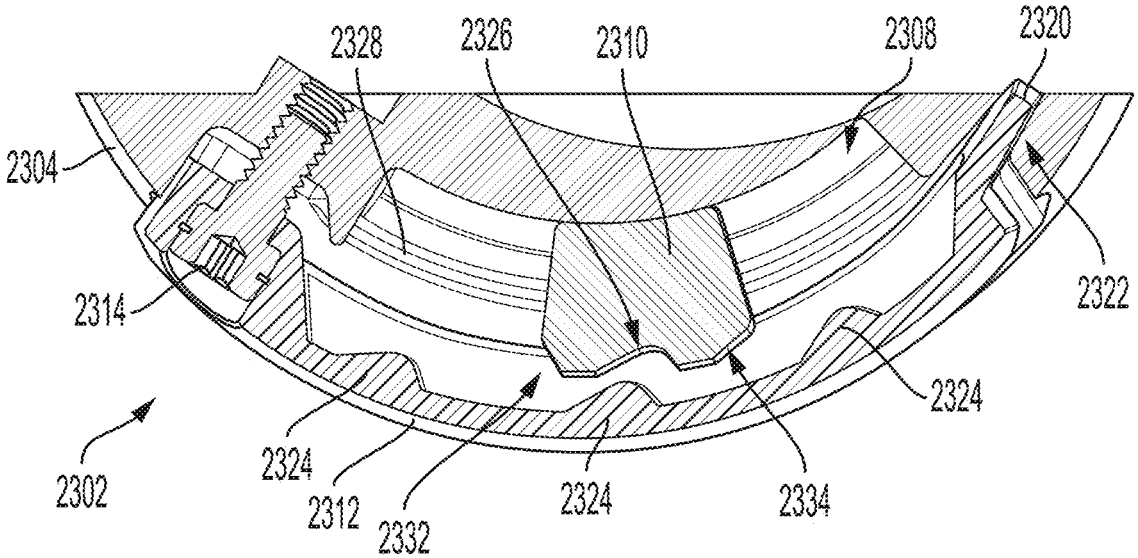
FIG. 60 is a cross-sectional view of the weight assembly taken along line 60-60 in FIG. 59.
Figure 61:
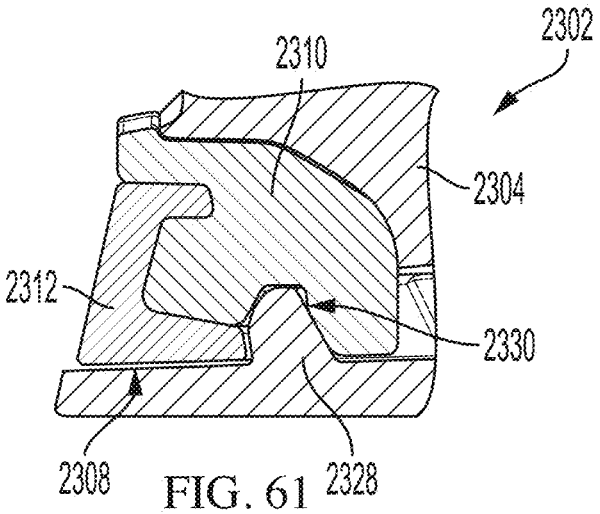
FIG. 61 is another cross-sectional view of the weight assembly taken along line 61-61 in FIG. 59.

FIG. 59 is a schematic perspective view of an exemplary test mule 2300 with another weight assembly 2302. FIG. 60 is a cross-sectional view of the weight assembly 2302 taken along line 60-60 in FIG. 59. FIG. 61 is another cross-sectional view of the weight assembly 2302 taken along line 61-61 in FIG. 59. Referring concurrently to FIGS. 59-61, the test mule 2300 represents a golf club head as described herein and can be utilized to test and develop features of the weight assembly 2302 as required or desired. The club head that the test mule 2300 represents can be any type of club head described herein as required or desired, such as, but not limited to, a metalwood-type golf club head, a fairway-metal type club head, an iron-type club head, or a hybrid-type club head. In an aspect, the club head that the test mule 2300 represents is a metalwood-type club head with a striking face, a sole extending from a lower edge of the striking face, and a crown extending from an upper edge of the striking face (all three components not shown in FIGS. 59-60). In an aspect, a transition area where the sole and the crown couple together opposite the striking face is known as a skirt of the club head, and the weight assembly 2302 is disposed at least partially on the skirt. As such, the weight assembly 2302 is disposed at a rear perimeter of the club head and proximate where the sole and the crown couple together. In an aspect, the weight assembly 2302 is disposed substantially at a rear portion of the club head opposite the striking face. One example of a weight assembly disposed on a skirt of a golf club head is shown in FIG. 8 and described above. In the example, the test mule 2300 includes a body 2304 having an outer surface 2306 that represents the body of the club head. Additionally, a bracket 2307 is coupled to the body 2304 to facilitate testing and development, and the bracket 2307 is not representative of the club head. In an aspect, the bracket 2307 is substantially triangular in shape.

In this example, a recessed channel 2308 is defined in the outer surface 2306 of the body 2304. The channel 2308 extends along a curve in a generally toe-heel direction so that the CG and the MOI of the club head can be adjusted via the weight assembly 2302. The weight assembly 2302 includes a weight 2310 disposed at least partially within the channel 2308 and configured to slide therein, a cover 2312 that extends at least partially over the channel 2308, and a fastener 2314 configured to couple the cover 2312 to the body 2304. The fastener 2314 is configured to retain the weight 2310 in the recessed channel 2308 indirectly via the cover 2312 and so that the weight 2310 can be used to adjust the CG and the MOI of the club head.

Similar to the examples described above, the weight assembly 2302 is configured to move between at least a locked configuration, shown in FIGS. 59 and 61, and an unlocked configuration, shown in FIG. 60. In the locked configuration, the cover 2312 is at least partially disposed within the recessed channel 2308, and the weight 2310 is secured within the channel 2308 with movement restricted. In the unlocked configuration, the fastener 2314 enables the cover 2312 to move along a fastener axis so that the weight 2310 can slide relative to cover 2312 and the body 2304. In an aspect, from the locked configuration, the fastener 2314 may be rotatable between about 2-3 turns to release the cover 2312 from the locked configuration and enable the weight 2310 to slide at least partially within the recessed channel 2308. In another aspect, the fastener 2314 may rotate about 212 turns to enable the weight 2310 to slide within the weight assembly 2302.

The cover 2312 has a first end 2316 and an opposite second end 2318. The fastener 2314 is coupled to the first end 2316 (e.g., via a lock washer) of the cover 2312 and so that the fastener 2314 is used for attaching the cover 2312 to the body 2304. The second end 2318 of the cover 2312 includes a projection 2320. The projection 2320 of the second end 2318 is configured to engage with a corresponding chamber 2322 defined at the end of the recessed channel 2308. In the locked configuration, the fastener 2314 secures the first end 2316 of the cover 2312 to the body 2304, while the projection 2320 of the second end 2318 engages with the chamber 2322 of the channel 2308 so that a position of the weight 2310 within the recessed channel 2308 is retained between the first end 2316 and the second end 2318 of the cover 2312. When the weight assembly 2302 is moved towards the unlocked configuration, the fastener 2314 is used to move the cover 2312 along the fastener axis and raise the cover 2312 at least partially out of the recessed channel 2308. This configuration enables the weight 2310 to slide and be repositioned on the body 2304 of the golf club head. In this example, the projection 2320 extends in a direction that is substantially parallel to the fastener axis so that the cover 2312 can uniformly raise out of the recessed channel 2308. In an aspect, the chamber 2322 is formed as an undercut in a sidewall of the recessed channel 2308, and this undercut engages with the projection 2320 of the cover 2312. The fastener 2314 is at the opposite end of the undercut.

To assist in positioning the weight 2310 at preselected positions within the recessed channel 2308, the cover 2312 includes at least one locating lug 2324 that extends from an inner surface of the cover 2312. The weight 2310 includes a corresponding hollow 2326 shaped and sized to receive at least a portion of the locating lug 2324. As illustrated in FIG. 60, the cover 2312 has three spaced apart locating lugs 2324 so that the hollow 2326 can selectively engage the lug 2324 at three discrete locations within the recessed channel 2308. In an aspect, the locating lug 2324 may not be symmetrical, for example, one side of the lug 2324 can have a steeper angled side than an opposite more shallower angle side. Furthermore, in this example, the weight 2310 has a first inclined surface 2332 on one end and a second inclined surface 2334 on the opposite end proximate the side of the hollow 2326. The first and second inclined surfaces 2332, 2334 are different and configured to engage with one of the steeper or shallower angled sides of the locating lug 2324. This configuration allows for the weight 2310 to be positioned between two locating lugs 2324 and selectively engage therewith. As such and as illustrated in FIG. 60, the weight 2310 can engage with the cover 2312 at two more discrete locations within the recessed channel 2308 and between pairs of locating lugs 2324. When the locating lug(s) 2324 is engaged with the weight 2310, the weight 2310 is retained more tightly within the cover 2312 to reduce or prevent rattling and further movement of the weight 2310 in the locked configuration. Additionally, one or more of the locating lugs 2324 can define a position of the weight 2310 on the golf club head. In other aspects, the cover 2312 can have five spaced apart locating lugs 2324. Other numbers of locating lugs 2324 are also contemplated herein. It should also be appreciated that in other examples, a locating lug 2324 may be provided for every discrete location of the weight 2310 as required or desired.

In this example, the weight 2310 is slidably engaged with the body 2304 within the recessed channel 2308. The body 2304 includes a partial wall 2328 that is disposed within the recessed channel 2308. The partial wall 2328 extends from a bottom of the recessed channel 2308, and the weight 2310 includes a recess 2330 shaped and sized to receive at least a portion of the partial wall 2328. By slidably engaging the partial wall 2328 and the recess 2330 of the weight 2310, the weight 2310 does not move with the cover 2312 when the cover is moved towards the unlocked configuration. This retention of the weight 2310 within the recessed channel 2308 enables the locating lugs 2324 of the cover 2312 to disengage with the weight 2310 and allow the weight 2310 to slide and change positions. Additionally, the orientation of the weight 2310 within the recessed channel 2308 can be held by the partial wall 2328 when the cover 2312 is in the unlocked configuration so that the weight 2310 can slide more easily to different positions.

Figure 62:
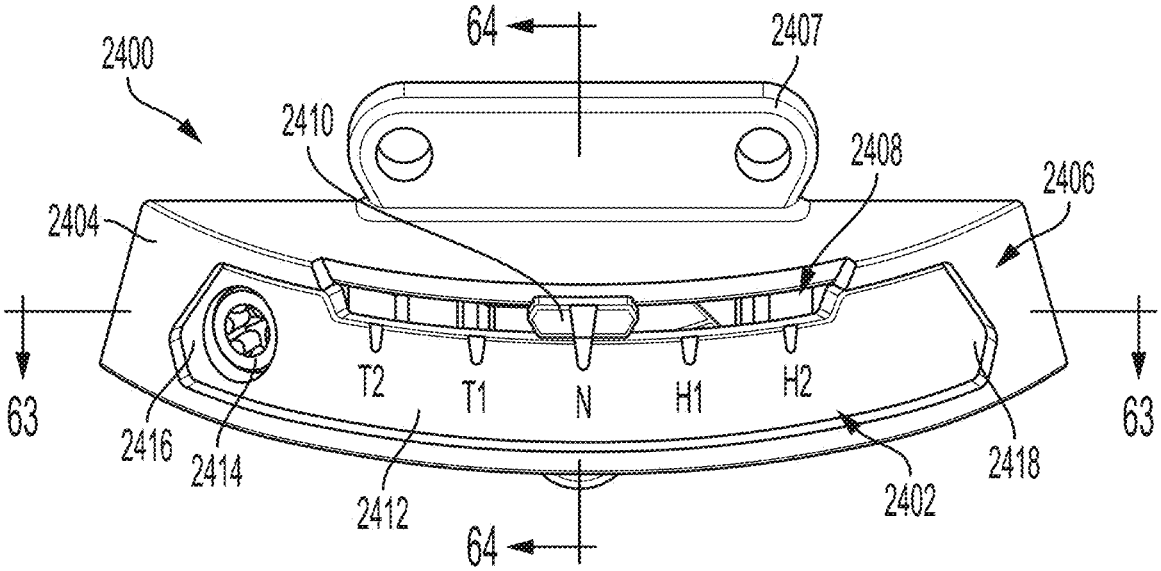
FIG. 62 is a schematic perspective view of another test mule with another weight assembly.

FIG. 62 is a schematic perspective view of another test mule 2400 with another weight assembly 2402. FIGS. 63A-E are cross-sectional views of the weight assembly 2402 taken along line 63-63 in FIG. 62 and with a weight 2410 in a variety of different positions. FIG. 64 is another cross-sectional view of the weight assembly 2402 taken along line 64-64 in FIG. 62. Referring concurrently to FIGS. 62-64, and similar to the example described above in FIGS. 59-61, the test mule 2400 represents a club head that can be any type of club head described herein as required or desired, and in an aspect, the weight assembly 2402 is disposed on a skirt of the club head and at a rear perimeter where the sole and the crown couple together. The test mule 2400 includes a body 2404 having an outer surface 2406 that represents the club head and a bracket 2407. A recessed channel 2408 is defined in the outer surface 2406 of the body 2404. The weight assembly 2402 includes the weight 2410 disposed at least partially within the channel 2408 and configured to slide therein, a cover 2412 that extends at least partially over the channel 2408, and a fastener 2414 configured to couple the cover 2412 to the body 2404. The cover 2412 has a first end 2416 and an opposite second end 2418. The fastener 2414 is coupled to the first end 2416 (e.g., via a lock washer) of the cover 2412 and so that the fastener 2414 is used for attaching the cover 2412 to the body 2404. The second end 2418 of the cover 2412 includes a projection 2420. The projection 2420 of the second end 2418 is configured to engage with a corresponding chamber 2422 defined at the end of the recessed channel 2408 and to secure the second end 2418 to the body 2404.

In this example, to assist in positioning the weight 2410 at preselected positions within the recessed channel 2408, the body 2404 includes at least one locating lug 2424 disposed within the recessed channel 2408. In an aspect, the locating lug 2424 extends from a back wall of the recessed channel 2408 relative to the outer surface 2406. In another aspect, the locating lug 2424 is substantially symmetrical with two similarly angled sides. The weight 2410 includes a corresponding hollow 2426 shaped and sized to receive at least a portion of the locating lug 2424. Furthermore, in this example, the weight 2410 has inclined surfaces 2432 on each end proximate the side of the hollow 2426. The inclined surfaces 2432 are similar to each other and configured to engage with the angled sides of the locating lugs 2424. As illustrated in FIGS. 63A-E, the cover 2412 has three spaced apart locating lugs 2424 so that the weight 2410 is selectively positionable at five discrete locations within the recessed channel 2408. Other numbers of locating lugs 2424 are also contemplated herein. The locating lugs 2424 are not evenly spaced apart in the heel-toe direction of the club head and have two different spacing distances. In the example, the locating lug 2424 proximate the fastener 2414 is spaced further apart from the locating lug 2424 in the middle than the locating lug 2424 proximate the projection 2420. In an aspect, the spacing between the fastener locating lug 2424 and the middle locating lug 2424 is approximately double the spacing between the projection locating lug 2424 and the middle locating lug 2424. Additionally, in some examples, the locating lugs 2424 can be substantially cone-shaped.

Figure 63A:
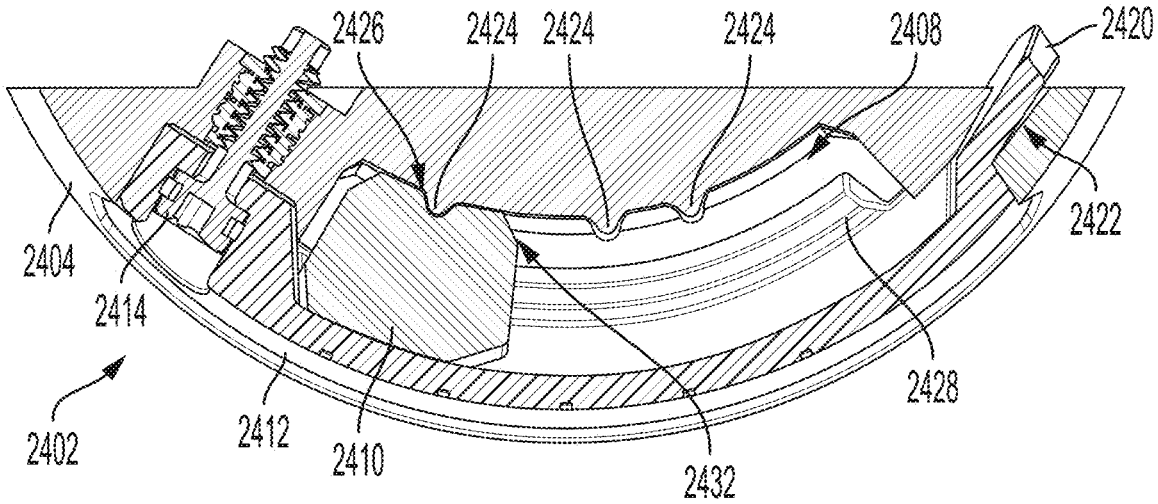
FIGS. 63A-E are cross-sectional views of the weight assembly taken along line 63-63 in FIG. 62 and with a weight in a variety of different positions.
Figure 63B:
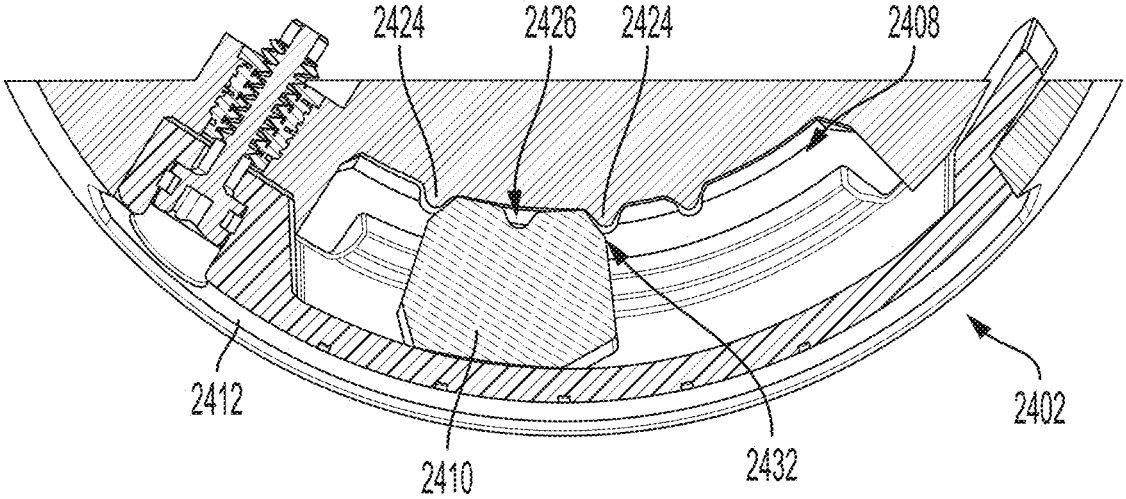
Figure 64:
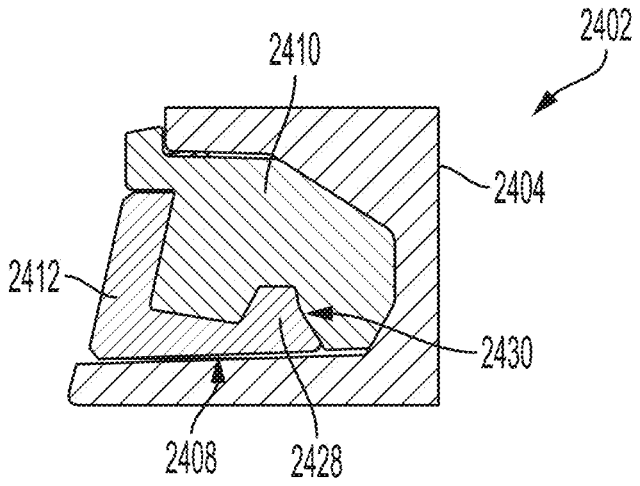
FIG. 64 is another cross-sectional view of the weight assembly taken along line 64-64 in FIG. 62.

Starting with FIG. 63A, the weight 2410 is disposed adjacent to the fastener 2414 and the hollow 2426 is engaged with the locating lug 2424 proximate the fastener 2414. As such, a portion of the weight 2410 is positioned on both sides of locating lug 2424. The weight assembly 2402 is in a locked configuration so that the position of the weight 2410 relative to the body 2404 is secured. In some aspects, the far side of the weight 2410 can be positioned directly against a portion of an end wall of the recessed channel 2408 and/or a portion of the cover 2412 that couples to the fastener 2414. Moving next to FIG. 63B, the weight assembly 2402 can be moved to an unlocked configuration (e.g., at least partially raising the cover 2412 out of the recessed channel 2408 to enable sliding movement of the weight 2410) for repositioning the weight 2410 and adjusting the CG and/or MOI of the club head. Once the weight 2410 is repositioned, the weight assembly 2402 can be moved into the locked configuration (as shown) to secure the position of the weight 2410. In this position, the weight 2410 is disposed between two locating lugs 2424 such that the hollow 2426 does not have a locating lug 2424 received therein. Rather, the inclined surfaces 2432 are engaged with a respective locating lug 2424.

Figure 63C:
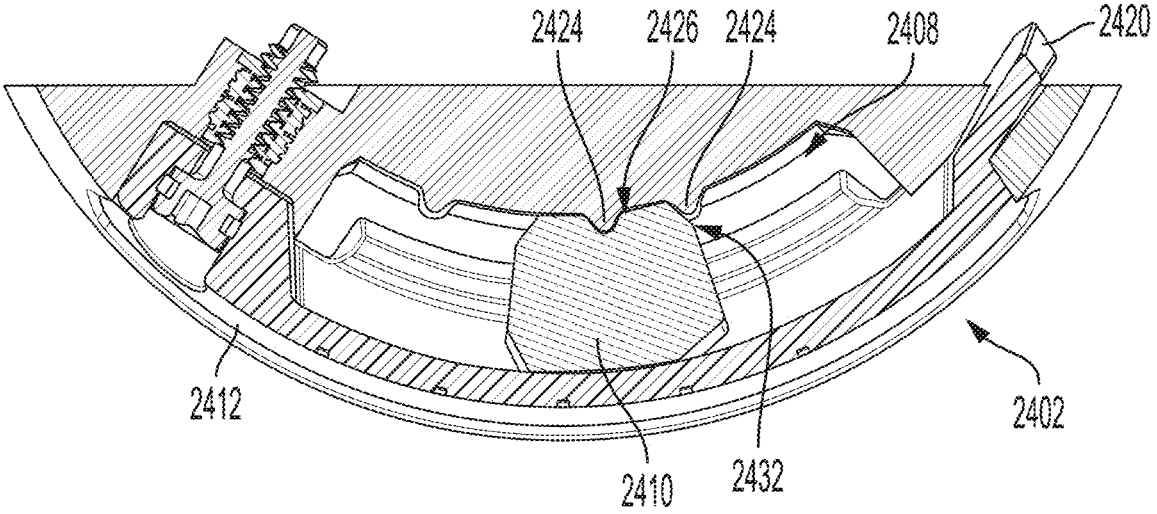
Figure 63D:
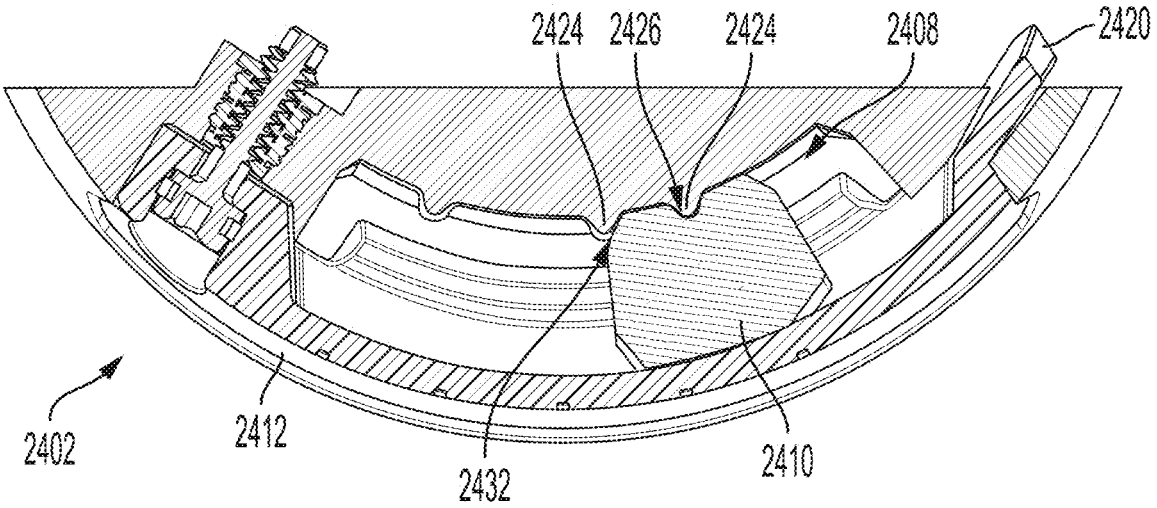
Figure 63E:
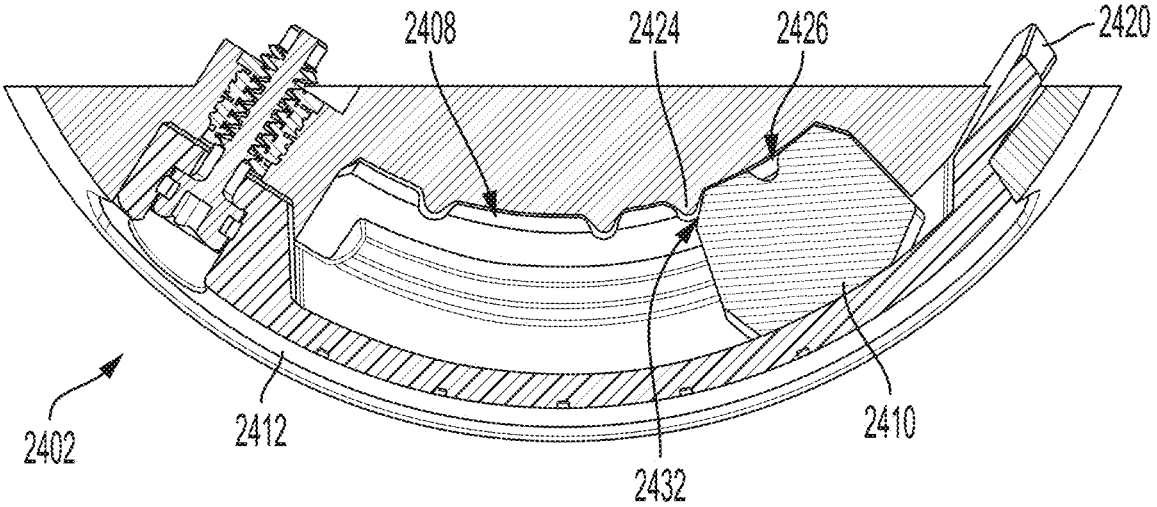

In FIG. 63C, the hollow 2426 of the weight 2410 is engaged with the locating lug 2424 in the middle. In this position, one of the inclined surfaces 2432 is also engaged with the locating lug 2424 proximate the projection 2420. In FIG. 63D, the hollow 2426 of the weight 2410 is engaged with the locating lug 2424 proximate the projection 2420. In this position, one of the inclined surfaces 2432 is engaged with the locating lug 2424 in the middle. Lastly, in FIG. 63E, the weight 2410 is disposed adjacent to the projection 2420 and between the locating lug 2424 and an end wall of the recessed channel 2408. The hollow 2426 does not have a locating lug 2424 received therein and one of the inclined surfaces 2432 is engaged with the locating lug 2424 proximate the projection 2420. In the example, the far side of the weight 2410 can be positioned directly against a portion of an end wall of the recessed channel 2408 and/or a portion of the cover 2412 proximate the projection 2420. When the locating lug(s) 2424 is engaged with the weight 2410, the weight 2410 is retained more tightly within the recessed channel 2408 to reduce or prevent rattling and further movement of the weight 2410 in the locked configuration. Additionally, one or more of the locating lugs 2424 can define a position of the weight 2410 on the golf club head. In the example, by shifting the locating lug 2424 proximate the projection 2420 inward, the weight 2410 can more easily slide between all positions without binding. It should be appreciated, that the spacing of the locating lugs 2424 can take on any other configuration as required or desired. For example, the recessed channel 2408 can have five spaced apart locating lugs 2424 such that in each position the hollow 2426 of the weight 2410 engages with a locating lug 2424. In other examples, three similarly spaced locating lugs 2424 can be used.

Additionally, the weight 2410 is slidably engaged with the cover 2412. The cover 2412 includes a flange 2428 that extends from an interior of the cover 2412 and the weight 2410 includes a groove 2430 shaped and sized to receive at least a portion of the flange 2428. By slidably engaging the flange 2428 and the groove 2430 of the weight 2410, the weight 2410 is configured to move with the cover 2412 when moved towards the unlocked configuration. This movement of the weight 2410 enables the weight 2410 to disengage with the locating lugs 2424 and so that the weight 2410 can slide and change positions.

Figure 65:
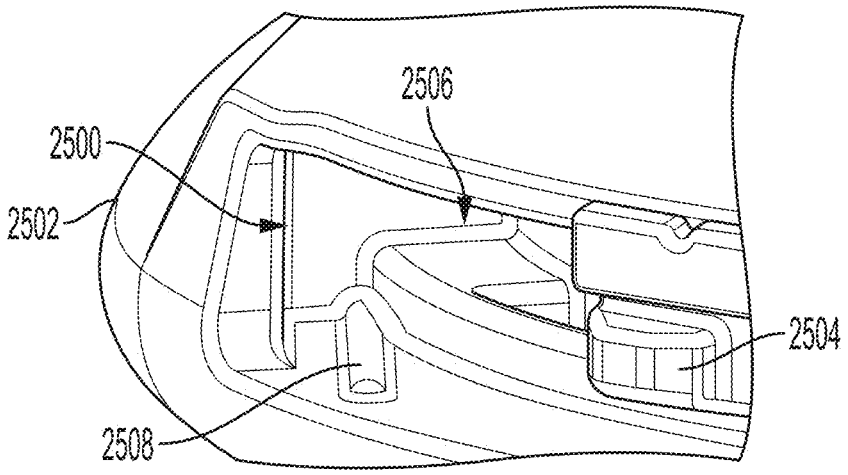
FIG. 65 is a partial perspective view of an exemplary recessed channel within a body of a test mule.
Figure 66:
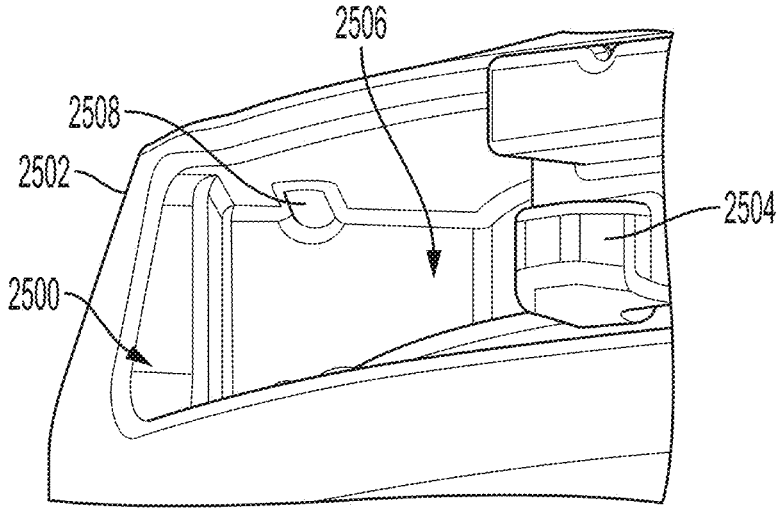
FIG. 66 is another partial perspective view of the recessed channel shown in FIG. 65.

FIG. 65 is a partial perspective view of an exemplary recessed channel 2500 within a body 2502 of a test mule. FIG. 66 is another partial perspective view of the recessed channel 2500. Referring concurrently to FIGS. 65 and 66, the body 2502 is illustrated schematically and the test mule represents a club head that can be any type of club head described herein as required or desired. The recessed channel 2500 is configured to receive a slidable weight 2504 and a cover (not shown) is configured to selectively retain the weight 2504 in different positions. The cover is coupled to the body 2502 with a fastener (not shown) that defines a fastener axis. The recessed channel 2500 includes a chamber 2506 that is sized and shaped to receive a corresponding projection (not shown) of the cover. The chamber 2506 is defined on the opposite end of the recessed channel 2500 from the fastener location so that both ends of the cover are engaged with the body 2502 and increase the retention of the weight 2504.

In this example, the recessed channel 2500 includes a lip 2508 proximate the chamber 2506. The lip 2508 extends into the recessed channel 2500 and is configured to engage with the cover at a corresponding duct (not shown). As such, when the cover is moved towards an unlocked configuration that allows the weight 2504 to slide within the recessed channel 2500, the end of the cover opposite the fastener remains at least partially engaged with the body 2502 to reduce or prevent the end of the cover from becoming loose relative to the body 2502. The lip 2508 is elongated in a direction that is substantially parallel to the fastener axis to enable movement of the cover as described herein. The lip 2508 can be positioned at a top wall of the recessed channel 2500, as illustrated in FIG. 65, at a bottom wall of the recessed channel 2500, as illustrated in FIG. 66, or both.

Figure 67:
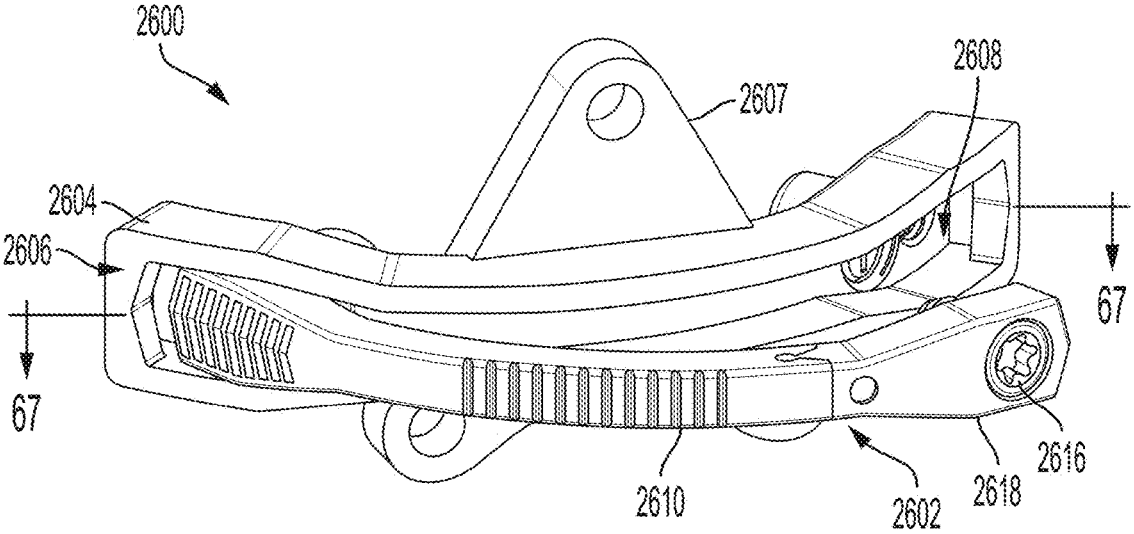
FIG. 67 is a schematic perspective view of another test mule with another weight assembly.
Figure 68:
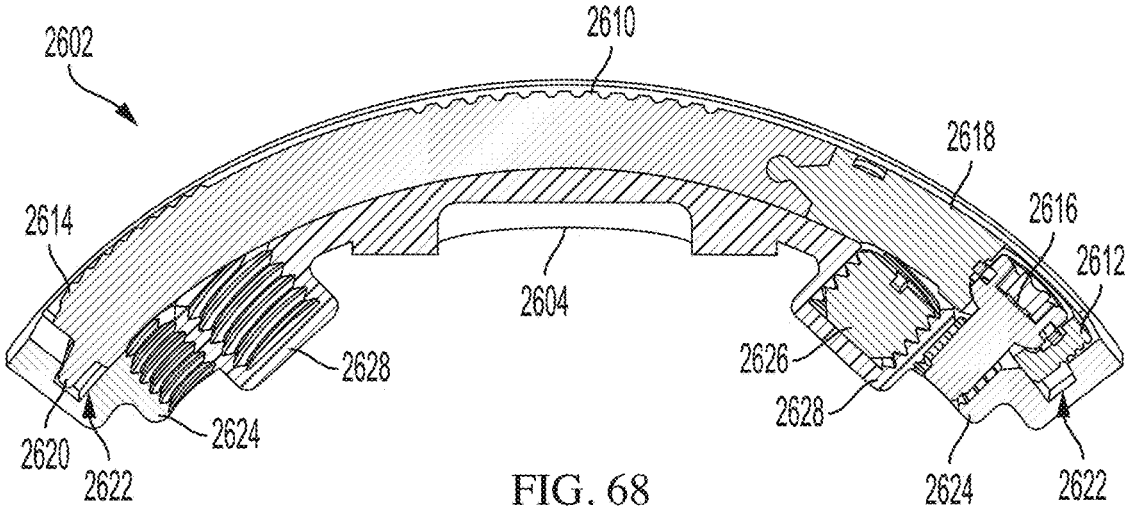
FIG. 68 is a cross-sectional view of the weight assembly in a first configuration taken along line 67-67 in FIG. 67.
Figure 69:
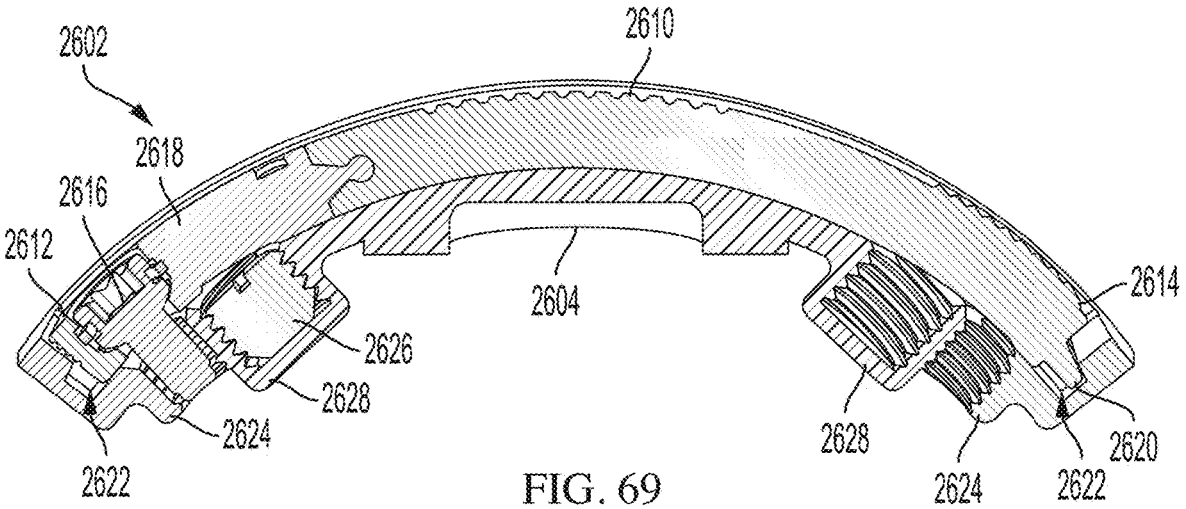
FIG. 69 is a cross-sectional view of the weight assembly in a second configuration taken along line 67-67 in FIG. 67.

FIG. 67 is a schematic perspective view of another test mule 2600 with another weight assembly 2602. FIG. 68 is a cross-sectional view of the weight assembly 2602 in a first configuration taken along line 67-67 in FIG. 67. FIG. 69 is a cross-sectional view of the weight assembly 2602 in a second configuration taken along line 67-67 in FIG. 67. Referring concurrently to FIGS. 67-69, and similar to the examples described above in FIGS. 59-64, the test mule 2600 represents a club head that can be any type of club head described herein as required or desired, and in an aspect, the weight assembly 2602 is disposed on a skirt of the club head and at a rear perimeter where the sole and the crown couple together. The test mule 2600 includes a body 2604 having an outer surface 2606 that represents the club head and a bracket 2607. A recessed channel 2608 is defined in the outer surface 2606 of the body 2604. In this example, however, the weight assembly 2602 includes a cover 2610 that is configured to be selectively oriented within the recessed channel 2608 and secured to the body 2604 to at least partially define a weight position of the club head and to adjust the CG and the MOI of the club head.

In this example, the weight assembly 2602 includes the cover 2610 that is removably coupled to the body 2604 and at least partially within the recessed channel 2608. The cover 2610 has a first end 2612 and an opposite second end 2614. A fastener 2616 is mounted (e.g., via a lock washer) on the first end 2612 of the cover 2610 and is configured to couple to the body 2604. Additionally, a first weight 2618 is disposed at the first end 2612 of the cover 2610. In this example, the first weight 2618 defines the first end 2612 of the cover 2610 itself and is removable from the second end 2614 of the cover 2610 so that different mass weights 2618 are interchangeable and can form the cover 2610 as required or desired. The second end 2614 of the cover 2610 includes a projection 2620 extending therefrom.

Each end of the recessed channel 2608 has a chamber 2622 and a fastener receiver 2624. The chamber 2622 is configured to engage with the projection 2620 of the cover 2610 and the fastener 2616 is configured to couple to the fastener receiver 2624. By having the recessed channel 2608 symmetrical at each end, the cover 2610 can be selectively coupled to the body 2604 so that the first weight 2618 can be oriented in either the first configuration (shown in FIG. 68) or the second configuration (shown in FIG. 69). In the first configuration, the first end 2612 of the cover 2610 is disposed on the heel side of the club head so that the first weight 2618 is positioned towards the heel side of the body 2604. In this configuration, the fastener 2616 is secured to the fastener receiver 2624 on the heel side and the projection 2620 of the cover 2610 engages with the chamber 2622 at the toe side. This leaves the fastener receiver 2624 on the toe side and the chamber 2622 on the heel side unused by the cover 2610. Conversely, in the second configuration, the first end 2612 of the cover 2610 is disposed on the toe side of the club head so that the first weight 2618 is positioned towards the toe side of the body 2604. In this configuration, the fastener 2616 is secured to the fastener receiver 2624 on the toe side and the projection 2620 of the cover 2610 engages with the chamber 2622 at the heel side. This leaves the fastener receiver 2624 on the heel side and the chamber 2622 on the toe side unused by the cover 2610. In this example, the cover 2610 has a dog-bone type shape so that is position within the recessed channel 2608 can be switched as required or desired.

Additionally or alternatively, a second weight 2626 may be coupled to a corresponding weight chamber 2628 defined in the body 2604 and within the recessed channel 2608. The weight chamber 2628 is positioned at both ends of the recessed channel 2608 proximate the fastener receiver 2624 and is covered by the cover 2610 when coupled to the body 2604. As such, the second weight 2626 is secured by the cover 2610 within the weight chamber 2628 and indirectly retained by the fastener 2616 of the weight assembly 2602. In an aspect, the second weight 2626 may thread at least partially into the weight chamber 2628. It should be appreciated that the position and use of the second weight 2626 does not necessarily need to correspond to the orientation of the cover 2610 and as illustrated in FIGS. 68 and 69. For example, the second weight 2626 can be used opposite of the first weight 2618 and retained at least partially by the second end 2614 of the cover 2610. In another example, only the first weight 2618 and no second weight 2626 can be utilized. In still another example, a pair of second weights 2626 may be used in the pair of weight chambers 2628. By using more than one weight 2618, 2626 the CG and the MOI of the club head can be more finely tuned as required or desired.

Figure 70:
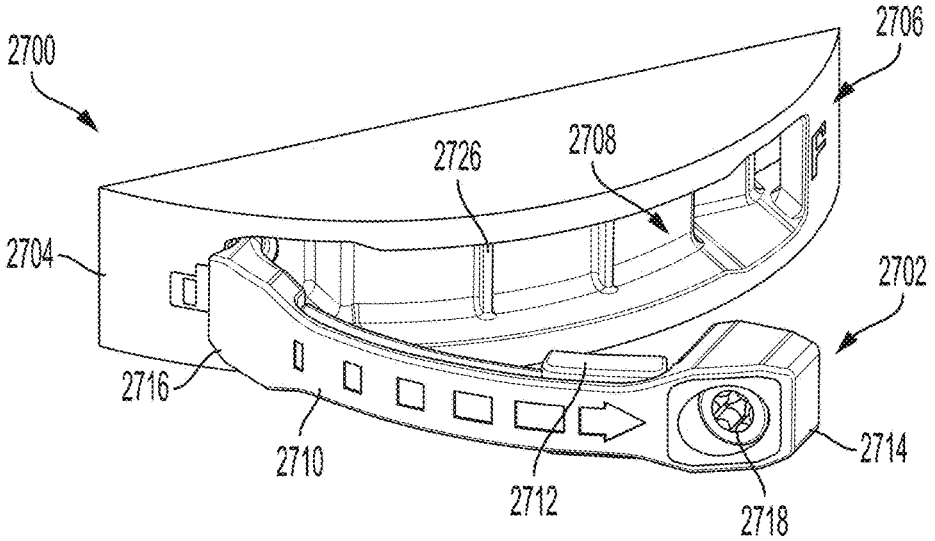
FIG. 70 is a schematic perspective view of another test mule with another weight assembly.
Figure 71:
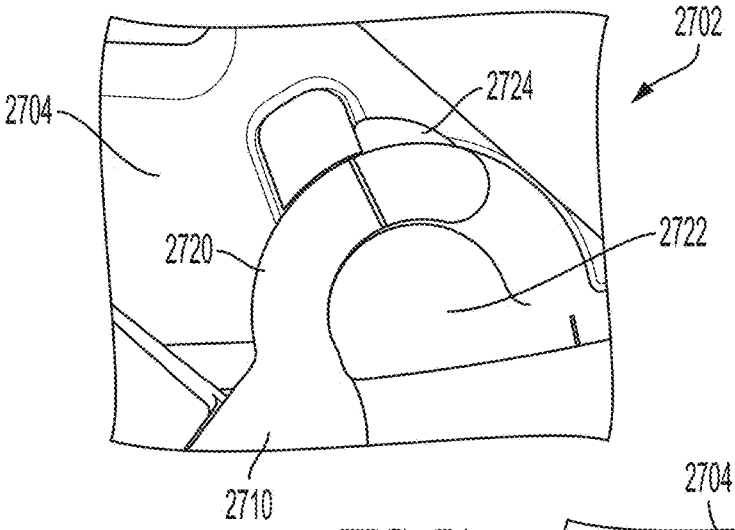
FIG. 71 is a partial cross-sectional view of the weight assembly shown in FIG. 70 in an unlocked configuration.
Figure 72:
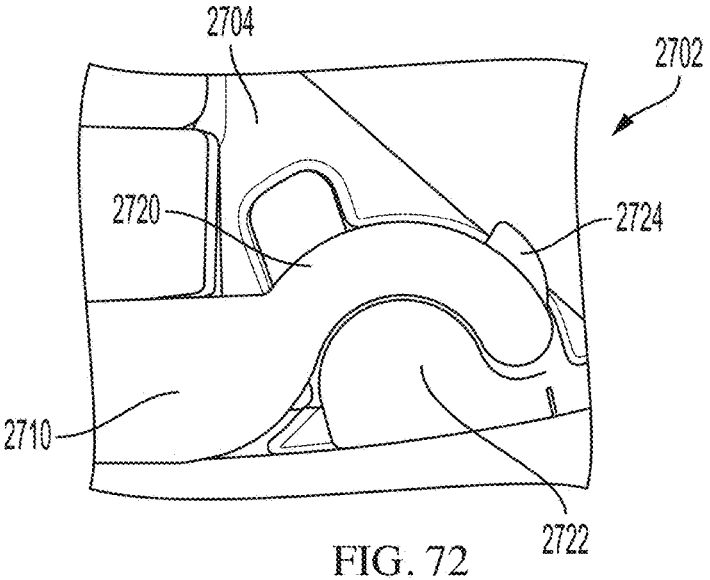
FIG. 72 is a partial cross-sectional view of the weight assembly shown in FIG. 70 in a locked configuration.

FIG. 70 is a schematic perspective view of another test mule 2700 with another weight assembly 2702. FIG. 71 is a partial cross-sectional view of the weight assembly 2702 in an unlocked configuration. FIG. 72 is a partial cross-sectional view of the weight assembly 2702 in a locked configuration. Referring concurrently to FIGS. 70-72, and similar to the examples described above in FIGS. 59-64 and 67-69, the test mule 2700 represents a club head that can be any type of club head described herein as required or desired, and in an aspect, the weight assembly 2702 is disposed on a skirt of the club head and at a rear perimeter where the sole and the crown couple together. The test mule 2700 includes a body 2704 having an outer surface 2706 that represents the club head. A recessed channel 2708 is defined in the outer surface 2706 of the body 2704. In this example, however, the weight assembly 2702 includes a cover 2710 that is pivotably coupled to the body 2704 and a slidable weight 2712 to adjust the CG and the MOI of the club head. In an aspect, the cover 2710 is lighter in density than the weight 2712 so that a larger amount of mass can be used to manipulate the CG and the MOI.

In this example, the cover 2710 has a first end 2714 and an opposite second end 2716. A fastener 2718 is mounted on the first end 2714 of the cover 2710 (e.g., via a lock washer) and is configured to secure the first end 2714 to the body 2704 of the club head. The second end 2716 of the cover 2710 is pivotably coupled to the body 2704. The weight 2712 is slidably coupled to the cover 2710 and is movable between the first end 2714 and the second end 2716. In operation, the cover 2710 is pivotable about its second end 2716 between at least a locked configuration and an unlocked configuration (shown in FIG. 70). In the locked configuration, the fastener 2718 secures the first end 2714 of the cover 2710 to the body 2704 and the weight 2712 is disposed at least partially within the recessed channel 2708 and retained therein by the cover 2710. The position of the weight 2712 within the recessed channel 2708 between the first end 2714 and the second end 2716 of the cover 2710 is thereby retained indirectly by the fastener 2718. In the unlocked configuration, the first end 2714 of the cover 2710 pivots out of the recessed channel 2708 to enable the weight 2712 to be repositioned (e.g., slide along the cover 2710) as required or desired. The unlocked configuration is illustrated in FIG. 70 and the weight 2712 moves with the cover 2710.

The second end 2716 of the cover 2710 can include a hook 2720 that pivotably engages with a post 2722 in the body 2704. The hook 2720 includes a hard stop 2724 that is configured to engage with the body 2704 in the unlocked position so as to define the pivot limit of the cover 2710. The hard stop 2724 can be tapered on one end so that the second end 2716 of the cover 2710 is more easily inserted into the body 2704 during assembly. In other example, the second end 2716 of the cover 2710 can be pivotably coupled to the body 2704 with a pin connection (not shown). The recessed channel 2708 can include one or more locating lugs 2726 to assist in positioning the weight 2712 as required or desired. In aspects, the weight 2712 can be positionable in two, four, or six discrete positions at least partially defined by the locating lugs 2726. In this example, the weight 2712 is slidably engaged with the cover 2710 and pivots therewith. In other examples, the weight can be slidably engaged with the body so that it does not pivot with the cover. This example is described below in reference to FIG. 73.

Figure 73:
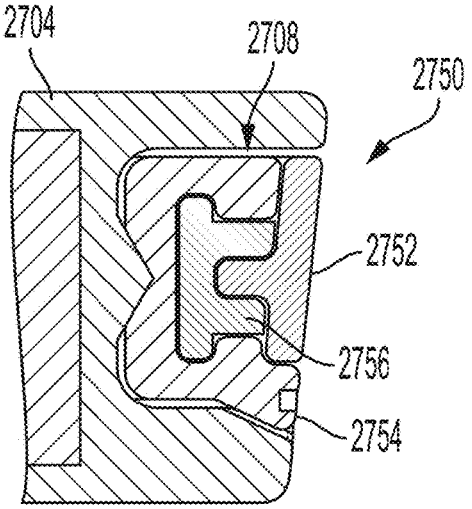
FIG. 73 is a cross-sectional view of another weight assembly that can be used with the test mule shown in FIG. 70.

FIG. 73 is a cross-sectional view of another weight assembly 2750 that can be used with the test mule 2700 (shown in FIG. 70). In this example, the weight assembly 2750 includes a pivotable cover 2752 and a slidable weight 2754. However, in this example, the weight 2754 is slidably engaged at least partially within the recessed channel 2708 of the body 2704 so that the weight 2754 does not pivot with the cover 2752. The weight assembly 2750 includes a rail 2756 that secures the weight 2754 to the body 2704 while still enabling the weight 2754 to slide. In the locked configuration as illustrated in FIG. 73, the cover 2752 secures the position of the weight 2754 relative to the body 2704 via the rail 2756.

Figure 74:
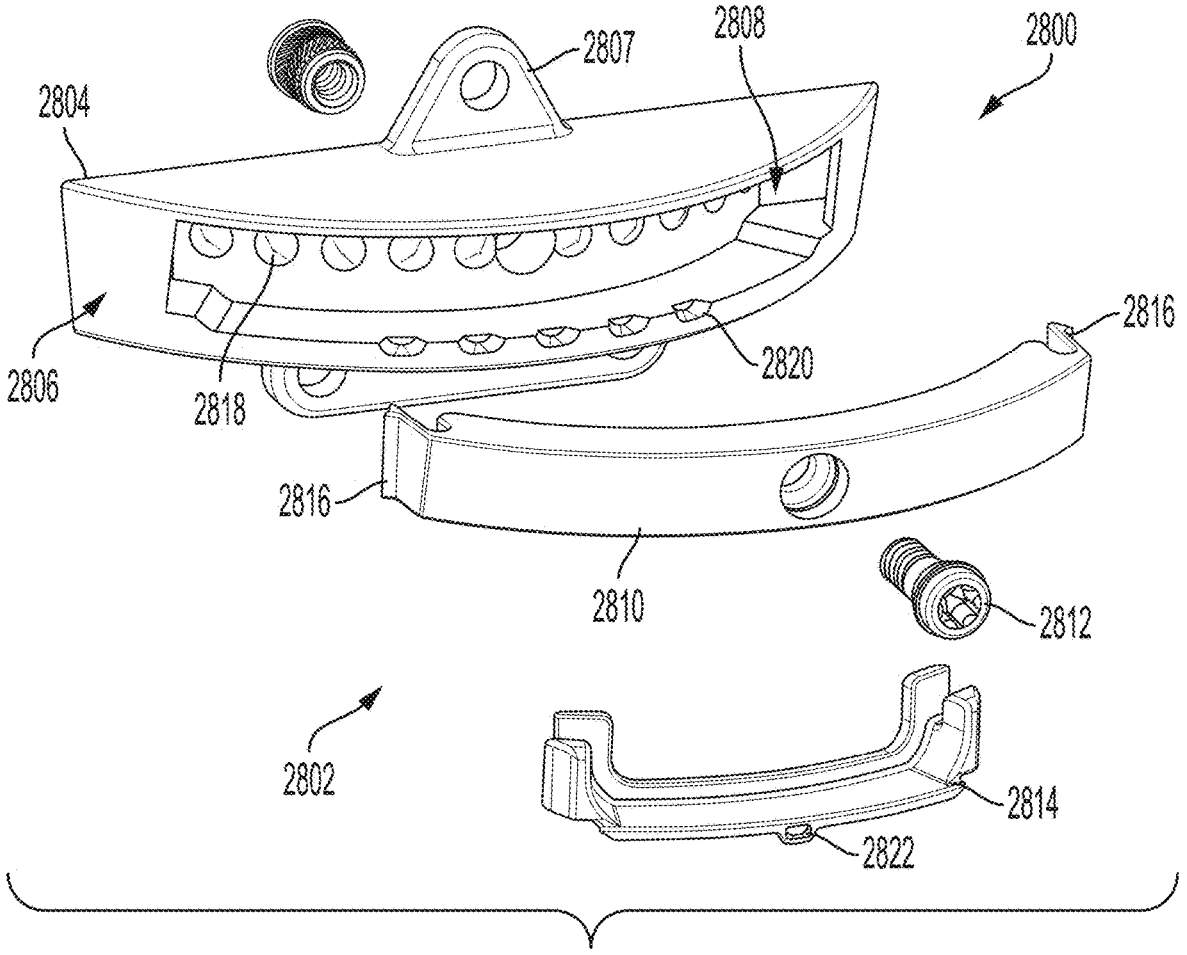
FIG. 74 is an exploded perspective view of another test mule with another weight assembly.

FIG. 74 is an exploded perspective view of another test mule 2800 with another weight assembly 2802. Similar to the examples described above in FIGS. 59-64 and 67-72, the test mule 2800 represents a club head that can be any type of club head described herein as required or desired, and in an aspect, the weight assembly 2802 is disposed on a skirt of the club head and at a rear perimeter where the sole and the crown couple together. The test mule 2800 includes a body 2804 having an outer surface 2806 that represents the club head and a bracket 2807. A recessed channel 2808 is defined in the outer surface 2806 of the body 2804. In this example, however, the weight assembly 2802 includes a cover 2810 that is coupled to the body 2804 via a fastener 2812 that is disposed proximate a center of the cover 2810. The cover 2810 is configured to secure a slidable weight 2814 while enabling a position of the weight 2814 to be selectively adjusted. The weight 2814 has an elongated U-shape so as to accommodate the center mounted fastener 2812 and a portion of the weight 2814 can be disposed on both sides of the fastener 2812. The cover 2810 has projections 2816 at each end to engage with the recessed channel 2808. The recessed channel 2808 includes locating lugs 2818 to assist in positioning the weight 2814 and dimples 2820 that receive at least a portion of a position indicator 2822 of the weight 2814.

Figure 75:
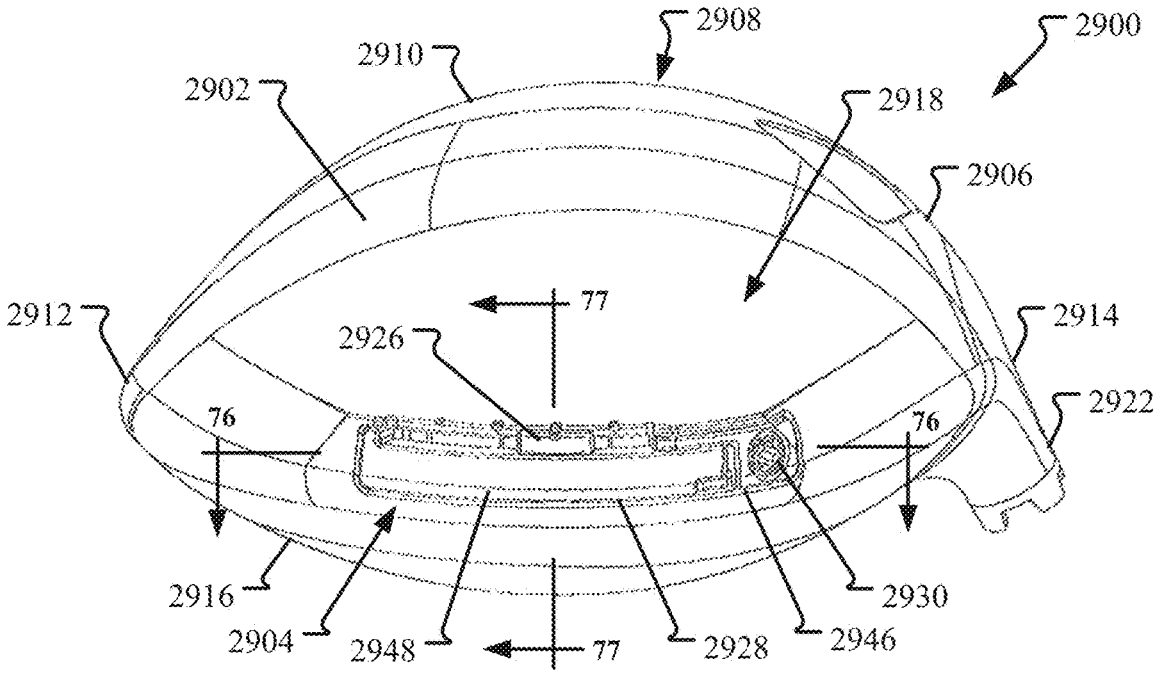
FIG. 75 is a perspective view of a sole of another golf club head with another weight assembly.
Figure 76:
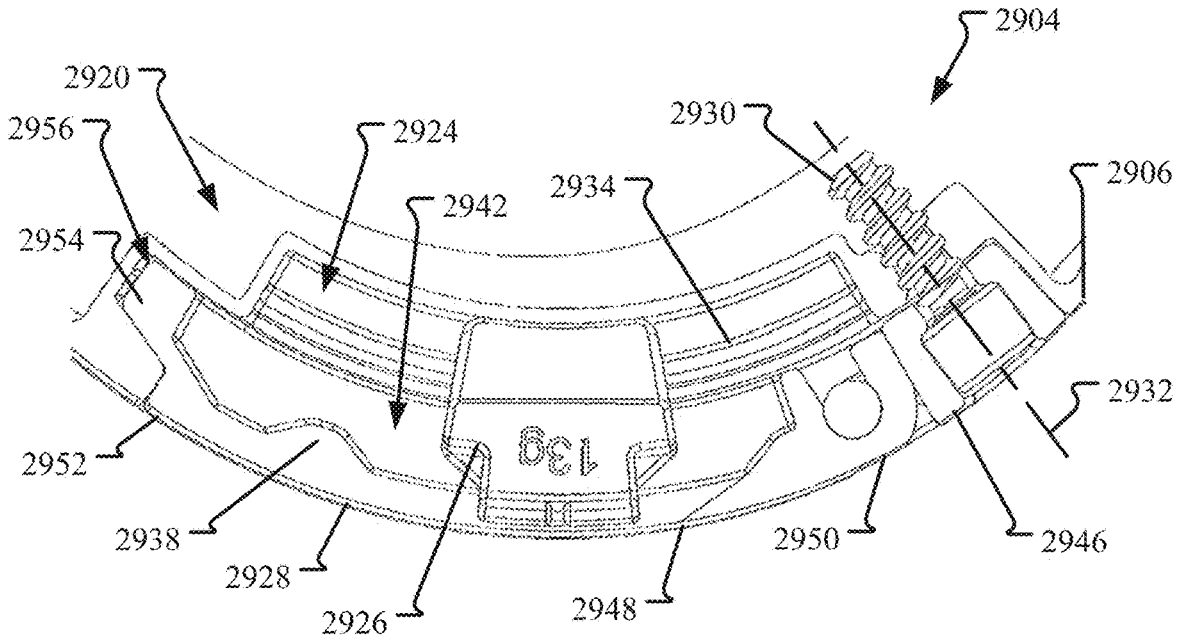
FIG. 76 is a cross-sectional view of the weight assembly taken along line 76-76 in FIG. 75.
Figure 77:
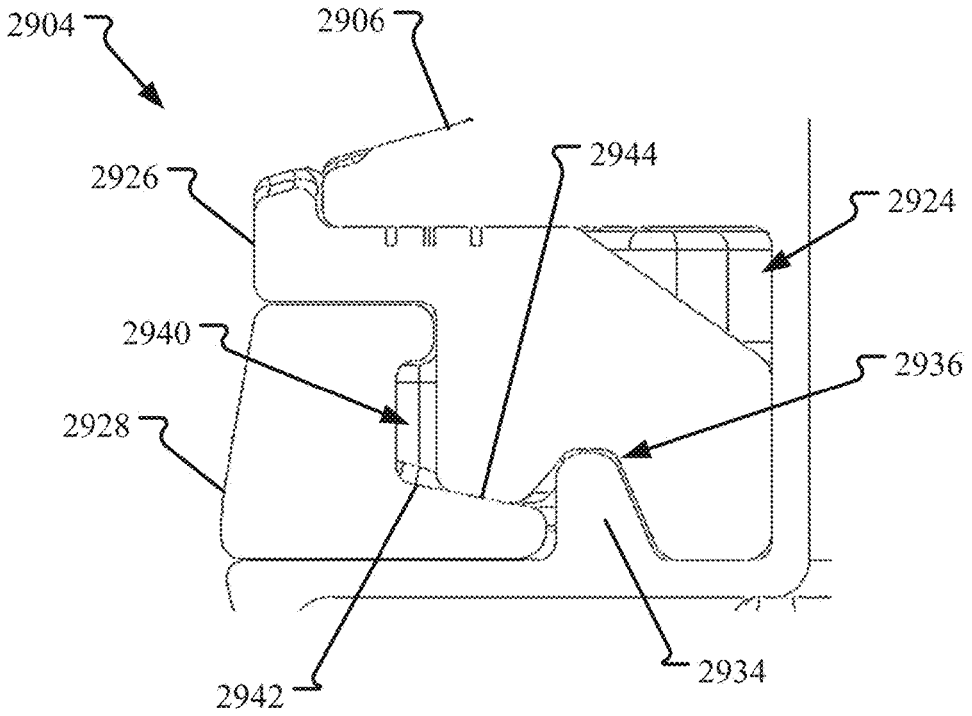
FIG. 77 is a cross-sectional view of the weight assembly taken along line 77-77 in FIG. 75.

FIG. 75 is a perspective view of a sole 2902 of another golf club head 2900 with another weight assembly 2904. FIG. 76 is a cross-sectional view of the weight assembly 2904 taken along line 76-76 in FIG. 75. FIG. 77 is a cross-sectional view of the weight assembly 2904 taken along line 77-77 in FIG. 75. Referring concurrently to FIGS. 75-77, the golf club head 2900 is a metalwood-type golf club head having a body 2906 that includes a striking face 2908 with a lower edge 2910 and an upper edge (not shown) extending between a toe 2912 and a heel 2914. The sole 2902 extends from the lower edge 2910 on the bottom side of the club head 2900 and a crown 2916 extends from the upper edge on the top of the club head 2900. The sole 2902, the striking face 2908, and the crown 2916 are coupled together so as to define an outer surface 2918 of the body 2906 with an interior cavity 2920 formed within. A hosel 2922 is disposed at the heel 2914 and is configured to couple to a shaft (not shown). The functions of the components (e.g., sole, striking face, crown, hosel, etc.) of the metalwood-type club head 2900 are similar to the component functions described above. The body 2906 may form any type club head, such as a fairway-metal type club head, an iron-type club head, or a hybrid-type club head as required or desired. Furthermore, the features of the weight assembly 2904 described below can additionally or alternatively be utilized in any type club head described herein as required or desired.

In this example, a recessed channel 2924 is defined within the sole 2902 of the body 2906 of the club head 2900. The channel 2924 extends in the toe 2912—heel 2914 direction so that the CG and the MOI of the club head 2900 can be adjusted for fade-draw bias. In an aspect, the recessed channel 2924 may be defined in a transition area where the sole 2902 and the crown 2916 couple together opposite the striking face 2908 and known as a skirt of the club head 2900. As such, the recessed channel 2924 and the weight assembly 2904 are disposed at a rear perimeter of the club head 2900 and proximate where the sole 2902 and the crown 2916 couple together. In an aspect, the recessed channel 2924 and the weight assembly 2904 are disposed substantially at a rear perimeter portion of the club head 2900 opposite the striking face 2908.

The weight assembly 2904 includes a slidable weight 2926 disposed at least partially within the recessed channel 2924 and configured to slide therein, a cover 2928 that extends at least partially over the channel 2924 and adapted to releasably secure the weight 2926 within the recessed channel 2924, and a fastener 2930 configured to couple the cover 2928 to the body 2906. The fastener 2930 retains the weight 2926 in the recessed channel 2924 indirectly via the cover 2928 and so that the weight 2926 can be used to adjust the CG and the MOI of the club head. Similar to the examples described above, the weight assembly 2904 is configured to move between at least a locked configuration, shown in FIG. 79 and described further below, and an unlocked configuration, shown in FIG. 80 and described further below. In the locked configuration, the cover 2928 is at least partially disposed within the recessed channel 2924, and the weight 2926 is secured within the channel 2924 with its movement restricted. In the unlocked configuration, the fastener 2930 enables the cover 2928 to move along a fastener axis 2932 so that the weight 2926 is released and can slide relative to cover 2928 and the body 2906. Additionally, in this example, the cover 2928 can also at least partially rotate relative to the recessed channel 2924 and the body 2906 towards a weight removal configuration, shown in FIG. 81 and described further below.

The body 2906 includes a partial wall 2934 that is disposed within the recessed channel 2924. The partial wall 2934 extends from a bottom of the recessed channel 2924, and the weight 2926 includes a recess 2936 shaped and sized to receive at least a portion of the partial wall 2934. By slidably engaging the partial wall 2934 and the recess 2936 of the weight 2926, the weight 2926 does not move with the cover 2928 when the cover is moved towards the unlocked configuration. To assist in positioning the weight 2926 at preselected positions within the recessed channel 2924, the cover 2928 includes at least one locating lug 2938 that extends from an inner surface of the cover 2928. The weight 2926 includes a corresponding hollow 2940 shaped and sized to receive at least a portion of the locating lug 2938. As such, when the weight 2926 is engaged with the cover 2928, the weight 2926 is retained more tightly within the cover 2928 to reduce or prevent rattling and further movement of the weight 2926 in the locked configuration. In the example, the inner surface of the cover 2928 includes an oblique surface 2942 that is configured to engage with a corresponding oblique surface 2944 on the weight 2926. The oblique surfaces 2942, 2944 taper in a direction such that their height above the bottom wall of the recessed channel 2924 is larger and increases along a direction that is away from the partial wall 2934. This configuration urges the weight 2926 in a direction towards the top wall of the recessed channel 2924 and induces a compression force on the weight 2926 between the cover 2928 and the recessed channel 2924 for securing the weight 2926 therein.

Figure 81:
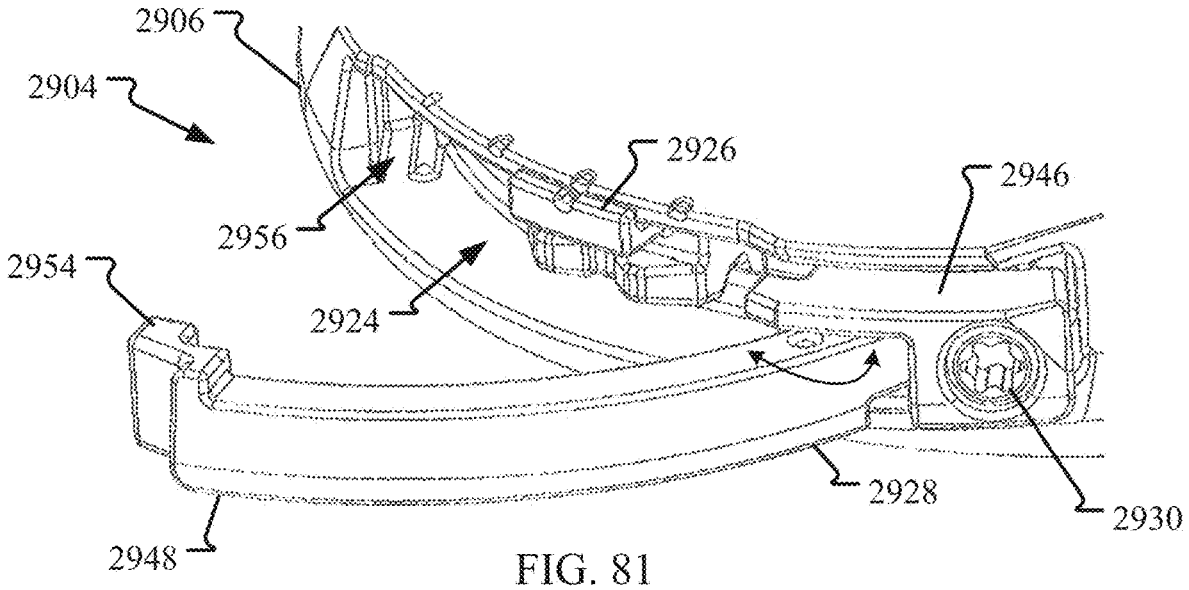
FIG. 81 is a perspective view of the weight assembly shown in FIG. 75 in a weight removal configuration.

In this example, the cover 2928 is formed from a first portion 2946 and a second portion 2948. The fastener 2930 engages with the first portion 2946 via a lock-washer (not shown) such that the entire cover 2928 is linearly moveable along the fastener axis 2932. The second portion 2948 has a first end 2950 that is rotatably coupled to the first portion 2946 and an opposite second end 2952 that has a projection 2954. Similar to the other examples described herein, the projection 2954 is configured to engage with a corresponding chamber 2956 defined in the body 2906 and within the recessed channel 2924, so that when the weight assembly 2904 is in the locked configuration, the second end 2952 more tightly secures the weight 2926 within the recessed channel 2924. By enabling the second portion 2948 of the cover 2928 to rotate relative to the first portion 2946 when the second end 2952 is not engaged with the recessed channel 2924, access to the weight 2926 is increased and allows for the weight 2926 to be completely removed from the club head 2900 as required or desired and as illustrated in FIG. 81.

Figure 78:
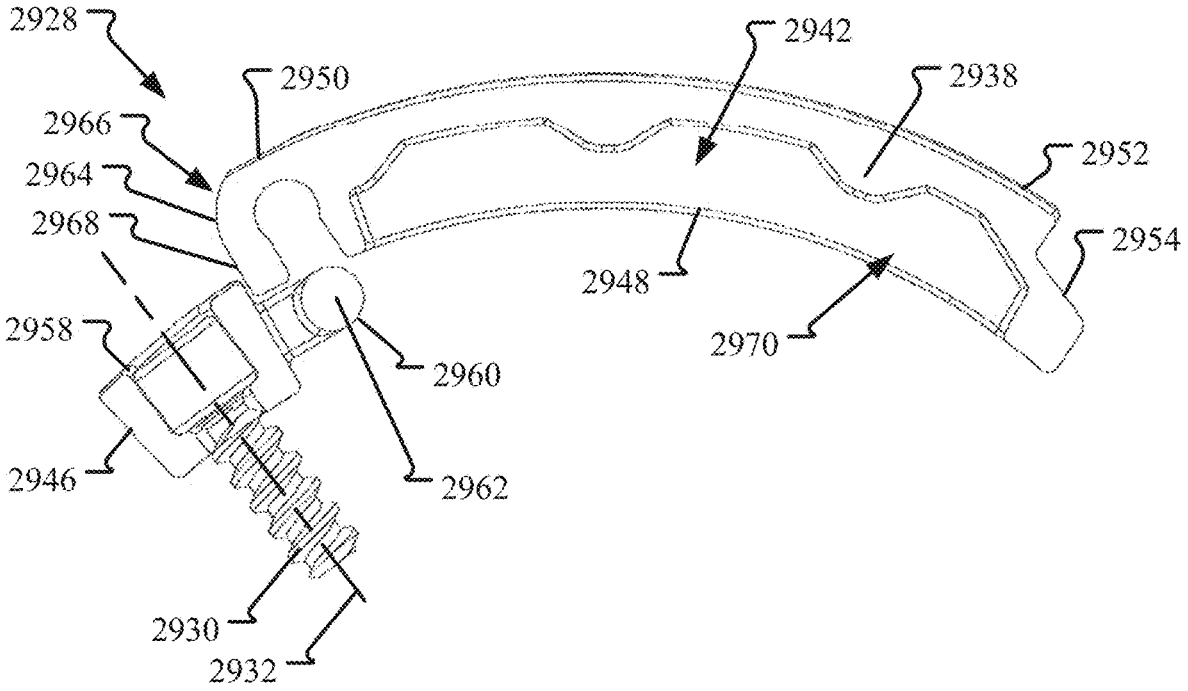
FIG. 78 is an exploded view of a cover of the weight assembly shown in FIG. 75.

FIG. 78 is an exploded view of the cover 2928 of the weight assembly 2904 (shown in FIGS. 75-77). The cover 2928 includes the first portion 2946 that couples to the fastener 2930 and the second portion 2948. In the example, the first portion 2946 and the second portion 2948 may be discrete and separable from one another. In other examples, the first portion 2946 and the second portion 2948 may be fixed to each other, while still being rotatable relative to one another. The first portion 2946 has a first end 2958 with a bore that is shaped and sized to receive and couple to the fastener 2930. The bore extends in a direction along the fastener axis 2932. The first portion 2946 also has an opposite second end 2960 that is configured to rotatably couple to the second portion 2948. The second end 2960 has a cylinder 2962 that is spaced away from the first end 2958 and that extends in a direction that is substantially orthogonal to the fastener axis 2932. The cylinder 2962 rotatably engages the second portion 2948 and defines a rotation axis for the second portion 2948 to rotate relative to the first portion 2946.

The second portion 2948 extends between the first end 2950 and the second end 2952. The first end 2950 has a hook 2964 that rotatably engages with the cylinder 2962 of the first portion 2946 such that the rotation axis of the second portion 2948 is substantially orthogonal to the fastener axis 2932. In an aspect, an outer surface 2966 of the hook 2964 is rounded so that the second portion 2948 can rotate around the cylinder 2962. The hook 2964 is formed at least partially by an arm 2968 that is elongated and engages with a sidewall of the bore of the first portion 2946 so that rotation of the second portion 2948 is partially limited. This configuration allows the second portion 2948 to move with the first portion 2946 when the first portion 2946 linearly moves along the fastener axis 2932. In some examples, the hook 2964 can snap-fit around the cylinder 2962 so that in order to separate the two portions 2946, 2948, a separation force is required. The second end 2952 of the second portion 2948 includes the projection 2954. Extending between the first end 2950 and the second end 2952 of the second portion 2948, a cutout 2970 is formed that is sized and shaped to at least partially receive the weight 2926 (shown in FIGS. 76 and 77). Within the cutout 2970, the locating lugs 2938 and the oblique surface 2942 of the cover 2928 are formed.

Figure 79:
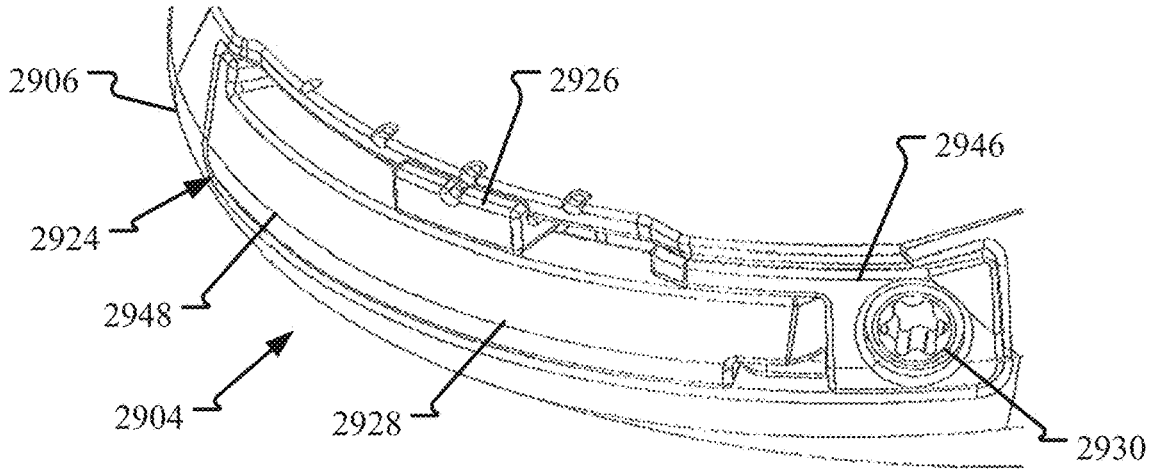
FIG. 79 is a perspective view of the weight assembly shown in FIG. 75 in a locked configuration.

FIG. 79 is a perspective view of the weight assembly 2904 in a locked configuration. In the locked configuration, the fastener 2930 is tightened to the body 2906 of the club head so that the cover 2928 is engaged to the body 2906 and at least partially within the recessed channel 2924 to secure a position of the weight 2926 within the recessed channel 2924. In the locked configuration, the fastener 2930 retains the weight 2926 in the recessed channel 2924 indirectly via the cover 2928. The first end of the first portion 2946 of the cover 2928 is secured to the body 2906 by the fastener 2930. The second end of the second portion 2948 of the cover 2928 is secured to the body 2906 via the projection 2954 (shown in FIG. 78) such that rotation of the second portion 2948 relative to the first portion 2946 is prevented. Between the first portion 2946 and the second portion 2948, the hook 2964 and cylinder 2962 (shown in FIG. 78) engagement restricts the portions 2946, 2948 from separating from one another in the locked configuration. In order to release the weight 2926 from its secured position, the fastener 2930 is used to move the weight assembly 2904 towards the unlocked configuration described below in reference to FIG. 80.

Figure 80:
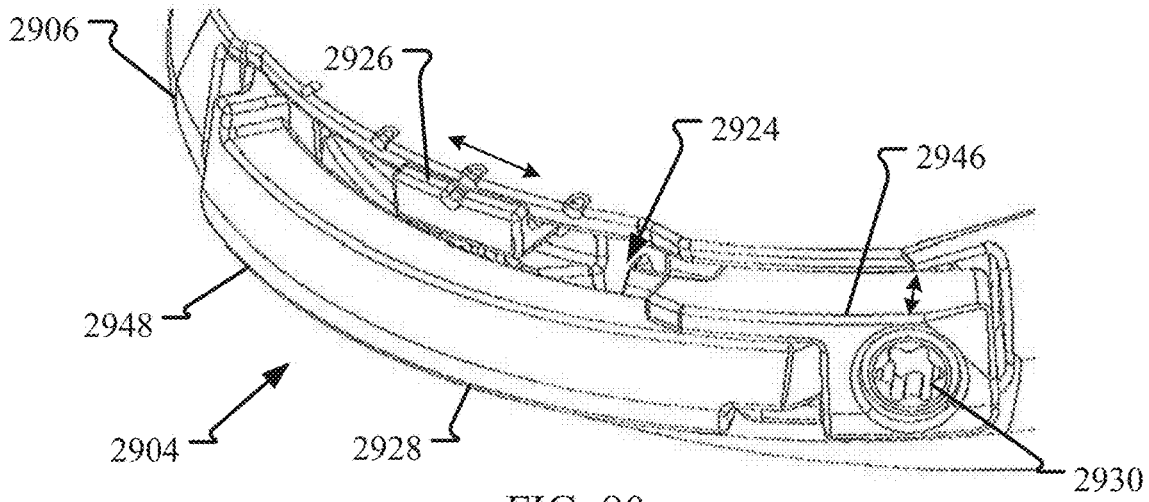
FIG. 80 is a perspective view of the weight assembly shown in FIG. 75 in an unlocked configuration.

FIG. 80 is a perspective view of the weight assembly 2904 in an unlocked configuration. In the unlocked configuration, the fastener 2930 is loosened with respect to the body 2906 of the club head. When the fastener 2930 is loosened, the cover 2928 linearly moves along the fastener axis 2932 (shown in FIG. 78) and at least partially raises out of the recessed channel 2924. In the unlocked configuration, the cover 2928 releases the weight 2926 so that the weight 2926 may slide within the recessed channel 2924. The first end of the first portion 2946 of the cover 2928 remains secured to the body 2906 by the fastener 2930 in the unlocked configuration.

In some examples, the second end of the second portion 2948 of the cover 2928 can remain partially engaged to the body 2906 via the projection 2954 (shown in FIG. 78) in the unlocked configuration so that rotation of the second portion 2948 relative to the first portion 2946 remains restricted and the weight 2926 cannot be removed from the recessed channel 2924. However, the weight 2926 is still enabled to slide and be repositioned as required or desired. In this example, to disengage the projection 2954 from the recessed channel 2924, the fastener 2930 is used to further raise the cover 2928 along the fastener axis 2932 so as to position the cover 2928 in a weight removal configuration as described below in reference to FIG. 81. In other examples, in the unlocked configuration the cover 2928 is raised such that the projection 2954 is disengaged from the recessed channel 2924 without any further movement along the fastener axis 2932. In this example, the cover 2928 is positioned such that it can be moved towards a weight removal configuration without further movement via the fastener 2930 as described below in reference to FIG. 81.

FIG. 81 is a perspective view of the weight assembly 2904 in a weight removal configuration. In the weight removal configuration, the first portion 2946 of the cover 2928 is raised at least partially out of the recessed channel 2924 such that the projection 2954 of the second portion 2948 is disengaged from the chamber 2956 defined within the recessed channel 2924. This disengagement enables the second portion 2948 of the cover 2928 to open towards the weight removal configuration by rotating relative to the first portion 2946 and in an outwards direction relative to the body 2906 of the club head. The fastener 2930 does not need to be used to open the second portion 2948 of the cover 2928. The rotation of the second portion 2948 is around a rotation axis that is substantially orthogonal to the fastener axis 2932 (shown in FIG. 78). By opening the cover 2928 the weight 2926 can be completely removed from the recessed channel 2924 as required or desired. Additionally, when the second portion 2948 is rotated relative to the first portion 2946 of the cover 2928, the hook 2964 and cylinder 2962 engagement (shown in FIG. 78) restricts the portions 2946, 2948 from separating from one another in the weight removal configuration.

Figure 82:
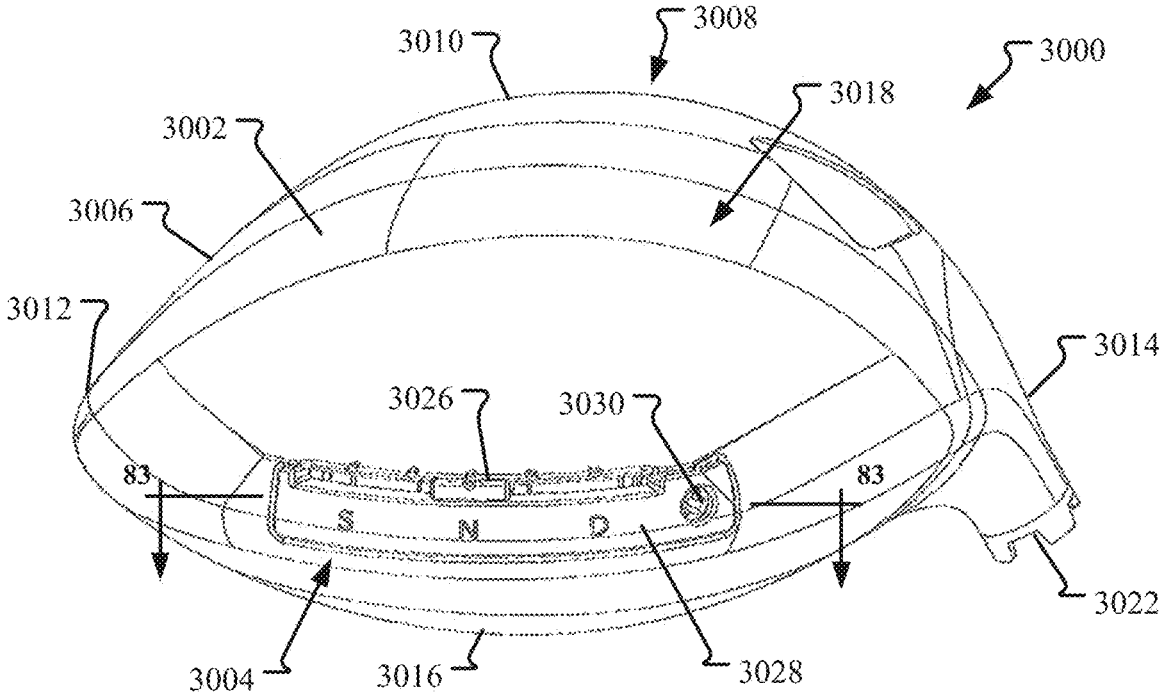
FIG. 82 is a perspective view of a sole of another golf club head with another weight assembly.
Figure 83:
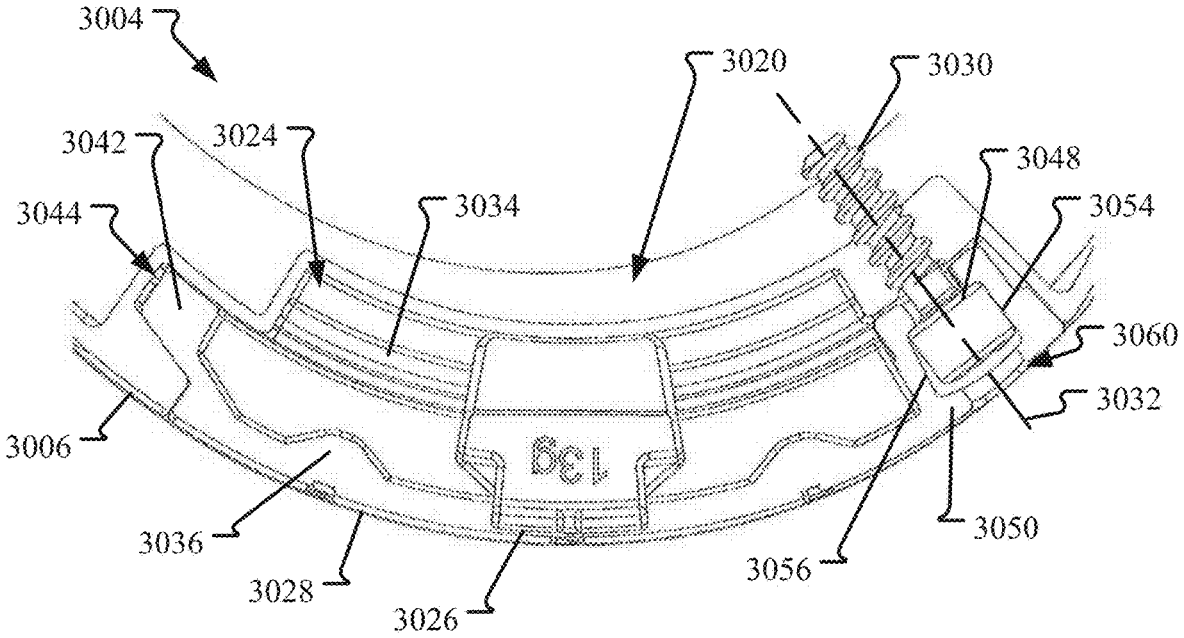
FIG. 83 is a cross-sectional view of the weight assembly taken along line 83-83 in FIG. 82.

FIG. 82 is a perspective view of a sole 3002 of another golf club head 3000 with another weight assembly 3004. FIG. 83 is a cross-sectional view of the weight assembly 3004 taken along line 83-83 in FIG. 82. Referring concurrently to FIGS. 82 and 83, the golf club head 3000 includes a body 3006, a striking face 3008, a lower edge 3010, an upper edge (not shown), a toe 3012, a heel 3014, a crown 3016, an outer surface 3018, an interior cavity 3020, and a hosel 3022, the functions of which are similar to the component functions described above. The body 3006 may form any type club head as described herein, such as, a metal-wood-type club head, a fairway-metal type club head, an iron-type club head, or a hybrid-type club head as required or desired. Furthermore, the features of the weight assembly 3004 described below can additionally or alternatively be utilized in any type club head described herein as required or desired.

In this example, a recessed channel 3024 is defined within the sole 3002, and/or a transition area (e.g., skirt) where the sole 3002 and the crown 3016 couple together. The channel 3024 extends in the toe 3012—heel 3014 direction so that the CG and the MOI of the club head 3000 can be adjusted for fade-draw bias. In an aspect, the recessed channel 3024 and the weight assembly 3004 are disposed substantially at a rear perimeter portion of the club head 3000 opposite the striking face 3008.

The weight assembly 3004 includes a slidable weight 3026 disposed at least partially within the recessed channel 3024 and configured to slide therein, a cover 3028 that extends at least partially over the channel 3024 and adapted to releasably secure the weight 3026 within the recessed channel 3024, and a fastener 3030 configured to couple the cover 3028 to the body 3006. Similar to the examples described above, the weight assembly 3004 is configured to move between at least a locked configuration, shown in FIG. 85 and described further below, and an unlocked configuration, shown in FIG. 86 and described further below. In the locked configuration, the cover 3028 is at least partially disposed within the recessed channel 3024, and the weight 3026 is secured within the channel 3024 with its movement restricted. In the unlocked configuration, the fastener 3030 enables the cover 3028 to move along a fastener axis 3032 so that the weight 3026 can slide relative to cover 3028 and the body 3006. Additionally, in this example, the cover 3028 can also at least partially rotate relative to the recessed channel 3024 and the body 3006 towards a weight removal configuration, shown in FIG. 87 and described further below. Additionally, the body 3006 includes a partial wall 3034 that slidably engages the weight 3026 and the cover 3028 includes at least one locating lug 3036 to facilitate positioning of the weight 3026.

Figure 84:
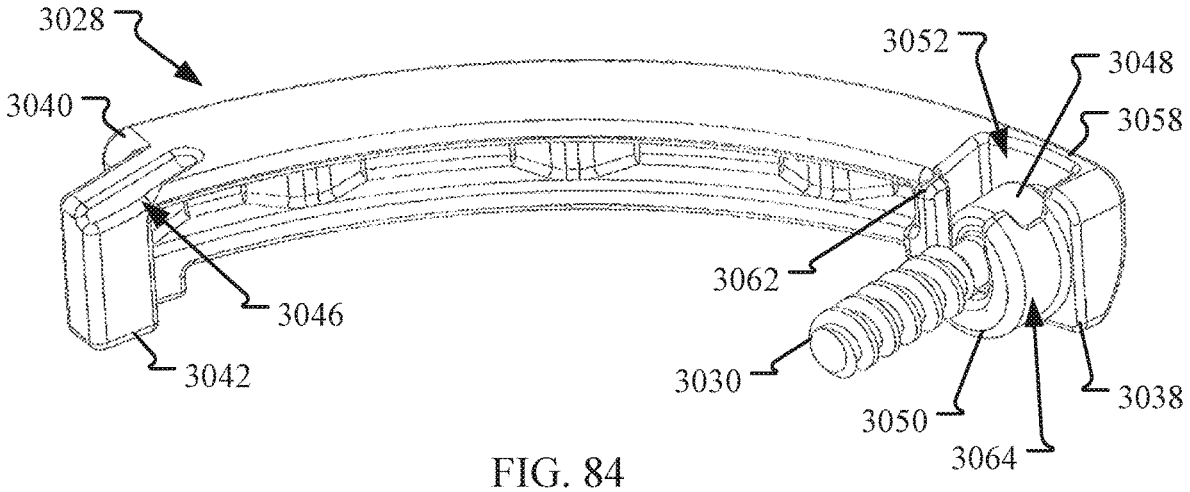
FIG. 84 is a perspective view of a cover of the weight assembly shown in FIG. 82.

FIG. 84 is a perspective view of the cover 3028 of the weight assembly 3004 (shown in FIGS. 82 and 83). With continued reference to FIG. 83, the cover 3028 has a first end 3038 and an opposite second end 3040. The second end 3040 has a projection 3042, which similar to the other examples herein, the projection 3042 is configured to engage with a corresponding chamber 3044 defined in the body 3006 and within the recessed channel 3024. As such, when the weight assembly 3004 is in the locked configuration, the second end 3040 more tightly secures the weight 3026 to the body 3006. In some examples, a duct 3046 is defined in the cover 3028 that is configured to engage with a corresponding lip (not shown) that extends from the recessed channel 3024. This duct and lip feature facilitates the sliding engagement of the second end 3040 of the cover 3028 with the recessed channel 3024 within the body 3006 and as described further above in reference to FIGS. 65 and 66. The first end 3038 of the cover 3028 engages with an enlarged head 3048 of the fastener 3030 and the fastener 3030 is freely rotatable relative to the cover 3028. In this example, the fastener 3030 is not coupled to the cover 3028 with a lock-washer, and the fastener 3030 is devoid of a lock-washer.

Figure 87:
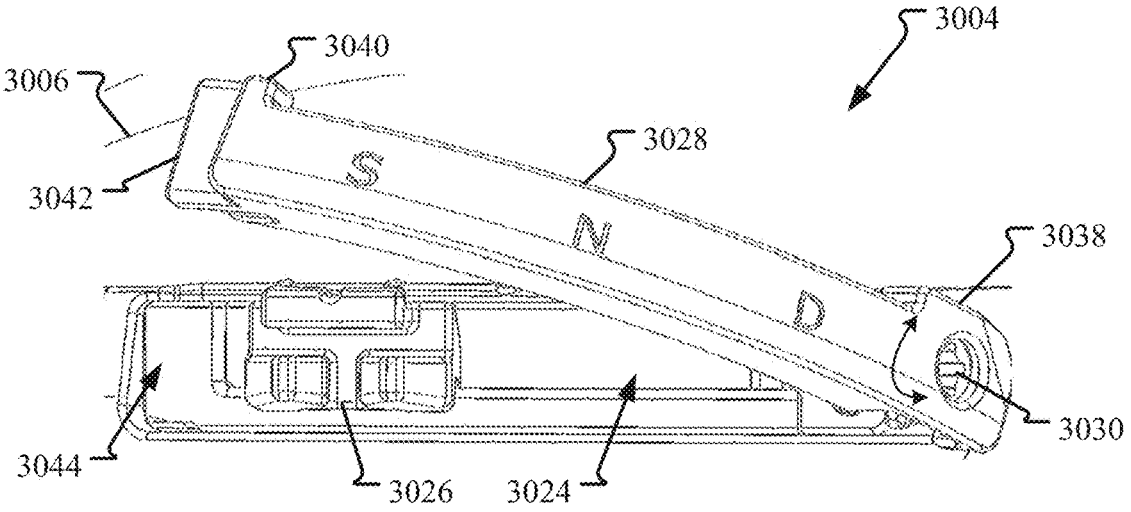
FIG. 87 is a perspective view of the weight assembly shown in FIG. 82 in a weight removal configuration.

The first end 3038 of the cover 3028 has a holder 3050 defined on an inner surface of the cover 3028 that is shaped and sized to receive the enlarged head 3048 of the fastener 3030. The holder 3050 has an inner surface 3052 that is larger than the enlarged head 3048 so that the enlarged head 3048 is freely rotatable within the holder 3050. In the example, the inner surface 3052 has a first sidewall 3054 that is substantially parallel to the fastener axis 3032 and an opposite second sidewall 3056 that is tapered relative to the fastener axis 3032. In an aspect, the second sidewall 3056 is oriented so as to increase the gap between the first sidewall 3054 and the second sidewall 3056 in a direction that is towards an outer surface of the cover 3028. When the fastener 3030 is tightened to or loosened from the body 3006 of the club head, the enlarged head 3048 is positioned against the first sidewall 3054 of the inner surface 3052, as illustrated in FIG. 83. This configuration aligns cover 3028 along the fastener axis 3032 so that the cover 3028 can linearly move along the fastener axis 3032 and engage or disengage the projection 3042 relative to the chamber 3044. However, when the fastener 3030 is loosened from the body 3006 (e.g., the enlarged head 3048 raised from the body 3006 along the fastener axis 3032) and the cover 3028 is disengaged from the body 3006, the second end 3040 of the cover 3028 can also be angled away from the body 3006 via the orientation of the second sidewall 3056. This movement of the cover 3028 enables the cover 3028 to at least partially rotate around the fastener axis 3032 towards a weight removal configuration as illustrated in FIG. 87 and described further below.

The inner surface 3052 of the holder 3050 also includes an outer axial wall 3058 that is substantially orthogonal to the fastener axis 3032. The outer axial wall 3058 confines the enlarged head 3048 within the holder 3050 in an axial direction along the fastener axis 3032 so that when the enlarged head 3048 is loosened and raised relative to the body 3006 of the club head, corresponding linear movement is induced on the cover 3028 even without use of a lock-washer. The outer axial wall 3058 can include an aperture 3060 so that a tool (not shown) can access the enlarged head 3048. In an aspect, the aperture 3060 has a diameter that is less than a diameter of the enlarged head 3048. An opposite inner axial wall 3062 is configured to at least partially hook around the enlarged head 3048 so that when the enlarged head 3048 is tightened and lowered relative to the body 3006, corresponding linear movement is induced on the cover 3028 even without use of a lock-washer. Additionally, the holder 3050 is a protruding component of the cover 3028 (e.g., via the inner axial wall 3062) with an outer surface 3064 that extends at least partially circumferentially around the fastener axis 3032. As such, the outer surface 3064 is curved and at least partially cylindrical in shape. In an aspect, the outer surface 3064 is curved and extends at least 180° around the fastener axis 3032. The outer surface 3064 facilitates rotation of the cover 3028 relative to the body 3006, when the cover 3028 is at least partially raised out of the recessed channel 3024.

In the example, the holder 3050 is accessible from either the top or bottom of the cover 3028 and allows the fastener 3030 to be at least partially inserted into the holder 3050 (e.g., the enlarged head 3048). When the cover 3028 is coupled to the body 3006 via the fastener 3030 and at least partially inserted within the recessed channel 3024, the holder 3050 is at least partially inserted within the recessed channel 3024 because it is a protruding feature so that the cover 3028 is restricted or prevented from being decoupled from the enlarged head 3048 without completely withdrawing the holder 3050 from the recessed channel 3024.

Figure 85:
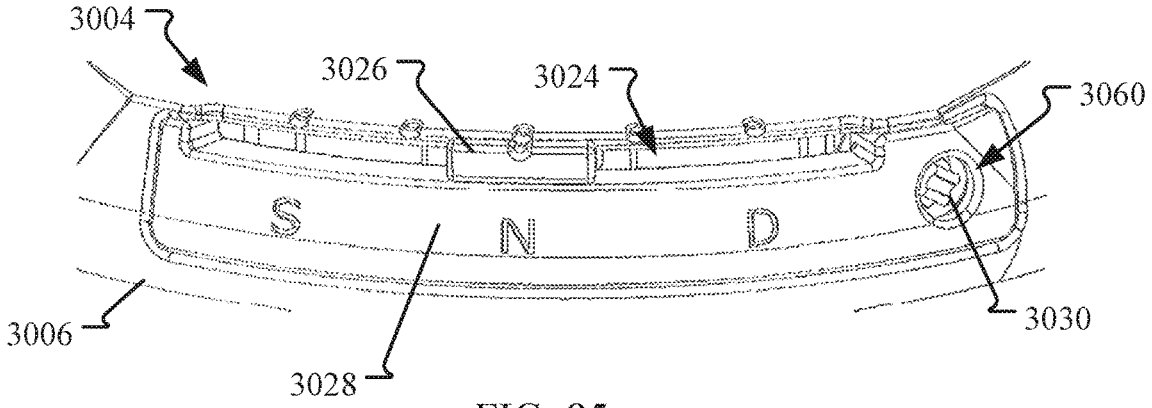
FIG. 85 is a perspective view of the weight assembly shown in FIG. 82 in a locked configuration.

FIG. 85 is a perspective view of the weight assembly 3004 in a locked configuration. In the locked configuration, the fastener 3030 is tightened to the body 3006 of the club head so that the cover 3028 is engaged to the body 3006 and at least partially within the recessed channel 3024 to secure a position of the weight 3026 within the recessed channel 3024. In the locked configuration, the fastener 3030 retains the weight 3026 in the recessed channel 3024 indirectly via the cover 3028. The first end of the cover 3028 is secured to the body 3006 by the fastener 3030. The second end of the cover 3028 is secured to the body 3006 via the projection 3042 (shown in FIG. 83) such that rotation of the cover 3028 is prevented. In order to release the weight 3026 from its secured position, the fastener 3030 via access by the aperture 3060 is used to move the weight assembly 3004 towards the unlocked configuration described below in reference to FIG. 86.

Figure 86:
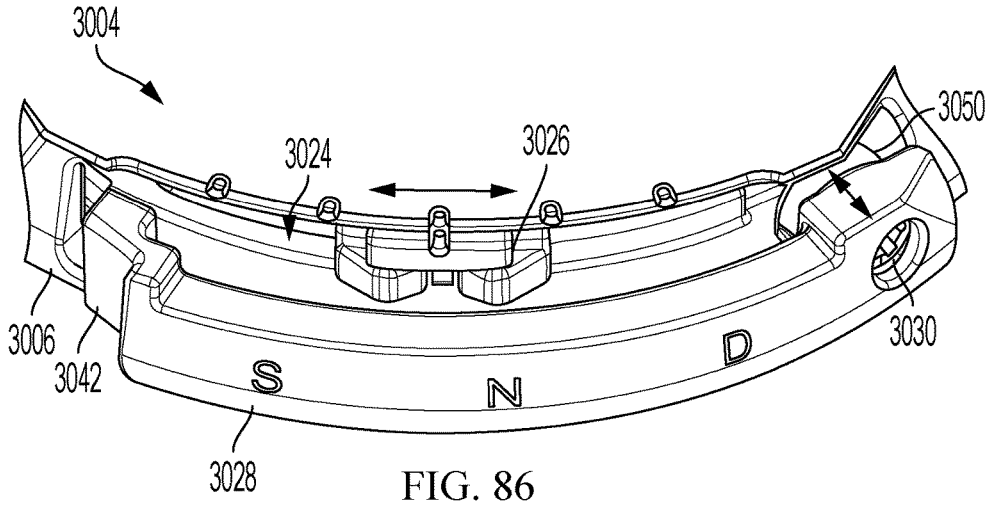
FIG. 86 is a perspective view of the weight assembly shown in FIG. 82 in an unlocked configuration.

FIG. 86 is a perspective view of the weight assembly 3004 in an unlocked configuration. In the unlocked configuration, the fastener 3030 is loosened with respect to the body 3006 of the club head. When the fastener 3030 is loosened, the cover 3028 linearly moves along the fastener axis 3032

(shown in FIG. 83) and at least partially raises out of the recessed channel 3024 by the fastener head engaging with the outer axial wall of the holder 3050. In the unlocked configuration, the cover 3028 releases the weight 3026 so that the weight 3026 may slide within the recessed channel 3024. The first end of the cover 3028 remains secured to the body 3006 by the fastener 3030 in the unlocked configuration.

In some examples, the second end of the cover 3028 can remain partially engaged to the body 3006 via the projection 3042 in the unlocked configuration so that rotation of the cover 3028 remains restricted and the weight 3026 cannot be removed from the recessed channel 3024. However, the weight 3026 is still enabled to slide and be repositioned as required or desired. In this example, to disengage the projection 3042 from the recessed channel 3024, the fastener 3030 is used to further raise the cover 3028 along the fastener axis 3032 so as to position the cover 3028 in a weight removal configuration as described below in reference to FIG. 87. In other examples, in the unlocked configuration the cover 3028 is raised such that the projection 3042 is disengaged from the recessed channel 3024 without any further movement along the fastener axis 3032. In this example, the cover 3028 is positioned such that it can be moved towards a weight removal configuration without further movement via the fastener 3030 as described below in reference to FIG. 87.

FIG. 87 is a perspective view of the weight assembly 3004 in a weight removal configuration. In the weight removal configuration, the first end 3038 of the cover 3028 is raised at least partially out of the recessed channel 3024 such that the projection 3042 of the second end 3040 is disengaged from the chamber 3044 defined within the recessed channel 3024. This disengagement enables the second end 3040 of the cover 3028 to be opened towards the weight removal configuration by angling away from the body 3006 of the club head and rotating it around the fastener axis of the fastener 3030. For example, the fastener head is positioned against the second sidewall 3056 (shown in FIG. 83) to angle the second end 3040 away from the body 3006 and the second end 3040 can be rotated around the fastener 3030. By opening the cover 3028, the weight 3026 can be completely removed from the recessed channel 3024 as required or desired. Additionally, the holder 3050 (shown in FIG. 83) of the fastener 3030 is still at least partially projecting into the recessed channel 3024 so that the cover 3028 cannot be completely removed from the body 3006 of the club head without further movement of the fastener 3030. This configuration enables both the cover 3028 and the fastener 3030 to remain coupled to the body 3006 in the weight removal configuration.

Figure 88:
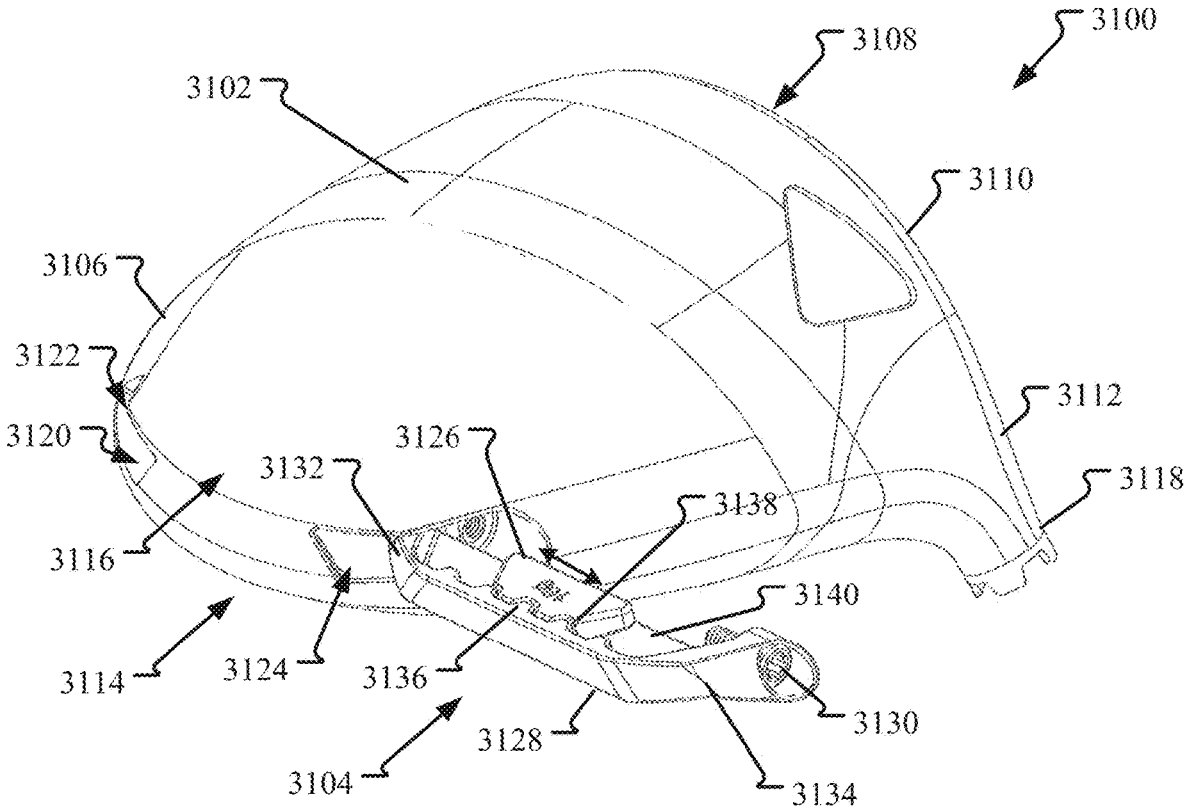
FIG. 88 is a perspective view of a sole of another golf club head with another weight assembly.

FIG. 88 is a perspective view of a sole 3102 of another golf club head 3100 with another weight assembly 3104. The golf club head 3100 includes a body 3106, a striking face 3108, a lower edge 3110, an upper edge (not shown), a toe (not shown), a heel 3112, a crown 3114, an outer surface 3116, an interior cavity (not shown), and a hosel 3118, the functions of which are similar to the component functions described above. The body 3106 may form any type club head as described herein, such as, a metalwood-type club head, a fairway-metal type club head, an iron-type club head, or a hybrid-type club head as required or desired. Furthermore, the features of the weight assembly 3104 described below can additionally or alternatively be utilized in any type club head described herein as required or desired.

In this example, a channel 3120 is defined by the body 3106 and the channel 3120 is a through-opening that extends through the body 3106 between a toe-side opening 3122 and a heel-side opening 3124. In some examples, the channel 3120 may be separated from the interior cavity of the body 3106 by a channel wall. In other examples, the channel 3120 may be at least partially open into the interior cavity of the body 3106. The channel 3120 may be disposed within the sole 3102, and/or a transition area where the sole 3102 and the crown 3114 couple together (e.g., skirt). The channel 3120 extends in the toe-heel direction so that the CG and the MOI of the club head 3100 can be adjusted for fade-draw bias. In an aspect, the channel openings 3122, 3124 are disposed substantially at a rear perimeter portion of the club head 3100 opposite the striking face 3108 and a front-rear centerline of the club head 3100.

The weight assembly 3104 includes a slidable weight 3126 slidably engaged with a cover 3128 and a fastener 3130 configured to couple the cover 3128 to the body 3106. The cover 3128 has a first end 3132 and an opposite second end 3134. The fastener 3130 is coupled to the first end 3132 (e.g., via a lock-washer) and the cover 3128 extends in a direction that is along the fastener axis. Both the first end 3132 and the second end 3134 of the cover 3128 have an outer surface that is shaped and sized to align with and not extend from the outer surface 3116 of the club head 3100 when secured thereto. Similar to the examples described above, the weight assembly 3104 is configured to move between at least a locked configuration (not illustrated) and an unlocked configuration (shown in FIG. 88). In the locked configuration, the cover 3128 inserted within the channel 3120 so that the weight 3126 is completely disposed within the channel 3120 and within the body 3106 of the club head 3100. The position of the weight 3126 on the cover 3128 is secured within the channel 3120 when the weight assembly 3104 is in the locked configuration. As such, the fastener 3130 retains the weight 3126 in the channel 3120 indirectly via the cover 3128. In the unlocked configuration, the fastener 3130 enables the cover 3128 to be at least partially withdrawn from the channel 3120 and along the fastener axis so that the weight 3126 is at least partially extracted from the channel 3120. When the weight 3126 is extracted from the body 3106, the weight 3126 can slide relative to cover 3128 for removal and/or repositioning on the cover 3128. As such, the position of the weight 3126 on the cover 3128 is adjustable so that the weight assembly 3104 is used to adjust the GC and MOI of the club head 3100.

In this example, an inner surface of the cover 3128 includes at least one locating lug 3136 spaced along the fastener axis. The weight 3126 includes one or more corresponding hollows 3138 shaped and sized to receive at least a portion of the locating lug 3136. Additionally, when the locating lug 3136 is engaged with the hollow 3138, the weight 3126 is retained more tightly by the cover 3128 to reduce or prevent rattling and further movement of the weight 3126 in the locked configuration. In an aspect, the cover 3128 can include a shelf 3140 that the weight 3126 is supported by. The shelf 3140 allows the weight 3126 to be extracted from within the channel 3120 when the weight assembly 3104 is moved into the unlocked configuration.

In some examples, the first end 3132 of the cover 3128 may be engaged at least partially with the channel 3120 so that the cover 3128 is coupled to the body 3106 of the club head 3100 in the unlocked configuration. In other example, the cover 3128 can be completely removable from the body 3106 of the club head 3100 as required or desired. By securing the slidable weight 3126 within the body 3106 of the club head 3100 aerodynamic performance of the outer surface 3116 of the club head 3100 can be increased.

Figure 89:
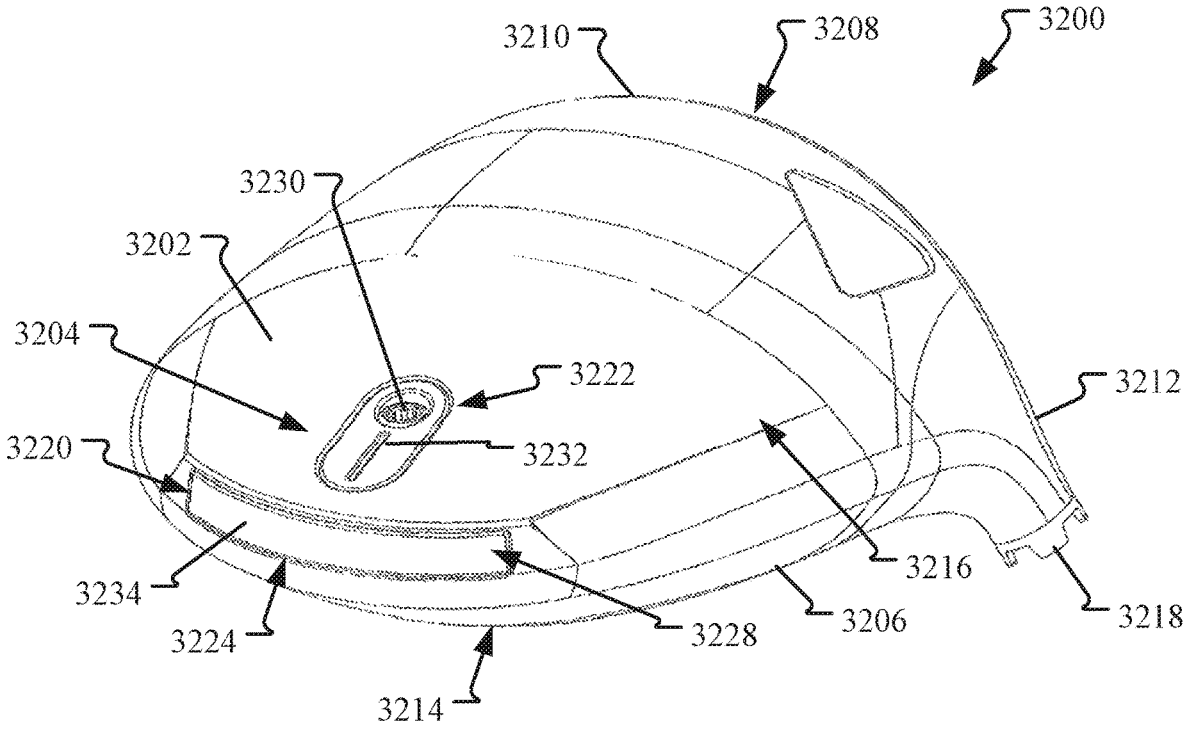
FIG. 89 is a perspective view of a sole of another golf club head with another weight assembly in a locked configuration.

FIG. 89 is a perspective view of a sole 3202 of another golf club head 3200 with another weight assembly 3204 in a locked configuration. The golf club head 3200 includes a body 3206, a striking face 3208, a lower edge 3210, an upper edge (not shown), a toe (not shown), a heel 3212, a crown 3214, an outer surface 3216, an interior cavity (not shown), and a hosel 3218, the functions of which are similar to the component functions described above. The body 3206 may form any type club head as described herein, such as, a metalwood-type club head, a fairway-metal type club head, an iron-type club head, or a hybrid-type club head as required or desired. Furthermore, the features of the weight assembly 3204 described below can additionally or alternatively be utilized in any type club head described herein as required or desired.

In this example, a channel 3220 is defined by the body 3206 for supporting the weight assembly 3204. The channel 3220 can include a first channel 3222 and a second channel 3224 that are in communication with one another. The first channel 3222 is defined in the sole 3202 of the body 3206 and extends in a front-rear direction of the club head 3200 with the striking face 3208 being the front of the club head 3200. The second channel 3224 is defined in the sole 3202, and/or a transition area (e.g., skirt) where the sole 3202 and the crown 3214 couple together. The second channel 3224 extends in the toe-heel direction so that the CG and the MOI of the club head 3200 can be adjusted for fade-draw bias. In an aspect, the second channel 3224 is disposed substantially at a rear perimeter portion of the club head 3200 opposite the striking face 3208. As such, the first channel 3222 and the second channel 3224 are oriented in substantially orthogonal directions and on different planes of the club head 3200.

The weight assembly 3204 includes a slidable weight 3226 (shown in FIG. 91) slidably engaged with a cover 3228 and a fastener 3230 configured to couple the cover 3228 to the body 3206. In this example, the cover 3228 includes a fastener tab 3232 and a weight tray 3234. The fastener tab 3232 is sized and shaped to be received within the first channel 3222 and the weight tray 3234 is sized and shaped to be received within the second channel 3224. The fastener 3230 is coupled to the fastener tab 3232 (e.g., via a lock washer) and the weight tray 3234. The fastener 3230 is configured to cooperate with both the fastener tab 3232 and the weight tray 3234 to retain and secure the weight 3226 within the body 3206 of the club head 3200. Similar to the examples described above, the weight assembly 3204 is configured to move between at least a locked configuration, shown in FIG. 89, and an unlocked configuration, shown in FIG. 90 and described further below. In the locked configuration, the cover 3228 is at least partially disposed within the recessed channel 3220, and the weight 3226 is secured within the body 3206 of the club head 3200 with its movement restricted. In the unlocked configuration, the fastener 3230 releases the cover 3228 from the body 3206 so that the weight assembly 3204 can move towards a weight adjustment configuration, shown in FIG. 91 and described further below. In the weight adjustment configuration, the position of the weight 3226 within the weight tray 3234 can be adjusted as required or desired.

In the locked configuration, both the fastener tab 3232 and the weight tray 3234 are positioned within the body 3206 of the club head 3200 so that they are not protruding and aligned with the outer surface 3216 of the club head 3200. Additionally, the weight 3226 is completely disposed within the body 3206 of the club head 3200, and secured therein, in the locked configuration. The fastener 3230 retains the weight 3226 in the recessed channel 3220 indirectly via the cover 3228 and so that the weight 3226 can be used to adjust the CG and the MOI of the club head 3200.

Figure 90:
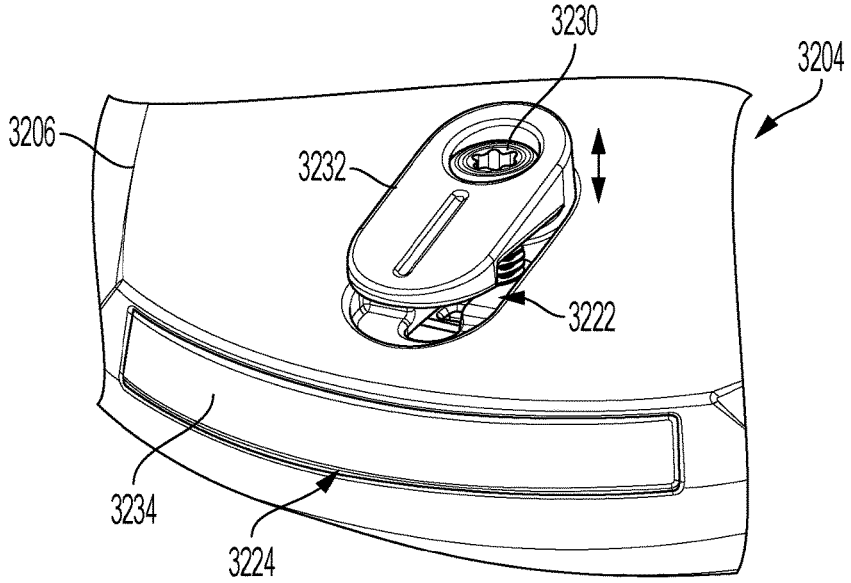
FIG. 90 is a perspective view of the weight assembly shown in FIG. 89 in an unlocked configuration.
Figure 91:
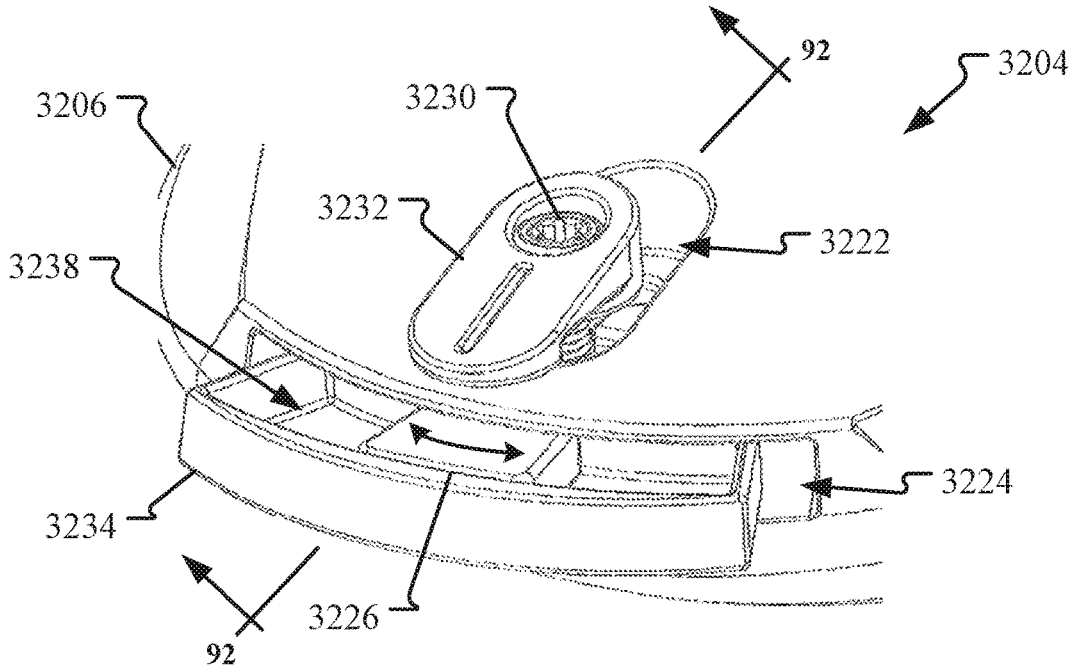
FIG. 91 is a perspective view of the weight assembly shown in FIG. 89 in a weight adjustment configuration.

FIG. 90 is a perspective view of the weight assembly 3204 in an unlocked configuration. In the unlocked configuration, the fastener 3230 is loosened such that it at least partially raises out of the first channel 3222 along the fastener axis. Because the fastener tab 3232 is coupled to the fastener 3230, the fastener tab 3232 also raises at least partially out of the first channel 3222. In the example, the fastener 3230 is positioned towards a front section of the first channel 3222. This movement of the fastener 3230 and the fastener tab 3232, however, does not correspond to the weight tray 3234 moving within the second channel 3224. Rather, once the weight assembly 3204 is in the unlocked configuration, the user can utilize the fastener tab 3232 to pull the weight tray 3234 at least partially out of the second channel 3224 and access the weight 3226 as illustrated in FIG. 91. In the unlocked configuration, the weight 3226 may still be disposed completely within the body 3206 of the club head.

Figure 92:
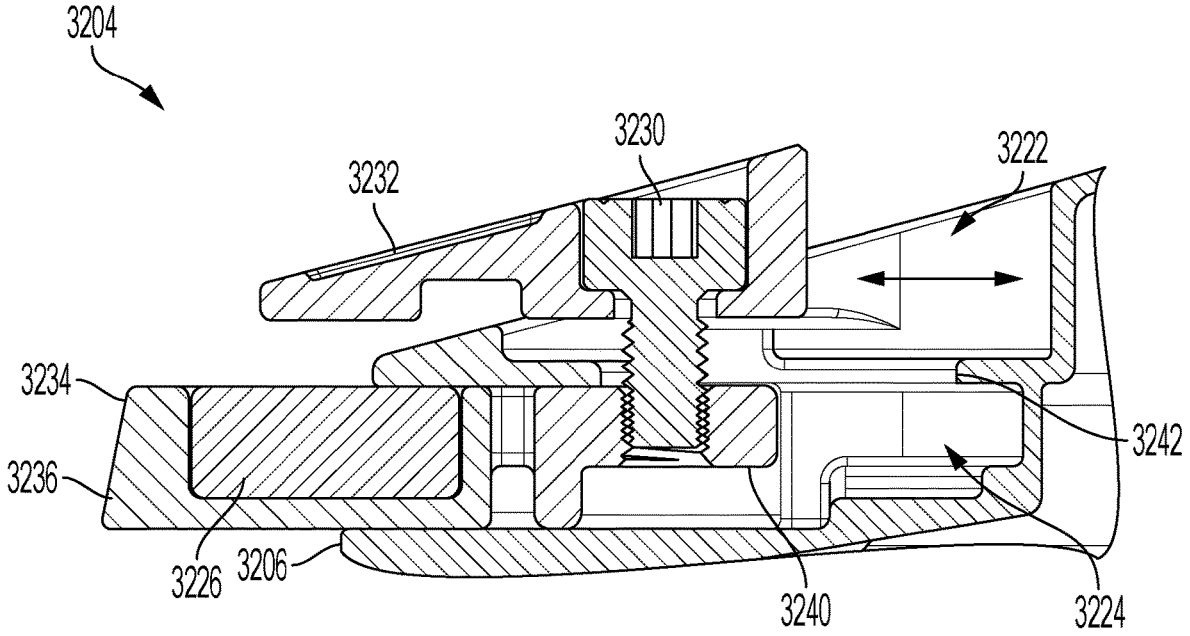
FIG. 92 is a cross-sectional view of the weight assembly taken along line 92-92 in FIG. 91.

FIG. 91 is a perspective view of the weight assembly 3204 in a weight adjustment configuration. FIG. 92 is a cross-sectional view of the weight assembly 3204 taken along line 92-92 in FIG. 91. Referring concurrently to FIGS. 91 and 92, the weight tray 3234 has a first end 3236 with a pool 3238 that is sized and shaped to receive the weight 3226 and allow the weight to be selectively positionable (e.g., via sliding) therein. A second end 3240 of the weight tray 3234 threadably engages with the fastener 3230 so that the fastener 3230 can rotate relative thereto. A slot 3242 is defined between the first channel 3222 and the second channel 3224 so that the fastener 3230 can extend between the two and couple to both the fastener tab 3232 and the weight tray 3234. The slot 3242 extends in a similar front-rear direction to the first channel 3222 so that the weight assembly 3204 can be linearly movable in a rearwards direction towards the weight adjustment configuration when the weight assembly 3204 is unlocked (e.g., disengage the fastener tab 3232 from the first channel 3222).

In operation, when the weight assembly 3204 is unlocked and then moved towards the weight adjustment configuration, the first end 3236 of the weight tray 3234 projects from the body 3206 so that the weight 3226 is accessible within the pool 3238 and its position can be adjusted. In some examples, the weight 3226 can be completely removable from the weight assembly 3204 as required or desired in the weight adjustment configuration.

Figure 93:
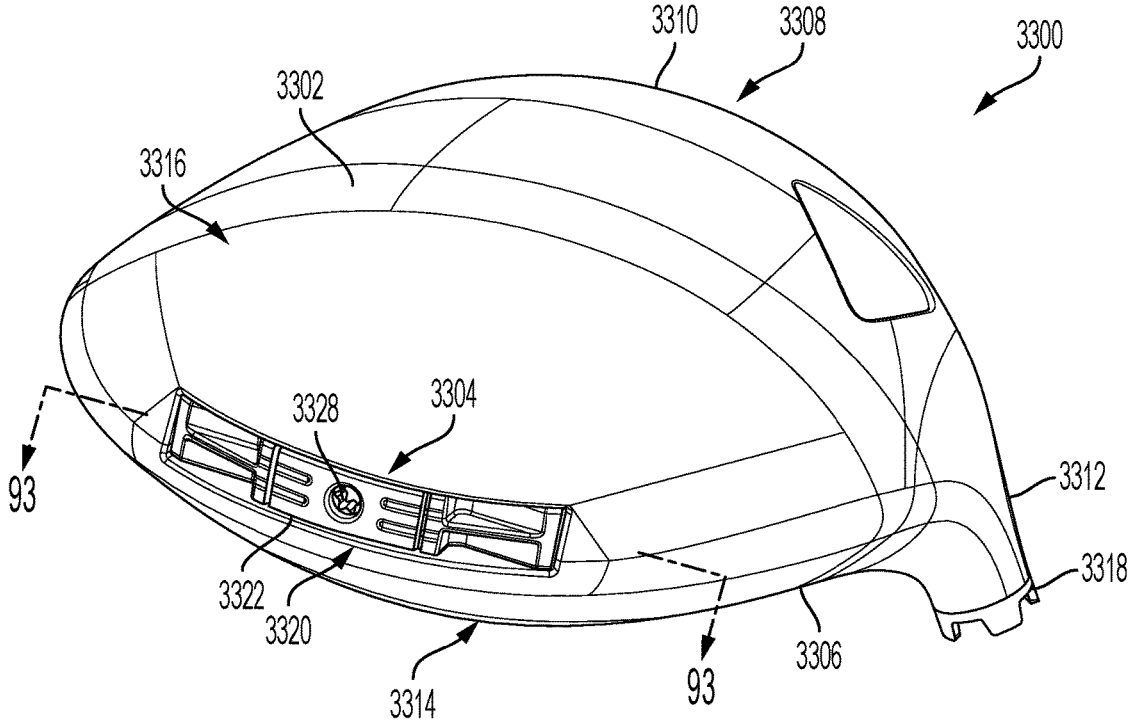
FIG. 93 is a perspective view of a sole of another golf club head with another weight assembly.
Figure 94:
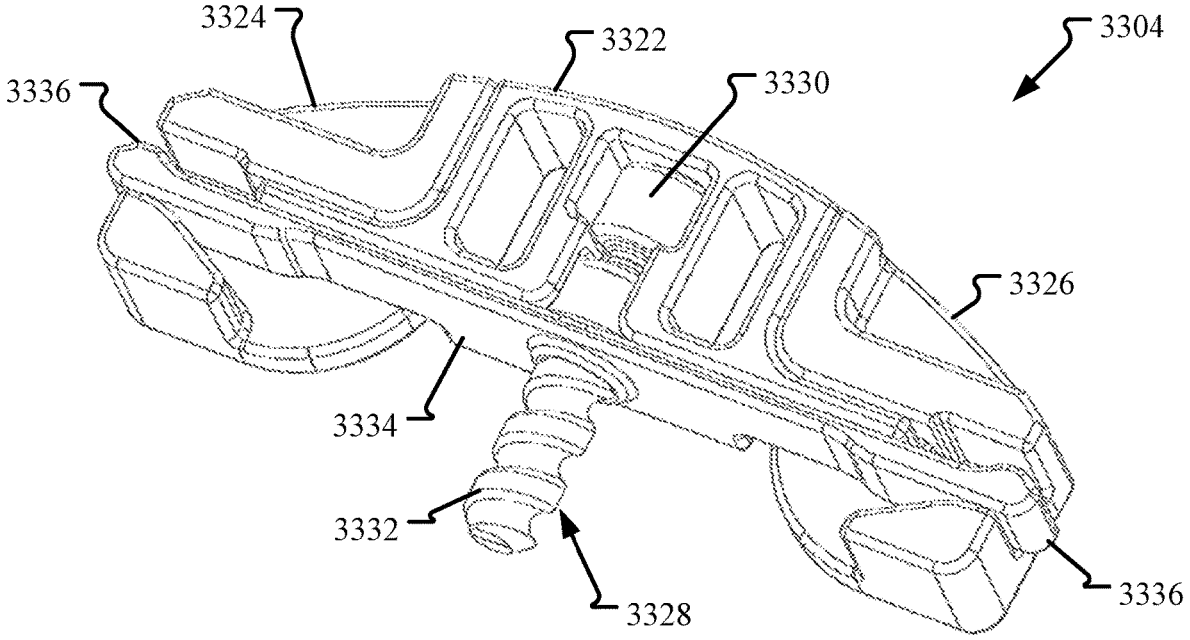
FIG. 94 is a perspective view of the weight assembly shown in FIG. 93.

FIG. 93 is a perspective view of a sole 3302 of another golf club head 3300 with another weight assembly 3304. FIG. 94 is a perspective view of the weight assembly 3304. Referring concurrently to FIGS. 93 and 94, the golf club head 3300 includes a body 3306, a striking face 3308, a lower edge 3310, an upper edge (not shown), a toe (not shown), a heel 3312, a crown 3314, an outer surface 3316, an interior cavity (not shown), and a hosel 3318, the functions of which are similar to the component functions described above. The body 3306 may form any type club head as described herein, such as, a metalwood-type club head, a fairway-metal type club head, an iron-type club head, or a hybrid-type club head as required or desired. Furthermore, the features of the weight assembly 3304 described below can additionally or alternatively be utilized in any type club head described herein as required or desired.

In this example, a recessed channel 3320 is defined within the sole 3302, and/or a transition area (e.g., skirt) where the sole 3302 and the crown 3314 couple together. The channel 3320 extends in the toe-heel direction so that the CG and the MOI of the club head 3300 can be adjusted for fade-draw bias. In an aspect, the recessed channel 3320 and the weight assembly 3304 are disposed substantially at a rear perimeter portion of the club head 3300 opposite the striking face 3308.

The weight assembly 3304 includes an insert 3322 that is configured to be inserted into the recessed channel 3320 and coupled to the body 3306 of the club head 3300. The insert 3322 has one or more weights coupled thereto. In this example, a first weight 3324 and a second weight 3326 are coupled to the insert 3322. The first weight 3324 may be a different mass than the second weight 3326. An actuator 3328 is also coupled to the insert 3322 and disposed between the weights 3324, 3326. In the example, the actuator 3328 is rotatable relative to the insert 3322 with an enlarged head 3330 and a leadscrew 3332. The enlarged head 3330 is captured within the insert 3322 and the leadscrew 3332 extends in a direction away from the insert 3322. The actuator 3328, however, is not used to couple the weight assembly 3304 to the body 3306 of the club head 3300. Rather, the insert 3322 includes a locking member 3334 configured to selectively engage with the body 3306 of the club head 3300 and secure the weight assembly 3304 within the recessed channel 3320. The locking member 3334 is engaged with the leadscrew 3332 and has a pair of opposing ends 3336 that project from the insert 3322.

In operation, the weight assembly 3304 is configured to move between a locked configuration, shown in FIG. 95 and described further below, and an unlocked configuration, shown in FIG. 96 and described further below. In the locked configuration, the insert 3322 is secured within the recessed channel 3320 via the ends 3336 of the locking member 3334 so that the weights 3324, 3326 are coupled to the golf club head 3300. In the unlocked configuration, the ends 3336 of the locking member 3334 disengage with the body 3306 of the club head 3300 so that the insert 3322 can be removed from the recessed channel 3320. Once the insert 3322 is removed, one or more of the weights 3324, 3326 can be changed out and replaced to adjust the weight in the weight assembly 3304. In other examples, the insert 3322 can be flipped around and inserted back into the recessed channel 3320 so as to adjust the position of the weights 3324, 3326 within the golf club head 3300.

Figure 95:
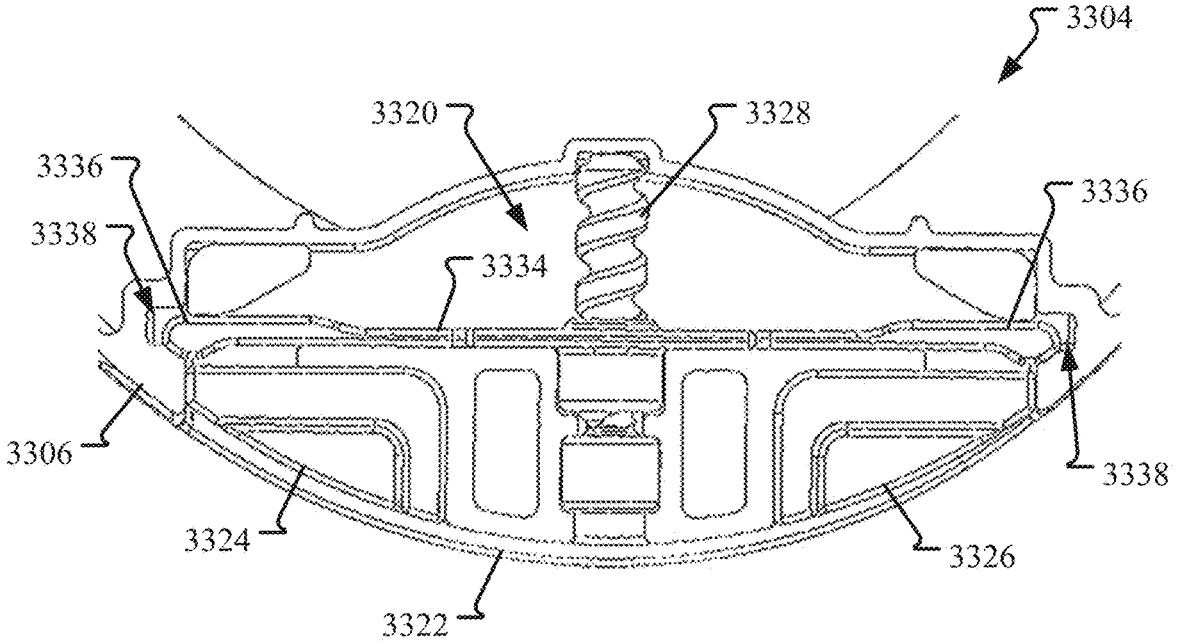
FIG. 95 is a cross-sectional view of the weight assembly taken along line 93-93 in FIG. 93 in a locked configuration.

FIG. 95 is a cross-sectional view of the weight assembly 3304 taken along line 93-93 in FIG. 93 in a locked configuration. In the locked configuration, the actuator 3328 is rotated such that the locking member 3334 is positioned substantially orthogonal to the rotation axis and in a linear orientation. This position of the locking member 3334 as illustrated in FIG. 95, results in the ends 3336 projecting from the insert 3322 and engaging with corresponding chambers 3338 defined in the body 3306 of the club head and within the recessed channel 3320. The locking member 3334 engaging with the body 3306 couples the weight assembly 3304 to the club head and secure the position and orientation of the weights 3324, 3326. The actuator 3328 is rotatable so as to move the locking member 3334 towards an unlocked configuration as described below to enable the insert 3322 to be removed and decoupled from the body 3306 of the club head.

Figure 96:
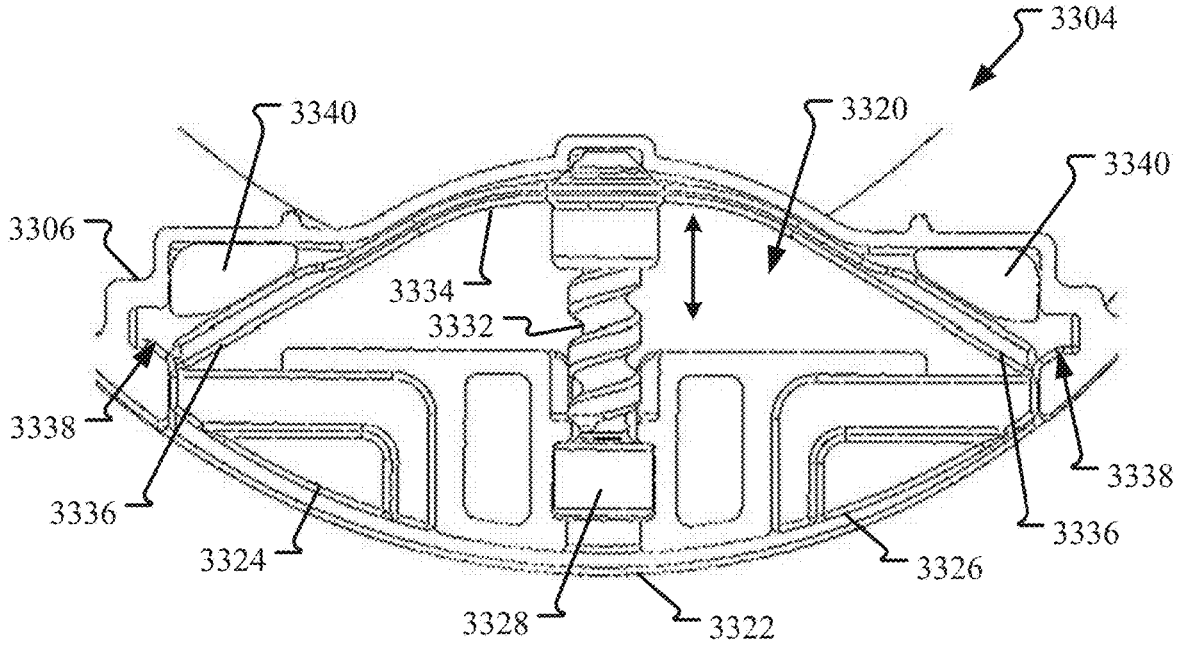
FIG. 96 is a cross-sectional view of the weight assembly taken along line 93-93 in FIG. 93 in an unlocked configuration.

FIG. 96 is a cross-sectional view of the weight assembly 3304 taken along line 93-93 in FIG. 93 in an unlocked configuration. The locking member 3334 is a flexible member such that when the actuator 3328 is rotated, the rotational movement of the leadscrew 3332 induces corresponding linear movement on the center of the locking member 3334. As such, the locking member 3334 can curve so as to retract the ends 3336 into the insert 3322. This retraction of the ends 3336 of the locking member 3334 disengages the ends 3336 from the chambers 3338 and allows the weight assembly 3304 to be removed from the recessed channel 3320 and the body 3306 of the club head. In the example, the ends 3336 of the locking member 3334 are stiffer relative to the middle section so that the ends 3336 are able to engage and secure to the recessed channel 3320.

The unlocked configuration allows the weights 3324, 3326 to be replaced or for the insert 3322 to be reinserted into the recessed channel 3320 in a flipped position and adjust the GC and MOI of the club head. The insert 3322 can include a pair of stops 3340 that engage with the ends 3336 of the locking member 3334 so as to help impart the curve into the locking member 3334 in the unlocked configuration. In this example, the weight assembly 3304 can be substantially systematical in both the toe-heel direction and sole-crown direction so that the insert 3322 can be used to reposition the weights 3324, 3326 within the body 3306. Additionally, the shape and size of the recessed channel 3320 enables the locking member 3334 to move as described herein.

Figure 97:
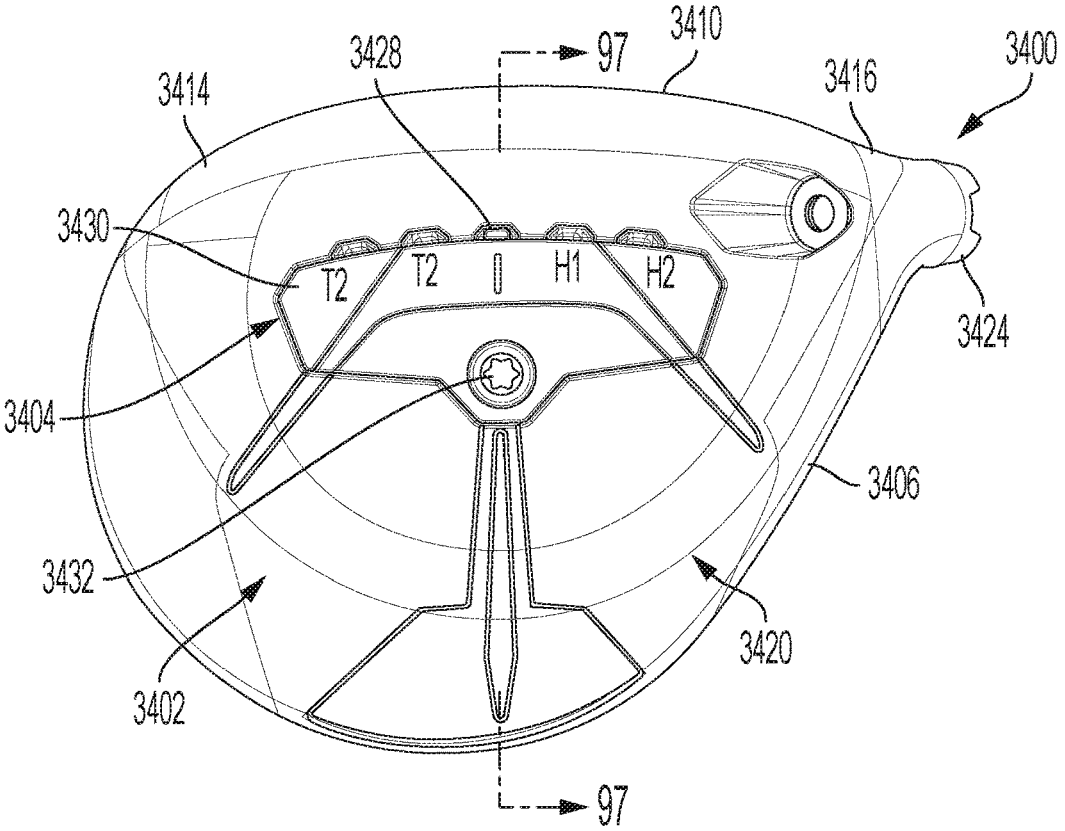
FIG. 97 is a bottom view of a sole of a golf club head with another weight assembly.
Figure 98:
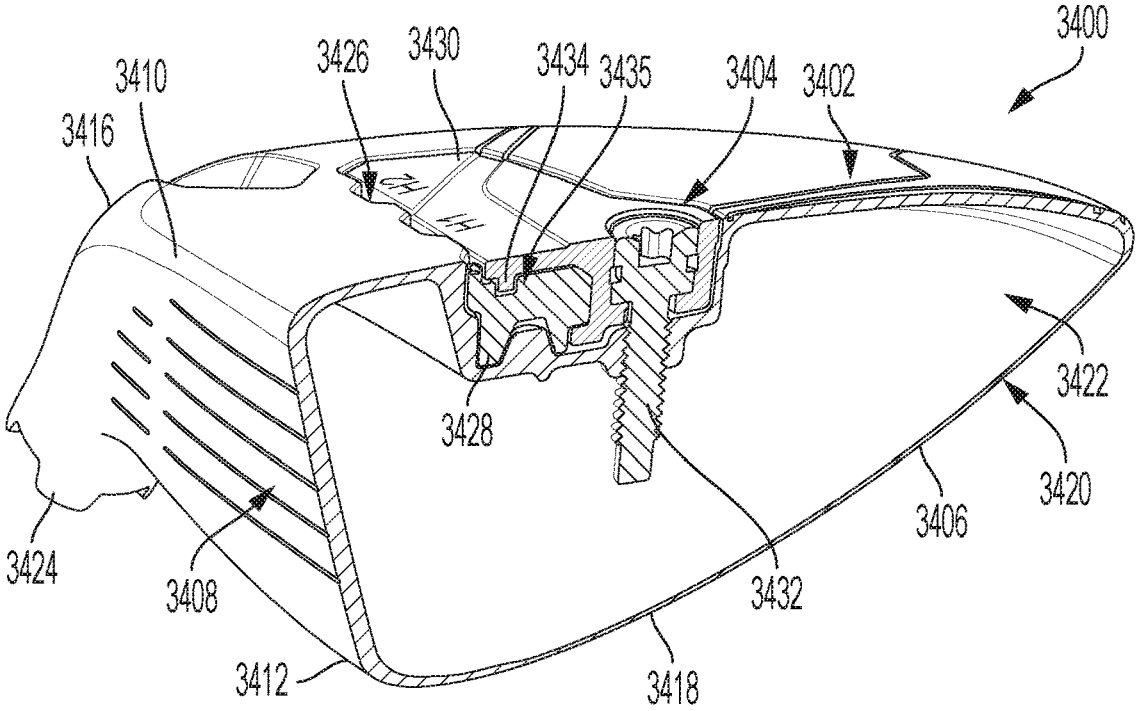
FIG. 98 is a perspective cross-sectional view of the golf club head taken along line 97-97 in FIG. 97 and in an locked configuration.
Figure 99:
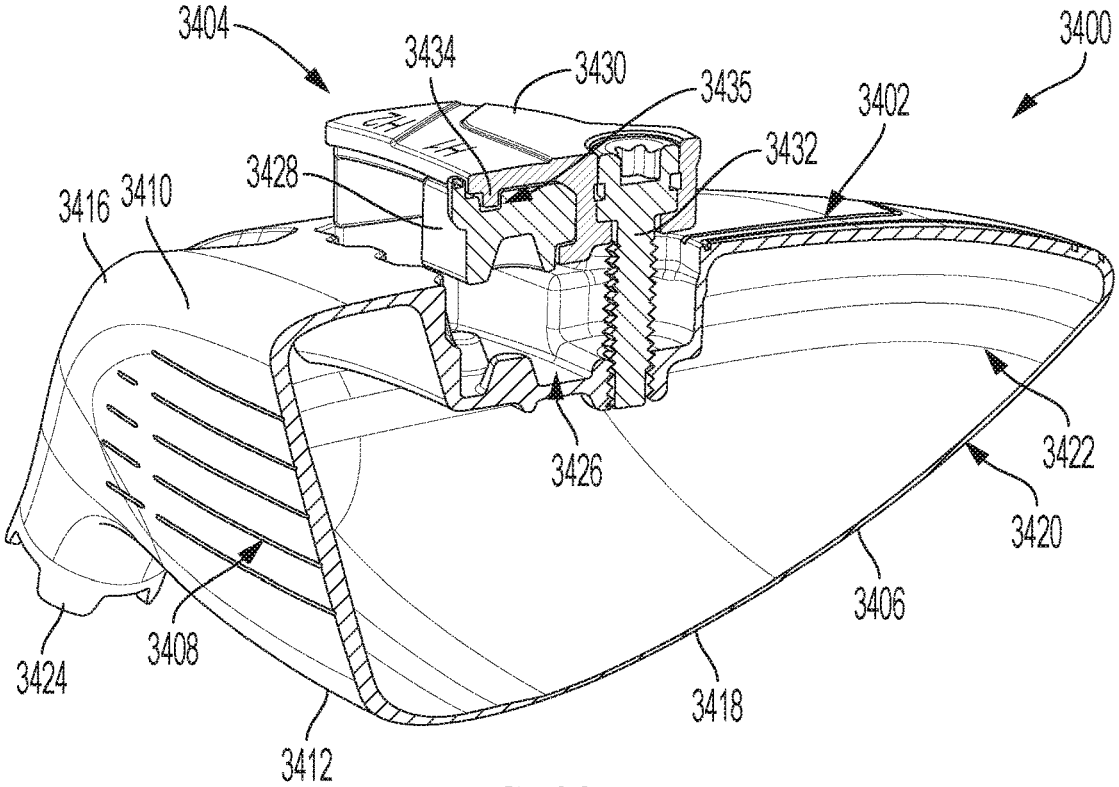
FIG. 99 is another perspective cross-sectional view of the golf club head taken along line 97-97 in FIG. 97 and in an unlocked configuration.

FIG. 97 is a bottom view of a sole 3402 of a golf club head 3400 with another weight assembly 3404. FIG. 98 is a perspective cross-sectional view of the golf club head 3400 taken along line 97-97 in FIG. 97 and in an locked configuration. FIG. 99 is another perspective cross-sectional view of the golf club head 3400 taken along line 97-97 in FIG. 97 and in an unlocked configuration. Referring concurrently to FIGS. 97-99, the golf club head 3400 is a fairway-metal type golf club head having a body 3406 that includes a striking face 3408 with a lower edge 3410 and an upper edge 3412 extending between a toe 3414 and a heel 3416. The sole 3402 extends from the lower edge 3410 on the bottom side of the club head 3400 and a crown 3418 extends from the upper edge 3412 on the top of the club head 3400. The sole 3402, the striking face 3408, and the crown 3418 are coupled together so as to define an outer surface 3420 of the body 3406 with an interior cavity 3422 formed within. A hosel 3424 is disposed at the heel 3416 and is configured to couple to a shaft (not shown). The functions of the components (e.g., sole, striking face, crown, hosel, etc.) of the fairway-metal type golf club head 3400 are similar to the component functions described above. The body 3406 may form any type club head, such as a metalwood-type club head, an iron-type club head, or a hybrid-type club head as required or desired. Furthermore, the features of the weight assembly 3404 described below can additionally or alternatively be utilized in any type club head described herein as required or desired.

In this example, a recessed channel 3426 is defined within the sole 3402 of the body 3406 of the club head 3400. The channel 3426 extends in the toe 3414—heel 3416 direction so that that the CG and the MOI of the club head 3400 can be adjusted for fade-draw bias. The weight assembly 3404 includes a slidable weight 3428 disposed at least partially within the channel 3426 and configured to slide therein, a cover 3430 that extends at least partially over the channel 3426 and adapted to releasably secure the weight 3428 within the channel 3426, and a fastener 3432 configured to couple the cover 3430 to the body 3406. The fastener 3432 retains the weight 3428 in the recessed channel 3426 indirectly via the cover 3430 so that the weight 3428 can be used to adjust the CG and the MOI of the club head 3400. In this example, the weight assembly 3404 and the recessed channel 3426 are located at a frontal section of the golf club head 3400.

Similar to the examples described above, the weight assembly 3404 is configured to move between at least two positions via the fastener 3432, for example, a locked configuration, shown in FIG. 98, and an unlocked configuration, shown in FIG. 99. In the locked configuration, the cover 3430 is at least partially disposed within the recessed channel 3426 in a secured position, and the weight 3428 is secured within the channel 3426 with its movement restricted. When the weight assembly 3404 is in the locked configuration, the weight 3428 is completely disposed within the channel 3426 and no portion of the weight 3428 extends above the outer surface 3420 of the body 3406. Because the weight 3428 is completely disposed within the recessed channel 3426 and at least aligned with, or below, the outer surface 3420 of the body 3406, the smoothness of the outer surface 3420 of the club head 3400 is maintained so as to promote good ground interaction. In the unlocked configuration, the fastener 3432 enables the cover 3430 to move along the fastener axis towards a raised position so that the weight 3428 is released and can slide relative to the cover 3430 and the body 3406. The fastener 3432 is coupled to cover 3430 with a retaining clip 3433. The retaining clip 3433 is configured to couple the fastener 3432 to the cover 3430 so that the fastener 3432 can rotate around the fastener axis and relative to the cover 3430, however, the fastener 3432 and cover 3430 are coupled together for corresponding linear movement along the fastener axis. In an aspect, the retaining clip 3433 includes a lock washer. In this example, the cover 3430 includes a retention rib 3434 that is configured to slidably engage with a slit 3435 defined in the weight 3428. The retention rib 3434 improves retention of the weight 3428 with the cover 3430 and as the weight assembly 3404 moves between configurations. The retention rib 3434 is described in further detail below.

Figure 100:
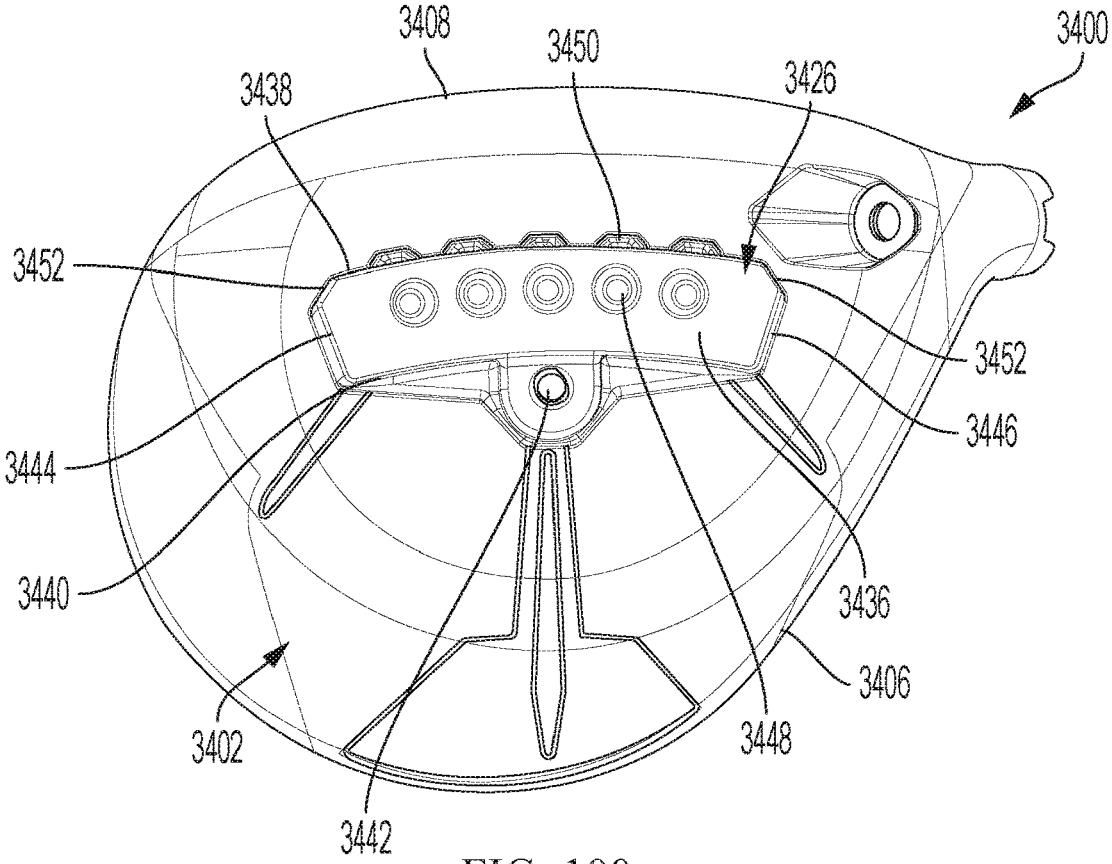
FIG. 100 is another bottom view of the sole of the golf club head shown in FIG. 97.

FIG. 100 is another bottom view of the sole 3402 of the golf club head 3400. The weight assembly 3404 (shown in FIGS. 97-99) is not shown for clarity. The recessed channel 3426 is defined by a bottom track 3436 and two opposing sidewalls 3438, 3440. A first sidewall 3438 is adjacent the striking face 3408 and a second sidewall 3440 is adjacent to the rear of the sole 3402. A nut 3442 is formed within the sole 3402 of the body 3406 proximate the second sidewall 3440. The nut 3442 is configured to engage the fastener 3432 so that the cover 3430 (both shown in FIGS. 97-99) is directly coupled to the body 3406. Additionally, the recessed channel 3426 is defined by two opposing end walls 3444, 3446. A toe end wall 3444 is located on the toe side of the club head 3400 and a heel end wall 3446 is located on the heel side of the club head 3400. In this example, no chambers or openings are defined at the ends of the recessed channel 3426 and the cover 3430 does not have any corresponding projections. In an aspect, the fastener 3432 is the only component of the weight assembly 3404 that extends into the interior cavity of the body 3406, for example, via the nut 3442. This configuration of the club head 3400 reduces dirt and debris from accumulating within the channel 3426 and within the body 3406.

The bottom track 3436 includes a plurality of bosses 3448 projecting into the channel 3426. In this example, there are five bosses 3448 equally spaced in the toe-heel direction. The bosses 3448 are configured to selectively engage with the weight 3428 when in the locked configuration (shown in FIG. 98) and so as to assist with positioning and retaining the weight 3428 within the recessed channel 3426 as described herein. In the example, the bosses 3448 can have a substantially frustoconical shape. Additionally, the first sidewall 3438 includes a plurality of dimples 3450 that correspond to the plurality of bosses 3448. The dimples 3450 are configured to selectively engage with the weight 3428 when in the locked configuration and so as to assist with positioning and retaining the weight 3428 within the recessed channel 3426 as described herein. In the example, there are five bosses 3448 and five dimples 3450 so that the weight 3428 is selectively positionable at five predefined positions. It should be appreciated that any other number of predefined positions, (e.g., three) can be utilized as required or desired.

Between the first sidewall 3438 and the end walls 3444, 3446, the recessed channel 3426 is defined by an oblique wall 3452. The oblique walls 3452 are formed at the terminal end of the channel 3426 in the toe-heel direction. Because the projections and chambers have been eliminated from the weight assembly 3404 when compared to prior examples, the oblique walls 3452 are configured to engage with the cover 3430 and secure the ends of the cover 3430 when in the locked configuration.

Figure 101:
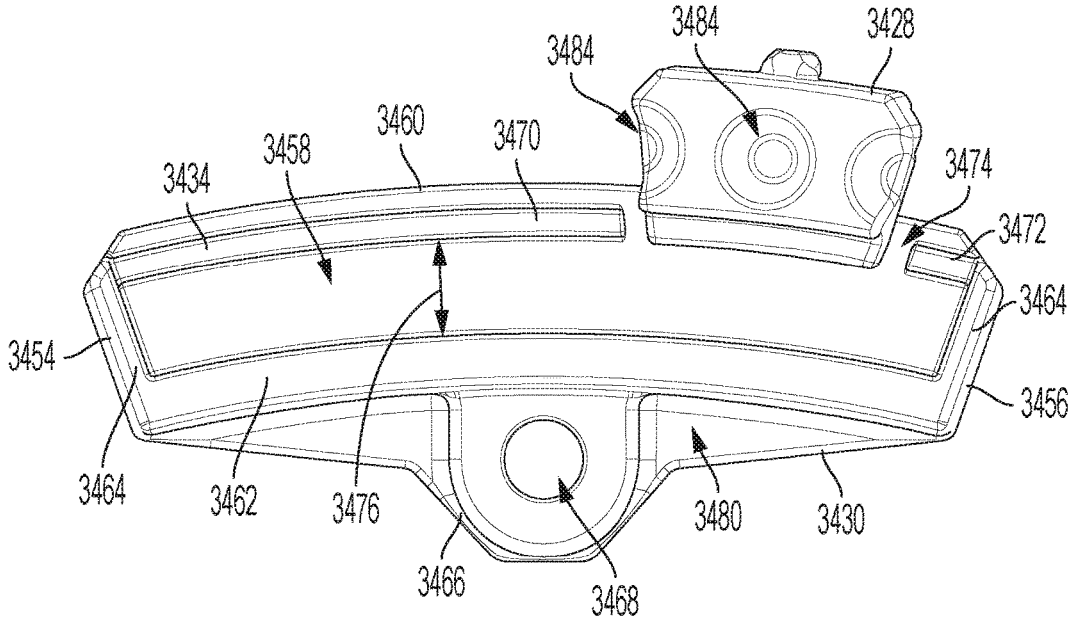
FIG. 101 is an inside surface view of a cover and a weight of the weight assembly shown in FIGS. 97-99.
Figure 102:
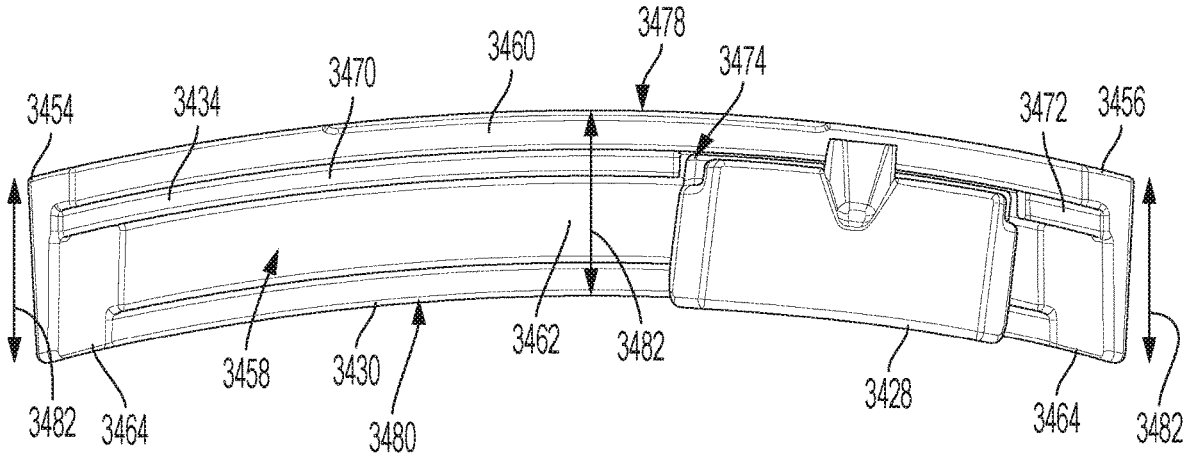
FIG. 102 is a side view of the cover and the weight shown in FIG. 101.

FIG. 101 is an inside surface view of the cover 3430 and the weight 3428 of the weight assembly 3404 (shown in FIGS. 97-99). FIG. 102 is a side view of the cover 3430 and the weight 3428. Referring concurrently to FIGS. 101 and 102, the cover 3430 has a first end 3454 and an opposite second end 3456. A rabbet 3458 is formed on one side of the cover 3430 and extends at least partially between the first end 3454 and the second end 3456. The rabbet 3458 is defined by at least an outer wall 3460 that forms an exterior surface of the cover 3430 and a sidewall 3462 of the cover 3430. The rabbet 3458 is sized and shaped to at least partially receive the weight 3428 and allow the weight 3428 to slide therein. An end wall 3464 is defined at both the first end 3454 and the second end 3456 and define a terminal end of the rabbet 3458. A fastener receiver 3466 is disposed opposite of the rabbet 3458 on the cover 3430 and is configured to support the fastener 3432 (shown in FIGS. 97-99) at an aperture 3468. The fastener 3432 couples the cover 3430 to the body of the club head at the fastener receiver 3466.

The retention rib 3434 projects from the outer wall 3460 within the rabbet 3458 and is elongated extended in a direction between the first end 3454 and the second end 3456 of the cover 3430. The retention rib 3434 is configured to engage the weight 3428 so as to improve the retention of the weight 3428 to the cover 3430. The retention rib 3434 is shaped and sized to be at least partially received within the slit 3435 (shown in FIGS. 98-99) of the weight 3428. This engagement between the weight 3428 and the cover 3430 via the retention rib 3434 enables the weight 3428 to move with the cover 3430 between the locked and unlocked configuration and so that the weight 3428 can be slidably repositioned when in the unlocked configuration. In this example, the retention rib 3434 is discontinuous in the elongated direction so that the weight 3428 can be completely removed from the weight assembly as required or desired.

In the example, the retention rib 3434 can include two discrete sections, a first rib 3470 and a second rib 3472 separated by a gap 3474 that is configured to allow the weight 3428 to be at least partially removably received within the rabbet 3458. As shown in FIG. 101, the retention rib 3434 is disposed proximate a distal end of the outer wall 3460 and on the opposite side of the cover 3430 from the fastener receiver 3466. As such, the retention rib 3434 is spaced 3476 from the sidewall 3462 of the cover 3430. The retention rib 3434 extends from each of the end walls 3464 and the gap 3474 is disposed proximate the second end 3456 of the cover 3430. In another aspect, the gap 3474 can be disposed proximate the first end 3454 of the cover 3430, or proximate a midpoint of the cover 3430. In other aspects, the gap 3474 can be disposed at one of the end walls 3464 such that the retention rib 3434 only extends from one end wall 3464, or more than one gap 3474 can be present within the retention rib 3434. In still another example, two or more parallel retention ribs 3434 can be used as required or desired.

The cover 3430 has an outside surface 3478 that is configured to align with the outer surface of the club head when in the locked configuration, and an opposite inside surface 3480 that faces the recessed channel 3426 (shown in FIG. 100) of the club head. A thickness 3482 of the cover 3430 is defined between the outside surface 3478 and the inside surface 3480 in a direction that is substantially parallel to a fastener axis of the fastener 3432 (shown in FIGS. 97-99). The thickness 3482 of the cover 3430 at the end walls 3464 is substantially equal to the thickness 3482 of the cover 3430 at a midpoint of the rabbet 3458 between the first end 3454 and the second end 3456. As such, the end walls 3464 of the cover 3430 are devoid of any projections and engage directly with the recessed channel 3426 of the club head.

At least one hollow 3484 is defined in the weight 3428 and in a surface that is opposite of the slit 3435 (shown in FIGS. 98-99). The hollow 3484 is sized and shaped to engage with the boss 3448 disposed within the channel 3426 (both shown in FIG. 100). In the example, the hollow 3484 includes a fully defined hollow 3484 and two partially defined hollows 3484 that flank the fully defined hollow 3484. This configuration enables for use of a more elongated weight 3428 while accommodating an increase in the amount of weight positioning locations, e.g., five and as illustrated in the depicted example.

Figure 103:
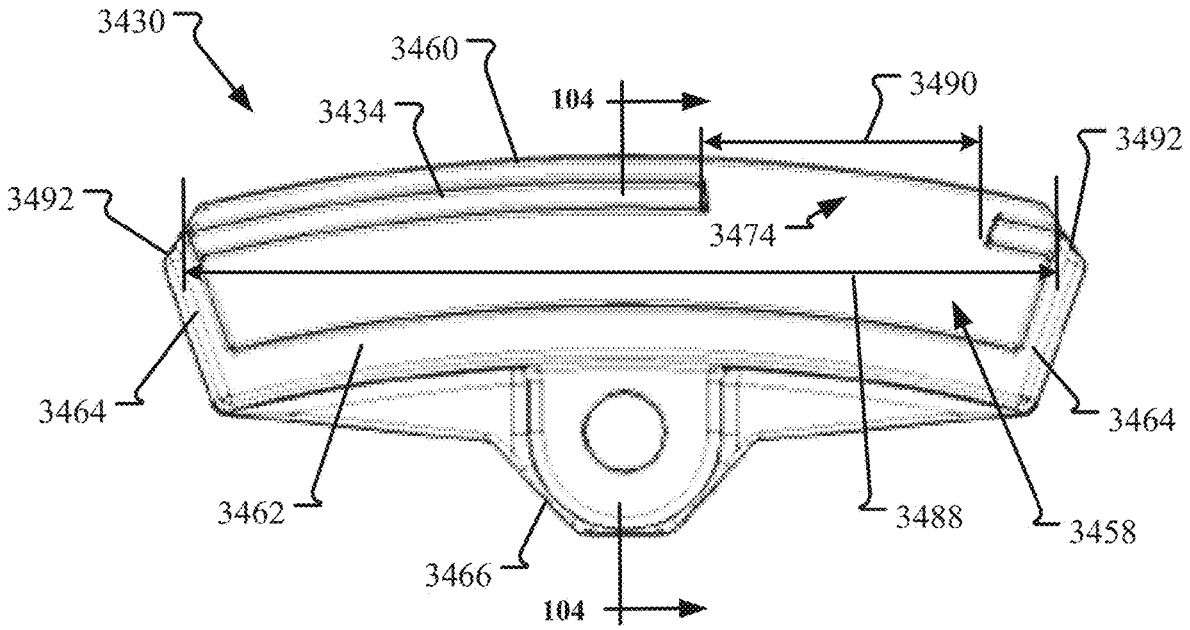
FIG. 103 is another inside surface view of the cover shown in FIG. 101.
Figure 104:
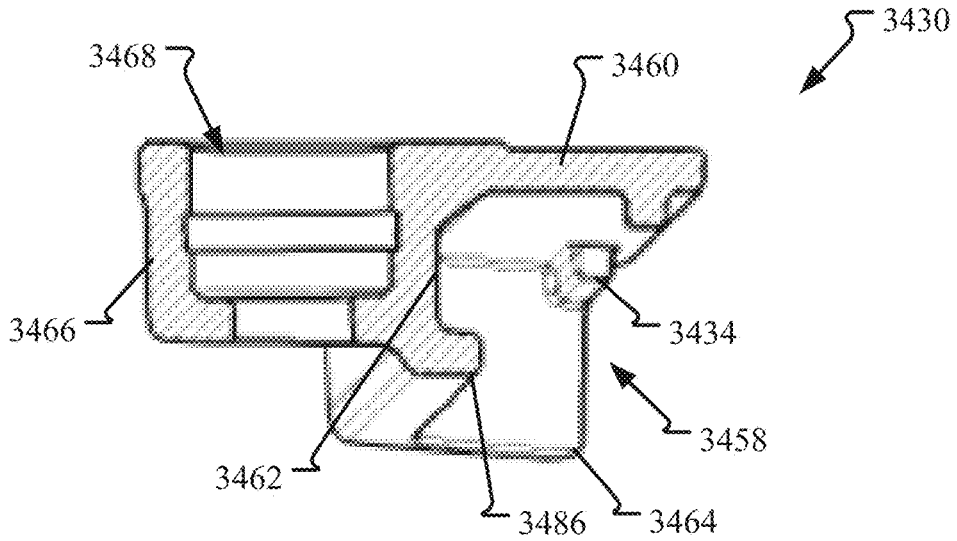
FIG. 104 is a cross-sectional view of the cover taken along line 104-104 in FIG. 103.

FIG. 103 is another inside surface view of the cover 3430. FIG. 104 is a cross-sectional view of the cover 3430 taken along line 104-104 in FIG. 103. Referring concurrently to FIGS. 103 and 104, certain components are described above, and thus, are not necessarily described further. The rabbet 3458 is formed by the outer wall 3460 and the sidewall 3462. The retention rib 3434 is disposed proximate the distal end of the outer wall 3460. A shelf 3486 extends from the distal end of the sidewall 3462 and is configured to at least partially support the weight 3428 (shown in FIGS. 101-102). The retention rib 3434 and the shelf 3486 extend in substantially orthogonal directions. In the example, the retention rib 3434 has a substantially square-shaped cross-section. It should be appreciated that the retention rib 3434 can have any other cross-sectional shape as required or desired.

In this example, the rabbet 3458 has a length 3488 that is defined between the end walls 3464 at the first and second ends of the cover 3430. The gap 3474 of the retention rib 3434 also has a length 3490 that is defined between the two sections of the rib. In an example, the length 3488 of the rabbet 3458 is between about two to four times the length 3490 of the gap 3474. In an aspect, the length 3488 of the rabbet 3458 is about three times the length 3490 of the gap 3474. As shown in FIG. 103, the retention rib 3434 has an arcuate shape in plan view that corresponds to the elongated shape of the rabbet 3458 defined within the cover 3430.

The end walls 3464 at each end of the cover 3430 have their inner surface aligned with the inner surface of the sidewall 3462 such that the end walls 3464 directly engage with the recessed channel 3426 (shown in FIG. 100) without the use of projections. Each end of the cover 3430 also includes a chamfer 3492 that corresponds to the oblique walls 3452 (shown in FIG. 100) of the channel 3426 which enables the ends of the cover to securely engage with the club head in the locked configuration and reduce weight rattling therein.

Figure 105:
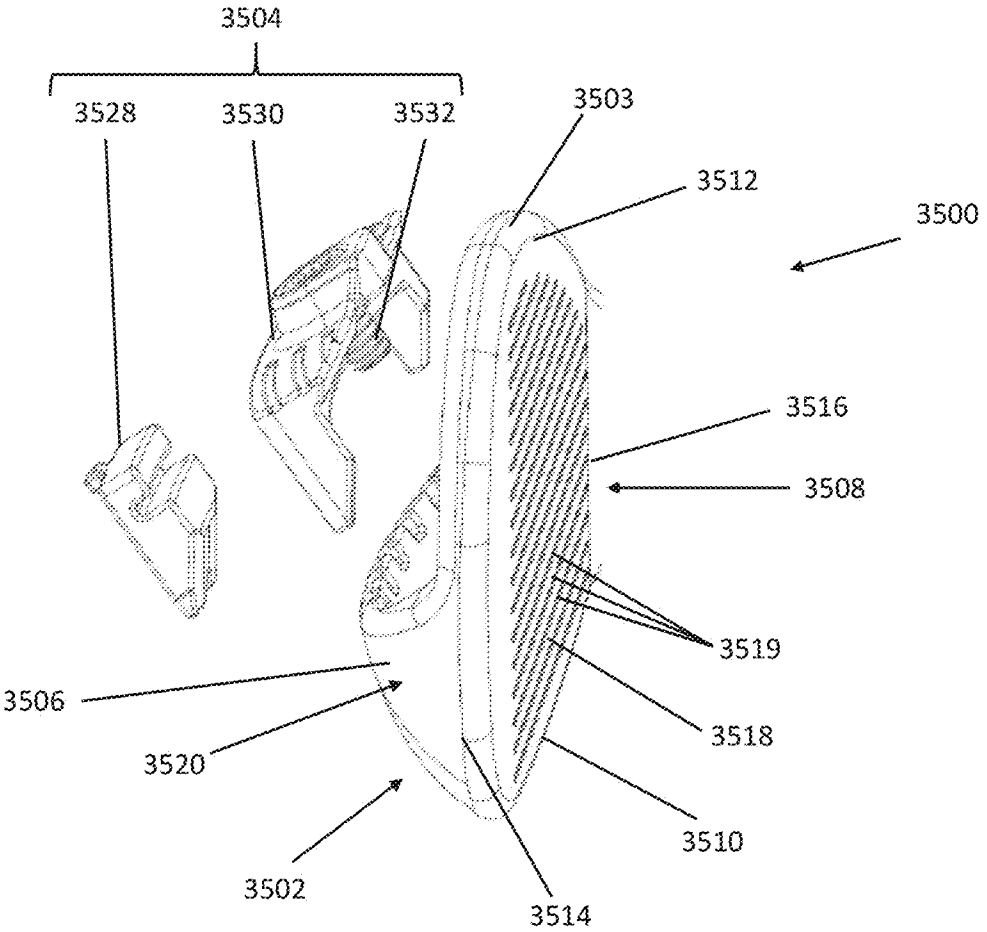
FIG. 105 is a partially exploded, perspective view of an iron-type golf club head with another weight assembly.
Figure 106:
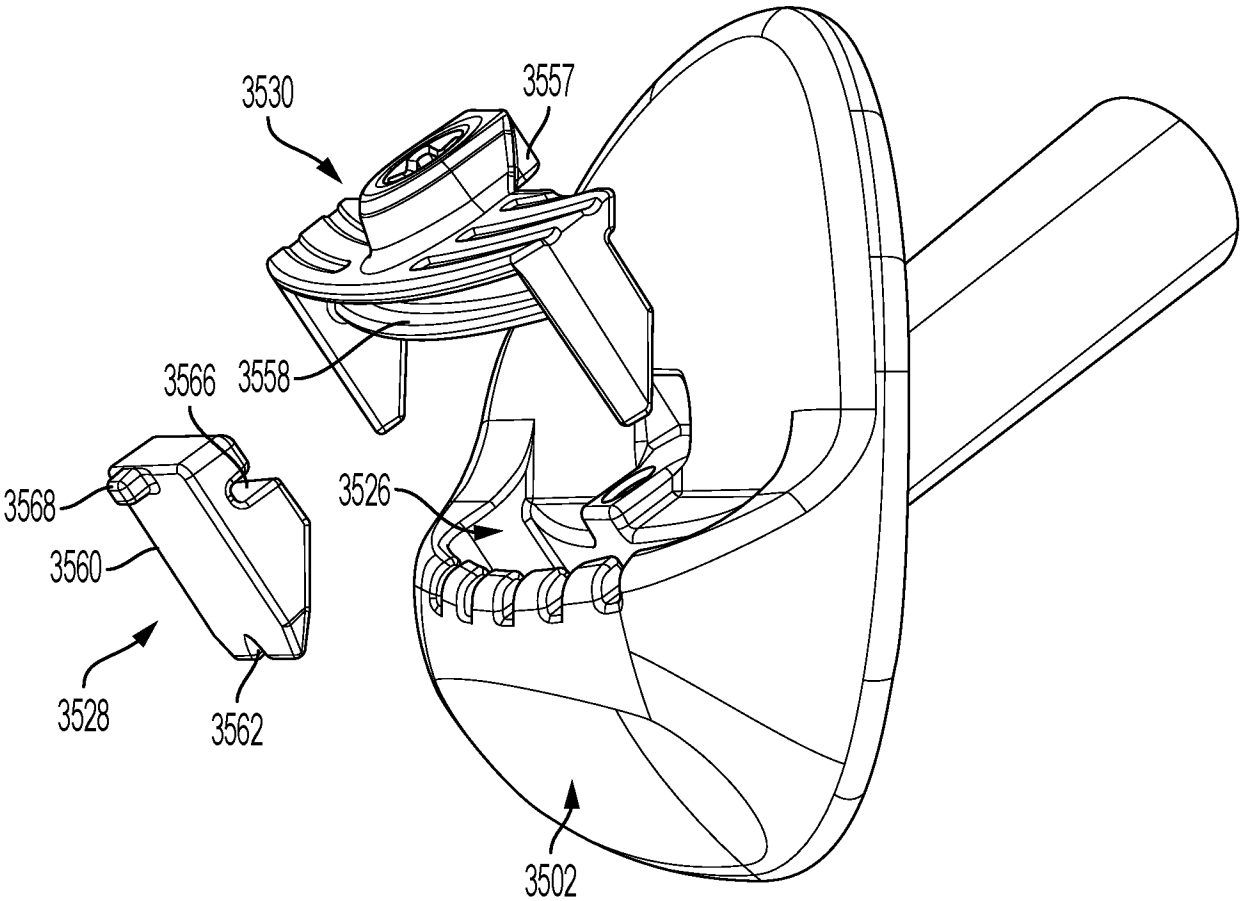
FIG. 106 is another partially exploded, perspective view of the golf club head of FIG. 105.
Figure 107:
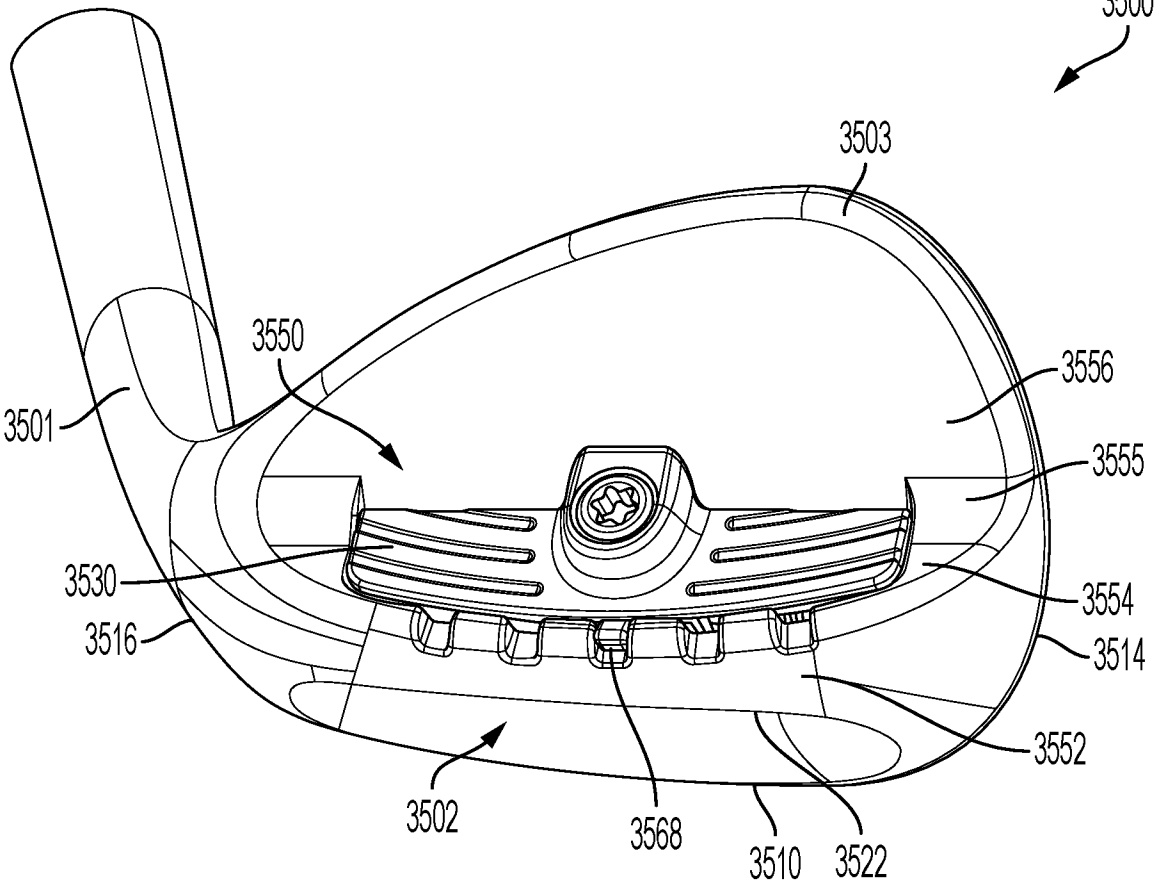
FIG. 107 is a back view of the golf club head of FIG. 105 with the weight assembly in a locked configuration.
Figure 108:
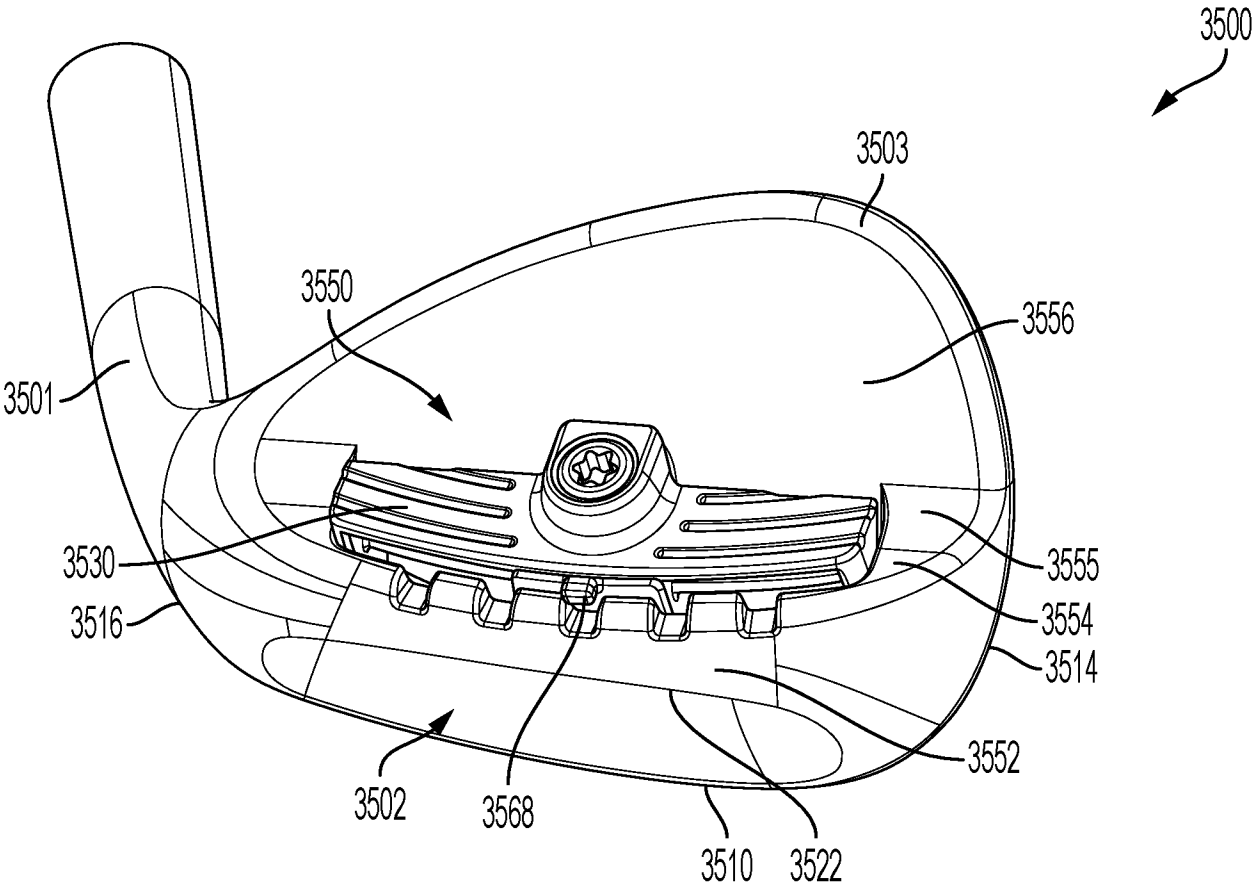
FIG. 108 is another back view of the golf club head of FIG. 105 with the weight assembly in an unlocked configuration.
Figure 109:
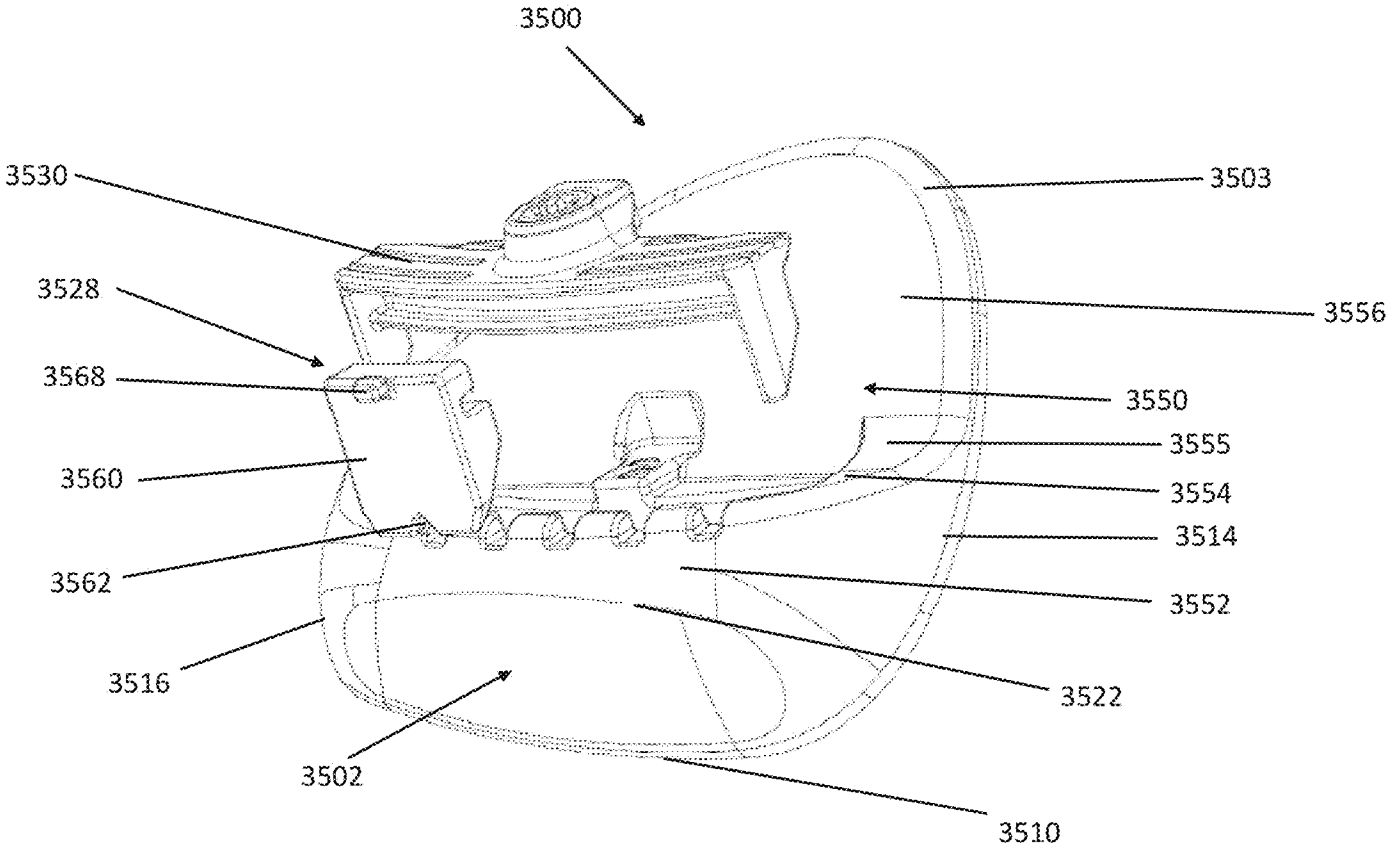
FIG. 109 is another partially exploded, perspective view of the golf club head of FIG. 105.
Figure 110:
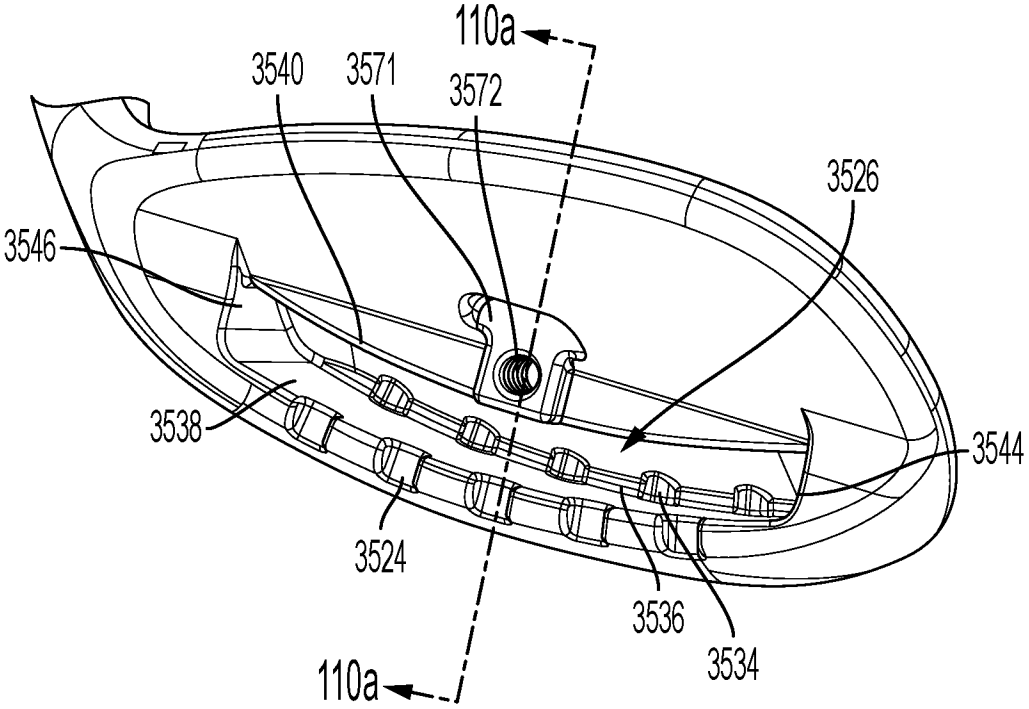
FIG. 110 is a top view of the golf club head of FIG. 105 without the weight assembly.
Figure 112:
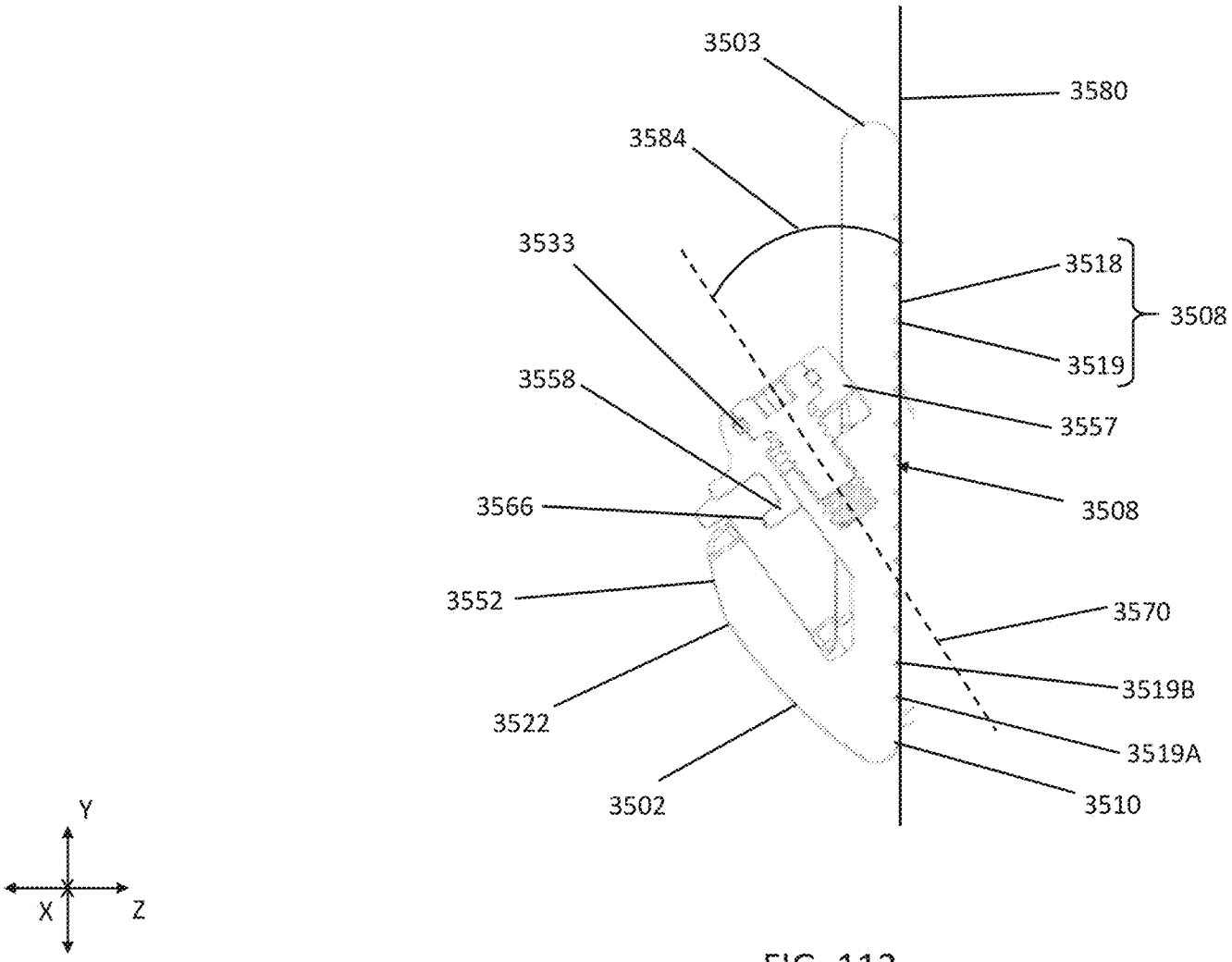
FIG. 112 is a cross-sectional view in the toe-to-heel direction of the golf club head of FIG. 105 taken along line **110*a*-110*a* in FIG. 110** and with the weight assembly in the unlocked configuration.

FIG. 105 is a partially exploded, perspective view of an iron-type golf club head 3500 with another weight assembly 3504. In particular, the golf club head 3500 is a wedge type golf club head. FIG. 106 is another partially exploded, perspective view of the golf club head 3500 of FIG. 105. FIG. 107 is a back view of the golf club head 3500 of FIG. 105 with the weight assembly 3504 in a locked configuration. FIG. 108 is another back view of the golf club head 3500 of FIG. 105 with the weight assembly 3504 in an unlocked configuration. FIG. 109 is another partially exploded, perspective view of the golf club head 3500 of FIG. 105. FIG. 110 is a top view of the golf club head 3500 of FIG. 105 without the weight assembly 3504. FIG. 111 is a cross-sectional view in the toe-to-heel direction of the golf club head 3500 of FIG. 105 taken along line **110*a*-110*a* in FIG. 110 and with the weight assembly 3504 in the locked configuration. FIG. 112 is a cross-sectional view in the toe-to-heel direction of the golf club head 3500 of FIG. 105 taken along line 110*a*-110*a* in FIG. 110 and with the weight assembly 3504 in the unlocked configuration. In FIG. 111 and FIG. 112**, the golf club head is shown with the loft being perpendicular to the ground plane, which is different from the setup at an address position that usually has the shaft that is vertical to the ground plane. The address position, as defined by the current application, sets up the golf club head at an orientation that has a lie angle of 60 degrees similar to the requirements of the USGA. Once the lie angle is set at 60 degrees, the face angle of the golf club head is set to be square, which is defined as having a face angle of 0 degrees.

Referring concurrently to FIGS. 105-112, the golf club head 3500 is an iron-type golf club head. The iron-type golf club head may be, for example, a wedge-type golf club head. The golf club head 3500 includes a body 3506 having a striking face 3508 with a lower leading edge 3510 and an opposite upper topline edge 3512 extending between a toe 3514 and a heel 3516. The striking face 3508 may have multiple grooves 3519 formed therein to help impart spin on a golf ball when struck by the striking face. The body 3506 has a sole 3502 extending from the lower leading edge 3510 on the bottom side of the golf club head 3500 to a rearward portion 3522 of the sole 3502. The rearward portion 3522 may be defined as an edge or corner on the body 3506. A back portion 3550 is between the rearward portion 3522 of the sole 3502 and the top portion 3503. The back portion 3550 comprises all surfaces of an outer surface 3520 of the body 3506 of the golf club head 3500 that are both between the rearward portion 3522 of the sole 3502 and the top portion 3503 and also between the toe 3514 and the heel 3516. Specific examples of the back portion 3550 will be described in more detail below. A top portion 3503 of the body 3506 is coupled between the upper topline edge 3512 and the back portion 3550. In some embodiments, the top portion 3503 is a thin surface. In some other embodiments, the top portion 3503 is not present, and the upper topline edge 3512 may be directly connected to the back portion 3550. The striking face 3508, the sole 3502, the back portion 3550, and the top portion 3503 are coupled together so as to define at least part of the outer surface 3520 of the body 3506. A hosel 3501 is disposed at the heel 3516 and is configured to couple to a shaft (not shown).

A recessed channel 3526 is defined in the outer surface 3520 of the body 3506, and in particular, in the back portion 3550. The channel 3526 extends along the toe 3514—heel 3516 direction so that the CG and the MOI of the golf club head 3500 can be adjusted for fade-draw bias. The weight assembly 3504 is adapted to be coupled to the body 3506 at the channel 3526. The weight assembly 3504 includes a weight 3528 disposed at least partially within the channel 3526 and configured to be movable along the toe 3514—heel 3516 direction within the channel 3526, a cover 3530 that extends at least partially over the channel 3526 and is adapted to releasably secure the weight 3528 in the channel 3526, and a fastener 3532 configured to couple the cover 3530 to the body 3506. The fastener 3532 retains the weight 3528 in the recessed channel 3526 only indirectly via the cover 3530. The fastener 3532 can therefore be used to secure the weight 3528 in the channel 3526 or to release the weight 3528 so that the weight 3528 can be moved at least along the toe 3514—heel 3516 direction in the channel 3526. As used herein, references to movement along the toe-heel direction includes along the heel-toe direction as well.

The weight assembly 3504 is configured to move between at least two positions via the fastener 3532, for example, a locked configuration as shown in FIGS. 107 and 111, and an unlocked configuration as shown in FIGS. 108 and 112. In some embodiments, the weight assembly 3504 may also be configured to move to a weight removable configuration in which the weight assembly 3504 may be removed entirely from channel 3526. In other embodiments, however, the fastener 3532 may be configured to not allow the weight assembly 3504 to be removed entirely from channel 3526, so as to prevent the weight 3528 from being accidentally lost, among other reasons. In the locked configuration, the cover 3530 is at least partially disposed within the recessed channel 3526 so that its movement is restricted. When the weight assembly 3504 is in the locked configuration, the weight 3528 is disposed in the channel 3526, and the position of the weight 3528 is secured by the cover 3530 so that it cannot move. The locked configuration may be used when a golf club including the golf club head 3500 is being swung so that the CG and the MOI of the golf club head 3500 is set during the swing. The fastener 3532 is selectively moveable along a fastener axis 3570 (see FIGS. 111 and 112). The fastener 3532 may be coupled to the cover 3530 with a retaining clip 3533 so that the fastener 3532 can rotate around the fastener axis 3570 and relative to the cover 3530. Accordingly, the fastener 3532 and the cover 3530 are coupled together so that the cover 3530 moves with the fastener 3532 along the fastener axis 3570.

In other embodiments, the retaining clip 3533 may not be present so that the cover 3530 does not necessarily move with the fastener 3532 when the fastener 3532 moves. However, in such embodiments, when the fastener 3532 is partially moved to a raised position to at least partially release the cover 3530, the cover 3530 may be moveable along the fastener axis 3570 to the extent that the fastener 3532 has been moved.

The weight assembly 3504 is moved from the locked configuration to the unlocked configuration by adjusting the position of the fastener 3532 to the raised position so that the weight 3528 is released and can move inside the channel 3526 at least along the toe 3514—heel 3516 direction and relative to the body 3506 and cover 3530. The unlocked configuration may be used to adjust the CG and MOI of the golf club head 3500 when a golf club including the golf club head 3500 is not being swung.

The weight assembly 3504 may be moved from the unlocked configuration to the weight removable configuration by further adjusting the position of the fastener 3532 to a position high enough so that the weight 3528 can be removed from the channel 3526 and/or decoupled from the cover 3530. In some embodiments, the weight assembly 3504 may be entirely decoupled from the body 3506 in the weight removable configuration. The weight removable configuration may be used to allow the weight 3528 to be replaced. For example, a plurality of weights having different masses may be usable with the weight assembly 3504, and the weights having different masses may be interchanged for greater control of the CG and MOI of the golf club head 3500.

In this nonexclusive example, and as shown for example in FIG. 107, the back portion 3550 includes a lower back surface 3552 coupled between the rearward portion 3522 of the sole 3502 and the top portion 3503, a first back surface 3554 coupled between the lower back surface 3552 and the top portion 3503, an intermediate surface 3555 coupled between the first back surface 3554 and the top portion 3503, and a second back surface 3556 coupled between the intermediate surface 3555 and the top portion 3503.

The lower back surface 3552 may be substantially flat in some embodiments. In some other embodiments, the lower back surface 3552 may be substantially flat except for a curve along the toe 3514—heel 3516 direction. A height (when viewed in the orientation of FIG. 105) of the lower back surface 3552 may be the lowest among heights of the lower back surface 3552, the first back surface 3554, the intermediate back surface 3555, and the second back surface 3556. In some embodiments, the lower back surface 3552 may not be present, and the first back surface 3554 may extend from the rearward portion 3522 of the sole 3502.

The first back surface 3554 may be substantially flat and may extend from an edge of the lower back surface 3552 distal to the rearward portion 3522 toward the intermediate surface 3555 along a direction such that at least part of a virtual extension of the first back surface 3554 intersects the striking face 3508. The first back surface 3554 may also extend towards (e.g., may extend along a direction to be closer to) the upper topline edge 3512 of the golf head club 3500.

The intermediate back surface 3555 may be a curved or substantially flat surface extending from an edge of the first back surface 3554 distal to the lower back surface 3552 to the second back surface 3556. In some embodiments, the intermediate back surface 3555 is not present, and the second back surface 3556 extends from the first back surface 3554.

The second back surface 3556 may be substantially flat and parallel to the striking face 3508. The second back surface 3556 extends from an edge of the intermediate back surface 3555 distal to the first back surface 3554 to the top portion 3503. The first and second surfaces 3554 and 3556 generally form an obtuse angle. For example, an obtuse angle may be formed where virtual extensions of the first and second surfaces 3554 and 3556 meet.

Although the back portion 3550 has been described as including the lower back surface 3552, the first back surface 3554, the intermediate back surface 3555, and the second back surface 3556, and the recessed channel 3526 has been described as being formed in the first back surface 3554, embodiments of the present disclosure are not limited thereto. The back portion 3550 may include any one or more of the lower back surface 3552, the first back surface 3554, the intermediate back surface 3555, and the second back surface 3556. Although lower back surface 3552, the first back surface 3554, the intermediate back surface 3555, and the second back surface 3556 have been illustrated and described as having certain features, the lower back surface 3552, the first back surface 3554, the intermediate back surface 3555, and the second back surface 3556 are not limited thereto. These features are provided for purpose of describing example embodiments, not for purpose of limitation. Furthermore, the recessed channel 3526 may be formed in any one or more surfaces included in the back portion 3550.

In this example, and as shown for example in FIG. 110, the recessed channel 3526 is formed in the back portion 3550, for example, in the first back surface 3554. A fastener receiver 3572 adapted to receive and engage with the fastener 3532 is also defined in the back portion 3550, for example, at a junction between the first and second surfaces 3554 and 3556 or at the intermediate back surface 3555. A fastener cutout 3571 is formed around the fastener receiver 3572 and is shallower than the fastener receiver 3572. The fastener cutout 3571 forms a hollow in the second back surface 3556. The cover 3530 includes a positioner protrusion 3557 having a shape and size corresponding to the fastener cutout 3571 so that the positioner protrusion 3557 can engage with the fastener cutout 3571 to at least partially define the position of the cover 3530 in the locked configuration and, in some embodiments, the unlocked configuration.

The channel 3526 has first and second opposing sidewalls 3538 and 3540 that extend along the toe 3514—heel 3516 direction. The second sidewall 3540 is adjacent to the fastener receiver 3572 and the first sidewall 3538 is adjacent to the rearward portion 3522 of the sole 3502. The channel 3526 also has toe and heel opposing end walls 3544 and 3546, where the toe end wall 3544 is adjacent to the toe 3514 and the heel end wall 3536 is adjacent to the heel 3516. The channel 3526 has a bottom track 3536 offset from the outer surface 3520 of the body 3506 and disposed both between the first and second sidewalls 3538 and 3540 and also between the toe and heel end walls 3544 and 3546.

The body 3506 includes multiple locating lugs 3534 on the bottom track 3536. The locating lugs 3534 protrude from the bottom track 3536 towards an opening of the recessed channel 3526. As shown in FIG. 109, the weight 3528 has a bottom indent 3562 shaped and sized to allow the weight 3528 to selectively engage with the locating lugs 3534 to thereby at least partially define the position of the weight 3528 in the recessed channel 3526. The first sidewall 3538 has multiple dimples 3524 at a top of the first sidewall 3524 at the opening of the recessed channel 3526. The dimples 3524 are cutouts or hollows in the first sidewall 3538 and have positions arranged along the toe 3514—heel 3516 direction that respectively correspond to the locating lugs 3534. The weight 3528 comprises a main body 3560 and a position indicator 3568 that protrudes from the main body 3560. The position indicator 3568 is shaped and sized to selectively engage with the dimples 3524 to visually indicate the position of the weight 3528 inside the channel 3526. In the locked configuration, the cover 3530 may cover and conceal the main body 3560 of the weight 3528, but the position indicator 3568 may extend from under the cover 3568 and be positioned at least partially in one of the dimples 3524. In the locked configuration, between 0% and 30% of an outer surface of the weight 3528 is visible.

As shown in FIGS. 111 and 112, the cover 3530 includes a flange 3558, and the weight 3528 has a groove 3566 shaped and sized to receive at least part of the flange 3558 to slidingly engage the weight 3528 with the cover 3530. Accordingly, when the weight assembly 3504 is in the unlocked configuration, the weight 3528 is able to slide back and forth inside the recessed channel 3526.

As shown in FIGS. 111 and 112, the striking face 3508 has an outermost surface 3518 and a plurality of grooves 3519, each having a longitudinal axis extending along the toe 3514—heel 3516 direction. The outermost surface 3518 may be substantially flat except for the grooves 3519. A striking face plane 3580 is tangential to the outermost surface 3518 and extends beyond the bounds of the striking face 3508 itself. In the example toe-to-heel cross-sectional views of FIG. 111 and FIG. 112, a Y coordinate is defined as extending up and down (generally top to bottom), a Z coordinate is defined as extending left and right (generally front to back), and an X coordinate is defined as extending into and out of the page (generally toe-to-heel). In the examples of FIG. 111 and FIG. 112, with the club head 3500 oriented as shown, the striking face plane 3580 is within the X-Y plane, and the Z axis is orthogonal to the striking face plane (the X-Y plane, as depicted). In examples, the fastener axis 3570, which includes a virtual extension of an axis along which the fastener 3532 moves between a locked and unlocked position, intersects the striking face plane 3580. In some examples, the intersection of the fastener axis 3570 and the striking face plane 3580 occurs at a point closer to the lower leading edge 3510 of the striking face 3508 than to the upper topline edge 3512 of the striking face 3508. In some embodiments, the fastener axis 3570 intersects the striking face 3508 itself. In some other embodiments, the fastener axis 3570 does not intersect the striking face 3508 but still intersects the striking face plane 3580 closer to the lower leading edge 3510 than the upper topline edge 3512, e.g., at a point below the lower leading edge 3510.

A fastener angle 3584 of the fastener axis 3570 may be measured in a cross-sectional plane. For example, as used herein, the cross-sectional plane is a plane that is orthogonal to the longitudinal axis of at least one groove 3519 (such as the groove 3519A nearest to the lower leading edge 3510, or the groove 3519B that is second-nearest to the lower leading edge 3510). That is, the longitudinal axis of the at least one groove 3519 may be normal to the cross-sectional plane. In the examples of FIGS. 111 and 112, the cross-sectional plane is depicted as the Y-Z plane. The fastener axis 3570 forms the fastener angle 3584 with the striking face plane 3580 in the cross-sectional plane. It is recognized that the fastener axis 3570 may not lie entirely within the cross-sectional plane (here, the Y-Z plane), and the vector of the fastener axis 3570 may include some component in the X direction (e.g., the fastener axis 3570 may tilt in a toe 3514—heel 3516 direction); however, as used herein, the fastener angle 3584 is measured only in the cross-sectional plane, ignoring any toe-to-heel (or "X") component of the vector defining the fastener axis 3570. The fastener angle 3584 is defined in the cross-sectional plane and is measured in a counter-clockwise direction from the striking face plane 3580 to the fastener axis 3570 when the cross-sectional plane is viewed in a toe-to-heel direction, as shown in FIGS. 111 and 112. The fastener angle 3584 may range from about 0 degrees to about 90 degrees. For example, the fastener angle 3584 of the fastener axis 3570 relative to the striking face plane 3580 may be from about 5 degrees to about 85 degrees, about 10 degrees to about 80 degrees, about 15 degrees to about 75 degrees, about 20 degrees to about 70 degrees, about 25 degrees to about 65 degrees, about 30 degrees to about 60 degrees, about 35 degrees to about 55 degrees, about 40 degrees to about 50 degrees, or about 45 degrees. In further examples, the fastener angle of the fastener axis 3570 relative to the striking face plane 3580 may be non-negative and may be less than about 80 degrees, less than about 70 degrees, less than about 60 degrees, less than about 50 degrees, less than about 45 degrees, less than about 40 degrees, less than about 30 degrees, less than about 20 degrees, less than about 10 degrees, less than about 5 degrees, or about zero degrees. In other examples, the fastener angle 3584 of the fastener axis 3570 relative to the striking face plane 3580 may even be negative, depending on the configuration of the back portion 3550 of the clubhead 3500, for example, about 0 degrees to about −5 degrees, about 0 degrees to about −10 degrees, about 0 degrees to about −20 degrees, about 0 degrees to about −30 degrees, or about 0 degrees to about −45 degrees. The foregoing recited ranges of the fastener angle 3584 are non-limiting example ranges, and the fastener angle 3584 may be within any range subsumed within the range of −45 degrees to about 135 degrees, for example, about 28 degrees to about 63 degrees or about 85 degrees to about 115 degrees. By forming the recessed channel 3526, and disposing the weight assembly 3504, in the back portion 3550 of the iron-type golf club head 3500 instead of in the sole 3502, interaction between the weight assembly 3504 and the ground may be reduced when a golf club including the golf club head 3500 is swung. Accordingly, dirt and other materials may be substantially prevented from entering into the recessed channel 3526 and interfering with the weight assembly 3504.

In examples, the fastener 3532 may have a height that can be measured in the cross-sectional plane along the direction from the lower leading edge 3510 to the upper leading edge 3512. In examples, the height of the fastener 3532 increases when the weight assembly 3504 moves from the locked configuration to the unlocked configuration.

Figure 113:
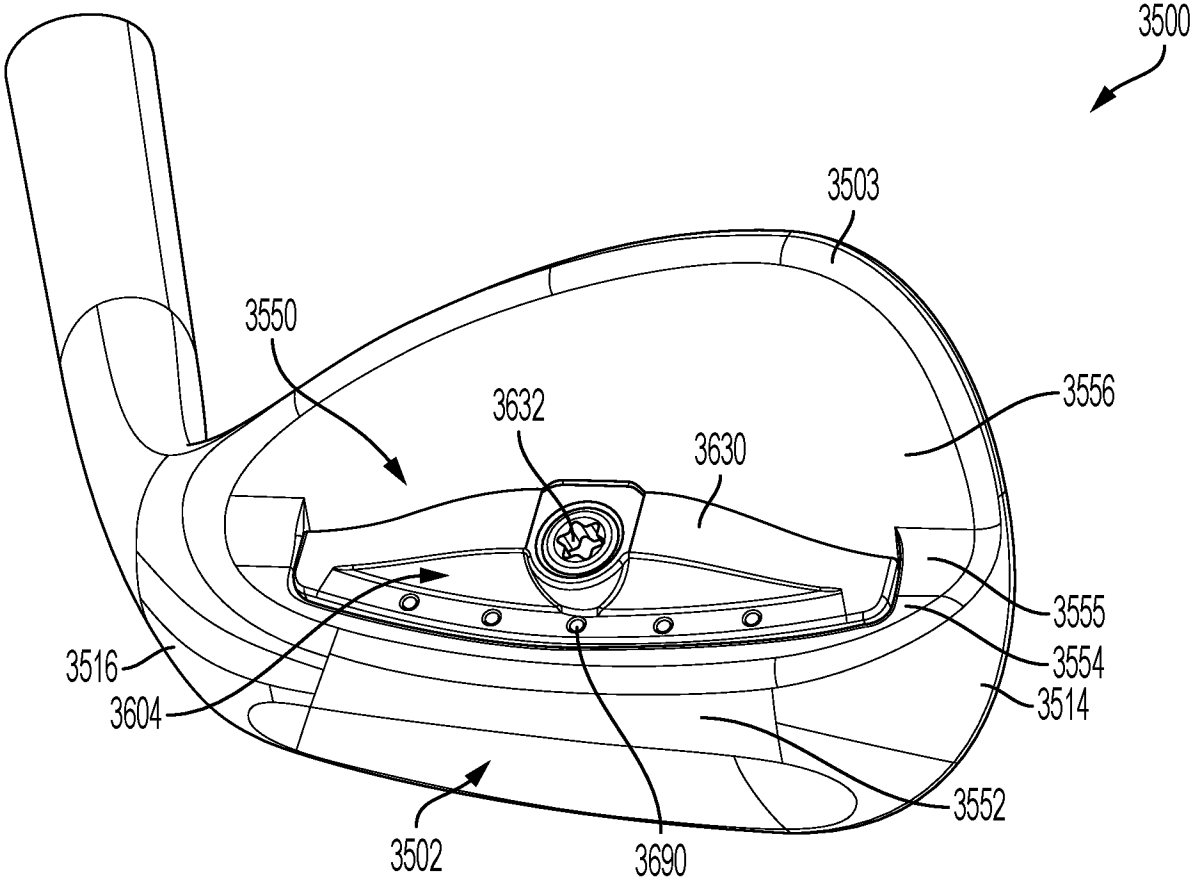
FIG. 113 is a back view of a golf club head with another weight assembly in the locked configuration.

FIG. 113 is a back view of a golf club head 3500 with another weight assembly 3604 in the locked configuration. The golf club head 3500 of the embodiment illustrated in FIG. 113 may include some features similar to, or the same as, features illustrated and described above with respect to the golf club head 3500 of FIGS. 105-112. Certain components are described above, and thus, are not necessarily described further. Referring to the example of FIG. 113, the golf club head 3500 has a body including a toe 3514, a heel 3516, a top portion 3503, a striking face (not shown), a sole 3502, and a back portion 3550. The back portion 3550 includes a lower back surface 3552, a first back surface 3554, an intermediate back surface 3555, and a second back surface 3556. A recessed channel (not shown) is formed in the first back surface 3554, and the weight assembly 3604 is couplable to the body of the golf club head 3500 at the recessed channel. The weight assembly 3604 includes a weight (not shown), a cover 3630, and a fastener 3632.

In this example, the weight assembly 3604 is similar to weight assembly 3504, except that when the weight assembly 3604 is in the locked configuration, the cover 3630 entirely covers the weight and the recessed channel, including a bottom track (not shown) of the recessed channel. In examples, the cover 3630 may comprise one or more see-through openings 3690 to provide an indication of where the weight is located within the recessed channel. For example, the body of the golf club head 3500 may have a plurality of locating lugs (similar to the locating lugs 3534 shown in FIG. 110) at a bottom track of the recessed channel to engage with the weight and at least partially define the position of the weight when the weight assembly 3604 is in the locked configuration, and the cover 3630 may include a plurality of see-through openings 3690 at positions respectively corresponding to the plurality of locating lugs. In examples, the weight may be adapted to slidingly engage with a flange on the cover 3730 (e.g., similar to how the weight 3528 in the embodiment shown in FIG. 106 is adapted to slidingly engage with the flange 3558 of the cover 3530), may be adapted to slidingly engage with a rail on the body (e.g., a rail protruding from the bottom track or from a sidewall of the recessed channel), or may not be adapted to slidingly engage with either the cover or the body. The weight assembly 3604 may include one or more of the weight assembly features described herein to enable the CG and the MOI of the golf club head 3500 to be adjustable for fade-draw bias, while securing the weight in the locked configuration indirectly by the cover 3630. In examples, faster 3632 forms a fastener angle measured in a cross-sectional plane with respect to a striking face and/or striking face plane of the golf club head 3500 in the manner described above with respect to weight assembly 3504.

Figure 114:
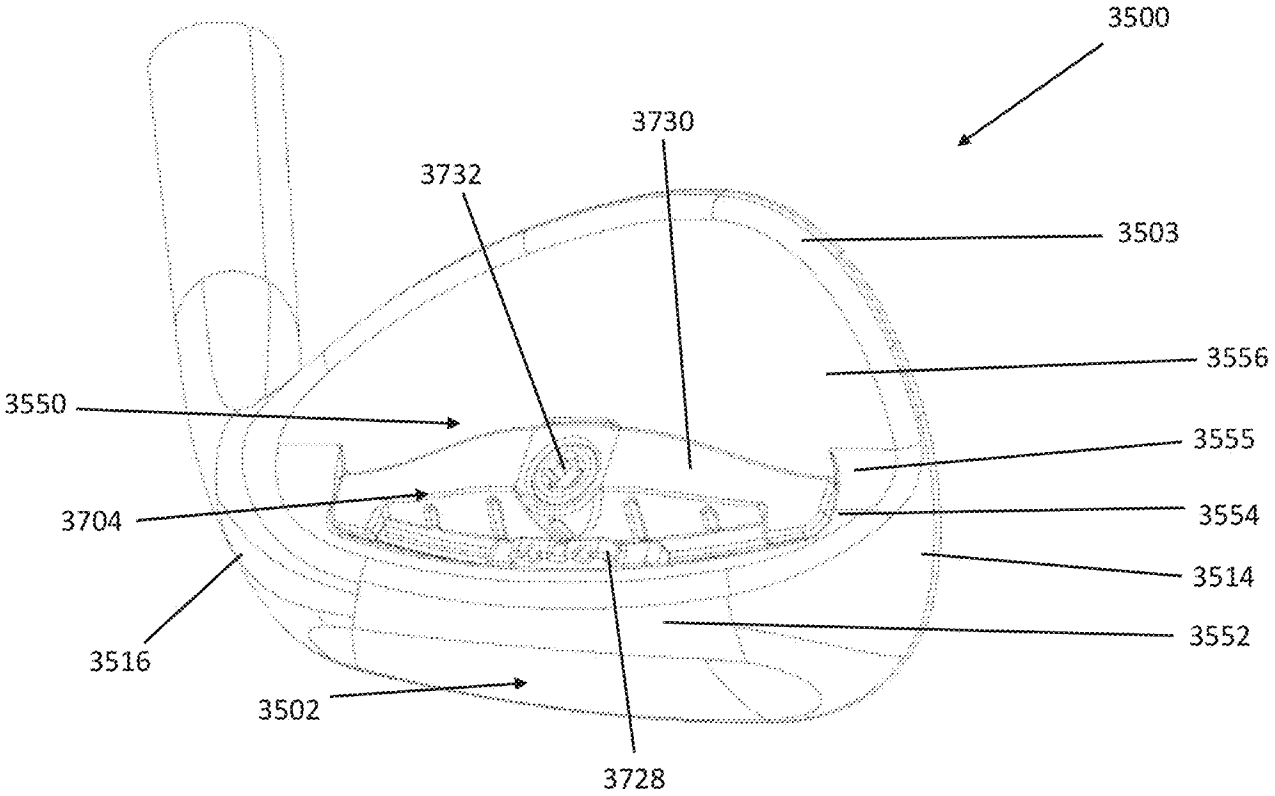
FIG. 114 is a back view of a golf club head with another weight assembly.
Figure 115:
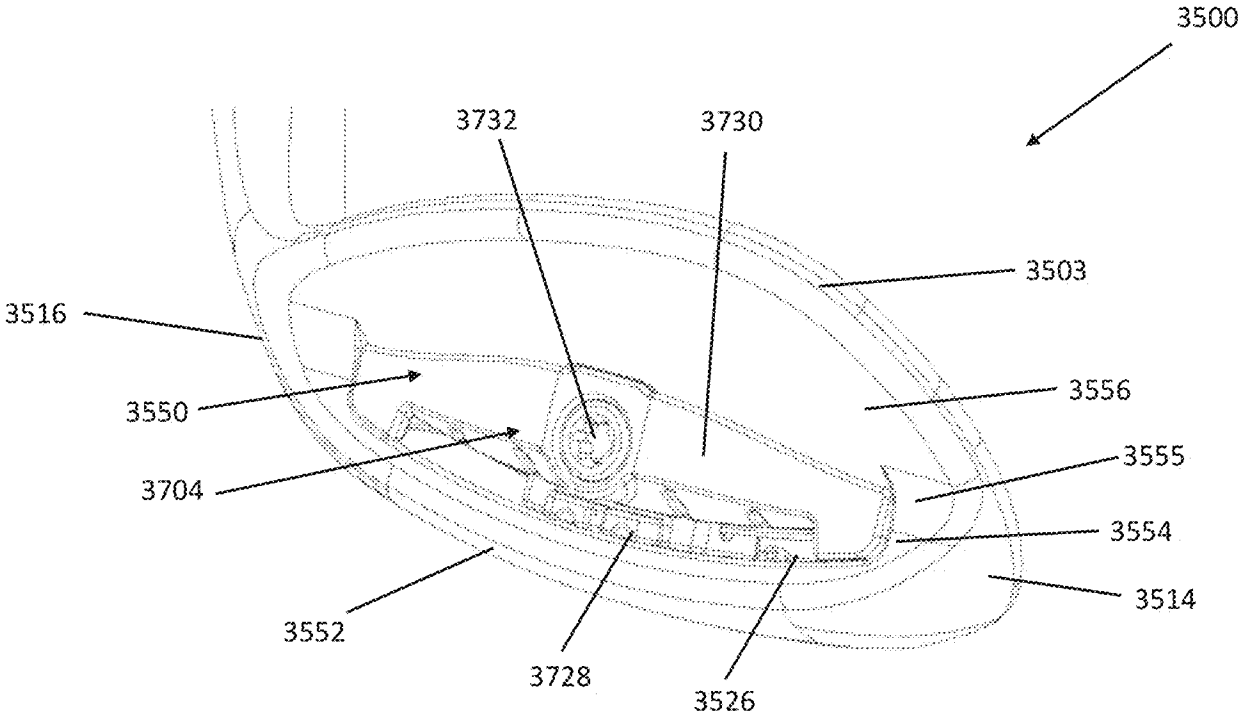
FIG. 115 is a top view of the golf club head of FIG. 114.

FIG. 114 is a back view of a golf club head 3500 with another weight assembly 3704, and FIG. 115 is a top view of the golf club head 3500 of FIG. 114. The golf club head 3500 of the embodiment illustrated in FIGS. 114 and 115 may include some features similar to, or the same as, features illustrated and described above with respect to the golf club head 3500 of FIGS. 105-112. Certain components are described above, and thus, are not necessarily described further. Referring to the example of FIGS. 114 and 115, the golf club head 3500 has a body including a toe 3514, a heel 3516, a top portion 3503, a striking face (not shown), a sole 3502, and a back portion 3550. The back portion 3550 includes a lower back surface 3552, a first back surface 3554, an intermediate back surface 3555, and a second back surface 3556. A recessed channel 3526 is formed in the first back surface 3554, and the weight assembly 3604 is couplable to the body of the golf club head 3500 at the recessed channel 3526. The weight assembly 3704 includes a weight 3728, a cover 3730, and a fastener 3732.

In this example, when the weight assembly 3704 is in the locked configuration, the cover 3730 exposes at least part of the weight 3728 and at least part of the recessed channel (e.g., at least part of a bottom track of the recessed channel 3526). For example, the cover 3730 may have a cutout portion overlapping at least part of the recessed channel 3526 while still allowing the cover 3730 to releasably secure the weight 3728 in the recessed channel 3526. Accordingly, a position of the weight 3728 in the recessed channel 3526 when the weight assembly 3704 is in the locked configuration may be visible through the cutout portion of the cover 3730. In examples, the weight 3728 may be adapted to slidingly engage with a flange on the cover 3730 (e.g., similar to how the weight 3528 in the embodiment shown in FIG. 106 is adapted to slidingly engage with the flange 3558 of the cover 3530), may be adapted to slidingly engage with a rail on the body (e.g., a rail protruding from the bottom track or from a sidewall of the recessed channel), or may not be adapted to slidingly engage with either the cover 3730 or the body. The weight assembly 3704 may include one or more of the weight assembly features described herein to enable the CG and the MOI of the golf club head 3500 to be adjustable for fade-draw bias, while securing the weight 3728 in the locked configuration. In examples, the faster 3732 forms a fastener angle measured in a cross-sectional plane with respect to a striking face and/or striking face plane of the golf club head 3500 in the manner described above with respect to weight assembly 3504.

Figure 116:
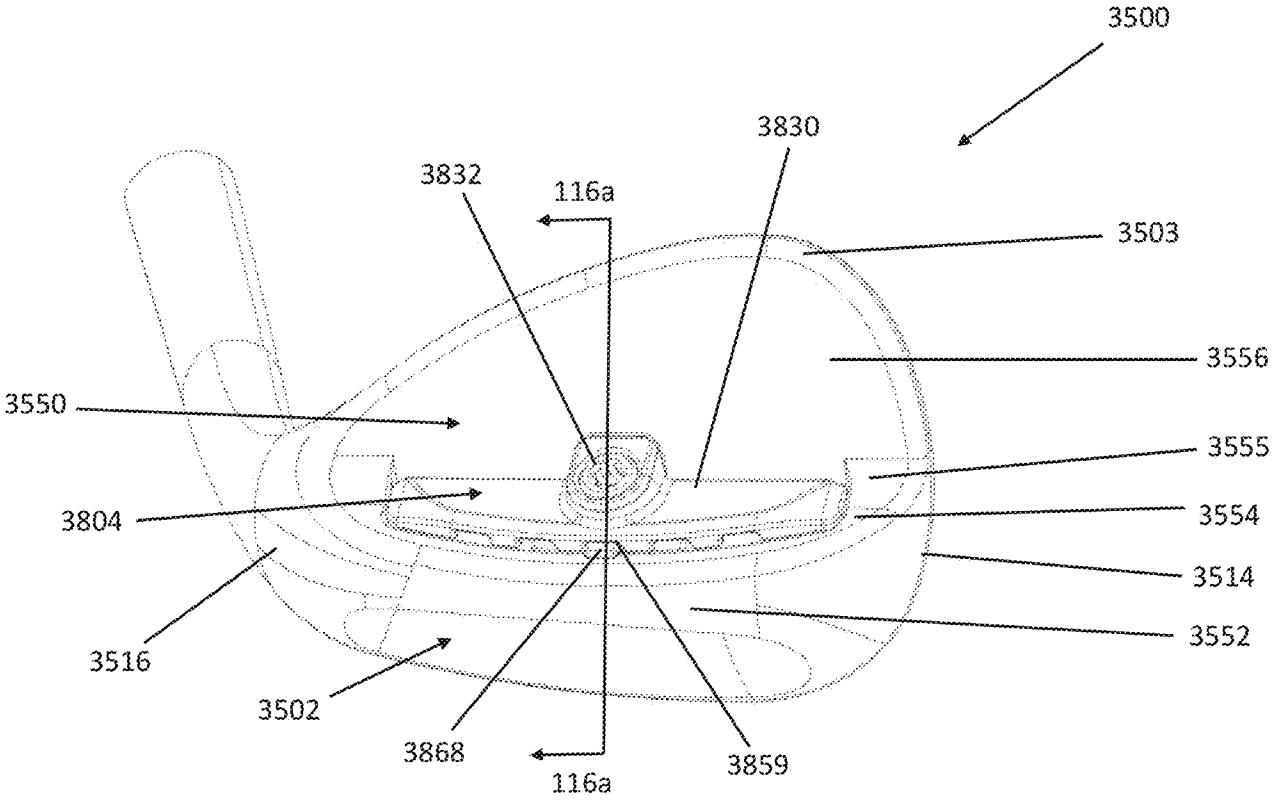
FIG. 116 is a back view of a golf club head with another weight assembly in the locked configuration.
Figure 117:
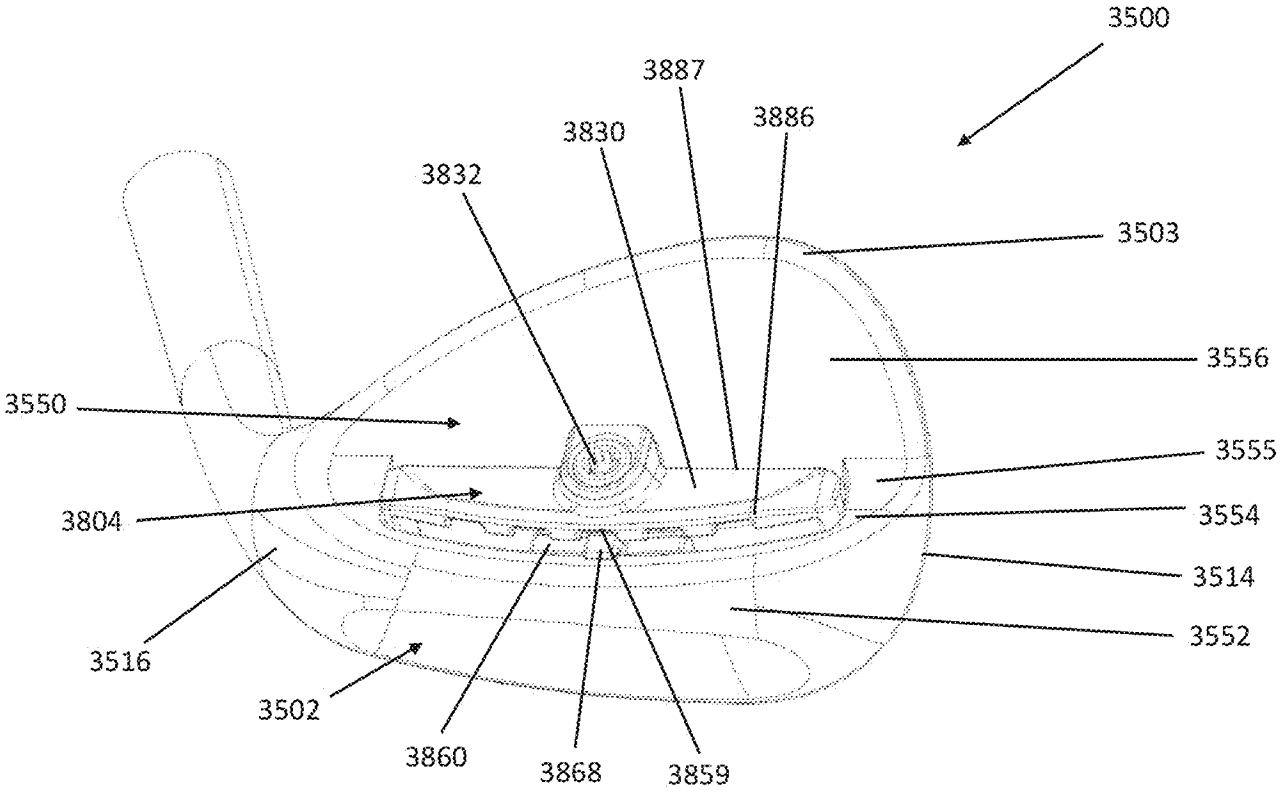
FIG. 117 is a back view of the golf club head of FIG. 116 when the weight assembly is in the unlocked configuration.
Figure 118:
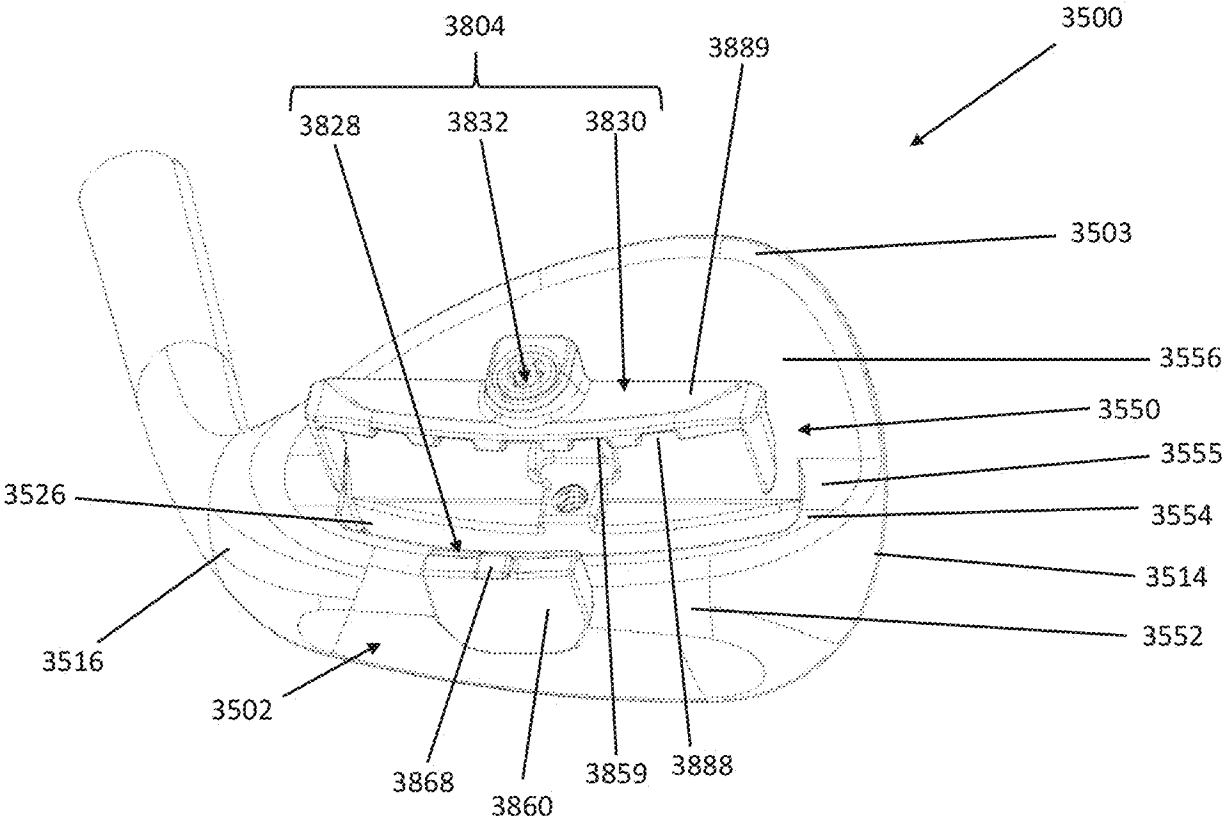
FIG. 118 is a partially exploded, back view of the golf club head of FIG. 116.
Figure 119:
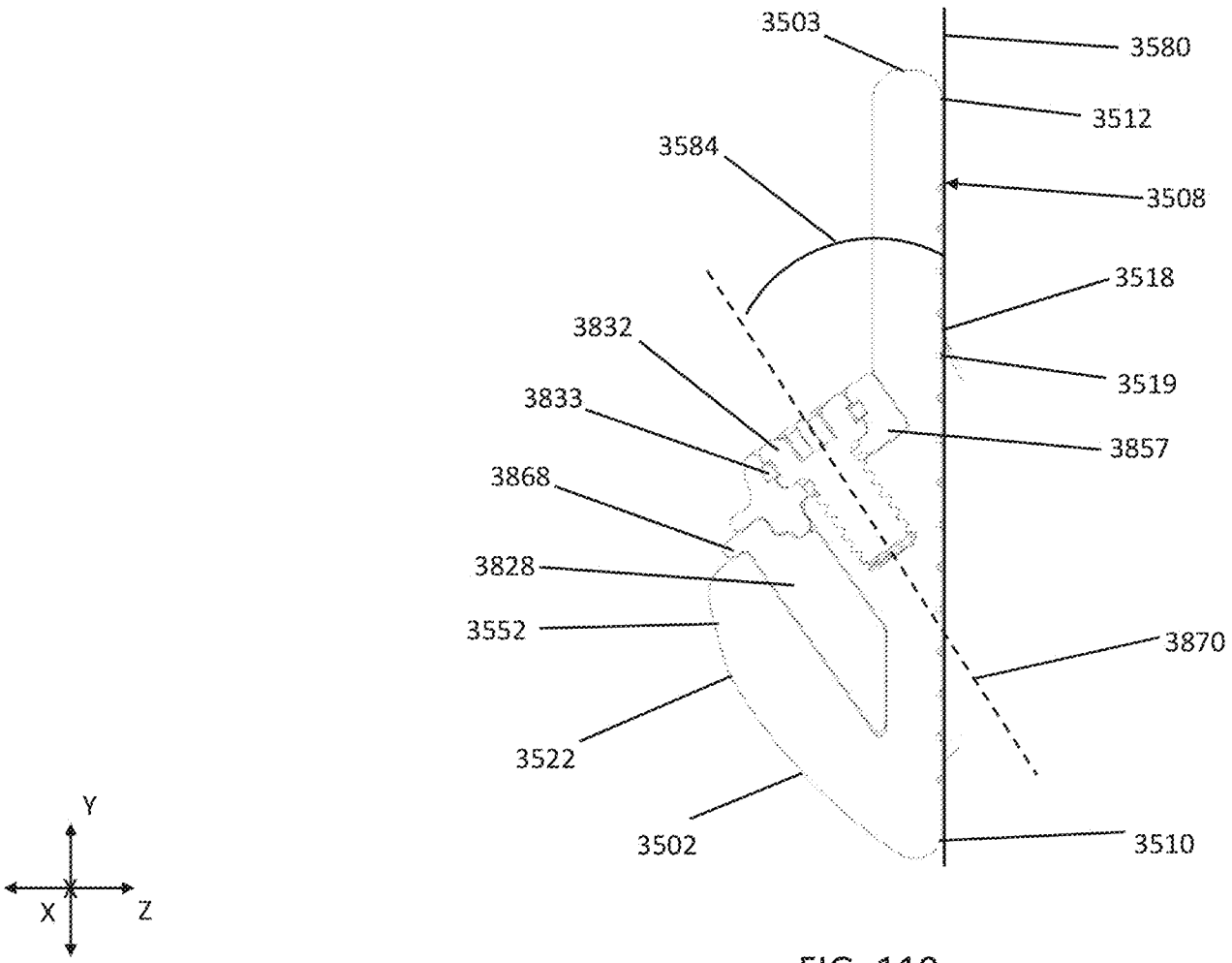

FIG. 116 is a back view of the golf club head 3500 with another weight assembly 3804 in the locked configuration. FIG. 117 is a back view of the golf club head 3500 of FIG. 116 when the weight assembly 3804 is in the unlocked configuration. FIG. 118 is a partially exploded, back view of the golf club head 3500 of FIG. 116. FIG. 119 is a cross-sectional view in the toe-to-heel direction of the golf club head 3500 of FIG. 116 taken along line 116*a*-116*a* when the weight assembly 3804 is in the locked configuration. FIG. 120 is a cross-sectional view in the toe-to-heel direction of the golf club head 3500 of FIG. 116 taken along line 116*a*-116*a* when the weight assembly 3804 is in the unlocked configuration. The golf club head 3500 of the embodiment illustrated in FIGS. 116-120 may include some features similar to, or the same as, features illustrated and described above with respect to the golf club head 3500 of FIGS. 105-112. Certain components are described above, and thus, are not necessarily described further. Referring to the example of FIGS. 116-120, the golf club head 3500 has a body including a toe 3514, a heel 3516, a top portion 3503, a striking face 3508 (see FIG. 119), a sole 3502, and a back portion 3550. The back portion 3550 includes a lower back surface 3552, a first back surface 3554, an intermediate back surface 3555, and a second back surface 3556. A recessed channel 3526 is formed in the first back surface 3554, and the weight assembly 3804 is coupled to the body of the golf club head 3500 at the recessed channel 3526.

The weight assembly 3804 includes a weight 3828, a cover 3830, and a fastener 3832. The fastener 3832 is coupled to the cover 3830 via a retaining clip 3533. In this example, the weight includes a main body 3860 and a protruding position indicator 3868 extending from an upper portion of the main body 3860. The upper portion of the main body 3860 refers to a portion of the main body 3860 closest to the cover 3830 and/or to the opening of the recessed channel 3526 when the weight assembly 3804 is in the locked configuration. A lower portion of the main body 3860 refers to a portion of the main body 3860 closest to a bottom of the recessed channel 3526 when the weight assembly 3804 is in the locked configuration. The recessed channel 3526 extends along a toe 3514—heel 3516 direction and the cover 3830 has two opposing long sides extending along the toe 3514—heel 3516 direction—a first long side 3886 distal to the striking face 3508 and a second long side 3887 proximal to the striking face 3508. The cover 3830 also has an interior surface 3888 facing the recessed channel 3526 when the weight assembly 3804 is in the locked configuration, and an exterior surface 3889 facing away from the recessed channel 3526 when the weight assembly 3804 is in the locked configuration. In some embodiments, when the weight assembly 3804 is in the locked configuration, at least part of the exterior surface 3889 may be level with the first back surface 3554, and at least part of the interior surface 3888 is offset from the first back surface 3554 and is inside the recessed channel 3526.

In the locked configuration, the cover 3830 covers and conceals at least part of the main body 3860, and at least part of the protruding position indicator 3868 extends from under the cover 3830 to be exposed. Accordingly, the protruding position indicator 3868 may indicate the position of the weight 3828 in the recessed channel 3526 when the weight assembly 3804 is in the locked configuration. The protruding position indicator 3868 may be on (e.g., in contact with) part of the outer surface (e.g., the first back surface 3554) of the body of the golf club head 3500 in the locked configuration. In this example, the weight 3828 is not adapted to slidingly engage with the cover 3830. When the cover 3830 is moved from the locked configuration to the unlocked configuration, the weight 3828 remains in the recessed channel 3526. In the unlocked configuration, the weight 3828 can be gripped by the protruding position indicator 3868 and moved along the toe 3514—heel 3516 direction. In some embodiments where the body includes locating lugs (similar to the locating lugs 3534 shown in FIG. 10) at a bottom track of the recessed channel 3526, the weight 3828 can be lifted up slightly by the protruding position indicator 3868 prior to being moved along the toe 3514—heel 3516 direction. The cover 3830 has at least one locating groove 3859 in the interior surface 3888 shaped and sized to receive at least part of the protruding position indicator 3868 and adapted to engage with the protruding position indicator 3868 to at least partially define the position of the weight 3828. The at least one locating groove 3859 may include a plurality (e.g., five) locating grooves, and the protruding position indicator 3868 can selectively engage with the locating grooves 3859. The locating grooves 3859 may extend from the first side 3886 toward (e.g., at least part way to) the second side 3887. The weight assembly 3804 may include one or more of the weight assembly features described herein to enable the CG and the MOI of the golf club head 3500 to be adjustable for fade-draw bias, while securing the weight in the lock configuration. In examples, the faster 3832 forms a fastener angle 3584 measured in a cross-sectional plane with respect to a striking face 3508 and/or striking face plane 3580 of the golf club head 3500 in the manner described above with respect to weight assembly 3504.

Figure 121:
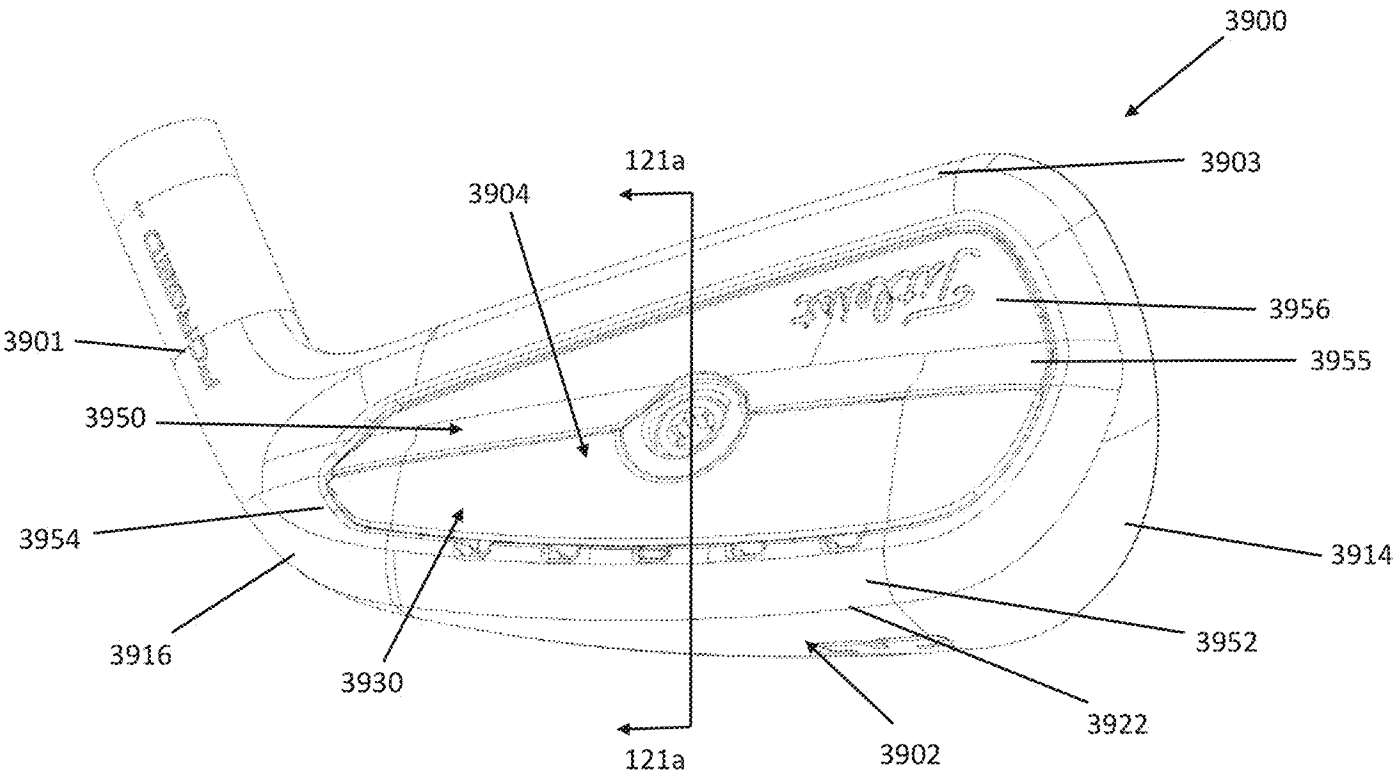
Figure 122:
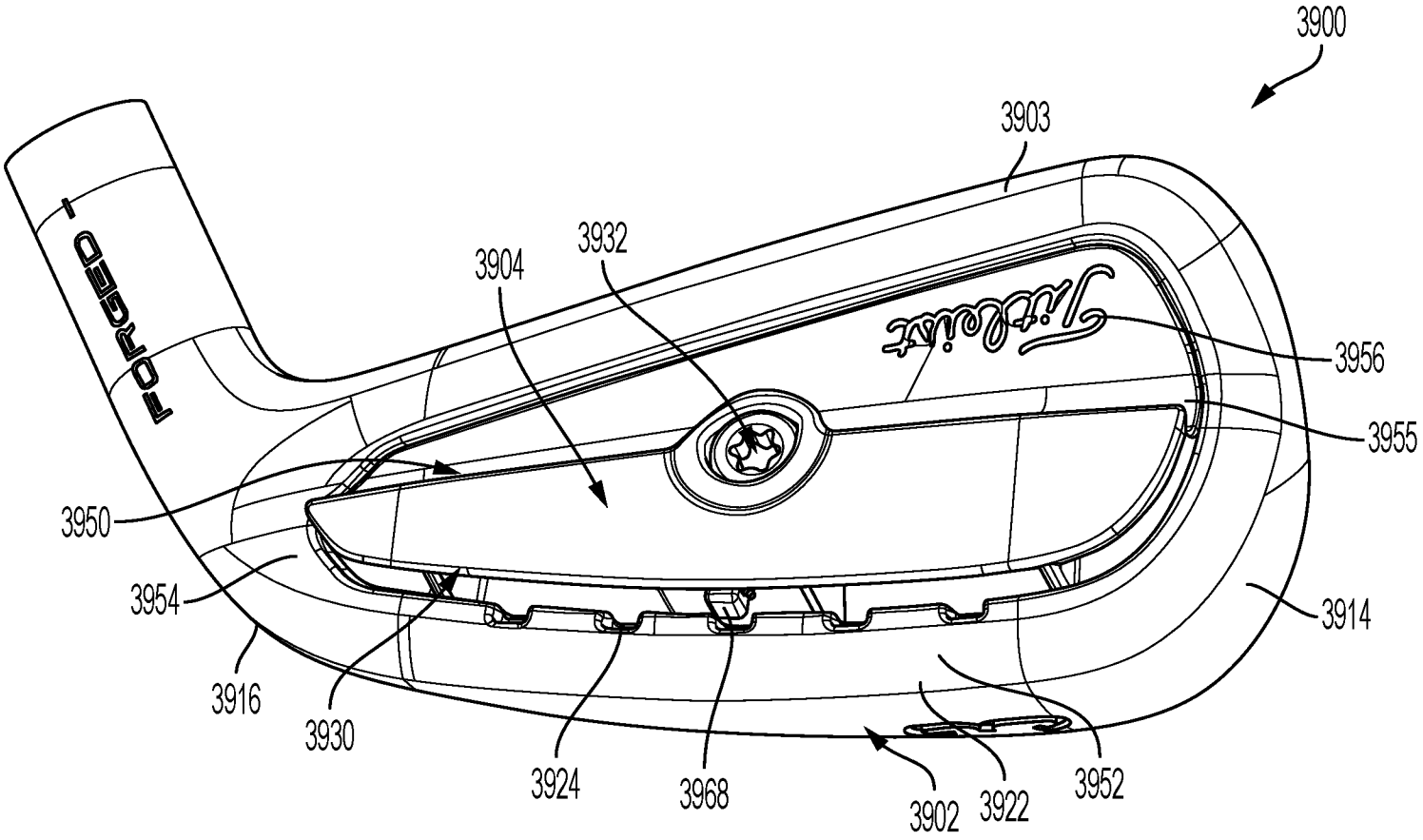
Figure 123:
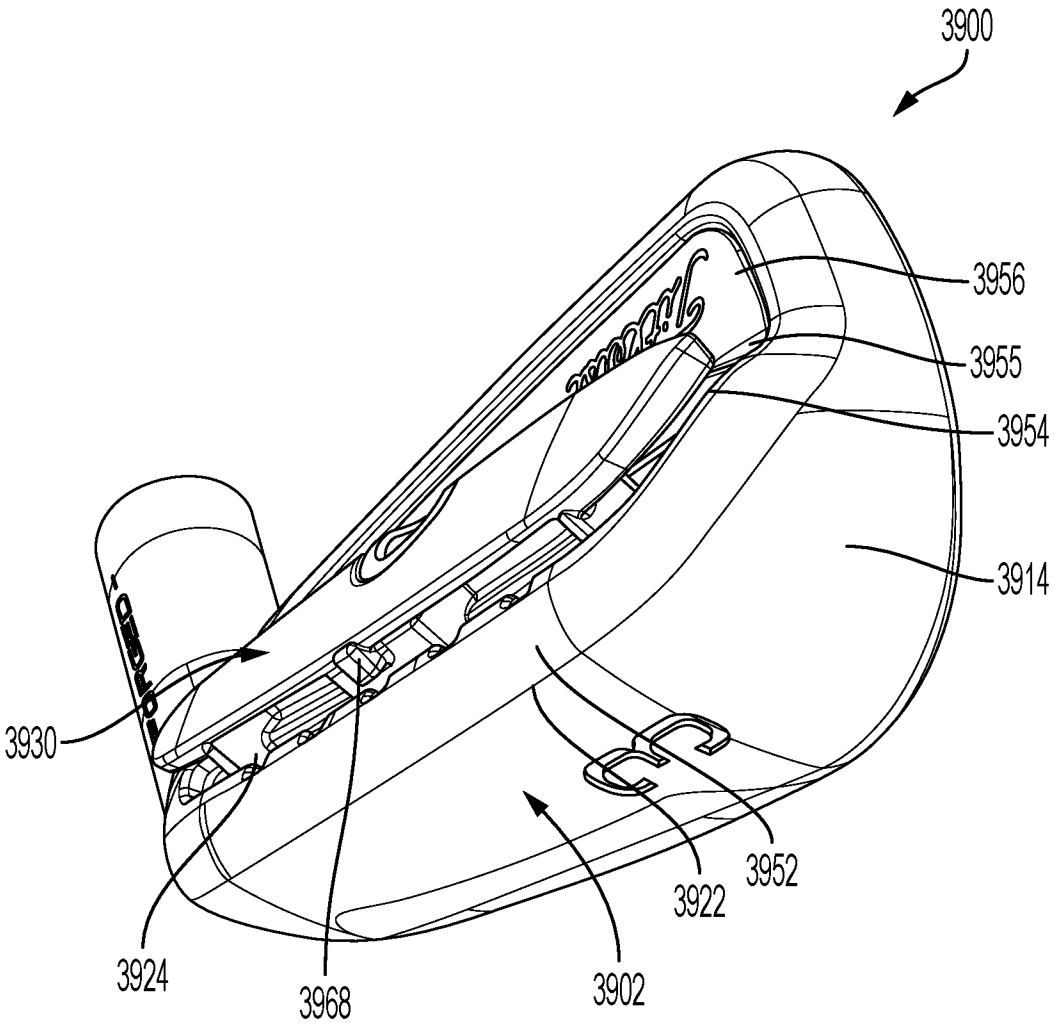
Figure 124:
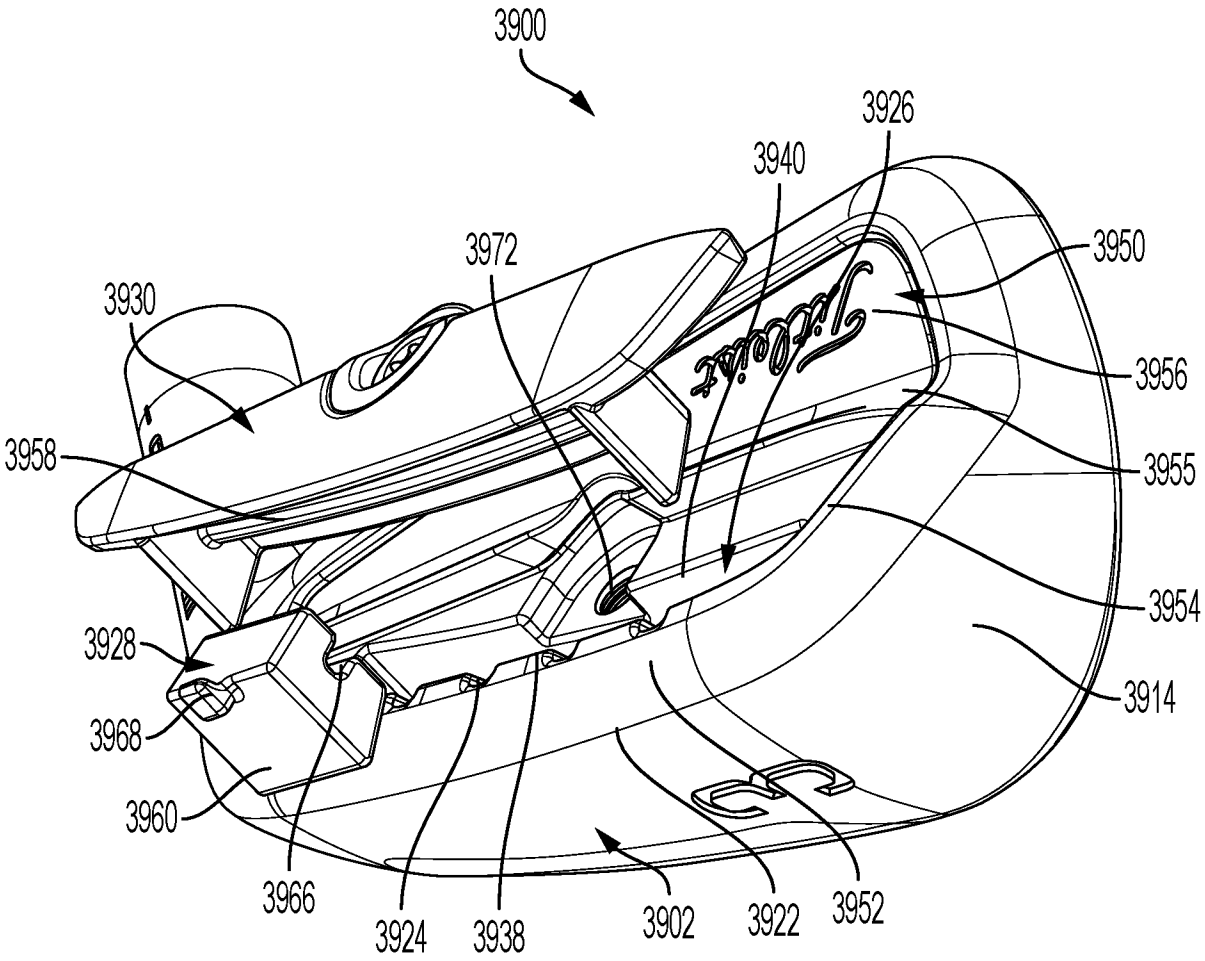
Figure 125:
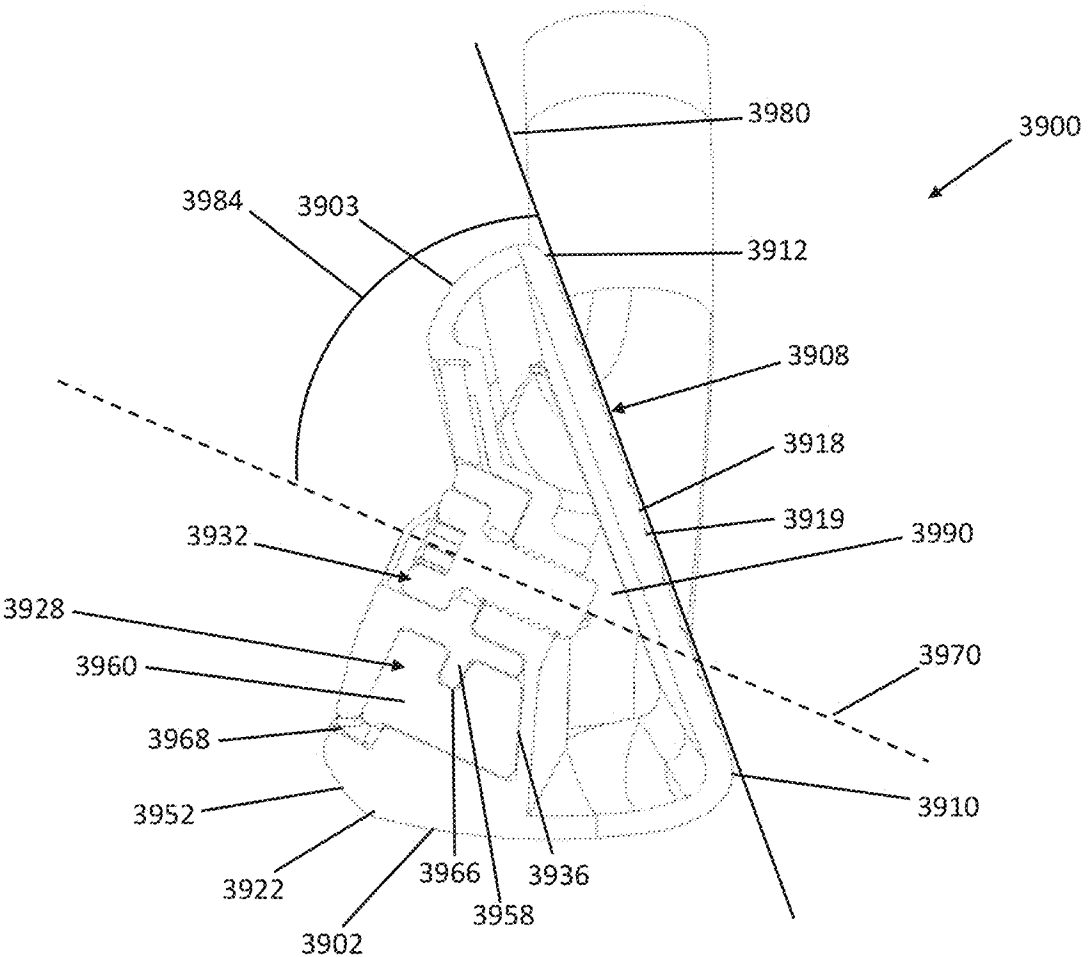
Figure 126:
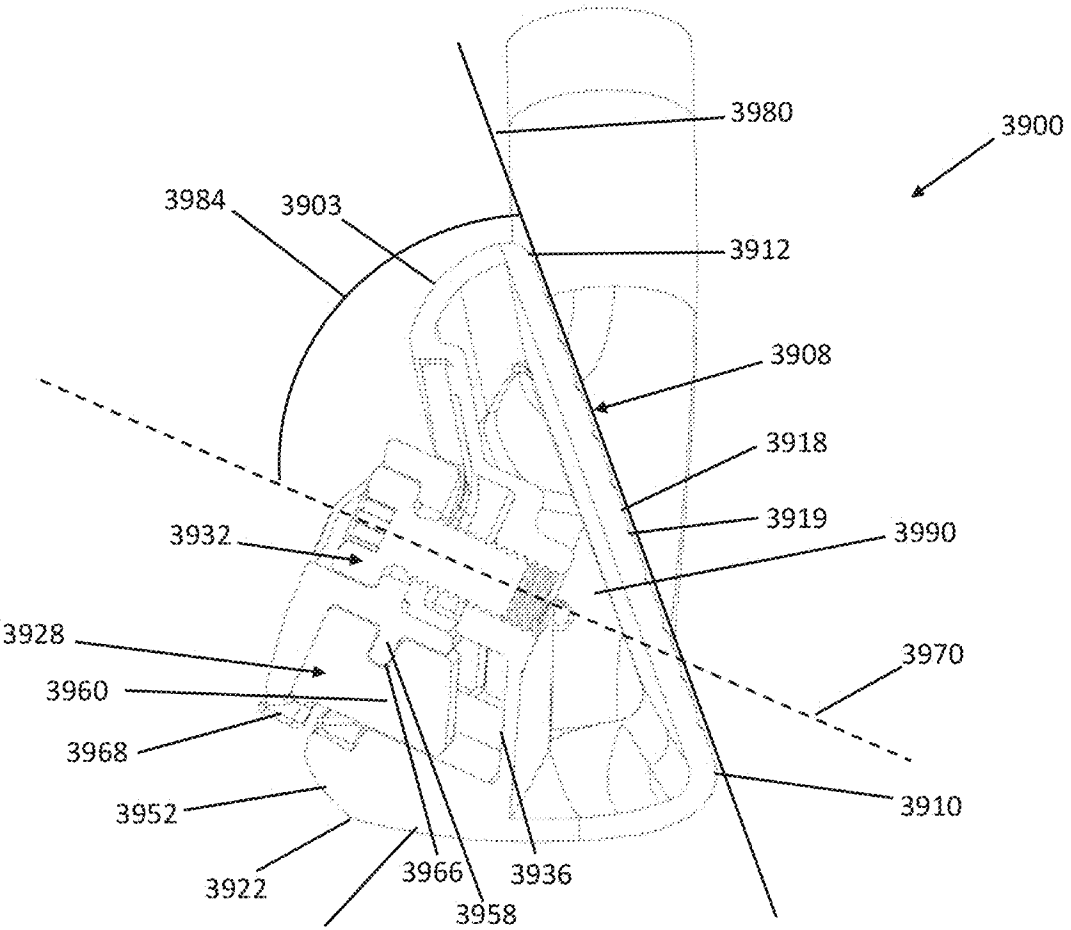

FIG. 121 is a back view of a golf club head 3900 with another weight assembly 3904 in the locked configuration. In this example, the golf club head 3900 is an iron-type golf club head, but not a wedge-type golf club head. In particular, the golf club head 3900 is illustrated as a 3-iron, Titleist® (Trademark of Acushnet) golf club head, but the embodiment is not limited thereto. FIG. 122 is a back view of the golf club head 3900 of FIG. 121 when the weight assembly 3904 is in the unlocked configuration. FIG. 123 is a perspective view of the golf club head 3900 of FIG. 121 when the weight assembly 3904 is in the unlocked configuration. FIG. 124 is a partially exploded, perspective view of the golf club head 3900 of FIG. 121. FIG. 125 is a cross-sectional view in the toe-to-heel direction of the golf club head 3900 of FIG. 121 along line 121*a*-121*a* when the weight configuration 3904 is in the locked configuration. FIG. 126 is a cross-sectional view of the golf club head 3900 of FIG. 121 along line 121*a*-121*a* when the weight configuration 3904 is in the unlocked configuration. The golf club head 3900 of the embodiment illustrated in FIGS. 121-126 may include some features similar to, or the same as, features illustrated and described above with respect to the golf club head 3500 of FIGS. 105-112.

Referring to FIGS. 121-126, the golf club head 3900 has a body including a toe 3914, a heel 3916, a top portion 3903, a striking face 3908, a sole 3902, and a back portion 3950. A hosel 3901 is disposed at the heel 3916 and is configured to couple to a shaft (not shown). The striking face 3908 has an upper topline edge 3912 and an opposite lower leading edge 3910. As shown in FIGS. 125 and 126, the striking face 3908 also has an outermost surface 3918 and grooves 3919 extending along the toe 3914—heel 3916 direction. The sole 3902 extends from the lower leading edge 3910 and has a rearward portion 3922 distal to the lower leading edge 3910.

The back portion 3950 is positioned between the rearward portion 3922 of the sole 3902 and the top portion 3903 and includes all surfaces of an outer surface of the body of the golf club head 3900 that are both between the rearward portion 3922 of the sole 3902 and the top portion 3903 and also between the toe 3914 and the heel 3916. In this example, the back portion 3950 includes a lower back surface 3952, a first back surface 3954, an intermediate back surface 3955, and a second back surface 3956. In examples, the second back surface 3956, along with the cover 3930, acts to conceal the cavity formed in the rear of the club head 3900; however, second back surface 3956 stays stationary, while the cover 3930 moves between a locked and unlocked position.

A recessed channel 3926 is formed in the first back surface 3954, and the weight assembly 3904 is couplable to the body of the golf club head 3900 at the recessed channel 3926. The recessed channel 3926 has bottom track 3936 offset from the outer surface of the body of the golf club head 3900. The recessed channel 3926 also has opposing first and second sidewalls 3938 and 3940 extending along the toe 3914—heel 3916 direction, the first sidewall 3938 being proximal or adjacent to the lower back surface 3952 and the second sidewall 3940 being distal to the lower back surface 3952. At least one dimple 3924 may be formed in the first sidewall 3938 at an upper end of the first sidewall 3938 where an opening of the recessed channel 3926 is formed in the outer surface of the body.

The weight assembly 3904 includes a weight 3928, a cover 3930, and a fastener 3932. A fastener receiver 3972 is formed in the body of the golf club head 3900 and is adapted to receive at least part of the fastener 3932 and to engage with the fastener 3932. The cover 3930 includes a flange 3958, and the weight 3928 has a groove 3966 shaped and sized to receive at least part of the flange 3958 and to slidingly engage the weight 3928 with the cover 3930. The weight 3928 has a main body 3960 and a protruding position indicator 3968 protruding from the main body 3960. The at least one dimple 3924 are shaped and sized to receive at least part of the protruding position indicator 3968. In the locked configuration of the weight assembly 3904, the cover 3930 may cover and conceal the main body 3960 of the weight 3928, and the protruding position indicator 3968 may at least partially protrude from under the cover 3930 and engage with a dimple of the at least one dimple 3924 to visibly indicate the position of the weight 3928 in the locked configuration. The weight assembly 3904 may include one or more of the weight assembly features described herein to enable the CG and the MOI of the golf club head 3900 to be adjustable for fade-draw bias, while securing the weight in the lock configuration.

In examples, the fastener 3932 forms a fastener angle 3984 measured in a cross-sectional plane with respect to a striking face 3908 and/or a striking face plane 3980 of the golf club head 3900 in the manner described above with respect to weight assembly 3504.

Figure 128:
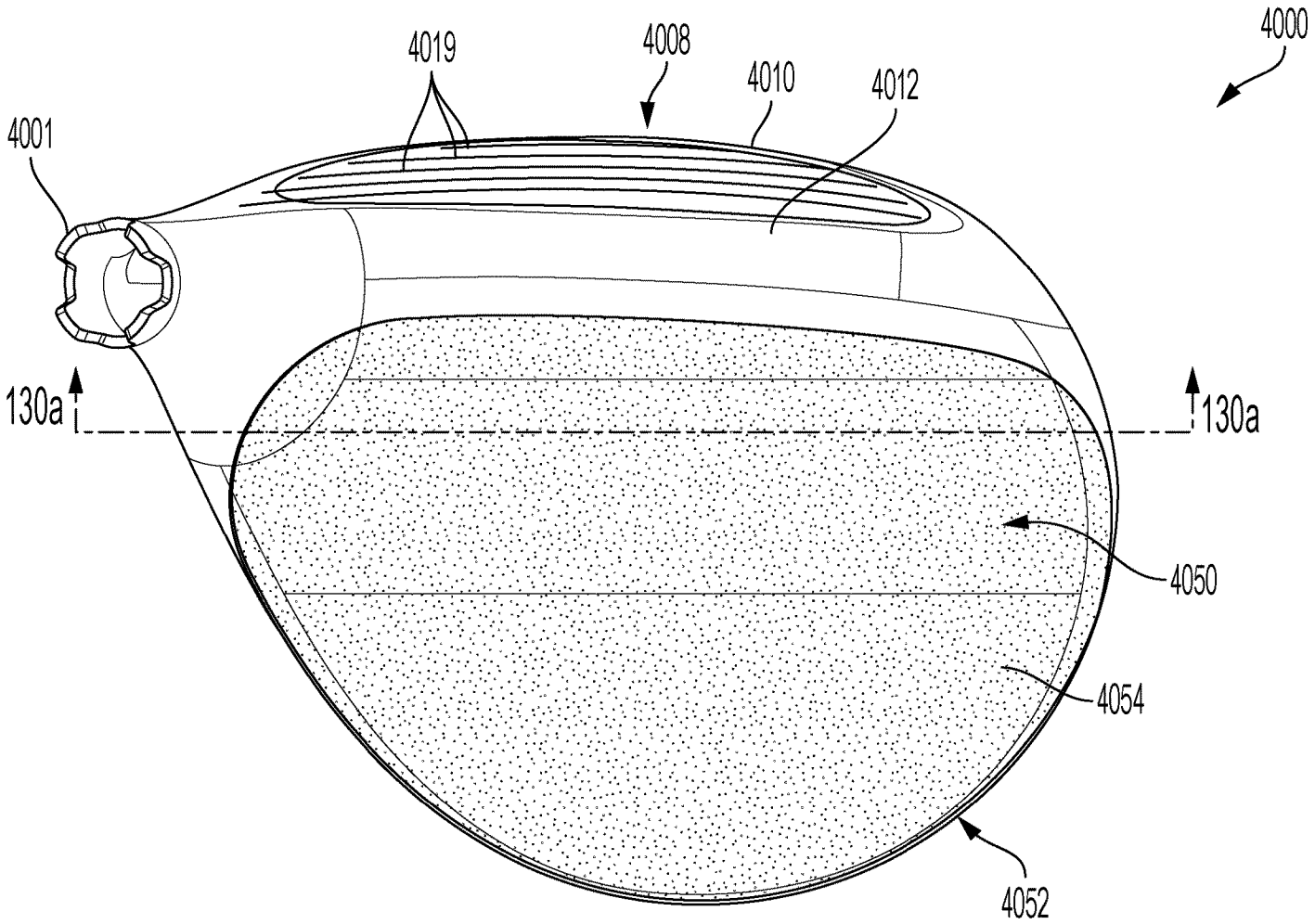
Figure 129:
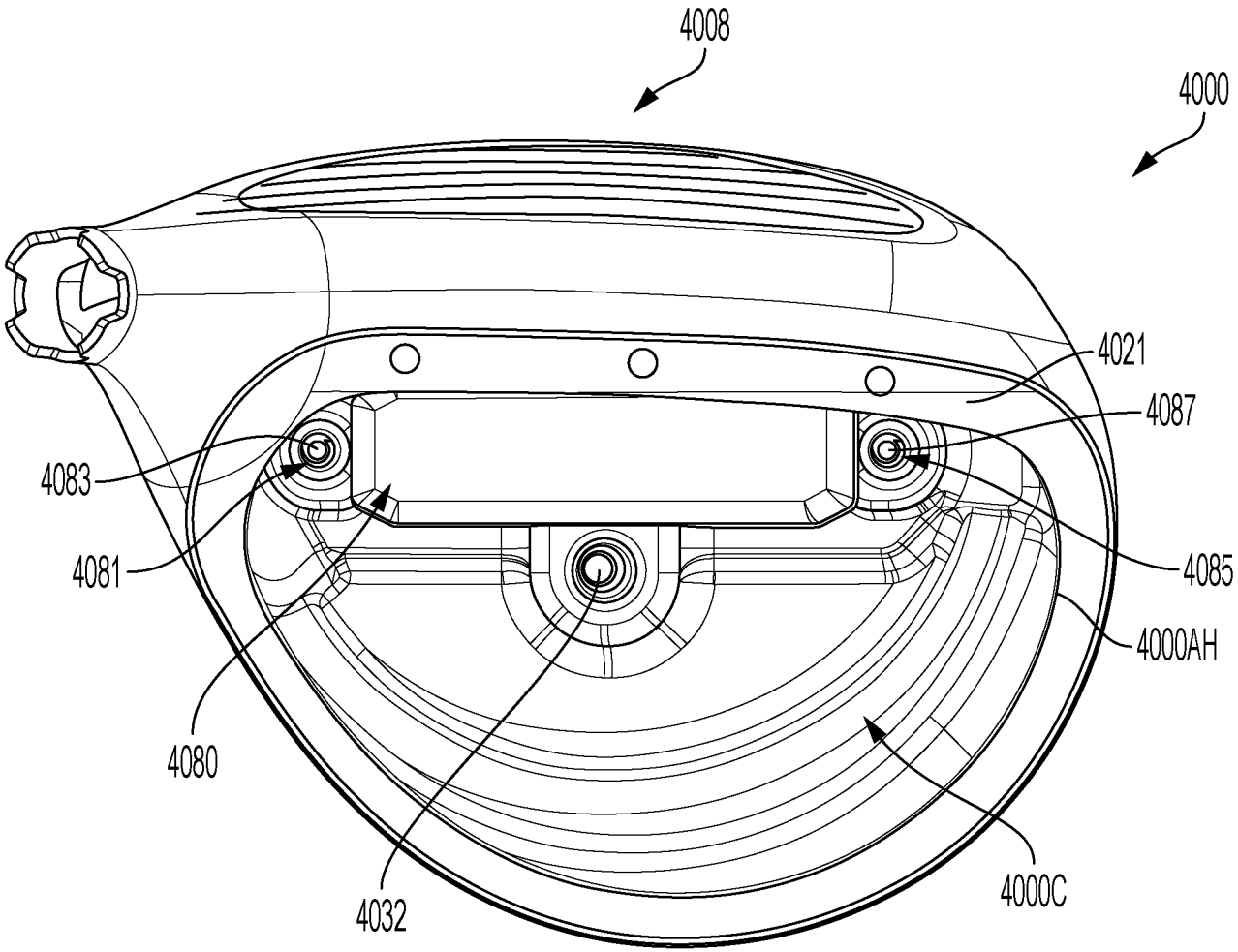
Figure 130:
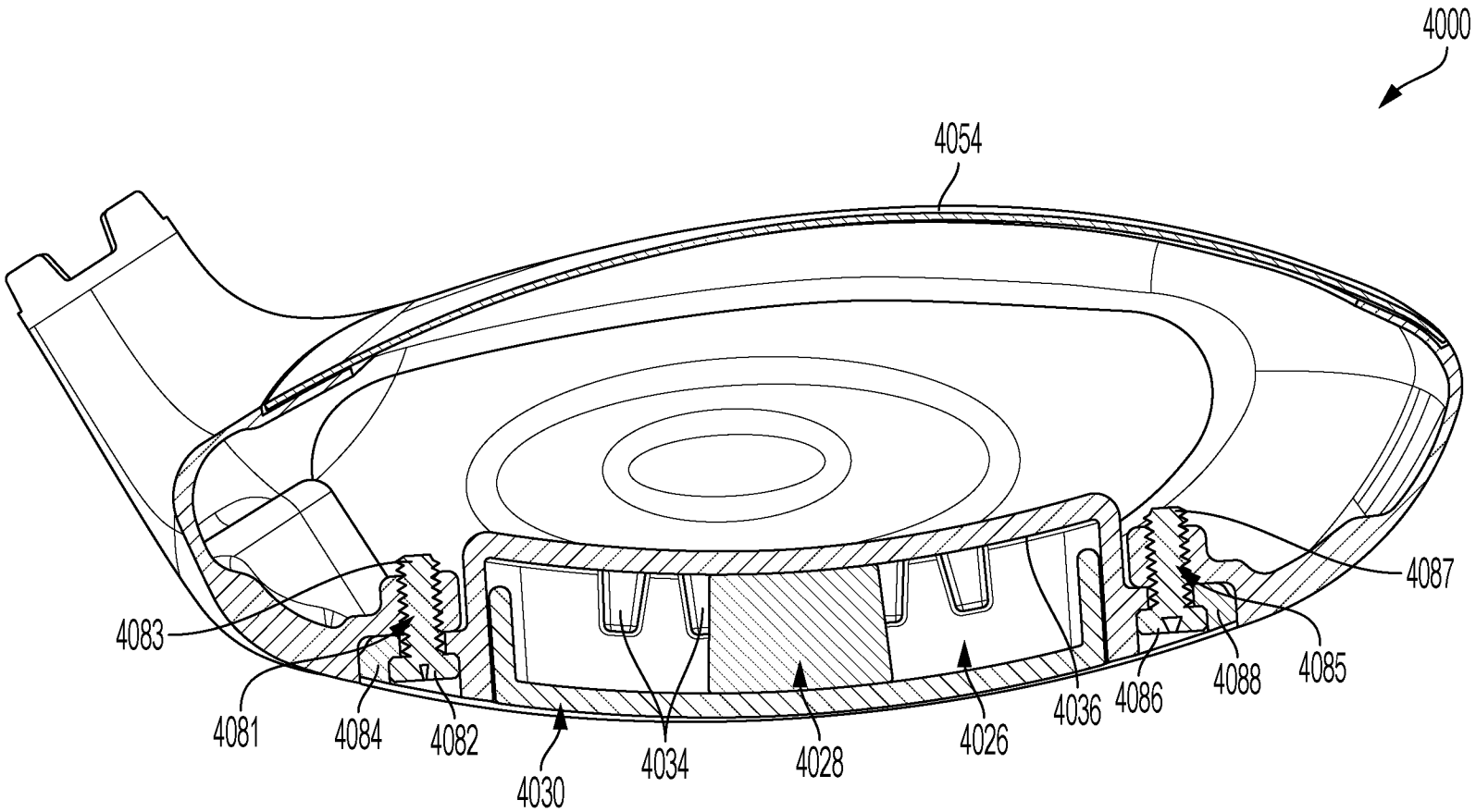

FIG. 127 is a bottom view of a golf club head 4000 with another weight assembly 4004 in the locked configuration. In particular, the golf club head 4000 is depicted as being a metal wood type golf club head. However, the present disclosure is not limited thereto. For example, the golf club head 4000 may be a hybrid type golf club or an iron type golf club, such as a wedge. FIG. 128 is a top view of the golf club head 4000 of FIG. 127. FIG. 129 is another top view of the golf club head 4000 of FIG. 127 without the crown piece 4054 of the golf club head 4000. FIG. 130 is a cross-sectional view of the golf club head 4000 of FIG. 127 along line 130*a*-130*a* of FIG. 128 when the weight assembly 4004 is in the locked configuration. FIG. 131 is another bottom view of the golf club head 4000 of FIG. 127 without the pocket 4080 and the weight assembly 4004 of the golf club head 4000. FIG. 132 is another top view of the golf club head 4000 of FIG. 127 without the crown piece 4054, the pocket 4080, and the weight assembly 4004 of the golf club head 4000. FIG. 133 is a perspective view of the pocket 4080 and weight assembly 4004 of the golf club head of FIG. 127 when the weight assembly 4004 is in the locked configuration. FIG. 134 is another perspective view of the pocket 4080 and weight assembly 4004 of the golf club head 4000 of FIG. 127 when the weight assembly 4004 is in the locked configuration. FIG. 135 is another perspective view of the pocket 4080 and weight assembly 4004 of the golf club head 4000 of FIG. 127 when the weight assembly 4004 is in the unlocked configuration. FIG. 136 is another perspective view of the pocket 4080 and weight assembly 4004 of the golf club head 4000 of FIG. 127 when the weight assembly 4004 is in the unlocked configuration. FIG. 137 is a perspective view of the pocket 4080 of the golf club head 4000 of FIG. 127 without the weight assembly 4004. FIG. 138 is a perspective view of the cover 4030 of the weight assembly 4004 of the golf club head 4000 of FIG. 127. FIG. 139 is another perspective view of the cover 4030 of the weight assembly 4004 of the golf club head 4000 of FIG. 127. FIG. 140 is a perspective view of the weight 4028 of the weight assembly 4004 of the golf club head 4000 of FIG. 127. FIG. 141 is another perspective view of the weight 4028 of the weight assembly 4004 of the golf club head 4000 of FIG. 127.

Referring concurrently to FIGS. 127-141, the golf club head 4000 may include a body 4006 having a striking face 4008 with a lower leading edge 4010 and an opposite upper topline edge 4012 extending between a toe 4014 and a heel 4016. The striking face 4008 may have multiple grooves 4019 (or score lines) formed therein and extending in a toe-heel direction to help impart spin on a golf ball when struck by the striking face 4008. The body 4006 may have a sole 4002 extending from the lower leading edge 4010 on the bottom side of the golf club head 4000. A crown 4050 may be coupled between the sole 4002 and the upper topline edge 4012, and the crown 4050 may be joined to the sole 4002 along a skirt 4052 of the body 4006. The striking face 4008, the sole 4002, and the crown 4050 may be coupled together so as to define at least part of an outer surface 4020 of the body 4006. The body 4006 may have a cavity 4000C at least partially enclosed by the striking face 4008, the sole 4002, and the crown 4050. A hosel 4001 may be disposed at the heel 4016 and be configured to couple to a shaft (not shown).

The body 4006 may include a crown piece 4054 (see FIG. 128) attached (e.g., welded) to the body 4006 to conceal an access hole 4000AH (see FIG. 129) at least partially in the crown 4050, and the crown piece 4054 may define at least a portion of the crown 4050. The body 4006 may be manufactured to include the access hole 4000AH to provide access to the cavity 4000C so that manufacturing steps requiring access to the cavity 4000C may be performed. Although an example is depicted where the access hole 4000AH is in the crown 4050, the present disclosure is not limited thereto. In some examples, the access hole 4000AH may be at least partially in at least one of the crown 4050, the sole 4002, or the striking face 4008. The outer surface 4020 of the body 4006 may have a recessed surface 4021 at least partially around the access hole 4000AH, and an outer portion of the crown piece 4054 may be attached to the recessed surface 4021. A thickness of at least the outer portion of the crown piece 4054 may be substantially the same as a depth by which the recessed surface 4021 is recessed from a portion of the outer surface 4020 adjacent to the recessed surface 4021 so that, when the crown piece 4054 is attached to the body 4006, the crown piece 4054 may be substantially level and continuous with the region of the outer surface 4020 adjacent to the recessed surface 4021.

A pocket 4080 defining a recessed channel 4026 may be provided in the body 4006, and a weight assembly 4004 may be coupled to the body 4006 at the recessed channel 4026. The weight assembly 4004 will be described in more detail below.

The pocket 4080 may be at least partially inserted into the cavity 4000C through a pocket hole 4022 in the body 4006. The pocket hole 4022 may be shaped and sized to receive at least a portion (e.g., a center portion or a portion defining the recessed channel 4026) of the pocket 4080. In some examples, such as the example depicted in FIGS. 127-141, the pocket hole 4022 is in the sole 4002. However, the present disclosure is not limited thereto. For example, the pocket hole 4022 may be provided at least partially in at least one of the sole 4002, the crown 4050, or the striking face 4008. In some examples, the golf club head is an iron type golf club head having a striking face, a sole, and a back portion positioned rearward to the striking face and coupled between the sole and the upper topline edge of the striking face, and the pocket hole may be provided at least partially in at least one of the sole or the back portion.

The pocket 4080 may have an exterior surface 4080ES that faces the outside of the golf club head 4080 when the pocket 4080 is at least partially inserted through the pocket hole 4022. For example, the external surface 4080ES of the pocket 4080 may be substantially level and continuous with the outer surface 4020 of the body 4006. The recessed channel 4026 may extend inward into the body 4006 from an opening in the exterior surface 4080ES to a bottom track 4036 of the recessed channel 4026.

The pocket 4080 may be the same or different in material from the body 4006. For example, the body 4006 may include a first material, the pocket 4080 may include a second material, and the second material may be the same or different from the first material. In some examples, the second material may be less in density than the first material. The first material may be, for example, a polymer, and the second material may be, for example, a metal. The pocket 4080 may be manufactured separately from the body 4006 and then installed in the body 4006—as opposed to, for example, manufacturing a body to have a cast—in recessed channel. Manufacturing the body to have a cast—in recessed channel may require a process that is complicated by constraints relating to casting, core removal, etc., and the cast—in recessed channel will generally be defined in a same, material as the body is formed from, which may significantly increase the weight of the golf club head. By manufacturing the pocket 4080 separately from the body 4006 with a light-weight material, and then installing the pocket 4080 in the body 4006, the manufacturing process of the golf club head 4000 may be simplified, and the weight of the golf club head 4000 may be reduced. In examples, the pocket 4080 may comprise a single, unitary piece—for example, a molded plastic.

The pocket 4080 may define the recessed channel 4026 in a central portion of the pocket 4080 between a heel end 4080H of the pocket 4080 and a toe end 4080T of the pocket 4080. When the pocket is installed, the toe end 4080T may be a portion of the pocket 4080 proximal to the toe 4014 and distal to the heel 4016, and the heel end 4080H may be a portion of the pocket 4080 proximal to the heel 4016 and distal to the toe 4014. The pocket 4080 may be at least partially secured to the body 4006 by at least one pocket fastener. For example, the pocket 4080 may be secured to the body 4006 at least in part by a first pocket fastener 4081 securing the heel end 4080H of the pocket 4080 to the body 4006 and a second pocket fastener 4085 securing the toe end 4080T of the pocket 4080 to the body 4006. In some examples, the pocket 4080 is at least partially secured to the body 4006 by an epoxy in conjunction with (or without) the at least one pocket fastener. The epoxy may be at least partially applied to the pocket 4080 around a portion of the body 4006 forming the pocket hole 4022 to at least partially secure the pocket 4080 within the pocket hole 4022 and to at least partially seal the pocket hole 4022.

The first pocket fastener 4081 may include a head 4082 at a first end of the first pocket fastener 4081, a tip 4083 at a second end opposite to the first end of the first pocket fastener 4081, and a shaft (e.g., an at least partially threaded shaft) extending from the head 4082 to the tip 4083. The second pocket fastener 4085 may include a head 4086 at a first end of the second pocket fastener 4085, a tip 4087 at a second end opposite to the first end of the second pocket fastener 4085, and a shaft (e.g., an at least partially threaded shaft) extending from the head 4086 to the tip 4087.

In the depicted example, when installed, the first pocket fastener 4081 extends into the body 4006 (e.g., toward or into the cavity 4000C) from the head 4082 to the tip 4083, and the second pocket fastener 4085 extends into the body 4006 from the head 4086 to the tip 4087. For example, the tips 4083 and 4087 of the first and second pocket fasteners 4081 and 4085 may respectively be positioned deeper inside the body 4006 from the outer surface 4020 (or from the exterior surface 4080ES) than the heads 4082 and 4086. In some such examples, manufacturing the golf club head 4000 may include attaching the pocket 4080 to the body 4006 by screwing the first and second pocket fasteners 4081 and 4085 at least partially into the pocket 4080 and at least partially into the body 4006 from outside of the body 4006. However, the present disclosure is not limited thereto.

The pocket 4080 may include a first protrusion 4084 at the heel end 4080H and a second protrusion 4088 at the toe end 4080T. The body 4006 may have a first indent 4024 in the outer surface 4020 (see FIG. 131), between the pocket hole 4022 and the heel 4016, and shaped and sized to receive at least part of the first protrusion 4084, and the body 4006 may have a second indent 4025 in the outer surface 4020, between the pocket hole 4022 and the toe 4014, and shaped and sized to receive at least part of the second protrusion 4088. The pocket 4080 may be configured such that the first and second protrusions 4084 and 4088 fit within the first and second indents 4024 and 4025, respectively, when the pocket 4080 is at least partially inserted through the pocket hole 4080. The first and second protrusions 4084 and 4088 may engage with the first and second indents 4024 and 4025 to help fix the position of the pocket 4080 when it is installed in the body 4006.

The pocket 4080 may have a first pocket fastener hole 4089 in the heel end 4080H (see FIG. 137) and shaped and sized to at least partially receive the first pocket fastener 4081, and the pocket 4080 may have a second pocket fastener hole 4090 in the toe end 4080T and shaped and sized to at least partially receive the second pocket fastener 4085. The first pocket fastener hole 4089 may have a shallow portion shaped and sized to receive at least part of the head 4082 of the first pocket fastener 4081 and a deep portion shaped and sized to receive at least part of the shaft of the first pocket fastener 4081. The shallow portion may be a recessed surface in the exterior surface 4080ES, and the deep portion may be a through-hole in the pocket 4080. In some examples, the deep portion may be shaped and sized such that it cannot receive at least part of the head 4082. The second pocket fastener hole 4090 may have a similar configuration as the first pocket fastener hole 4089.

The body 4086 may have a first pocket fastener receiver 4027 (see FIG. 131) shaped and sized to at least partially receive the first pocket fastener 4081 and a second pocket fastener receiver 4029 shaped and sized to at least partially receive the second pocket fastener 4085. The first pocket fastener receiver 4027 may be positioned between the pocket hole 4022 and the heel 4016, and the second pocket fastener receiver 4029 may be positioned between the pocket hole 4022 and the toe 4014. In some examples, the first pocket fastener receiver 4027 is a hole in the first indent 4024 that extends through to the cavity 4000C, and the second pocket fastener receiver 4029 is a hole in the second indent 4025 that extends through to the cavity 4000C. The pocket 4080 may be configured such that the first and second pocket fastener holes 4089 and 4090 respectively align with the first and second pocket fastener receivers 4027 and 4029 when the pocket 4080 is at least partially inserted into the pocket hole 4022 such that the first pocket fastener 4081 may extend at least partially through both of the first pocket fastener hole 4089 and the first pocket fastener receiver 4027, and the second pocket fastener 4085 may extend at least partially through both of the second pocket fastener hole 4090 and the second pocket fastener receiver 4029.

The pocket 4080 may have a lip 4078 (see FIGS. 134 and 137) forming at least part of the exterior surface 4080ES of the pocket 4080, and the lip 4078 may at least partially surround at least one of the recessed channel 4026, the first protrusion 4089, or the second protrusion 4090. The body 4006 may have a recessed surface 4023 (see FIG. 131) in the outer surface 4020 corresponding to the lip 4078 and at least partially surrounding at least one of the pocket hole 4022, the first indent 4024, or the second indent 4025. The recessed surface 4023 may be recessed from the outer surface 4020 by a depth that is substantially equal to a thickness of the lip 4078 such that the exterior surface 4080ES of the pocket 4080 is substantially level and continuous with the outer surface 4020 when the pocket 4080 is at least partially inserted through the pocket hole 4080 (e.g., installed in the body 4006).

The recessed channel 4026 may have some features that are the same as, or similar to, the features of other recessed channels illustrated and described herein. In some examples, the recessed channel 4026 has first and second opposing sidewalls 4038 and 4040 that extend along the toe-heel direction, and toe and heel opposing end walls 4044 and 4046, wherein the toe end wall 4044 is adjacent to the toe end 4080T and the heel end wall 4046 is adjacent to the heel end 4080H. The first sidewall 4038 may be closer to the striking face 4008 than the second sidewall 4040, but the present disclosure is not limited thereto. The recessed channel 4026 may also have the bottom track 4036 offset from the exterior surface 4080ES of the pocket 4080 and disposed both between the first and second sidewalls 4038 and 4040 and also between the toe and heel end walls 4044 and 4046.

The weight assembly 4004 may include some features that are the same as, or similar to, the features of other weight assemblies described and illustrated herein. In some examples, the weight assembly 4004 includes a weight 4028, a cover 4030, and a fastener 4032. The weight 4028 may be at least partially disposed within the recessed channel 4026 and configured to move (e.g., slide) therein. The cover 4030 may extend at least partially over the recessed channel 4026 to at least partially cover the weight 4028 inside the recessed channel 4026. In some examples, the cover 4030 is adapted to releasably secure the weight 4028 within the recessed channel 4026. The fastener 4032 may be configured to releasably secure (e.g., indirectly releasably secure) the weight 4028 inside the recessed channel 4026. In some examples, the fastener 4032 couples the cover 4030 to the body 4006 and is selectively movable along a fastener axis 4070 so that the fastener 4032 is configured to only indirectly secure the weight 4028 within the recessed channel 4026 by the cover 4030. However, the present disclosure is not limited thereto. For example, in some embodiments, a golf club head may include a weight assembly including a weight at least partially within a recessed channel of a pocket and a fastener configured to directly releasably secure the weight within the recessed channel.

The weight assembly 4004 may be positionable in at least a locked configuration whereby the cover 4030 is at least partially disposed within the recessed channel 4026 and the weight 4028 is secured within the recessed channel 4026, and an unlocked configuration whereby the cover 4030 is raised at least partially out of the recessed channel 4026 and the weight 4028 is selectively movable within the recessed channel 4026. In some examples, the weight assembly 4004 is also positionable in a weight removable configuration whereby the cover 4030 is sufficiently raised out of the recessed channel 4026 to allow the weight 4028 to be removed from the recessed channel 4026.

The cover 4030 may have a flange 4058 (see FIG. 139) extending along the toe-heel direction between opposing toe and heel end walls 4030T and 4030H. The weight 4028 may have a groove 4066 (see FIG. 140) shaped and sized to receive at least part of the flange 4058 such that the weight 4028 is configured to slidingly engage with the weight 4030. When the weight 4028 is slidingly engaged with the cover 4030, the toe and heel end walls 4030T and 4030H may block the weight 4028 from sliding off of the flange 4058 along a longitudinal axis of the flange 4058. In some examples, the weight 4028 is engaged with the cover 4030 such that the weight 4028 moves with the cover 4030 when the weight assembly 4004 moves between the locked and unlocked configurations. However, the present disclosure is not limited thereto. In some other examples, the weight 4028 does not so engage with the cover 4030 such that the weight 4028 may remain in the recessed channel 4126 (e.g., by the force of gravity) when the weight assembly 4004 moves from the locked configuration to the unlocked configuration.

The weight 4028 may have a side indent 4062 (see FIG. 141), and the pocket 4080 may include at least one locating lug 4034 (see FIG. 137) arranged along the toe-heel direction on at least one of the first sidewall 4038 or the second sidewall 4040. In the depicted example, the pocket 4080 includes five locating lugs 4034 arranged along the toe-heel direction on the first sidewall 4038. The side indent 4062 may be shaped and sized to receive at least part of each of the at least one locating lug 4034 such that the weight 4028 is configured to selectively engage with the at least one locating lug 4034. The locating lugs 4034 may help fix the position of the weight 4028 within the recessed channel 4026 along the toe-heel direction and define discrete positions within the recessed channel 4026 at which the weight 4028 may be positioned when the weight assembly 4004 is in the locked configuration.

In some examples, the pocket 4080 includes at least one pocket notch 4091 (see FIG. 137) in the exterior surface 4080ES of the pocket 4080 and arranged along at least one of the first sidewall 4038 or the second sidewall 4040. The at least one pocket notch 4091 may be positioned along the toe-heel direction to respectively correspond to the positions of the at least one locating lugs 4034. In the depicted example, five pocket notches are provided in the exterior surface 4080ES and arranged along the first sidewall 4038. The pocket 4080 may include at least one position indicator symbol 4075 on the exterior surface 4080ES and arranged along the toe-heel direction. The at least one position indicator symbol 4075 may be positioned along the toe-heel direction to respectively correspond to the positions of the at least one pocket notch 4091. In the depicted example, five position indicator symbols, labeled T2, T1, N, H1, and H2, are arranged in this order in the toe-heel direction from the toe end 4080T to the heel end 4080H. The cover 4030 may include at least one cover notch 4092 (see FIGS. 138-139) arranged along a side of the cover 4030 that faces the first sidewall 4038 when the weight assembly 4004 is in the locked configuration. The at least one cover notch 4092 may be positioned along the toe-heel direction to respectively correspond to the positions of the at least pocket notch 4091. The weight 4028 may be visible through the at least one pocket notch 4091 and the at least one cover notch 4092 when the weight assembly 4004 is in the locked configuration so that the position of the weight 4028 within the recessed channel 4026 along the toe-heel direction may be discernable when the weight assembly 4004 is in the locked configuration. When the weight assembly 4004 is in the locked configuration, between about 0% and about 30% of an outer surface of the weight 4028 may be visible.

The cover 4030 may include a main body 4056 (see FIG. 138) and a fastener protrusion 4057 extending from the main body 4056. The main body 4056 may be a portion of the cover 4030 that at least partially extends over the recessed channel 4026 and at least partially covers the weight 4028 within the recessed channel 4026 when the weight assembly 4004 is in the locked configuration. The fastener protrusion 4057 may extend from the main body 4056, for example, in a direction perpendicular to the toe-heel direction, and the fastener protrusion 4057 may have a hole 4059 shaped and sized to at least partially receive the fastener 4032. In some examples, the fastener 4032 includes a head and a shaft (e.g., an at least partially threaded shaft) extending from the head. The hole 4059 may have a shallow portion and a through portion. The shallow portion of the hole 4059 may be shaped and sized to receive at least part of the head of the fastener 4032, and the through portion of the hole 4059 may extend entirely through the fastener protrusion 4057 and be shaped and sized to at least partially receive the shaft of the fastener 4032. In some examples, the through portion of the hole 4059 is shaped and sized such that it cannot receive at least part of the head of the fastener 4032.

The pocket 4080 may have an indent 4094 (see FIG. 137) in a portion of the exterior surface 4080ES, for example, at least partially along the second sidewall 4040. The indent 4094 may be shaped and sized to allow the fastener protrusion 4057 to at least partially extend through the indent 4094. The pocket 4080 may include a fastener tab 4095 protruding from the indent 4094 in the exterior surface 4080ES of the pocket 4080. The fastener tab 4095 may have a hole 4096 shaped and sized to at least partially receive the fastener 4032, for example, at least part of the shaft of the fastener 4032.

The body 4006 may have a fastener cutout 4071 in the outer surface 4020. The fastener cutout 4071 may be shaped and sized to receive at least part of the fastener tab 4095 and at least part of the fastener protrusion 4057. The fastener tab 4095 and the fastener protrusion 4057 may at least partially secure the position of the pocket 4080 and cover 4030, respectively, when they are at least partially fitted into the fastener cutout 4071. The body 4006 may have a fastener receiver 4072 positioned, for example, in the fastener cutout 4071 and shaped and sized to at least partially receive the fastener 4032, for example, at least part of the shaft of the fastener 4032. The hole 4059 in the fastener protrusion 4057 of the cover 4030, the hole 4096 in the fastener tab 4095 of the pocket 4080, and the fastener receiver 4072 may all be aligned such that the fastener 4032 can extend at least partially through each of the hole 4059, the hole 4096, and the fastener receiver 4072 to couple the cover 4030 to the body 4006.

FIG. 142 is a top view of another golf club head 4100 with another weight assembly 4104. In particular, the golf club head 4100 is depicted as a metal wood type of golf club head. FIG. 143 is a top, cross-sectional view of the golf club head 4100 of FIG. 142 along line 143*a*-143*a* of FIG. 142. FIG. 144 is a cross-sectional view of the golf club head 4100 of FIG. 142 along line 144*a*-144*a* of FIG. 142 when the weight assembly 4104 is in the locked configuration. The golf club head 4100 may include some features similar to, or the same as, features illustrated or described herein with respect to the golf club head 4000 of FIGS. 127-141. Certain components are described herein, and thus, are not necessarily described further.

Referring concurrently to FIGS. 142-144, the golf club head 4100 may include a body 4106 including a toe 4114, a heel 4116, a hosel 4101, a striking face 4108, a sole 4102, and a crown 4150. The body 4106 may include a crown piece 4154 attached to the body 4106 and forming at least part of the crown 4150. The golf club head 4100 may include a pocket 4180 defining a recessed channel 4126 and that is at least partially inserted into a cavity 4100C of the body 4106 through a pocket hole (not shown). The pocket 4180 may have some features that are similar to, or the same as, the features illustrated and described herein with respect to the pocket 4080 of FIGS. 127-141.

The pocket 4180 may be secured to the body 4106 by at least one pocket fastener. In the depicted example, the pocket 4180 is secured to the body 4106 by a first pocket fastener 4181 and a second pocket fastener 4185. The first pocket fastener 4181 may have a head 4182, a tip 4183, and a shaft (e.g., an at least partially threaded shaft) extending from the head 4182 to the tip 4183, and the second pocket fastener 4185 may have a head 4186, a tip 4187, and a shaft (e.g., an at least partially threaded shaft) extending from the head 4186 to the tip 4187. In the depicted example, the first pocket fastener 4181 extends towards an outside of the body 4106 from the head 4182 to the tip 4183, and the second pocket fastener 4185 extends towards the outside of the body 4106 from the head 4186 to the tip 4187. For example, the heads 4182 and 4186 of the first and second pocket fasteners 4181 and 4185 may respectively be positioned deeper inside the body 4106 from the outer surface 4120 (or from an exterior surface of the pocket 4180) than the tips 4183 and 4187. In some such examples, manufacturing the golf club head 4100 may include attaching the pocket 4180 to the body 4106 by screwing the first and second pocket fasteners 4181 and 4185 at least partially into the body 4106 and at least partially into the pocket 4180 from inside the cavity 4100C of the body 4106.

The weight assembly 4104 may be coupled to the golf club head 4100 at the recessed channel 4126, and the weight assembly 4104 may include some features similar to, or the same as, features illustrated and described herein with respect to the weight assembly 4004 of FIGS. 127-141. The weight assembly 4104 may include a weight 4128 at least partially disposed within the recessed channel 4126 and configured to move (e.g., slide) therein, a cover 4130 extending at least partially over the recessed channel 4126 and adapted to releasably secure the weight 4128 within the recessed channel 4126, and a fastener (not shown) configured to releasably secure the weight 4128 within the recessed channel 4126, for example, only indirectly by the cover 4130. The weight assembly 4104 may be positionable in at least an unlocked configuration whereby the cover 4130 is raised at least partially out of the recessed channel 4126 and the weight 4128 is selectively movable within the recessed channel 4126, and a locked configuration whereby the cover 4130 is at least partially disposed within the recessed channel 4126 and the weight 4128 is secured within the recessed channel 4126.

FIG. 145 is a top view of another golf club head 4200 with another weight assembly 4204. In particular, the golf club head 4200 is depicted as a metal wood type of golf club head. FIG. 146 is a cross-sectional view of the golf club head 4200 of FIG. 145 along line 146*a*-146*a* of FIG. 145. FIG. 147 is a side view of the pocket 4280 of the golf club head 4200 of FIG. 145. The golf club head 4200 may include some features similar to, or the same as, features illustrated and described herein with respect to the golf club head 4000 of FIGS. 127-141. Certain components are described herein, and thus, are not necessarily described further.

Referring to the example of FIGS. 145-147, the golf club head 4200 includes a body 4206 including a toe 4214, a heel 4216, a hosel 4201, a striking face 4208, a sole 4202, and a crown 4250. The golf club head 4200 may include a pocket 4280 at least partially inserted into a cavity 4200C of the body 4206 through a pocket hole (not shown), and the pocket 4280 may be at least partially secured to the body 4206 by at least one pocket fastener, for example, by at least first and second pocket fasteners 4181 and 4185. The pocket 4280 may include a first protrusion 4284 at a heel end 4280H of the pocket 4280 and a second protrusion 4288 at a toe end 4280T of the pocket 4280. In the depicted example, the first protrusion 4284 forms part of a first hook together with a central portion 4280C of the pocket 4080 that defines the recessed channel 4226, and the second protrusion 4288 forms part of a second hook together with the central portion 4280C. For example the first protrusion 4284 may be spaced apart from the central portion 4280C in the toe-heel direction with a gap 4284G therebetween, and the second protrusion 4288 may be spaced apart from the central portion 4280C in the toe-heel direction with a gap 4288G therebetween.

The weight assembly 4204 may be coupled to the golf club head 4200 at the recessed channel 4226, and the weight assembly 4204 may include some features respectively similar to, or the same as, features illustrated and described herein with respect to the weight assembly 4004 of FIGS. 127-141. The weight assembly 4204 may include a weight 4228 at least partially disposed within the recessed channel 4226 and configured to move (e.g., slide) therein, a cover 4230 extending at least partially over the recessed channel 4226 and adapted to releasably secure the weight 4228 within the recessed channel 4226, and a fastener 4232 configured to releasably secure the weight 4228 within the recessed channel 4226 only indirectly by the cover 4230. The weight assembly 4204 may be positionable in at least an unlocked configuration whereby the weight 4228 is at least partially raised out of the recessed channel 4226 such that the weight 4228 is movable within the recessed channel 4226, and a locked configuration whereby the cover 4230 is at least partially disposed within the recessed channel 4226 such that the weight 4228 is secured within the recessed channel 4226.

FIG. 148 is a bottom, heel perspective view of another golf club head 4300 with another weight assembly 4304. In particular, the golf club head 4300 is depicted as a fairway metal golf club head in this non-limiting and non-exhaustive example. However, the present disclosure is not limited thereto. In some examples, the golf club head 4300 is a fairway metal golf club head, a hybrid golf club head, or a driver golf club head. FIG. 149 is a toe-to-heel cross-sectional view of the golf club head 4300 of FIG. 148 along line 149*a*-149*a* of FIG. 148. The golf club head 4300 may include some features similar to, or the same as, features illustrated and described herein with respect to other golf club heads disclosed herein or otherwise within the scope of the present disclosure. Therefore, certain components are described herein, and thus, are not necessarily described further.

Referring concurrently to FIGS. 148-149, the golf club head 4300 includes a body 4306, including a toe 4314, a heel 4316, a hosel 4301 disposed at the heel 4316, a striking face 4308, a sole 4302, and a crown 4350 joined to the sole 4302 at a skirt 4352. The striking face 4308 may have a lower leading edge 4310, an upper topline edge 4312 opposite to the lower leading edge 4310, and a plurality of score lines (or grooves) 4319 generally extending in the toe-heel direction, and the striking face 4308 may define a striking face plane 4380 tangential to an outermost surface of the striking face 4308. The golf club head 4300 may include a recessed channel 4326 in an outer surface of the body 4306, for example, in the sole 4302, and the recessed channel 4326 may generally extend in a toe-heel direction. The golf club head 4300 may include a weight assembly 4304 coupled to the golf club head 4300 at the recessed channel 4326. The weight assembly 4304 and the recessed channel 4326 may respectively include features similar to, or the same as, the features of other weight assemblies and recessed channels disclosed herein or otherwise within the scope of the present disclosure.

The weight assembly 4304 may include a weight 4328 at least partially disposed within the recessed channel 4326 and configured to move (e.g., slide) therein, a cover 4330 extending at least partially over the recessed channel 4326 and adapted to releasably secure the weight 4328 within the recessed channel 4326, and a fastener 4332 configured to releasably secure the weight 4328 within the recessed channel 4326, for example, only indirectly by the cover 4330. The weight assembly 4304 may be positionable in at least an unlocked configuration whereby the cover 4330 is at least partially raised out of the recessed channel 4326 such that the weight 4328 is movable within the recessed channel 4326, and a locked configuration whereby the cover 4330 is at least partially disposed within the recessed channel 4326 such that the weight 4328 is secured within the recessed channel 4326.

The weight 4328 may have a weight main body 4360, a position indicator 4368 protruding from the weight main body 4360, and a weight indent 4362 in the weight main body 4360. The recessed channel 4326 may have a first sidewall 4338 generally extending along the toe-heel direction, a second sidewall 4340 opposite to the first sidewall 4338 and generally extending along the toe-heel direction, and a bottom track 4336 offset from the outer surface of the body 4306 (e.g., offset from the sole 4302). One or more dimples 4324 may be provided in the first sidewall 4338 (e.g., at a juncture between the first sidewall 4338 and the sole 4302), may be arranged along the toe-heel direction, and may each be shaped and sized to at least partially receive the position indicator 4368 such that the weight 4328 can selectively engage with the one or more dimples 4324 via the position indicator 4368. The golf club head 4300 may have one or more locating lugs 4334 protruding at least partially into the recessed channel 4326 from the bottom track 4336 and arranged along the toe-heel direction. The weight indent 4362 may be shaped and sized to at least partially receive each of the one or more locating lugs 4334 so that the weight 4328 is selectively engageable with the one or more locating lugs 4334 via the weight indent 4362.

The recessed channel 4326 may have a heel end wall proximal to the heel 4316 and an opposite toe end wall proximal to the toe 4314. The first sidewall 4338, the second sidewall 4340, and the bottom track 4336 may each extend between the heel end wall and the toe end wall generally along the toe-heel direction. In some examples, the second sidewall 4340 has a fastener indentation 4341 protruding away from an adjacent portion of the second sidewall 4340 and away from the striking face 4308. The fastener indentation 4341 may, for example, accommodate space of a portion of the cover 4330 configured to at least partially receive the fastener 4332. The first sidewall 4338 and the second sidewall 4340 may respectively be proximal and distal to the striking face 4308, as shown in the non-liming and non-exhaustive example depicted. In some other examples, the orientation of the recessed channel 4326 and the weight assembly 4304 may be reversed such that the first sidewall 4338 and the second sidewall 4340 are respectively distal and proximal to the striking face 4308.

The cover 4330 may have an interior surface 4364 configured to face the interior of the golf club head 4300, toward the bottom track 4336, and/or toward the weight main body 4360, at least when the cover 4330 is in the locked configuration. The cover 4330 may have an exterior surface 4363 opposite to the interior surface 4364 and configured to face the outside of the golf club head 4300, away from the bottom track 4336, and/or away from the weight main body 4360 at least when the cover 4330 is in the locked configuration. The exterior surface 4363 may have a first portion 4363A proximal to the first sidewall 4338, for example, when the cover 4330 is in the locked configuration, and a second portion 4363B proximal to the second sidewall 4340, for example, when the cover 4330 is in the locked configuration. In some examples, the first portion 4363A generally extends, together with the first sidewall 4338, along the toe-heel direction, and the second portion 4363B generally extends, together with the second sidewall 4340, along the toe-heel direction. For example, the first portion 4363A may include (e.g., be) a first edge of the exterior surface 4363 adjacent to the first sidewall 4338, and the second portion 4363B may include (e.g., be) a second edge of the exterior surface 4363 adjacent to the second sidewall 4340.

At least part of the exterior surface 4363 may be positioned inside the recessed channel 4326 and offset from portions of the outer surface of the body 4306 adjacent to the recessed channel 4326 (e.g., offset from portions of the sole 4302 adjacent to the recessed channel 4326) at least when the cover 4330 is in the locked configuration. The first portion 4363A may be offset from a portion of the sole 4302 adjacent to the first sidewall 4338 by a first gap (or depth) 4363G1. The first gap 4363G1 may be a distance measured along a depth direction from the first portion 4363A to an opening of the recessed channel 4326 in the sole 4302. The first gap 4363G1 may be defined from (e.g., measured from) any part of the first portion 4363A, including a heel-end part of the first portion 4363A proximal to the heel 4316, a toe-end part of the first portion 4363A proximal to the toe 4314, or any part of the first portion 4363A between the heel-end part of the first portion 4363A and the toe-end part of the first portion 4363A, for example, a part of the first portion 4363A between any two dimples from among the plurality of dimples 4324. In some examples, the second portion 4363B is offset from a portion of the sole 4302 adjacent to the second sidewall 4340 by a second gap (or depth) 4363G2. The second gap 4363G2 may be a distance measured along the depth direction from the second portion 4363B to the opening of the recessed channel 4326 in the sole 4302. The second gap 4363G2 may be defined from (e.g., measured from) any part of the second portion 4363B, including a heel-end part of the second portion 4363B proximal to the heel 4316, a toe-end part of the second portion 4363B proximal to the toe 4314, or any part of the second portion 4363B between the heel-end part of the second portion 4363B and the toe-end part of the second portion 4363B, for example, a part of the second portion 4363B between any two dimples from among the plurality of dimples 4324.

The depth direction may be a direction parallel to at least one of a flat portion of the first sidewall 4338 or a flat portion of the second sidewall 4340, and the depth direction may be perpendicular to at least one of the toe-heel direction or a longitudinal axis of at least one of the score lines 4319 (e.g., the score line closest to the lower leading edge 4310). In the cross-sectional view of FIG. 149, which may be defined in the Y-Z plane, the toe-heel direction may be parallel to the X-axis direction, and the longitudinal axis of the at least one of the score lines 4319 may be parallel to the X-axis direction. In some examples, the depth direction may be a direction extending from a top edge of the first sidewall 4338 closest to (e.g., joined to) the sole 4302 toward (e.g., along a shortest path toward, for example, along a path perpendicular to the toe-heel direction toward) a bottom edge of the first sidewall 4338 closest to (e.g., joined to) the bottom track 4336. In some examples, the depth direction may be a direction parallel to the striking face plane 4380 and perpendicular to at least one of the toe-heel direction or the longitudinal axis of the at least one of the score lines 4319. In some examples, the depth direction may be a direction perpendicular to a flat ground plane when the golf club head 4300 is in the address position on the flat ground plane. For example, the flat ground plane may be a plane parallel to the X-Z plane shown in FIG. 149, and the depth direction may be parallel to the Y-axis direction.

The opening of the recessed channel 4326 may be defined, for example, for purposes of defining the first gap 4363G1 or another depth within the recessed channel 4326 of part of the exterior surface 4363 closer to the first sidewall 4338 than to the second sidewall 4340, as a first virtual plane 43RP1 that extends at least partially over the recessed channel 4326 and that is tangential to a portion of the sole 4302 adjacent to the first sidewall 4338, for example, a portion of the sole 4302 adjacent to a portion of the first sidewall 4338 closest to where on the exterior surface 4363 the first gap 4363G1 or the other depth is measured from. In some examples, the opening of the recessed channel 4326 is defined, for example, for purposes of defining the second gap 4363G2 or an other depth within the recessed channel 4326 of part of the exterior surface 4363 closest to the second sidewall 4340 than to the first sidewall 4338, as a second virtual plane 43RP2 that extends at least partially over the recessed channel 4326 and that is tangential to a portion of the sole 4302 adjacent to the second sidewall 4340, for example, a portion of the sole adjacent to a part of the second sidewall 4340 closest to where on the exterior surface 4363 the second gap 4363G2 or the other depth is measured from.

The first gap 4363G1 may be greater than or equal to 0.6 mm, 0.9 mm, 1.0 mm, 1.1 mm, 1.2 mm, 1.3 mm, 1.4 mm, or 1.5 mm. For example, the first gap 4363G1 may be within a range of 0.6 mm to 2.0 mm, 0.9 mm to 1.5 mm, 1.0 mm to 1.5 mm, 1.0 mm to 1.4 mm, 1.1 mm to 1.4 mm, 1.1 mm to 1.3 mm, or 1.2 mm to 1.3 mm, or the first gap 4363G1 may be about 1.25 mm.

In examples where the first gap 4363G1 is less than or equal to 0.85 mm, a whistling type noise may be generated and noticeable during a golf swing with the golf club head. Whistling of a golf club head during a golf swing is undesirable. For example, a whistling sound made by a golf club during a golf swing may cause a biomechanical response in the golfer that causes the golfer's muscles to tense or twitch, or otherwise affect performance of the golfer (and, by extension, the quality of shots hit by the golfer using such golf club head). However, an unexpected and surprising result has been found that, when the first gap 4363G1 is made to be greater than or equal to 0.9 mm, the whistling noise does not occur (or is at least much less noticeable) during the golf swing. Although this phenomenon is not entirely understood, it is believed that, as air flows over the sole 4302 toward the exterior surface 4363 of the cover 4330 during the golf swing, if the first gap 4363G1 is sufficiently shallow (i.e., less than or equal to 0.85 mm), then streams of air flow down into the dimples 4324 instead of flowing onto the exterior surface 4363 during the golf swing. The streams of air flowing into the dimples 4324 can cause a pressure resonance within the dimples 4324 that results in the whistling noise. However, if the first gap 4363G1 is sufficiently deep (i.e., greater than or equal to 0.9 mm), then the streams of air flow from the sole 4302 onto the exterior surface 4363 instead of into the dimples 4324 during the golf swing, and thus, the whistling does not occur.

Tables 1 and 2 below displays data illustrating this phenomenon. At least some whistling was detected during golf swings using the three golf club heads of Table 1, and no whistling was detected during golf swings using the three golf club heads of Table 2. For each of golf club heads 1, 2, 4, and 5, three sets of data were obtained at the following locations: at a "Heel" portion of exterior surface 4363, at a "Center" portion of the exterior surface 4363, and at a "Toe" portion of the exterior surface 4363. For each of golf club heads 3, and 6, one set of data was obtained at the "Heel" portion of the exterior surface 4363. Each set of data includes a first distance measured from a reference point to the first portion 4363A, a second distance measured from the reference point to a portion of the sole 4302 adjacent to the first portion 4363A, and a first gap 4363G1 calculated to be the difference of the second distance and the first distance.

TABLE 1

| Golf Club | Heel | | First Gap | Center | | First Gap | Toe | | First Gap |
|---|---|---|---|---|---|---|---|---|---|
| Head | 4302 | 4363A | 4363G1 | 4302 | 4363A | 4363G1 | 4302 | 4363A | 4363G1 |
| Head 1 | 93.67 | 92.82 | 0.85 | 93.57 | 93.07 | 0.5 | 91.57 | 90.83 | 0.74 |
| Head 2 | 92.63 | 92.02 | 0.61 | 93.6 | 93.08 | 0.52 | 91.6 | 90.86 | 0.74 |
| Head 3 | 92.76 | 92 | 0.76 | | | | | | |

TABLE 2

| Golf Club | Heel | | First Gap | Center | | First Gap | Toe | | First Gap |
|---|---|---|---|---|---|---|---|---|---|
| Head | 4302 | 4363A | 4363G1 | 4302 | 4363A | 4363G1 | 4302 | 4363A | 4363G1 |
| Head 4 | 94.79 | 93.7 | 1.09 | 95.45 | 94.13 | 1.32 | 92.98 | 91.58 | 1.4 |
| Head 5 | 94.86 | 93.6 | 1.26 | 95.29 | 93.93 | 1.36 | 93 | 91.61 | 1.39 |
| Head 6 | 94.85 | 93.57 | 1.28 | | | | | | |

In some examples, a cover thickness 4330T between the exterior surface 4363 and the interior surface 4364 may decrease (e.g., via one or more steps and/or via a taper) along a thinning direction parallel to a direction extending from the second sidewall 4340 to the first sidewall 4338 such that the first gap 4363G1 is greater than or equal to 0.9 mm. In some other examples, the thinning direction may be perpendicular to the striking face plane 4380. In some other examples, the thinning direction may be parallel to at least one of a flat part of the exterior surface 4363 or a flat part of the interior surface 4364, and the thinning direction may be perpendicular to at least one of the toe-heel direction or the longitudinal axis of at least one of the score lines 4319 (e.g., a score line closest to the lower leading edge 4310).

The cover thickness 4330T may decrease along the thinning direction at a heel-side edge of the cover 4330 proximal to the heel 4316, at a toe-side edge of the cover 4330 proximal to the toe 4314, or at any portion of the cover 4330 between the heel-side edge of the cover 4330 and the toe-side edge of the cover 4330, for example, a center of the cover 4330.

A depth of the exterior surface 4363 in the recessed channel 4326 may increase (e.g., via one or more steps and/or via one or more tapered or gradual increases) along the thinning direction, for example, due to cover thickness 4330T decreasing along the thinning direction. In some examples, the first gap 4363G1 may be larger than the second gap 4363G2 due to the cover thickness 4330T decreasing along the thinning direction.

In some other examples, the cover 4330 may be shaped and sized such that, when the cover 4330 is in the locked configuration, a depth of the exterior surface 4363 within the recessed channel 4326 increases along a set direction. The set direction may be defined in a manner similar to, or the same as, the thinning direction. For example, the cover 4330 may be shaped such that, when the cover 4330 is in the locked configuration, a portion of the cover 4330 configured to cover the weight main body 4360 is angled downward into the recessed channel 4326 so that the first gap 4363G1 is greater than or equal to 0.6 mm, 0.9 mm, 1.0 mm, 1.1 mm, 1.2 mm, 1.3 mm, 1.4 mm, 1.5 mm; is within a range of 0.6 mm to 2.0 mm, 0.9 mm to 1.5 mm, 1.0 mm to 1.5 mm, 1.0 mm to 1.4 mm, 1.1 mm to 1.4 mm, 1.1 mm to 1.3 mm, or 1.2 mm to 1.3 mm; or is about 1.25 mm.

FIG. 150 is a bottom, heel perspective view of another golf club head 4400 with another weight assembly 4404. In particular, the golf club head 4400 is depicted as a hybrid golf club head in this non-limiting and non-exhaustive example. However, the present disclosure is not limited thereto. In some examples, the golf club head 4400 is a hybrid golf club head, or a fairway metal golf club head, or a driver golf club head. FIG. 151 is cross-sectional view of the golf club head 4400 of FIG. 150 along line 151*a*-151*a* of FIG. 150. The golf club head 4400 may include some features similar to, or the same as, features illustrated and described herein with respect to other golf club heads disclosed herein or otherwise within the scope of the present disclosure, including, without limitation, the golf club head 4300. Therefore, certain components are described herein, and thus, are not necessarily described further.

Referring concurrently to FIGS. 150-151, the golf club head 4400 may include a body 4406, including a toe 4414, a heel 4416, a hosel 4401, a striking face 4408, a sole 4402, and a crown 4450 joined to the sole 4402 at a skirt 4452. The striking face 4408 may have a lower leading edge 4410, an upper topline edge 4412 opposite to the lower leading edge 4410, and a plurality of score lines (or grooves) 4419 generally extending in the toe-heel direction, and the striking face 4408 may define a striking face plane 4480 tangential to an outermost surface of the striking face 4408. The golf club head 4400 may include a recessed channel 4426 in an outer surface of the body 4406, for example, in the sole 4402, and the recessed channel 4426 may generally extend in a toe-heel direction. The golf club head 4400 may include a weight assembly 4404 coupled to the golf club head 4400 at the recessed channel 4426. The weight assembly 4404 and the recessed channel 4426 may respectively include features similar to, or the same as, the features of other weight assemblies and recessed channels disclosed herein or otherwise within the scope of the present disclosure, including, without limitation, the weight assembly 4304 and the recessed channel 4326.

The weight assembly 4404 may include a weight 4428 at least partially disposed within the recessed channel 4426 and configured to move (e.g., slide) therein, a cover 4430 extending at least partially over the recessed channel 4426 and adapted to releasably secure the weight 4428 within the recessed channel 4326, and a fastener 4432 configured to releasably secure the weight 4428 within the recessed channel 4426, for example, only indirectly by the cover 4430. The weight assembly 4404 may be positionable in at least an unlocked configuration whereby the cover 4430 is at least partially raised out of the recessed channel 4426 such that the weight 4428 is movable within the recessed channel 4426, and a locked configuration whereby the cover 4430 is at least partially disposed within the recessed channel 4426 such that the weight 4428 is secured within the recessed channel 4426.

The weight 4428 may have a weight main body 4460, a position indicator 4468 protruding from the weight main body 4460, and a weight indent 4462 in the weight main body 4460. The recessed channel 4426 may have a first sidewall 4438 generally extending along the toe-heel direction, a second sidewall 4440 opposite to the first sidewall 4438 and generally extending along the toe-heel direction, and a bottom track 4436 offset from the outer surface of the body 4406 (e.g., offset from the sole 4402). One or more dimples 4424 may be provided in the first sidewall 4438 (e.g., at a juncture between the first sidewall 4438 and the sole 4402), may be arranged along the toe-heel direction, and may each be shaped and sized to at least partially receive the position indicator 4468 such that the weight 4428 is selectively engageable with the one or more dimples 4424 via the position indicator 4468. The golf club head 4400 may have one or more locating lugs 4434 protruding at least partially into the recessed channel 4426 from the bottom track 4436 and arranged along the toe-heel direction. The weight indent 4462 may be shaped and sized to at least partially receive each of the one or more locating lugs 4434 so that the weight 4428 is selectively engageable with the one or more locating lugs 4434.

The cover 4430 may have an interior surface 4464 and an exterior surface 4463 opposite to the interior surface 4464. The exterior surface 4463 may have a first portion 4463A proximal to the first sidewall 4438 and a second portion 4463B proximal to the second sidewall 4440. In some examples, the first portion 4463A generally extends, together with the first sidewall 4438, along the toe-heel direction, and the second portion 4463B generally extends, together with the second sidewall 4440, along the toe-heel direction. For example, the first portion 4463A may include (e.g., be) a first edge of the exterior surface 4463 adjacent to the first sidewall 4438, and the second portion 4463B may include (e.g., be) a second edge of the exterior surface 4463 adjacent to the second sidewall 4440.

The first portion 4463A may be offset from a portion of the sole 4402 adjacent to the first sidewall 4438 by a first gap (or depth) 4463G1. The second portion 4463B may be offset from a portion of the sole 4402 adjacent to the second sidewall 4440 by a second gap (or depth) 4463G2. The first and second gaps 4463G1 and 4463G2 may respectively be defined in a manner similar to, or the same as, the first and second gaps 4363G1 and 4363G2. For example, the first gap 4463G1 may be a distance measured along a depth direction from the first portion 4463A (e.g., a part of the first portion 4463A) to an opening of the recessed channel 4426 in the sole 4402, and the second gap 4463G2 may be a distance measured along the depth direction from the second portion 4463B (e.g., a part of the second portion 4463B) to the opening of the recessed channel 4426 in the sole 4402. The depth direction of the golf club head 4400 may be defined in a manner similar to, or the same as, the depth direction of the golf club head 4300, and the opening of the recessed channel 4426 may be defined in a manner similar to, or the same as, the opening of the recessed channel 4326. For example, first and second virtual planes 44RP1 and 44RP2 may be defined in a manner similar to, or the same as, the first and second virtual planes 43RP1 and 43RP2.

The first gap 4463G1 may be greater than or equal to 0.6 mm, 0.9 mm, 1.0 mm, 1.1 mm, 1.2 mm, 1.3 mm, 1.4 mm, or 1.5 mm. For example, the first gap 4363G1 may be within a range of 0.6 mm to 2.0 mm, 0.9 mm to 1.5 mm, 1.0 mm to 1.5 mm, 1.0 mm to 1.4 mm, 1.1 mm to 1.4 mm, 1.1 mm to 1.3 mm, or 1.2 mm to 1.3 mm, or the first gap 4363G1 may be about 1.25 mm.

The golf club head 4400 and the weight assembly 4404 may be configured such that, when the cover 4430 is at least partially disposed in the recessed channel 4426 (e.g., when the cover 4430 is in the locked configuration), the first gap 4463G1 has one of the values, or is within one of the ranges, described above, and/or the first gap 4463G1 is greater than the second gap 4463G2.

For example, a depth of the recessed channel 4426 (e.g., depth of the bottom track 4436) may be configured (e.g., set to have a depth) such that, when the cover 4430 is at least partially disposed in the recessed channel 4426 (e.g., when the cover 4430 is in the locked configuration), the first gap 4463G1 may have one of the values, or be within one of the ranges, described above. In some examples, the depth of at least part of the recessed channel 4426 is substantially constant and set to be sufficiently deep such that, when the cover 4430 is at least partially disposed in the recessed channel 4426, the first gap 4463G1 may have one of the values, or be within one of the ranges, described above. In some other examples, the depth of at least part of the recessed channel 4426 (e.g., the depth of at least part of the bottom track 4436) is configured to increase along a set direction such that, when the recessed channel is at least partially disposed in the recessed channel 4426, the first gap 4463G1 may have one of the values, or be within one of the ranges, described above, and/or such that the first gap 4463G1 is greater than the second gap 4463G2. The set direction may be defined in a manner similar to, or the same as, the thinning direction of the golf club head 4300.

A depth of the exterior surface 4463 in the recessed channel 4426 may increase (e.g., via one or more steps and/or via one or more tapered or gradual increases) along the set direction, for example, due to the configuration of the recessed channel 4326 (e.g., due to the configuration of the bottom track 4436). In some examples, the first gap 4463G1 may be larger than the second gap 4463G2 due to the configuration of the recessed channel 4326 (e.g., due to the configuration of the bottom track 4436).

FIG. 152 is a bottom view of another golf club head 4500 with another weight assembly 4504 in a locked position. In particular, the golf club head 4500 is depicted as a metal wood golf club head in this non-limiting and non-exhaustive example. In some other examples, the golf club head 4500 may be, for example, a hybrid golf club head or a driver golf club head. FIG. 153 is another bottom view of part of the golf club head 4500 of FIG. 152 without the weight assembly 4504. FIG. 154 is an exploded perspective view of the weight assembly 4504 of the golf club head 4500 of FIG. 152. FIG. 155 is a cross-sectional view of the weight assembly 4504 along the line 155'-155' in FIG. 154 when the weight assembly 4504 is assembled. The golf club head 4500 may include some features similar to, or the same as, features illustrated and described herein with respect to other golf club heads disclosed herein or otherwise within the scope of the present disclosure. Therefore, certain components are described herein, and thus, are not necessarily described further.

Referring concurrently to FIGS. 152-155 the golf club head 4500 may include a body 4506, including a toe 4514, a heel 4516, a hosel 4501, a striking face 4508, a sole 4502, and a crown joined to the sole 4502 at a skirt 4552. The striking face 4508 may have a lower leading edge, an upper topline edge opposite to the lower leading edge, and the sole 4502 may extend from the lower leading edge of the striking face 4508. The golf club head 4500 may include a recessed channel 4526 in an outer surface 4520 of the body 4506, for example, in the sole 4502, and the recessed channel 4526 may generally extend in a toe-heel direction. The golf club head 4500 may include a weight assembly 4504 coupled to the golf club head 4500 at the recessed channel 4526. The weight assembly 4504 and the recessed channel 4526 may respectively include features similar to, or the same as, the features of other weight assemblies and recessed channels disclosed herein or otherwise within the scope of the present disclosure.

The weight assembly 4504 may include a weight 4528 at least partially disposed within the recessed channel 4526 and configured to move (e.g., slide) therein, a cover 4530 extending at least partially over the recessed channel 4526 and adapted to releasably secure the weight 4528 within the recessed channel 4526, and a fastener 4532 configured to releasably secure the weight 4528 within the recessed channel 4526, for example, only indirectly by the cover 4530. The weight assembly 4504 may be positionable in at least an unlocked configuration whereby the cover 4530 is at least partially raised out of the recessed channel 4526 such that the weight 4528 is movable within the recessed channel 4526, and a locked configuration whereby the cover 4530 is at least partially disposed within the recessed channel 4526 such that the weight 4528 is secured within the recessed channel 4526.

The cover 4530 may have an exterior surface 4530E configured to face outwardly from the golf club head 4500 when the weight assembly 4504 is in the locked configuration, and an interior surface 45301 opposite to the exterior surface 4530E and configured to face inwardly (e.g., toward the recessed channel 4526 and/or toward the weight 4528) when the weight assembly 4504 is in the locked configuration. The weight 4528 may have a top groove 4566T and a side groove 4566S defined in the weight 4528 and respectively shaped and sized to receive at least part of a top rail 4558T and a side rail 4558S of the cover 4530 such that the weight 4528 is slidably engaged with the cover 4530. The top rail 4558T may protrude from the interior surface 45301 of the cover 4530, and the side rail 4558S may protrude from a side surface 4530S of the cover 4530. For example, the side rail 4558S may protrude from the side surface 4530S in a direction substantially perpendicular (e.g., within 15 degrees, 10 degrees, 5 degrees, 2 degrees, 1 degree, or 0.5 degrees from exactly perpendicular) to a direction in which the top rail 4558T extends from the interior surface 45301. By slidably engaging the weight 4528 to the cover 4530 via two rails protruding from the cover 4530 in substantially perpendicular directions (instead of via one rail), the stability of the weight 4528 relative to the cover 4530 can be improved, and the likelihood of the weight 4528 detaching from the cover 4530 while the weight assembly 4504 is in the unlocked configuration can be reduced.

The golf club head 4500 may have one or more locating lugs 4534 protruding at least partially into the recessed channel 4526, for example, from a bottom track 4536 of the recessed channel 4526. In some examples, the one or more locating lugs 4534 include a plurality of locating lugs arranged along the toe-heel direction. The weight 4528 may have a weight indent 4562 shaped and sized to at least partially receive the one or more locating lugs 4534 so that the weight 4528 can selectively engage with the one or more locating lugs 4534. In some examples, the weight 4528 is positionable along the toe-heel direction only in one or more discrete positions respectively corresponding to the positions of the one or more locating lugs 4534 when the weight assembly 4504 is in the locked configuration.

The weight 4528 may have at least one textured surface 4528TS. The at least one textured surface 4528TS may, for example, have a plurality of grooves formed therein that allow the at least one textured surface 4528TS to be more easily gripped by a person compared to a smooth surface. In some examples the at least one textured surface 4528TS may include a front surface of the weight 4528 configured to be proximal to the striking face 4508 when the weight assembly 4504 is in the locked configuration. The at least one textured surface 4528TS can therefore allow a golfer to easily grab and adjust the weight 4528 when the weight assembly 4504 is raised into the unlocked configuration such that the at least one textured surface 4528TS is exposed.

Two leg openings 4572 may be defined in the body 4506, for example, in the bottom track 4536 of the recessed channel 4526 and respectively at toe and heel ends 4526T and 4526H of the recessed channel 4526. The cover 4530 may include a cover main body 4580 and two legs 4570 extending from the cover main body 4580. The two legs 4570 may be configured to extend at least partially through the two leg openings 4572. Each leg of the two legs 4570 may have a length such that the leg extends at least partially through the corresponding leg opening 4572 when the weight assembly 4504 is in the locked and unlocked configurations. By providing the legs 4570 with such a length, detachment of the legs 4570 from the body 4506 may be prevented when the cover 4530 is raised from the locked configuration to the unlocked configuration, and thus, rotation of the cover 4530 relative to the body 4506 when the weight assembly 4504 is in the unlocked configuration may be prevented or reduced. In some examples, the length of the legs 4570 may differ between covers for different models of golf club heads (e.g., models for right-handed individuals and models for left-handed individuals), which can improve the ease of identifying between different covers for different models and better ensure that an appropriate cover is installed on a particular golf club head.

The cover 4530 may have one or more window openings 4530W defined therein. The one or more window openings 4530 may identify a location of the weight within the recessed channel 4526, which may include visibly exposing the recessed channel 4526, for example, when the cover secures the weight 4528 within the recessed channel 4526 (e.g., when the weight assembly 4504 is in the locked configuration). The one or more window openings 4530W can allow visible confirmation of the position of the weight 4528 in the recessed channel 4526 even when the weight assembly 4504 is in the locked configuration. For example, the one or more window openings 4530W may extend through the cover 4530 from the exterior surface 4530E to the interior surface 45301. In some examples, the exterior surface 4530E may have a front edge 4530EF and a rear edge 4530ER opposite to the front edge 4530EF, and the one or more window openings 4530W may be between, and spaced apart from, the front and rear edges 4530EF and 4530ER. The front and rear edges 4530EF and 4530ER may each generally extend along the toe-heel direction and respectively be proximal and distal to the striking face 4508 when the weight assembly 4504 is in the locked configuration. In some other examples, the one or more window openings 4530W may be joined to the front edge 4530EF such that the one or more window openings 4530W form indents in the front edge 4530EF.

The one or more window openings 4530W may be elongated and/or arranged generally along the toe-heel direction. For example, as depicted in the nonlimiting and non-exhaustive example of FIGS. 152-155, the one or more window openings 4530W may include a plurality of window openings 4530W arranged along the toe-heel direction and having positions respectively corresponding to the one or more locating lugs 4534. The weight 4528 may have a position indicator 4568 configured to be visibly exposed to the outside of the golf club head 4500 through the one or more window openings 4530W when weight 4528 is engaged with the cover 4530 and the weight assembly 4504 is in the locked configuration. For example, the position indicator 4568 may include an indent and/or a mark in a surface of the weight 4528 configured to face the interior surface 45301 of the cover when the weight 4528 is engaged with the cover 4530. The position indicator 4568 may assist visible confirmation of the position of the weight 4528 in the recessed channel 4526 when the weight assembly 4504 is in the locked configuration.

The weight assembly 4504 may include an at least partially transparent window member 4542 attached to the cover 4530 and overlapping the one or more window openings 4530W. For example, the window member 4542 may be positioned on the cover 4530 such that the window member 4542 intersects a line of sight (or at least partially blocks a physical path) between the outside of the golf club head 4500 and the recessed channel 4526 through the one or more window openings 4530W when the weight assembly 4504 is in the locked configuration. In some examples, the window member 4542 is attached to the interior surface 45301 of the cover 4530 and covers the one or more window opening 4530W (e.g., with or without being positioned in the one or more window openings 4530W). In the nonlimiting and non-exhaustive example depicted in FIGS. 152-155, the window member 4542 is attached to the interior surface 45301 and has a plurality of protrusion members 4542P that protrude at least partly through the window openings 4530W. The protrusion members 4542P can assist with aligning the window member 4542 on the cover 4530 when the window member 4542 is attached onto the cover 4530 during a manufacturing process. In some other examples, the plurality of protrusion members 4542P are omitted such that the window member 4542 covers the one or more window openings 4530W without being positioned in the window openings 4530W.

In some examples, the window member 4542 is attached to the exterior surface 4530E of the cover 4530 and covers the one or more window openings 4530W (e.g., with or without being positioned in the one or more window openings 4530W). In some examples, the window member 4542 may comprise multiple pieces that are at least partially (e.g., partly or entirely) within the one or more window openings 4530W, and the window member 4542 may fill at least part (e.g., part or all) of the one or more window openings 4530W.

In some examples where the window member 4542 is omitted, air is able to flow through the one or more window openings 4530W and into the recessed channel 4526 during a golf swing, which can cause whistling type sound to occur that some golfers find unpleasant or distracting and that can negatively affect their golf swing performance. However, in examples where the window member 4542 is included as described herein, an unexpected and surprising result has been found where the whistling noise does not occur (or is at least much less noticeable) during a golf swing. Although this phenomenon is not entirely understood, it is believed that, as air flows over the exterior surface 4530E of the cover 4530 during a golf swing, air can that flows into the recessed channel 4526 through the one or more window openings 4530 and cause a pressure resonance that results in the whistling noise. However, in examples where the window member 4542 is included and at least partially blocks the path into the recessed channel 4526 through the one or more window openings 4530W, the streams of air can be blocked from entering the recessed channel 4526 through the one or more window openings 4530, and the pressure resonance and whistling noise can be prevented or reduced.

In some examples, the cover 4530 does not include any window openings. In such examples, although a golfer may be unable to visibly confirm the position of the weight 4528 within the recessed channel 4526 when the weight assembly 4504 is in the locked configuration, the whistling noise resulting from air flowing through window openings into the recessed channel 4526 can be prevented.

The window member 4542 may be attached to the cover 4530 by any suitable means, for example, by an adhesive 4544. In the nonlimiting and non-exhaustive example depicted, the adhesive 4544 is positioned between the interior surface 45301 of the cover 4530 and the window member 4542. Because the adhesive 4544 may obscure visibility and/or cause foreign matter (e.g., dirt or debris) to collect thereon, the adhesive 4544 may be shaped and sized so as to not overlap the one or more window openings 4530. For example, the adhesive 4544 may at least partially surround each of the one or more window openings 4530W. In the nonlimiting and non-exhaustive example depicted in FIGS. 152-155, the adhesive 4544 surrounds each of the plurality of protrusion members 4542P.

FIG. 156 depicts an exploded perspective view of another weight assembly 4604. FIG. 157 depicts a cross-sectional view of the weight assembly 4604 of FIG. 156 along the line 157'-157' in FIG. 156 and when the weight assembly 4604 is assembled. FIG. 158 depicts a cross-sectional view of the weight assembly 4604 of FIG. 156 along the line 158'-158' in FIG. 156 and when the weight assembly 4604 is assembled. The weight assembly 4604 may include some features similar to, or the same as, features illustrated and described with respect to other weight assemblies disclosed herein or otherwise within the scope of the present disclosure, including, without limitation, the weight assembly 4504. Therefore, certain components are described herein, and thus, are not necessarily described further. The weight assembly 4604 may be coupled to a body of a golf club head, for example, to the body of any suitable golf club head disclosed herein or otherwise within the scope of the present disclosure, including, without limitation, the body 4506 of the golf club head 4500.

Referring concurrently to FIGS. 156-158, the weight assembly 4604 may include a weight 4628, a cover 4630, and a fastener 4632. The weight assembly 4604 may be positionable in at least an unlocked configuration and a locked configuration.

The weight 4628 may have a top groove 4666T and a side groove 4666S respectively shaped and sized to receive at least part of a top rail 4658T and a side rail 4658S of the cover 4630 such that the weight 4628 can slidably engage with the cover 4630. The weight 4628 may have a weight indent 4662 shaped and sized to receive at least part of a locating lug of a body of a golf club head that the weight assembly 4604 is coupled to.

The cover 4630 may have an exterior surface 4630E and an opposite interior surface 46301. In the nonlimiting and non-exhaustive example depicted, the cover 4630 has a single window opening 4630W that is elongated along the toe-heel direction and that extends through the cover 4630 between the exterior and interior surfaces 4630E and 46301. The cover 4630 may also have an exterior indent 4630EI around at least part (e.g., partially or completely surrounding) the window opening 4630W and extending only part way through the cover 4630 from the exterior surface 4630E toward the interior surface 46301.

The weight assembly 4630 may include a window member 4642 attached to the cover 4630 and overlapping the window opening 4630W. The window member 4642 may be at least partially in at least part of the window opening 4630W. The window member 4642 may also be in the exterior indent 4630EI, which may provide support for the window member 4642. In the non-limiting and non-exhaustive example depicted, the entire window member 4642 is in the window opening 4630W and in the exterior indent 4630EI. In some other examples, the cover 4630 may have an interior indent formed in the interior surface 46301 of the cover 4630 around the window opening 4630W, and the window member 4642 may be in the interior indent.

The window member 4642 may be attached to the cover 4630 via an adhesive 4644. In the nonlimiting and non-exhaustive example depicted, the adhesive 4644 has a closed loop shape corresponding to the shape of the exterior indent 4630EI, and the adhesive 4644 adheres the window member 4642 to the cover 4630 at the exterior indent 4630EI.

FIG. 159 depicts a top view of another weight assembly 4704. FIG. 160 depicts a cross-sectional view of the weight assembly 4704 of FIG. 159 along the line 160'-160' in FIG. 159. The weight assembly 4704 may include some features similar to, or the same as, features illustrated and described with respect to other weight assemblies disclosed herein or otherwise within the scope of the present disclosure, including, without limitation, the weight assemblies 4504 and 4604. Therefore, certain components are described herein, and thus, are not necessarily described further. The weight assembly 4704 may be coupled to a body of a golf club head, for example, to the body of any suitable golf club head disclosed herein or otherwise within the scope of the present disclosure, including, without limitation, the body 4506 of the golf club head 4500.

Referring concurrently to FIGS. 159-160, the weight assembly 4704 may include a weight (not shown), a cover 4730, and a fastener (not shown). The weight assembly 4704 may be positionable in at least an unlocked configuration and a locked configuration.

The weight may have a side groove shaped and sized to receive at least part of a side rail 4758S of the cover 4730 such that the weight can slidably engage with the cover 4730.

The cover 4730 may have an exterior surface 4730E and an opposite interior surface 47301. The cover 4730 may have one or more window openings 4730W adapted to visibly expose a recessed channel of the golf club head (e.g., when the weight assembly 4704 is in the locked configuration). The one or more window openings 4730W may allow a golfer to visibly confirm a position of the weight inside a recessed channel of the golf club head even when the weight assembly 4704 is in the locked configuration. The weight may have a position indicator configured to be visible through the one or more window openings 4730W when the weight assembly 4704 is in the locked configuration. The position indicator may assist in visibly confirming the position of the weight.

In some examples the one or more window openings 4730W include a plurality of window openings arranged along the toe-heel direction. In some other examples, the one or more window openings 4730W include a single window opening elongated along the toe-heel direction. The one or more window openings 4730W may be between a front edge 4730EF and a rear edge 4730ER of the exterior surface 4730E of the cover 4730. In some other examples, the one or more window openings 4730W may be provided along the front edge 4730EF such that the one or more window openings 4730W define indents in the front edge 4730EF. The front and rear edges 4730EF and 4730ER may respectively be proximal and distal to a striking face of the golf club head when the weight assembly 4704 is in the locked configuration.

The cover 4730 may have one or more airflow indents 4730AI in the exterior surface 4730E of the cover and respectively corresponding to the one or more window openings 4730W. The one or more airflow indents 4730AI may be respectively positioned adjacent (e.g., immediately adjacent) to the corresponding one or more window openings 4730W, for example, such that the one or more window openings 4730W are positioned between the striking face of the golf club head (or the front edge 4730EF) and the one or more airflow indents 4730AI when the weight assembly 4704 is in the locked configuration. For example, the one or more airflow indents 4730AI may be respectively joined to the one or more window openings 4730W.

In some examples, the one or more airflow indents 4730AI may have an elongated shape extending away from the striking face (or the front edge 4730EF) along an extension direction when the weight assembly is in the locked configuration. For example, the extension direction may be a direction away from the striking face of the golf club head (or from the front edge 4730EF) and/or toward the rear edge 4730ER.

An airflow indent of the one or more airflow indents 4730AI may have a depth that is greater at a first position along the extension direction than at a second position along the extension direction. A distance of the second position from the corresponding window opening may be greater than a distance of the first position from the corresponding window opening. For example, the depth may decrease (continuously or via one or more step changes) via a taper along the extension direction. The depth of the airflow indent at a position along the extension direction may be a maximum depth of the airflow indent measured along a depth direction perpendicular to a virtual plane tangential to the exterior surface 4730E at a point adjacent (e.g., immediately adjacent) to the airflow indent. In some examples, the depth of the airflow indent at the position along the extension direction is a maximum depth of the airflow indent measured perpendicular to both the extension direction and the toe-heel direction. In some examples, the depth of the airflow indent 4730AI at a position adjacent (e.g., immediately adjacent) to the corresponding window opening 4730W may be greater than or equal to 0.9 mm.

The airflow indent may have a width that is greater at the first position than at the second position. For example, the width may decrease (continuously or by one or more step changes) via a taper along the extension direction. The width of the airflow indent at a position along the extension direction may be a maximum width of the airflow indent measured in a toe-heel direction and/or along a direction perpendicular to both the extension direction and the depth direction of the airflow indent.

A window member, for example, a window member as illustrated and described in FIGS. 152-155 and in FIGS. 156-158, may be included or omitted in the weight assembly 4704.

In examples where the one or more airflow indents 4730AI are not included, a whistling type noise may be generated and noticeable during a golf swing for reasons similar to the reasons discussed above with respect to the golf club head 4300. However, in examples where the one or more airflow indents 4730AI are included, the whistling noise can be prevented or reduced in intensity, even when a window member is not included. Although this phenomenon is not entirely understood, it is believed that, if the one or more airflow indents 4730AI are not present, then as air flows over the sole during a golf swing, streams of air can flow through the one or more window openings 4730W and into the recessed channel to create a pressure resonance that causes the whistling noise. However, when the one or more airflow indents 4730AI are included, then the streams of air are caused to flow into the one or more airflow indents 4730AI instead of down into the recessed channel through the one or more window openings 4730W. Thus, the pressure resonance and the whistling noise can be prevented or reduced in intensity.

FIG. 161 is a partially exploded bottom view of part of another golf club head 4800 without the weight assembly 4804 of the golf club head 4800. The golf club head 4800 may be, for example, a metal wood club head, a hybrid golf club head, or a driver golf club head. FIG. 162 is a bottom view of part of the golf club head 4800 of FIG. 161 without the weight assembly 4804 of the golf club head 4800. FIG. 163 is a perspective view of the weight assembly 4804 of the golf club head 4800 of FIG. 161. The golf club head 4800 may include some features similar to, or the same as, features illustrated and described herein with respect to other golf club heads disclosed herein or otherwise within the scope of the present disclosure, including, without limitation, the golf club head 4500. Therefore, certain components are described herein, and thus, are not necessarily described further.

Referring concurrently to FIGS. 161-163, the golf club head 4800 may include a body 4806, including a toe 4814, a heel 4816, a hosel, a striking face, a sole 4802, and a crown joined to the sole 4802 at a skirt. The golf club head 4800 may have a recessed channel 4826 in an outer surface 4820 of the body 4806, for example, in the sole 4802, and the recessed channel 4826 may generally extend in a toe-heel direction. The golf club head 4800 may also have an outer surface indent 48201 defined in the outer surface 4820 and at least partially around (e.g., partly or entirely surrounding) the recessed channel 4826. The golf club head 4800 may include a weight assembly 4804 coupled to the golf club head 4800 at the recessed channel 4826. The weight assembly 4804 may include features similar to, or the same as, the features of other weight assemblies disclosed herein or otherwise within the scope of the present disclosure, including, without limitation, the weight assemblies 4504, 4604, and 4704.

The weight assembly 4804 may include a weight 4828 at least partially disposed within the recessed channel 4826 and configured to move (e.g., slide) therein, a cover 4830 extending at least partially over the recessed channel 4826 and adapted to releasably secure the weight 4828 within the recessed channel 4826, and a fastener 4832 configured to releasably secure the weight 4828 within the recessed channel 4826, for example, only indirectly by the cover 4830. The weight assembly 4804 may be positionable in at least an unlocked configuration whereby the cover 4830 is at least partially raised out of the recessed channel 4826 such that the weight 4828 is movable within the recessed channel 4826, and a locked configuration whereby the cover 4830 is at least partially disposed within the recessed channel 4826 such that the weight 4828 is secured within the recessed channel 4826.

The body 4806 may include one or more locating lugs 4834 protruding into the recessed channel 4826 (e.g., from a bottom track 4836 of the recessed channel 4826), and the weight 4828 may have a weight indent 4862 shaped and sized to receive at least part of the one or more locating lugs 4834 so that the weight 4828 can selectively engage with the one or more locating lugs 4834. The cover 4830 may include a top rail 4858T and a side rail 4858S, and the weight 4828 may have a top groove 4866T and a side groove 4866S respectively shaped and sized to receive at least part of the top rail 4858T and the side rail 4858S such that the weight 4828 slidably engages with the cover 4830.

The golf club head 4800 (e.g., the cover 4830 or the body 4806) may include an airflow sealing line 4890 (e.g., airflow sealing ring) configured to surround at least part of the recessed channel 4826 (e.g., when the weight assembly 4804 is in the locked configuration). In some examples, the airflow sealing line 4890 at least partially surrounds the recessed channel 4826 and is attached (e.g., by an adhesive) in the outer surface indent 48201. The airflow sealing line 4890 may have a shape corresponding to a shape of at least part of the perimeter of the outer surface indent 48201 and/or of at least part of the perimeter of the cover 4830 (e.g., of an interior surface 48301 of the cover 4830). In some examples, the cover 4830 is shaped and sized such that, when the cover is in the locked position, a gap exists between the cover 4830 and the walls defining the recessed channel 4826, or between the cover 4830 and the walls defining the outer surface indent 48201.

In some examples, the airflow sealing line 4890 is attached (e.g., via an adhesive) to the cover 4830 instead of to the body 4806. For example, the airflow sealing line 4890 may be attached to an outer perimeter of the interior surface 48301 of the cover 4830 or along an intermediate part (e.g., an edge or surface) of the cover 4830 between the interior surface 48301 of the cover 4830 and an exterior surface of the cover 4830 opposite to the interior surface 48301. When the cover 4830 is moved from the unlocked position to the locked position, the airflow sealing line 4890 may be compressed and fill at least part of the gap and block at least some air from flowing through the gap. In examples, the airflow sealing line 4890 may have a round cross-sectional shape when in an uncompressed state, although other cross-sectional shapes are possible and contemplated.

The airflow sealing line 4890 may be any suitable material, such as a plastic, rubber, or foam. In some examples, the material of the airflow sealing line 4890 is a flexible and/or compressible material. In some examples, the airflow sealing line 4890 forms a closed line (e.g., a loop or ring).

In examples where the airflow sealing line 4890 is not included, air may flow into the gap during a golf swing and cause a whistling sound that is distracting or undesirable to some golfers, and that can negatively impact their golf swing performance. However, in examples where the airflow sealing line 4890 is included, the airflow sealing line 4890 may fill at least part of the gap, and thus can block at least some of the air flow to prevent, or reduce the intensity of, the whistling sound.

FIG. 164 is a partially exploded perspective view of another golf club head 4900 with another weight assembly 4904. FIG. 165 is a cross-sectional view of the golf club head 4900 along the line 165'-165' in FIG. 164 and when the weight assembly 4904 is in a locked configuration. The golf club head 4900 may be, for example, a metal wood golf club head, a driver golf club head, or a hybrid golf club head. The golf club head 4900 may include some features similar to, or the same as, features illustrated and described herein with respect to other golf club heads disclosed herein or otherwise within the scope of the present disclosure, including, without limitation, the golf club heads 4500 and 4800. Therefore, certain components are described herein, and thus, are not necessarily described further.

Referring concurrently to FIGS. 164-165, the golf club head 4900 may include a body 4906, including a toe 4914, a heel 4916, a hosel, a striking face 4908, a sole 4902, and a crown joined to the sole 4902 at a skirt. The striking face 4908 may have a lower leading edge, an upper topline edge opposite to the lower leading edge, and the sole 4902 may extend from the lower leading edge of the striking face 4908. The golf club head 4900 may include a recessed channel 4926 in an outer surface of the body, for example, in the sole 4902, and the recessed channel 4926 may generally extend in a toe-heel direction. The golf club head 4900 may include a weight assembly 4904 coupled to the body 4906 at the recessed channel 4926. The weight assembly 4904 may include features similar to, or the same as, the features of other weight assemblies disclosed herein or otherwise within the scope of the present disclosure, including, without limitation, the weight assemblies 4504, 4604, 4704, and 4804.

The weight assembly 4904 may include a weight 4928 at least partially disposed within the recessed channel 4926 and configured to move (e.g., slide) therein, a cover 4930 extending at least partially over the recessed channel 4926 and adapted to releasably secure the weight 4928 within the recessed channel 4926, and a fastener 4932 configured to releasably secure the weight 4928 within the recessed channel 4926, for example, only indirectly by the cover 4930. The weight assembly 4904 may be positionable in at least an unlocked configuration whereby the cover 4930 is at least partially raised out of the recessed channel 4926 such that the weight 4928 is movable within the recessed channel 4926, and a locked configuration whereby the cover 4930 is at least partially disposed within the recessed channel 4926 such that the weight 4928 is secured within the recessed channel 4926.

The cover 4930 may include a top rail 4958T and a side rail 4958S, and the weight 4928 may have a top groove 4966T and a side groove 4966S respectively shaped and sized to receive at least part of the top and side rails 4958T and 4958S such that the weight 4928 slidably engages with the cover 4930.

The body 4906 may include one or more locating lugs 4934 protruding into the recessed channel 4926, for example, from a bottom track 4936 of the recessed channel 4926. The weight 4928 may have a weight indent 4962 shaped and sized to receive at least part of the one or more locating lugs 4934 such that the weight 4928 can selectively engage with the one or more locating lugs 4934.

The recessed channel 4926 may have first and second sidewalls 4938 and 4940 generally extending along the toe-heel direction and respectively being proximal and distal to the striking face 4908. The cover 4930 may include a cover main body 4980 having a front side 4980F and a rear side 4980R opposite to the front side 4980F. The front and rear sides 4980F and 4980R may generally extend along the toe-heel direction and may respectively be proximal and distal to the striking face 4908 when the weight assembly 4904 is in the locked configuration. The cover 4930 may include an interface member 4982 protruding from the front side 4980F and extending along the toe-heel direction. The interface member 4982 may be configured (e.g., shaped and sized) such that it contacts the first sidewall 4938 when the weight assembly 4904 is in the locked configuration. For example, the interface member 4982 may contact the first sidewall 4938 along a length extending in the toe-heel direction.

In examples where the interface member 4982 is omitted, a whistling type noise can occur during a golf swing, which can be distracting or unpleasant to some golfers, and which can negatively impact the golfers' swing performance. Although this phenomenon is not entirely understood, it is believed that, during the golf swing, air streams flow into the recessed channel 4926 through a gap between the cover 4930 and the first sidewall 4938, and create a pressure resonance that generates the whistling noise. However, in examples where the interface member 4938 is included and contacts the first sidewall 4938 when the weight assembly 4904 is in the locked configuration, air can be blocked from flowing into the recessed channel 4926 through between the cover 4930 and the first sidewall 4938 during a golf swing. This can prevent, or reduce the intensity of, the whistling noise.

In some examples, as in the nonlimiting and non-exhaustive example depicted in FIGS. 164-165, the interface member 4982 includes a wall (e.g., a flat wall) that, when the cover 4930 is in the locked configuration, protrudes from the cover main body 4980 towards a bottom (e.g., a bottom track 4936) of the recessed channel 4926. The wall may extend across a center of the front side 4980F of the cover main body 4980 and may extend along part or all of the front side 4980F of the cover main body 4980. For example, the wall may extend between a toe end 4980FT of the front side 4980F and a heel end 4980FH of the front side 4980F. In some other examples, the wall may extend only part way between the toe and heel ends 4980FT and 4980FH.

In some examples, the wall of the interface member 4982 contacts the first sidewall 4938 and blocks at least some air from flowing into the recessed channel 4926 during a golf swing. In some other examples, the wall of the interface member 4982 does not contact the first sidewall 4938, and the whistling noise is still prevented or reduced in intensity. In such examples, the wall may increase the length of the path between the recessed channel 4926 and the outside of the golf club head through a gap between the cover 4930 and the first sidewall 4938 compared to if the wall of the interface member 4982 were omitted. This increased path length can distort and reduce the pressure resonance that would otherwise occur without the wall of the interface member 4982, and thus, prevent or reduce the occurrence of the whistling sound.

FIG. 166 is a perspective view of another weight assembly 5004. FIG. 167 is a cross-sectional view of the weight assembly 5004 of FIG. 166 along the line 167'-167' when the weight assembly 5004 is coupled to a golf club head 5000 and the weight assembly 5004 is in a locked configuration. The golf club head 5000 may be, for example, a metal wood golf club head, a hybrid golf club head, or a driver golf club head. The golf club head 5000 and the weight assembly 5004 may include some features similar to, or the same as, features illustrated and described herein with respect to other golf club heads and weight assemblies, including, without limitation, the golf club heads 4500 and 4900, and the weight assembly 4504, 4604, 4704, 4804, and 4904. Therefore, certain components are described herein, and thus, are not necessarily described further.

Referring concurrently to FIGS. 166-167, the golf club head 5000 may include a body 5006, including a toe, a heel, a hosel, a striking face, a sole 5002, and a crown joined to the sole 5002 at a skirt. The golf club head 5000 may include a recessed channel 5026 in an outer surface of the body 5006, for example, in the sole 5002, and the recessed channel 5026 may generally extend in a toe-heel direction. The golf club head 5000 may include a weight assembly 5004 coupled to the golf club head 5000 at the recessed channel 5026.

The weight assembly 5004 may include a weight 5028 at least partially disposed within the recessed channel 5026 and configured to move (e.g., slide) therein, a cover 5030 extending at least partially over the recessed channel 5026 and adapted to releasably secure the weight 5028 within the recessed channel 5026, and a fastener 5032 configured to releasably secure the weight 5028 within the recessed channel 5026, for example, only indirectly by the cover 5030. The weight assembly 5004 may be positionable in at least an unlocked configuration whereby the cover 5030 is at least partially raised out of the recessed channel 5026 such that the weight 5028 is movable within the recessed channel 5026, and a locked configuration whereby the cover 5030 is at least partially disposed within the recessed channel 5026 such that the weight 5028 is secured within the recessed channel 5026.

The body 5006 may include one or more locating lugs 5034 protruding into the recessed channel 5026, for example, from a bottom track 5036 of the recessed channel 5026, and the weight 5028 may have a weight indent 5062 shaped and sized to receive at least part of the one or more locating lugs 5034 such that the weight 5028 can selectively engage with the one or more locating lugs 5034.

The cover 5030 may include a top rail 5058T and a side rail 50585, and the weight 5028 may have a top groove 5066T and a side groove 50665 respectively shaped and sized to receive at least part of the top rail 5058T and the side rail 50585 such that the weight 5028 can slidably engage with the cover 5030.

The recessed channel 5026 may have a first sidewall 5038 generally extending along the toe-heel direction and a second sidewall opposite to the first sidewall 5038 and generally extending along the toe-heel direction. The first sidewall 5038 and the second sidewall may respectively be proximal and distal to the striking face. The cover 5030 may include a cover main body 5080 having a front side 5080F and a rear side 5080R opposite to the front side 5080F. The front and rear sides 5080F and 5080R may generally extend along the toe-heel direction and may respectively be proximal and distal to the striking face. The cover 5030 may include an interface member 5082 protruding from the front side 5080F and extending along the toe-heel direction. The interface member 5082 may be configured (e.g., shaped and sized) such that it contacts the first sidewall 5038 when the weight assembly 5004 is in the locked configuration. For example, the interface member 5082 may contact the first sidewall 5038 along a length of the interface member 5082 extending along the toe-heel direction. Because the interface member 5082 contacts the first sidewall 5038 when the weight assembly 5004 is in the locked configuration, air can be blocked from flowing into the recessed channel 5026 through a gap between the cover 5030 and the first sidewall 5038 during a golf swing. This can prevent, or reduce the intensity of, a whistling type noise that occurs in examples where the interface member 5082 is omitted.

In some examples, as in the nonlimiting and non-exhaustive example depicted in FIGS. 166-167, the interface member 5082 includes a wall (e.g., a curved wall) that, when the cover 5030 is in the locked position, protrudes from the cover main body 5080 (e.g., from the front side 5080F of the cover main body 5080) away from a bottom (e.g., the bottom track 5036) of the recessed channel 5026.

When the weight assembly 5004 is in the unlocked configuration, the wall may form, together with at least part of the front side 5080F of the cover main body 5080, an empty space 5084 between the front side 5080F of the cover main body 5080 and the wall of the interface member 5082. In some examples, the cover 5030 may be shaped and sized such that the wall of the interface member 5082 is caused to be compressed towards the front side 5080F of the cover main body 5080 by the first sidewall 5038 when the cover 5030 is moved (e.g., lowered) from the unlocked configuration to the locked configuration. For example, a size of the empty space 5084 may be reduced when the wall of the interface member 5082 is compressed towards the front side 5080F of the cover main body 5080. In some examples, a minimum distance between a portion of the front side 5080F of the cover main body 5080 that is joined to an exterior surface 5080E of the cover main body 5080 and an end portion of the wall of the interface member 5082 distal to the cover main body 5080 is reduced when the wall of the interface member 5082 is compressed towards the front side 5080 of the cover main body 5080.

The cover 5080 (e.g., the interface member 5082) may be shaped and sized such that the cover 5080 cannot be moved from the unlocked position to the locked position without being compressed by the first sidewall 5038. For example, FIG. 167 shows a region of overlap 5086 of the interface member 5082 and the first sidewall 5038, where a portion of the interface member 5082 would be positioned when the cover 5030 is in the locked position if the first sidewall 5038 were not present. As the cover 5030 is lowered from the unlocked position to the locked position (e.g., along a fastener axis of the fastener 5032), this portion of the interface member 5082 comes into contact with the first sidewall 5038 and, as the cover 5030 is further lowered, the first sidewall 5038 causes the interface member 5082 to be pushed towards the front end 5080F of the cover main body 5080.

FIG. 168 is a partially exploded bottom view of part of another golf club head 5100 with another weight assembly 5104. FIG. 169 is a cross-sectional view of the golf club head 5100 of FIG. 168 along the line 169'-169' when the weight assembly 5104 is in a locked configuration. The golf club head 5100 may be, for example, a metal wood golf club head, a hybrid golf club head, or a driver golf club head. The golf club head 5100 and the weight assembly 5104 may include some features similar to, or the same as, features illustrated and described herein with respect to other golf club heads and weight assemblies, including, without limitation, the golf club heads 4500, 4900 and 5000, and the weight assemblies 4504, 4604, 4704, 4804, 4904 and 5004. Therefore, certain components are described herein, and thus, are not necessarily described further.

Referring concurrently to FIGS. 168-169, the golf club head 5100 may include a body 5106, including a toe, a heel, a hosel, a striking face, a sole 5102, and a crown joined to the sole 5102 at a skirt. The golf club head 5100 may include a recessed channel 5126 in an outer surface of the body 5106, for example, in the sole 5102, and the recessed channel 5126 may generally extend in a toe-heel direction. The golf club head 5100 may include a weight assembly 5104 coupled to the golf club head 5100 at the recessed channel 5126.

The weight assembly 5104 may include a weight 5128 at least partially disposed within the recessed channel 5126 and configured to move (e.g., slide) therein, a cover 5130 extending at least partially over the recessed channel 5126 and adapted to releasably secure the weight 5128 within the recessed channel 5126, and a fastener 5132 configured to releasably secure the weight 5128 within the recessed channel 5126, for example, only indirectly by the cover 5130. The weight assembly 5104 may be positionable in at least an unlocked configuration whereby the cover 5130 is at least partially raised out of the recessed channel 5126 such that the weight 5128 is movable within the recessed channel 5126, and a locked configuration whereby the cover 5130 is at least partially disposed within the recessed channel 5126 such that the weight 5128 is secured within the recessed channel 5126.

The body 5106 may include one or more locating lugs 5134 protruding into the recessed channel 5126, for example, from a bottom track 5136 of the recessed channel 5126, and the weight 5128 may have a weight indent 5162 shaped and sized to receive at least part of the one or more locating lugs 5134 such that the weight 5128 can selectively engage with the one or more locating lugs 5134.

The cover 5130 may include a top rail 5158T and a side rail 5158S, and the weight 5128 may have a top groove 5166T and a side groove 5166S respectively shaped and sized to receive at least part of the top rail 5158T and the side rail 5158S such that the weight 5128 can slidably engage with the cover 5130.

The recessed channel 5126 may have opposite first and second sidewalls 5138 and 5140 generally extending along the toe-heel direction and respectively being proximal and distal to the striking face. The cover 5130 may include a cover main body 5180 having opposite front and rear sides 5180F and 5180R generally extending along the toe-heel direction and respectively being proximal and distal to the striking face when the weight assembly 5004 is in the locked configuration. The cover 5130 may be shaped and sized such that the front side 5180F forms a friction fit with the first sidewall 5138 when the cover 5130 is lowered from the unlocked position to the locked position. Because the front side 5180F of the cover main body 5180 forms the friction fit with the first sidewall 5138, air can be blocked from flowing into the recessed channel 5126 through a gap between the cover 5130 and the first sidewall 5138 during a golf swing. This can prevent, or reduce the intensity of, a whistling type noise that occurs in examples where a gap exists between the front side 5180F of the cover and the first sidewall 5138 when the weight assembly 5104 is in the locked configuration.

FIG. 169 shows a region of overlap 5186 of the front side 5180F of the cover main body 5180 and the first sidewall 5138. This region of overlap 5186 depicts a region where a portion of front side 5180F of the cover main body 5180 would be positioned if the first sidewall 5138 were not present. As the cover 5130 is lowered from the unlocked position to the locked position (e.g., along a fastener axis of the fastener 5132), this portion of the front side 5180F of the cover main body 5180 comes into contact with the first sidewall 5138 and, as the cover 5130 is further lowered, the first sidewall 5138 causes the front side 5180F of the cover main body 5180 to be compressed (e.g., towards the rear side 5180R) so that the friction fit is formed.

FIG. 170 is a perspective view of another golf club head 5200 with another weight assembly 5204 that is raised part way out of the recessed channel 5226 of the golf club head 5200. In the non-limiting example depicted, the golf club head 5200 is a metalwood. In some examples, the golf club head 5200 may be, for example, a driver or a hybrid. FIG. 171 is a toe-to-heel cross-sectional view of the golf club head 5200 of FIG. 170 along line 171'-171' in FIG. 170 when the weight assembly 5204 is in a locked configuration. FIG. 172 is a cross-sectional view of the weight assembly 5204 of the golf club head 5200 of FIG. 170 along the line 171'-171' and according to a slightly different example than the example shown in FIG. 171. The weight assembly 5204 according to the example shown in FIG. 172 differs from the weight assembly 5204 as shown in FIG. 171 in that the weight member 5242 in FIG. 171 has a protrusion that protrudes into the window opening 5230W, whereas the window member 5242 in FIG. 172 does not, and in that the side rail 5258SR and the side groove 5266SG in FIG. 171 are higher up than in FIG. 172. The golf club head 5200 may include some features similar to, or the same as, features illustrated and described herein with respect to other golf club heads disclosed herein or otherwise within the scope of the present disclosure, including, without limitation, the golf club head 4500. Therefore, some features may not be repeated.

Referring concurrently to FIGS. 170-172 the golf club head 5200 may include a body 5206 including a toe 5214, a heel 5216, a hosel 5201, a striking face 5208 having a lower leading edge 5210 an opposite upper topline edge 5212, a sole 5202 extending rearward from the lower leading edge 5210, and a crown (not shown) extending rearward from the upper topline edge 5212 and joined to the sole 5202 at a skirt 5252. The body 5206 may have an outer surface 5220. The striking face 5208 may have one or more grooves 5219 (or scorelines) in an outermost surface of the striking face 5208. In some examples, the golf club head 5200 is a metalwood type golf club head, a driver type golf club head, or a hybrid type golf club head, and the outermost surface of the striking face 5208 is curved outwardly (e.g., having a rounded or bulging shape) such that the outermost surface protrudes outwardly and is not flat.

The golf club head 5200 may include a recessed channel 5226 in the outer surface 5220 of the body 5206, for example, in the sole 5202, and the recessed channel 5226 may generally extend in a toe-heel direction. The recessed channel 5226 may have a lower track 5236 offset from the outer surface 5220, and opposite first and second sidewalls 5238 and 5240 that extend in the toe-heel direction and are respectively proximal and distal to the striking face 5208.

The golf club head 5200 may include a weight assembly 5204 coupled to the golf club head 5200 at the recessed channel 5226. The weight assembly 5204 may include features similar to, or the same as, the features of other weight assemblies disclosed herein or otherwise within the scope of the present disclosure, including, without limitation, the weight assemblies 4504 and 4604 respectively of the golf club heads 4500.

The weight assembly 5204 may include a weight 5228 at least partially disposed within the recessed channel 5226 and configured to move (e.g., slide) therein, a cover 5230 extending at least partially over the recessed channel 5226 and adapted to releasably secure the weight 5228 within the recessed channel 5226, and a fastener 5232 configured to releasably secure the weight 5228 within the recessed channel 5226, for example, only indirectly by the cover 5230. The cover 5230 may include one or more window openings 5230W that are adapted to visibly expose the weight 5228 within the recessed channel 5226, and the weight assembly 5204 may further include one or more at least partially transparent window member 5242 that are attached to the cover 5230 (e.g., by an adhesive 5244) and overlap the one or more window openings 5230W. In the non-limiting example depicted, the one or more window openings 5230W include five window openings arranged in a toe-heel direction, and the weight assembly 5204 includes one window member that covers all of the five window openings. In some other examples, the cover 5230 may have a plurality of window openings 5230W and a corresponding plurality of window members 5242 that respectively cover the plurality of window openings 5230W. In some examples, the cover 5230 has one window opening 5230W that is elongated in the toe-heel direction, and the weight assembly 5204 includes one window member 5242 covering the one window. Other examples are within the scope of the present disclosure.

The weight assembly 5204 may be positionable in at least an unlocked configuration whereby the cover 5230 is at least partially raised out of the recessed channel 5226 such that the weight 5228 is movable within the recessed channel 5226, and a locked configuration whereby the cover 5230 is at least partially disposed within the recessed channel 5226 such that the weight 5228 is secured within the recessed channel 5226.

The fastener 5232 may be a threaded fastener (e.g., a single, double, triple, or quadruple lead threaded fastener) that is linearly movable relative to the body 5206 along a fastener axis 5232A by rotating about the fastener axis 5232A. In some examples, the fastener 5232 is rotatably coupled to the cover 5230 such that the fastener 5232 is rotatable relative to the cover 5230 while the cover 5230 is linearly movable with the fastener 5232 along the fastener axis 5232A. For example, the fastener 5232 may be rotatably coupled to the cover 5230 by a retaining clip. The fastener 5232 may be linearly movable between a first (e.g., lowered) position, corresponding to when the weight assembly 5204 is in the locked configuration, and a second (e.g., raised) position, corresponding to when the weight assembly 5204 is in the unlocked configuration.

The cover 5230 may have a cover main body 5230M having an exterior surface 5230E, an interior surface 52301 opposite to the exterior surface 5230E, and a side surface 5230S. The cover 5230 may be configured such that, when the weight assembly 5204 is in the locked configuration, the exterior surface 5230E faces outwardly from the golf club head 5200, the interior surface 52301 faces inwardly (e.g., toward the recessed channel 5226 and/or toward the weight 5228), and the side surface 5230S is at least partially (e.g., entirely) positioned within the recessed channel 5226 and faces toward the first sidewall 5238 and/or toward the striking face 5208. The cover 5230 may include two legs extending from the cover main body 5230M and that are configured to extend at least partially through two leg openings 5272 in the recessed channel 5226 (e.g., in the bottom track 5236).

The cover may include a top rail 5258TR and a side rail 5258SR that each extends along the toe-heel direction and that respectively protrude from the interior and side surfaces 52301 and 5230S. The top rail 5258TR may protrude away from the interior surface 52301 of the cover 5230 along a first direction, and the side rail 5258SR may protrude away from the side surface 5230S of the cover 5230 along a second direction different from the first direction and, in some examples, substantially perpendicular to the first direction. In some examples, the second direction is within 45 degrees, 30 degrees, 15 degrees, 10 degrees, 5 degrees, 2 degrees, 1 degree, or 0.5 degrees from being exactly perpendicular to the first direction. In some examples, the first direction is a direction normal (e.g., perpendicular) to a portion of the interior surface 52301 adjacent to the top rail 5258TR or normal (e.g., perpendicular) to a portion of the exterior surface 5230E opposite to the top rail 5258TR. The first direction may be parallel to a shortest line between a base of the top rail 5258TR and a distalmost point or distalmost surface of the top rail 5258TR and/or may be perpendicular to a longitudinal axis of the top rail 5258TR (e.g., perpendicular to the toe-heel direction or to the direction along which the top rail 5258TR extends). In some examples, the second direction is a direction normal (e.g., perpendicular) to a portion of the side surface 5230S adjacent to the side rail 5230S. The second direction may be parallel to a shortest line between a base of the side rail 5258SR and a distalmost point or distalmost surface of the side rail 5258SR and/or may be perpendicular to a longitudinal axis of the side rail 5258SR (e.g., perpendicular to the toe-heel direction or to a direction along which the side rail 5258SR extends).

The weight 5228 may have opposite front and rear surfaces 5228F and 5228R and opposite top and bottom surfaces 5228T and 5228B. The weight 5228 may be configured such that, when the weight assembly 5204 is in the locked configuration, the front and rear surfaces 5228F and 5228R are respectively proximal and distal to the striking face 5208 and/or respectively adjacent to (e.g., respectively face) the first and second sidewalls 5238 and 5240 of the recessed channel 5226. The weight 5228 may be configured such that, when the weight assembly 5204 is in the locked configuration, the top and bottom surfaces 5228T and 5228B are respectively proximal and distal to the exterior surface 5230E (or to the sole 5202) and/or distal and proximal to the bottom track 5236 of the recessed channel 5226. The weight 5228 may have at least one textured surface 5228TS over at least part of the front surface 5228F of the weight 5228. The at least one textured surface 5228TS may, for example, have a plurality of grooves formed therein that enhance a person's ability to grip and move the weight 5228 from under the cover 5230 when the weight assembly 5204 is in the unlocked configuration.

The weight 5228 may have top and side grooves 5266TG and 5266SG defined in the weight 5228 and that are respectively shaped and sized to receive at least part of the top and side rails 5258TR and 5258SR of the cover 5230 such that the weight 5228 is slidably engaged with the cover 5230.

The top groove 5266TG may be formed in the top surface 5228T of the weight 5228, and may be spaced apart from the front and rear surfaces 5228F and 5228R of the weight 5228. The top groove 5266TG may have opposite front and rear surfaces 5266TF and 5266TR, and a bottom surface 5266TB that connects the front and rear surfaces 5266TF and 5266TR. The bottom surface 5266TB may be offset from the top surface 5228T of the weight 5228, and the front and rear surfaces 5266TF and 5266TR may be joined to the top surface 5228T.

Each of the front, rear, and bottom surfaces 5266TF, 5266TR, and 5266TB of the top groove 5266TG may be at least partly (e.g., partly or entirely) flat (e.g., planar) or at least partly (e.g., partly or entirely) curved. For example, each of the front, rear, and bottom surfaces 5266TF, 5266TR, and 5266TB of the top groove 5266TG may be entirely flat, and the bottom surface 5266TB may be joined to the front and rear surfaces 5266TF and 5266TR at respective sharp corners. In some other examples, the bottom surface 5266TB may curve into each of the front and rear surfaces 5266TF and 5266TR such that rounded corners are formed between the bottom surface 5266TB and the front and rear surfaces 5266TF and 5266TR. In some examples, the shape of the top groove 5266TG is part of an oval, circle, or ellipse in a cross-sectional plane (e.g., the cross-sectional plane along line 171'-171') such that each of the front, rear, and bottom surfaces 5266TF, 5266TR, and 5266TB are entirely non-planar (or entirely curved) in the cross-sectional plane. At least part of each of the front and rear surfaces 5266TF and 5266TR may be flat, and the flat parts respectively of the front and rear surfaces 5266TF and 5266TR may be substantially parallel (e.g., within 5 degrees, 3 degrees, 1 degree, or 0.5 degrees from being exactly parallel) or nonparallel (e.g., more than 5 degrees of being parallel).

The side groove 5266SG may be formed in the rear surface 5228R of the weight 5228, and may be spaced apart from the top and bottom surfaces 5228T and 5228B of the weight 5228. The side groove 5266SG may have opposite top and bottom surfaces 5266ST and 5266SB, and a front surface 5266SF that connects the top and bottom surfaces 5266ST and 5266SB. The front surface 5266SF may be offset from the rear surface 5228R of the weight 5228, and the top and bottom surfaces 5266ST and 5266SB may be joined to the rear surface 5228R.

Each of the top, bottom, and front surfaces 5266ST, 5266SB, and 5266SF of the side groove 5266SG may be at least partly (e.g., partly or entirely) flat (e.g., planar) or at least partly (e.g., partly or entirely) curved. For example, each of the top, bottom, and front surfaces 5266ST, 5266SB, and 5266SF of the side groove 5266SG may be entirely flat, and the front surface 5266SF may be joined to each of the top and bottom surfaces 5266ST and 5266SB at sharp corners. In some other examples, the front surface 5266SF is curved into each of the top and bottom surfaces 5266ST and 5266SB such that rounded corners are formed between the front surface 5266F and the top surface 5266ST or the bottom surface 5266SB. In some examples, the shape of the side groove 5266SG is part of an oval, a circle, or an ellipse in a cross-sectional plane (e.g., the cross-sectional plane along line 171'-171') such that each of the top, bottom, and front surfaces 5266SF, 5266SB, and 5266SF of the side groove 5266SG are entirely non-planar (or entirely curved) in the cross-sectional plane. At least part of each of the top and bottom surfaces 5266ST and 5266SB may be flat, and the flat parts respectively of the top and bottom surfaces 5266ST and 5266SB may be substantially parallel (e.g., within 5 degrees, 3 degrees, 1 degree, or 0.5 degrees from being exactly parallel) or nonparallel (e.g., more than 5 degrees from being parallel).

In some examples, the top and side grooves 5266TG and 5266SG are respectively shaped and sized to surround (e.g., cover) at least part (e.g., part or all) of each of opposite surfaces of the top and side rails 5258TR and 5258SR. For example, the top rail 5258TR may have front and rear surfaces configured to be respectively proximal and distal to the striking face 5208, and the top groove 5266TG may be shaped and sized to surround at least part of each of the front and rear surfaces of the top rail 5258TR. The side rail 5258SR may have top and bottom surfaces configured to be respectively proximal and distal to the exterior surface 5230E of the cover 5230 and/or configured to be respectively distal and proximal to the lower track 5236, and the side groove 5266SG may be shaped and sized to surround at least part of each of the top and bottom surfaces of the side rail 5258SR.

In some examples, the weight assembly 5204 may be configured such that, when the weight assembly 5204 is in the locked configuration, the weight 5228 is covered (e.g., entirely covered), and the weight 5228 is visibly concealed (e.g., entirely visibly concealed) except for being visible through the one or more window openings 5230W.

Because the top and side grooves 5266TG and 5266SG are each formed in a respective side of the weight 5228 and have three sides (as opposed to being rabbets formed in corners of the weight 5228 and having two sides), the top and side grooves 5266TG and 5266SG can more fully wrap around the top and side rails 5258TR and 5258SR. Therefore, the weight 5228 can be more stably held in place against the cover 5230, which can reduce movement of the weight 5228 inside the recessed channel 5226. This can more stably fix a center of gravity of the golf club head 5200 and/or reduce rattling of the weight 5228, which can be distracting to some players and affect their performance during a golf swing.

Additionally, because the top groove 5266TG may be formed in the top surface 5228T and has three sides (as opposed to being a rabbet formed in a corner joining the top and front surfaces 5228T and 5228F) the weight 5228 can wrap around the front of the top rail 5258TR such that a front portion (including a portion of the front surface 5228F) is configured to be positioned between the top rail 5258TR and the striking face 5208 and/or between the top rail 5258TR and the first sidewall 5238 when the weight assembly 5204 is in the locked configuration. Thus, a fewer number of turns of the fastener 5232 may be needed until the cover 5230 and the weight 5228 are raised upwards from the locked configuration toward the unlocked configuration such that the weight 5228 becomes visible from under the cover 5230 (and accessible for movement by a person via the person's fingers or a tool).

For example, referring to FIG. 171, first, second, and third lines 52L1, 52L2, and 52L3 are depicted. The first line 52L1 may be tangential to the outer surface 5220 of the sole 5202 at a region adjacent to the first sidewall 5238 of the recessed channel 5226. The second line 52L2 may be parallel to the first line 52L1 and may be offset, along a thickness direction, from the first line 52L1 by a first thickness 52H1 of a front portion of the cover 5230 (e.g., a thickness between the exterior and interior surfaces 5230E and 52301 of the cover 5230) that is configured to be adjacent to the first sidewall 5238 when in the locked position. The third line 52L3 may be parallel to the first line 52L1 and may be offset, along the thickness direction, from the second line 52L2 by a second thickness 52H2 of the top rail 5258TR. The thickness direction may be, for example, parallel to the fastener axis 5232A.

The weight assembly 5204 may be configured (e.g., may have a first thickness 52H1 and a lead distance of the fastener 5232) such that, when the cover 5230 is in the locked configuration, the weight 5228 becomes visible from under the cover 5230 after the fastener 5232 is moved from a lowered position toward a raised position by rotating about the fastener axis 5232A through less than a first number of turns (e.g., 4, 3.5, 3, 2.5, 2, or 1.5 turns). With respect to fastener 5232, the lead distance is the distance traveled by the screw along its fastener axis 5232A after the screw has been rotated 360 degrees. For example, the first thickness 52H1 may be less than the product of the first number of turns and the lead distance of the fastener 5232. In some examples, the weight 5228 is configured such that, as the cover 5230 is raised from the locked configuration to the unlocked configuration, the front surface 5228F of the weight 5228 begins to be raised out of the recessed channel 5226 before the bottom surface 5266TB of the top groove 5266TG (or a distal portion of the top rail 5258TR) begins to be raised out from the recessed channel 5226. For example, as the cover 5230 is raised from the locked configuration to the unlocked configuration, a portion of the weight 5228 passes the edge of the sole 5202 (e.g., passes above line 52L1) prior to the bottom surface 5266TB of the top groove 5266TG. The weight assembly 5204 may also be configured such that the weight 5228 becomes accessible for movement (e.g., via a person's fingers or a tool for moving the weight 5228) after the fastener 5232 is rotated through less than a second number of turns (e.g., 8, 7, 6, 5, 4, or 3 turns). In some examples, the difference in the first number of turns and the second number of turns may correlate to the thickness of a tool that can be used to access the weight 5228 under the cover 5230 in an unlocked position, so that the weight 5228 can be slid into the desired position within the recessed channel 5226.

In contrast, a toe-to-heel cross-sectional view of another golf club head 5200' is shown in FIG. 173, which is similar to the golf club head 5200, except for the top and side grooves 5266TG' and 5266SG' and the top and side rails 5258TR' and 5258SR'. In the example of the golf club head 5200', the top groove 5266TG' is a 2-sided rabbet formed in a corner between top and front surfaces of the weight 5228', and the side groove 5266SG' is a 2-sided rabbet formed in a corner between rear and bottom surfaces of the weight 5228'. The top and side grooves 5266TG' and 5266SG' therefore only surround two sides of the top and side rails 5258TR' and 5258SR', respectively.

In comparison to the weight 5228 of the golf club head 5200, the weight 5228' of the golf club head 5200' may not be as stably held against the cover 5230', and can be more likely to rattle and cause the golf club head's center of gravity to move during a golf swing. Moreover, because the top groove 5266TG' is formed in part of the front surface of the weight 5228', the cover 5230' must be raised further out from the recessed channel 5226 before the weight 5228' becomes visibly exposed from under the cover 5230'. In some examples, the cover 5230' must be raised by a third thickness 52H3 before the weight 5228' becomes visibly exposed from under the cover 5230'. The third thickness 52H3 may be defined as a thickness along the thickness direction between the first and third lines 52L1 and 52L3 (e.g., the sum of the first and second thicknesses 52H1 and 52H2).

In some examples, the weight assembly 5204' may be configured such that, when the cover 5230' is in the locked configuration, the weight 5228' becomes visible from under the cover 5230' when the fastener 5232 is moved from the lowered position toward the raised position by rotating through less than a third number of turns that is greater than the first number of turns. The weight assembly 5204' may also be configured such that the weight 5228' becomes accessible for movement when the fastener 5232 is rotated through less than a fourth number of turns that is greater than the second number of turns. The third and fourth numbers of turns may be greater than the first and second numbers of turns, respectively, by an amount equal to the ratio of the second thickness 52H2 to the lead distance of the fastener 5232.

Accordingly, in the golf club head 5200, by positioning the top groove 5266TG rearward from the front surface 5228F such that the top groove 5266TG is a three-sided groove (as opposed to a rabbet), a person (e.g., a fitter or a player) may be able to more easily and quickly raise the weight assembly 5204 from the locked configuration to the unlocked configuration, thereby saving the person time and reducing the likelihood that the person will become frustrated.

The golf club head 5200 may have one or more locating lugs 5234 protruding at least partially into the recessed channel 5226, for example, from the bottom track 5236. The weight 5228 may have a weight indent 5262 shaped and sized to at least partially receive the one or more locating lugs 5234 so that the weight 5228 can selectively engage with the one or more locating lugs 5234.

In some examples, either one, or both, of the top and side rails 5258TR and 5258SR may extend continuously or discontinuously in the toe-heel direction between toe and heel ends of the cover 5230. For example, either one, or both, of the top and side rails 5258TR and 5258SR may have a gap defined therein sufficient to allow the weight 5228 to be installed onto (e.g., slidingly engaged with) the cover 5230.

FIG. 174A is a sole view of another golf club head, according to some examples, and without a weight assembly installed on the golf club head. FIG. 174B is a perspective view of the cover 5330 and fastener 5332 of the weight assembly of the golf club head of FIG. 174A. The golf club head may be, in some examples, a metalwood type golf club head, a driver type golf club head, or a hybrid type golf club head. The golf club head may have some features similar to, or the same as, other golf club heads described herein.

The golf club head of FIG. 174A may be designed for a right handed player, and may include a body 5306 having an outer surface 5320 and including a toe 5314, a heel 5316, a striking face (not shown) having a lower leading edge and an upper topline edge, a sole 5302 extending rearwardly from the lower leading edge, and a crown (not shown) extending rearwardly from the upper topline edge and coupled to the sole 5302 at a skirt (not shown). The golf club head may also include a hosel (not shown) disposed at the heel 5316.

The body 5306 may have a recessed channel 5326 formed in the outer surface 5320 (for example, in the sole 5302, as in the depicted example), and the golf club head may include a weight assembly configured to be coupled to the golf club head at the recessed channel 5326. The recessed channel 5326 may have a bottom track 5336 offset from the outer surface 5320, and opposite front and rear sidewalls 5338 and 5340 that extend in a toe-heel direction of the golf club head and are respectively proximal and distal to the striking face. The recessed channel 5326 and the weight assembly may include features similar to, or the same as, other recessed channels and weight assemblies described herein.

The weight assembly may include a cover 5330, a weight (not shown), and a fastener 5332. The cover 5330 may have an exterior surface 5330E configured to face outwardly from the golf club head, and the exterior surface 5330E may have front and rear sides 5330EF and 5330ER configured to be respectively proximal and distal to the striking face (and to be respectively adjacent to the front and rear sidewalls 5338 and 5340) when the weight assembly is coupled to the body 5306.

The cover 5330 may include a cover main body 5380, a heel side leg 5370H extending from the cover main body 5380 and configured to be at a heel side of the recessed channel 5326 when the weight assembly is coupled to the body 5306, and a toe side leg 5370T extending from the cover main body 5380 and configured to be at a toe side of the recessed channel 5326 when the weight assembly is coupled to the body 5306. A heel side leg opening 5372H and a toe side leg opening 5372T may be defined in the body 5306, for example, in the bottom track 5336 of the recessed channel 5326 and respectively at the toe and heel ends of the recessed channel 5326.

The heel and toe side leg openings 5372H and 5372T may have different geometries, and the heel and toe side legs 5370H and 5370T may be shaped and sized to extend at least partially through the heel and toe side leg openings 5372H and 5372T, respectively. For example, as shown in the depicted example, the toe side leg opening 5372T is wider than the heel side leg opening 5372H, and the toe side leg 5370T is wider than the heel side leg 5370H such that the toe side leg 5370T is shaped and sized to extend at least partially through the toe side leg opening 5372T, but not through the heel side leg opening 5372H (e.g., because the toe side leg 5370T is too wide to fit through the heel side opening 5372H).

FIG. 175A is a sole view of another golf club head, according to some examples, and without a weight assembly installed on the golf club head. FIG. 175B is a perspective view of the cover 5430 and fastener 5432 of the weight assembly of the golf club head of FIG. 175A. The golf club head may be, in some examples, a metalwood type golf club head, a driver type golf club head, or a hybrid type golf club head. The golf club head may have some features similar to, or the same as, other golf club heads described herein.

The golf club head of FIG. 175A may be designed for a left handed player, and may include a body 5406 having an outer surface 5420 and including a toe 5414, a heel 5416, a striking face (not shown) having a lower leading edge and an upper topline edge, a sole 5402 extending rearwardly from the lower leading edge, and a crown (not shown) extending rearwardly from the upper topline edge and coupled to the sole 5402 at a skirt (not shown). The golf club head may also include a hosel (not shown) disposed at the heel 5416.

The body 5406 may have a recessed channel 5426 formed in the outer surface 5420 (for example, in the sole 5402, as in the depicted example), and the golf club head may include a weight assembly configured to be coupled to the golf club head at the recessed channel 5426. The recessed channel 5426 may have a bottom track 5436 offset from the outer surface 5420, and opposite front and rear sidewalls 5438 and 5440 that extend in a toe-heel direction of the golf club head and are respectively proximal and distal to the striking face. The recessed channel 5426 and the weight assembly may include features similar to, or the same as, other recessed channels and weight assemblies described herein.

The weight assembly may include a cover 5430, a weight (not shown), and a fastener 5432. The cover 5430 may have an exterior surface 5430E configured to face outwardly from the golf club head, and the exterior surface 5430E may have front and rear sides 5430EF and 5430ER configured to be respectively proximal and distal to the striking face (and respectively adjacent to the front and rear sidewalls 5438 and 5440) when the weight assembly is coupled to the body 5406.

The cover 5430 may include a cover main body 5480, a heel side leg 5470H extending from the cover main body 5480 and configured to be at a heel side of the recessed channel 5426 when the weight assembly is coupled to the body 5406, and a toe side leg 5470T extending from the cover main body 5480 and configured to be at a toe side of the recessed channel 5426 when the weight assembly is coupled to the body 5406. A heel side leg opening 5472H and a toe side leg opening 5472T may be defined in the body 5406, for example, in the bottom track 5436 of the recessed channel 5426 and respectively at the toe and heel ends of the recessed channel 5426.

The heel and toe side leg openings 5472H and 5472T may have different geometries, and the heel and toe side legs 5470H and 5470T may be shaped and sized to extend at least partially through the heel and toe side leg openings 5472H and 5472T, respectively. For example, as shown in the depicted example, the toe side leg opening 5472T is wider than the heel side leg opening 5472H, and the toe side leg 5470T is wider than the heel side leg 5470H such that the toe side leg 5470T is shaped and sized to extend at least partially through the toe side leg opening 5472T, but not through the heel side leg opening 5472H (e.g., because the toe side leg 5470T is too wide to fit through the heel side opening 5472H).

Referring collectively to FIGS. 174A, 174B, 175A, and 175B, right-handed and left-handed golf club heads generally have certain differences. For example, when right-handed and left-handed golf club heads are set up in the address position, and a person faces the same direction that the striking faces of the right-handed and left-handed golf club heads face, the hosel and the heel of the right-handed golf club head will be on the person's left, and the hosel and the heel of the left-handed golf club head will be on the person's right. Furthermore, the weight assemblies of the right-handed and left-handed golf club heads may also have certain differences. For example, as described herein, the cover may have position indicator symbols (e.g., T2, T1, N, H1, and H2) on the exterior surface of the cover and arranged along a toe-heel direction. When the right-handed and left-handed golf club heads are set up in the address position, and the person faces the same direction that the striking faces of the right-handed and left-handed golf club heads face, the arrangement order of the position indicator symbols along the person's left-to-right direction may be reversed. For example, the position indicator symbols for the right-handed golf club head may be arranged as H2, H1, N, T1, and T2 in the person's left-to-right direction, while the position indicator symbols for the left-handed golf club head may be arranged as T2, T1, N, H1, and H2 in the person's left-to-right direction.

Accordingly, it can be desirable to have a way to avoid unintentionally installing a weight assembly for a right-handed golf club head on a left-handed golf club head, and vice versa. By differing the geometries between the toe side and heel side leg openings (and the toe side and heel side legs) as described herein with reference to FIGS. 174A, 174B, 175A, and 175B, this can be avoided. For example, if the weight assembly of the right-handed golf club head of FIG. 174A were attempted to be installed on the left-handed golf club head of FIG. 175A, it would not fit because the toe side leg 5370T of the weight assembly would need to be inserted through the heel side leg opening 5472H, but would be blocked due to the difference in size between the toe side leg 5370T and the heel side leg opening 5472H. A similar result would occur if the weight assembly of the left-handed golf club head of FIG. 175A were attempted to be installed on the right-handed golf club head of FIG. 174A. Thus, a person (e.g., a golfer, a fitter, a retailer, or a manufacturer) may recognize when installing a weight assembly onto a particular golf club head when the golf club head and the weight assembly have incompatible handedness by the inability of the weight assembly to be installed on the golf club head.

In some examples, the present disclosure includes a pair of golf club heads including the golf club head of FIG. 174A and the golf club head of FIG. 175A. The pair of golf club heads may have features that are similar or the same as each other, except for differences in their handedness and their weight assemblies. For example, the pair of golf club heads may be the same type of golf club head (e.g., both drivers, both metalwoods, both hybrids, etc.) and the same model (e.g., both TSR2 Titleist golf club heads, both TSR4 Titleist golf club heads, etc.).

Although specific embodiments and aspects were described herein and specific examples were provided, the scope of the technology is not limited to those specific embodiments and examples. For instance, while many of the present examples have been depicted particularly for use with a driver, a fairway metal, and an iron, any the present technology may be applied to any metal wood, fairway metal or wood, iron, or hybrid golf club. Further, each of the above examples may be combined with another and/or one or more features of some examples may be combined with other examples. One skilled in the art will recognize other embodiments or improvements that are within the scope and spirit of the present technology. Therefore, the specific structure, acts, or media are disclosed only as illustrative embodiments. In addition, if the limits of the terms "about," "substantially," or "approximately" as used in the following claims are unclear from the foregoing specification to one having skill in the art, those terms shall mean within ten percent of the value described. The scope of the technology is defined by the following claims and any equivalents therein.

What is claimed is:

1. A golf club head, comprising:
a body comprising:
a striking face having a lower leading edge, and
a sole extending from the lower leading edge, wherein the striking face and the sole form part of an outer surface of the body;
a recessed channel formed in the outer surface; and
a weight assembly comprising:
a weight at least partially disposed within the recessed channel and configured to be moveable therein,
a cover at least partially covering the recessed channel, the cover including a cover main body, a top rail extending along a toe-heel direction and protruding from the cover main body along a first direction, and a side rail extending along a toe-heel direction and protruding from the cover main body along a second direction different from the first direction, and
a fastener coupling the cover to the body and configured to indirectly retain the weight within the recessed channel by the cover,
wherein the weight has top and side grooves that are respectively shaped and sized to receive at least part of the top and side rails,
wherein the top groove has opposite front and rear surfaces respectively proximal and distal to the striking face, and a bottom surface connecting the front and rear surfaces, and
wherein the side groove has opposite top and bottom surfaces respectively proximal and distal to an exterior surface of the cover configured to face outwardly from the golf club head, and a front surface connecting the top and bottom surfaces.

2. The golf club head of claim 1, wherein the first and second directions are within 15 degrees of being perpendicular to each other.

3. The golf club head of claim 1, wherein at least part of the front surface, at least part of the rear surface, and at least part of the bottom surface of the top groove are each substantially flat, and the substantially flat parts respectively of the front and rear surfaces of the top groove are substantially parallel to each other, and wherein at least part of the top surface, at least part of the bottom surface, and at least part of the front surface of the side groove are each substantially flat, and the substantially flat parts respectively of the top and bottom surfaces of the side groove are substantially parallel to each other.

4. The golf club head of claim 1, wherein between about 0% and about 30% of an outer surface of the weight is visible when the cover secures the weight within the recessed channel.

5. The golf club head of claim 1, wherein one or more windows are formed in the cover and are adapted to visibly identify a position of the weight within the recessed channel, and wherein the weight assembly further comprises one or more at least partially transparent window members attached to the cover and overlapping the one or more windows.

6. The golf club head of claim 1, wherein the cover is moveable, via the fastener, between at least an unlocked configuration, whereby the cover is raised at least partially out of the recessed channel and the weight is selectively movable within the recessed channel, and a locked configuration, whereby the cover is at least partially disposed within the recessed channel and the weight is secured within the recessed channel.

7. The golf club head of claim 6, wherein the fastener is a threaded fastener that is movable along a fastener axis by rotating about the fastener axis, and the threaded fastener is selectively positionable in at least a first position and when the cover is in the locked configuration, and a second position when the cover is in the unlocked configuration, and wherein the weight assembly is configured such that:

the weight is entirely covered when the cover is in the locked configuration, and the weight becomes visible from under the cover when the threaded fastener is rotated through three or fewer full rotations about the fastener axis from the first position.

8. The golf club head of claim 1, wherein the recessed channel is in the sole.

9. A golf club head, comprising:

a body, comprising:

a striking face having a lower leading edge, and a sole extending from the lower leading edge;

a recessed channel formed in the sole; and a weight assembly comprising:

a weight at least partially disposed within the recessed channel and configured to be moveable therein, a cover coupled to the body and adapted to releasably secure the weight within the recessed channel, the cover:

having an exterior surface and an opposite interior surface, and one or more window openings extending through the cover between the exterior and interior surfaces;

including a top rail extending along a toe-heel direction and protruding from the interior surface along a first direction; and including a side rail extending along a toe-heel direction and protruding from a side surface of the cover along a second direction different from the first direction, and one or more at least partially transparent window members attached to the cover and overlapping the one or more window openings, wherein the weight has top and side grooves that are respectively shaped and sized to receive at least part of the top and side rails, wherein the top groove has opposite front and rear surfaces respectively proximal and distal to the striking face and that are each at least partly substantially flat, and a bottom surface connecting the front and rear surfaces, and wherein the side groove has opposite top and bottom surfaces respectively proximal and distal to the exterior surface and that are each at least partly substantially flat, and a front surface connecting the top and bottom surfaces.

10. The golf club head of claim 9, wherein the golf club head is a driver type golf club head, a metalwood type golf club head, or a hybrid type golf club head, and wherein an outermost surface of the striking face is curved outwardly.

11. The golf club head of claim 9, wherein the weight assembly further comprises a threaded fastener coupling the cover to the body and configured to only indirectly retain the weight in the recessed channel.

12. The golf club head of claim 11, wherein the cover is moveable, via the threaded fastener, between at least an unlocked configuration, whereby the cover is raised at least partially out of the recessed channel and the weight is selectively movable within the recessed channel, and a locked configuration, whereby the cover is at least partially disposed within the recessed channel and the weight is entirely concealed except for through the one or more window openings, and wherein the weight assembly is configured such that, as the cover is moved from the locked configuration toward the unlocked configuration, the weight becomes visible from under the cover before the top rail is entirely removed from the recessed channel.

13. The golf club head of claim 9, wherein the one or more window openings comprises a plurality of window openings arranged along the toe-heel direction of the golf club head.

14. The golf club head of claim 9, wherein the one or more window openings comprises only one window opening that is elongated along the toe-heel direction of the golf club head.

15. A golf club head, comprising:

a body comprising:

a striking face having a lower leading edge, and a sole extending from the lower leading edge, wherein the striking face and the sole form part of an outer surface of the body;

a recessed channel formed in the outer surface; and a weight assembly comprising:

a weight at least partially disposed within the recessed channel and configured to be moveable therein, a cover coupled to the body and adapted to releasably secure the weight within the recessed channel, the cover having one or more window openings adapted to identify a location of the weight within the recessed channel, and a threaded fastener coupling the cover to the body and selectively moveable along a fastener axis between at least a first position and a second position by rotating about the fastener axis, wherein the cover is moveable, via the threaded fastener, between at least:

an unlocked configuration, whereby the cover is raised at least partially out of the recessed channel, the weight is selectively movable within the recessed channel, and the threaded fastener is in the first position; and a locked configuration, whereby the cover is at least partially disposed within the recessed channel, the weight is secured within the recessed channel, and the threaded fastener is in the second position, wherein the weight assembly is configured such that, when the cover is in the locked configuration, the cover entirely conceals the weight except for through the one or more window openings, and such that the weight becomes visibly exposed from under the cover when the threaded fastener is rotated through three or fewer full rotations about the fastener axis from the first position toward the second position, wherein the cover includes a top rail extending along a toe-heel direction of the golf club head, and protruding from an interior surface of the cover that is configured to face the recessed channel, and wherein the weight has a top groove shaped and sized to receive at least part of the top rail.

16. The golf club head of claim 15, wherein the top groove has opposite front and rear surfaces respectively proximal and distal to the striking face, and a bottom surface connecting the front and rear surfaces.

17. The golf club head of claim 15, wherein the top groove is spaced apart from a front surface of the weight proximal to the striking face.

18. The golf club head of claim 15, wherein the cover includes a side rail extending along the toe-heel direction, and protruding from a side surface, and wherein the weight has a side groove shaped and sized to receive at least part of the side rail.

19. The golf club head of claim 15, wherein the recessed channel comprises a plurality of locating lugs arranged along a toe-heel direction of the golf club head, and wherein the weight is configured to engage with the one or more locating lugs such that the weight is positionable in the recessed channel in a plurality of discrete locations corresponding to the plurality of locating lugs when the recessed channel secures the weight within the recessed channel.

* * * * *